US008997827B2

(12) United States Patent
Anderson et al.

(10) Patent No.: US 8,997,827 B2
(45) Date of Patent: Apr. 7, 2015

(54) COVERING FOR ARCHITECTURAL OPENINGS WITH BRAKES IN SERIES

(71) Applicant: Hunter Douglas Inc., Pearl River, NY (US)

(72) Inventors: Richard Anderson, Whitesville, KY (US); Robert E. Fisher, II, Owensboro, KY (US); Donald E. Fraser, Owensboro, KY (US); Steven R. Haarer, Maceo, KY (US)

(73) Assignee: Hunter Douglas Inc., Pearl River, NY (US)

( * ) Notice: Subject to any disclaimer, the term of this patent is extended or adjusted under 35 U.S.C. 154(b) by 24 days.

(21) Appl. No.: 13/889,409

(22) Filed: May 8, 2013

(65) Prior Publication Data

US 2013/0292068 A1 Nov. 7, 2013

Related U.S. Application Data

(60) Continuation of application No. 12/983,912, filed on Jan. 4, 2011, now Pat. No. 8,459,328, which is a division of application No. 11/332,692, filed on Jan. 13, 2006, now Pat. No. 7,886,803, which is a continuation-in-part of application No. PCT/US2004/022694, filed on Jul. 15, 2004.

(60) Provisional application No. 60/488,208, filed on Jul. 16, 2003.

(51) Int. Cl.

| | |
|---|---|
| ***E06B 9/32*** | (2006.01) |
| ***E06B 9/80*** | (2006.01) |
| ***E06B 9/262*** | (2006.01) |
| ***E06B 9/322*** | (2006.01) |
| ***E06B 9/324*** | (2006.01) |

(52) U.S. Cl.

CPC . *E06B 9/80* (2013.01); *E06B 9/262* (2013.01); *E06B 9/322* (2013.01); *E06B 9/324* (2013.01); *E06B 2009/3225* (2013.01); *E06B 2009/3227* (2013.01); *E06B 2009/807* (2013.01)

(58) Field of Classification Search

USPC ..... 160/170, 171, 178.2, 303, 168.1 R, 160/84.04, 84.05, 173 R, 344; 24/136 K, 24/115 R

See application file for complete search history.

(56) References Cited

U.S. PATENT DOCUMENTS

| | | | | |
|---|---|---|---|---|
| 15,615 | A | 8/1856 | Miles | |
| 59,009 | A | 10/1866 | Handforth | |
| 177,482 | A | 5/1876 | Dohen | |
| 201,109 | A | 3/1878 | Griffith | |
| 337,043 | A | 3/1886 | Baker | |
| 1,232,927 | A * | 7/1917 | Johnston | 160/308 |
| 1,964,205 | A | 6/1934 | Johnson | |
| 2,410,549 | A | 11/1946 | Olson | |
| 2,520,629 | A | 8/1950 | Esposito | |
| 2,758,644 | A | 8/1955 | Virlouvet | |
| 4,347,885 | A | 9/1982 | von Knorring et al. | |
| 5,628,356 | A | 5/1997 | Marocco | |
| 5,799,715 | A | 9/1998 | Biro et al. | |
| 6,129,131 | A | 10/2000 | Colson | |
| 6,325,131 | B1 | 12/2001 | Dekker et al. | |
| 6,536,503 | B1 | 3/2003 | Anderson et al. | |

(Continued)

*Primary Examiner* — David Purol

(74) *Attorney, Agent, or Firm* — Camoriano & Associates

(57) ABSTRACT

A cord drive mechanism to convert linear motion to circular motion for use in coverings for architectural openings. Various controls are used to provide a braking force on the cord. Some of the embodiments incorporate a capstan.

7 Claims, 119 Drawing Sheets

(56) References Cited

U.S. PATENT DOCUMENTS

| | | | |
|---|---|---|---|
| 6,571,853 | B1 | 6/2003 | Ciuca et al. |
| 6,675,861 | B2 | 1/2004 | Palmer et al. |
| 6,889,741 | B1 | 5/2005 | Cheng et al. |
| 6,901,988 | B2 | 6/2005 | Colson et al. |
| 6,915,831 | B2 | 7/2005 | Anderson |
| 7,025,107 | B2 | 4/2006 | Ciuca |
| 7,380,582 | B1 | 6/2008 | Anderson et al. |
| 2002/0050539 | A1 | 5/2002 | Anderson |
| 2003/0024656 | A1 | 2/2003 | Ciuca |
| 2004/0177933 | A1 | 9/2004 | Hillman et al. |

* cited by examiner

452

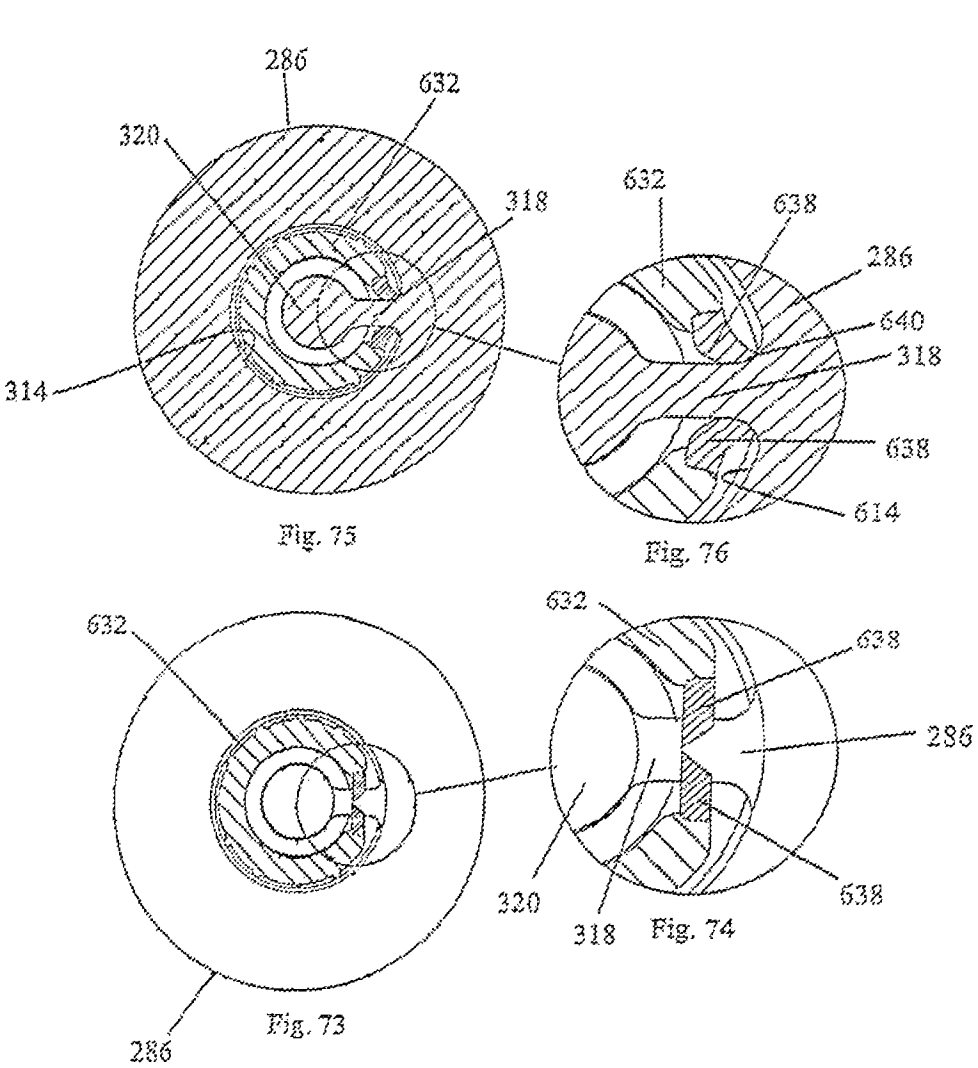
286
640
318
638
614
638
632
Fig. 76
318
632
286
320
314
Fig. 75
286
638
638
632
318
320
Fig. 74
632
286
Fig. 73
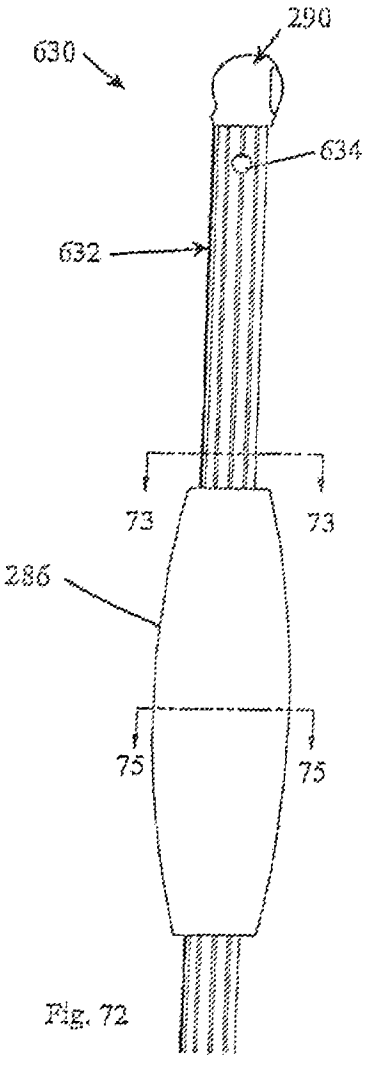
290
634
630
632
73
73
286
75
75
Fig. 72

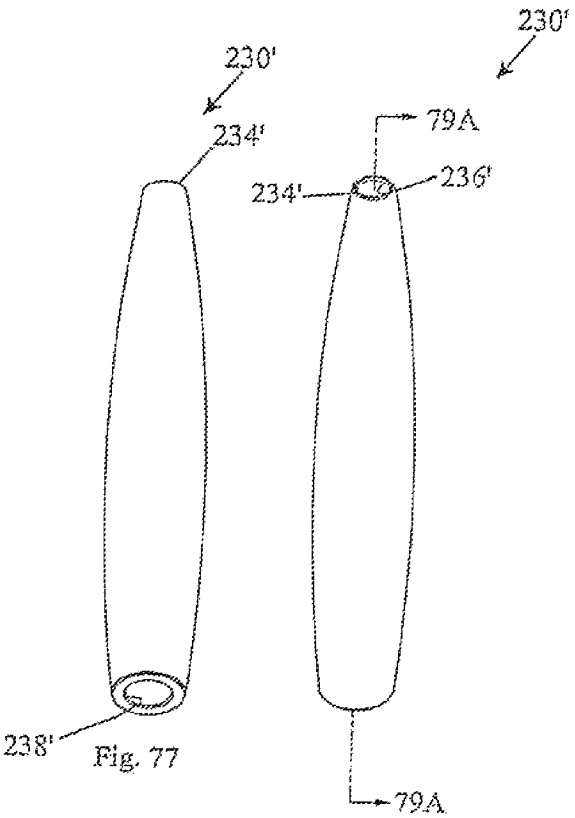
Fig. 78
Fig. 77
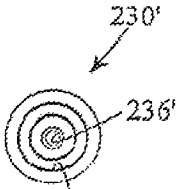
Fig. 79C
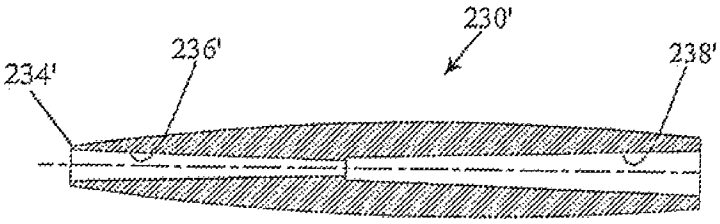
Fig. 79A
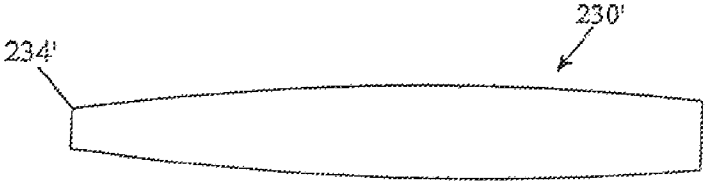
Fig. 79D
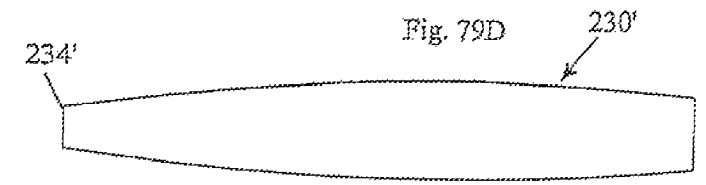
Fig. 79E
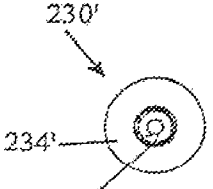
Fig. 79B

COVERING FOR ARCHITECTURAL OPENINGS WITH BRAKES IN SERIES

This is a continuation of U.S. application Ser. No. 12/983,912, filed Jan. 4, 2011, which is a divisional of U.S. application Ser. No. 11/332,692, filed Jan. 13, 2006, now U.S. Pat. No. 7,886,803, which is a continuation-in-part of PCT application PCT/US 04/22694 filed Jul. 15, 2004, which claims priority from U.S. Provisional Application Ser. No. 60/448,208, filed Jul. 16, 2003, all of which are hereby incorporated herein by reference.

BACKGROUND OF THE INVENTION

The present invention relates to a cord drive which can be used for opening and closing or tilting coverings for architectural openings such as Venetian blinds, pleated shades, vertical blinds, other expandable materials, and other mechanical devices.

Typically, a blind transport system will have a head rail which both supports the blind and hides the mechanisms used to raise and lower or open and close the blind. Such a blind system is described in U.S. Pat. No. 6,536,503, Modular Transport System for Coverings for Architectural Openings, which is hereby incorporated herein by reference. In the typical top/down product, the raising and lowering of the blind is done by a lift cord or lift cords suspended from the head rail and attached to the bottom rail (also referred to as the moving rail or bottom slat). The opening and closing of the blind is typically accomplished with ladder tapes (and/or tilt cables) which run along the front and back of the stack of slats. The lift cords usually run along the front and back of the stack of slats or through holes in the middle of the slats. In these types of blinds, the force required to raise the blind is at a minimum when the blind is fully lowered (fully extended), since the weight of the slats is supported by the ladder tape so that only the bottom rail is being raised at the onset. As the blind is raised further, the slats stack up onto the bottom rail, transferring the weight of the slats from the ladder tape to the lift cords, so progressively greater lifting force is required to raise the blind as the blind approaches the fully raised (fully retracted) position.

Some window covering products are built in the reverse (bottom up), where the moving rail, instead of being at the bottom of the window covering bundle, is at the top of the window covering bundle, between the bundle and the head rail, such that the bundle is normally accumulated at the bottom of the window when the covering is retracted and the moving rail is at the top of the window covering, next to the head rail, when the covering is extended. There are also composite products which are able to do both, to go top down and/or bottom up.

In horizontal window covering products, there is an external force of gravity against which the operator is acting to move the expandable material from one of its expanded and retracted positions to the other.

In contrast to a blind, in a typical top down shade, such as a shear horizontal window shade, the entire light blocking material wraps around a rotator rail as the shade is raised. Therefore, the weight of the shade is transferred to the rotator rail as the shade is raised, and the force required to raise the shade is thus progressively lower as the shade (the light blocking element) approaches the fully raised (fully open) position. Of course, there are also bottom up shades and also composite shades which are able to do both, to go top down and/or bottom up. In the case of a bottom/up shade, the weight of the shade is transferred to the rotator rail as the shade is lowered, mimicking the weight operating pattern of a top/down blind.

In the case of vertically-oriented window coverings, which move from side to side rather than up and down, a first cord is usually used to pull the covering to the retracted position and then a second cord is used to pull the covering to the extended position, since the operator is not acting against gravity. However, these window coverings may also be arranged to have another outside force or load other than gravity, such as a spring, against which the operator would act to move the expandable material from one position to another.

A wide variety of drive mechanisms is known for moving coverings between their extended and retracted positions and for tilting slats. A cord drive to raise or lower the blind is very handy. It does not require a source of electrical power, and the cord may be placed where it is readily accessible, getting around many obstacles.

A single cord may perform both a drive function and a lift function, being pulled by the operator to drive the blind up and down (the drive function), and attaching to the bottom rail to raise and lower the blind (the lift function), so the same cord functions both to drive the blind and to lift the bottom rail. Alternatively, there may be drive cord(s) and lift cords that are totally separate and independent from each other, with the drive cord being pulled to cause a drive spool to rotate, and the rotation of the drive spool driving a lift spool, which then wraps up the lift cord to raise the bottom rail.

Known cord drives have some drawbacks. The cords in a cord drive, for instance, may be hard to reach when the cord is way up (and the blind is in the fully lowered position), or the cord may drag on the floor when the blind is in the fully raised position. The cord drive also may be difficult to use, requiring a large amount of force to be applied by the operator, or requiring complicated changes in direction in order to perform various functions such as locking or unlocking the drive cord. There may also be problems with overwrapping of the cord onto the drive spool, and many of the mechanisms for solving the problem of overwrapping require the cord to be placed onto the drive spool at a single location, which prevents the drive spool from being able to be tapered to provide a mechanical advantage.

SUMMARY OF THE INVENTION

The present invention provides a cord drive which has the advantages of prior art cord drives, plus it eliminates many of their problems. One embodiment of the present invention provides a cord drive which does not require the drive cord to travel as far as the window covering. Other embodiments permit the use of a cord drive in unpowered, underpowered, or overpowered blinds and shades.

In an embodiment involving unpowered window coverings having a drive cord lock, unlocking and releasing the cord lock may allow the covering to lower gradually as the drive cord winds up onto a drive spool, rather than falling precipitously. In some embodiments, the drive cord may automatically lock when it is released to keep the covering in place where it was released, and simply lifting up on the tassel weight attached to the cord may allow the covering to lower gradually, thereby eliminating the need for the operator to move the drive cord sideways to disengage a cord lock. Pulling on the single drive cord may then raise the covering, perhaps with a mechanical advantage, such that the vertical distance the drive cord travels (the stroke) is less than the vertical distance traveled by the window covering. In the case of lightweight window coverings (as compared to the heavier blinds), a spring assist generally is not required to raise or lower the covering, but a spring assist (also referred to as a spring motor) may be used as needed for heavier coverings.

A very interesting feature of the cord drive in some of the embodiments of the present invention is that the drive cord remains under tension except when tension is released by the operator. The moment the tension is released on the drive cord, the drive cord winds up onto the drive spool until tension is re-established (or until the window covering is fully lowered and the drive cord is essentially fully retracted onto the drive spool). Thus, should someone pick up the tassel weight or the drive cord, releasing the tension on the drive cord, the drive cord immediately retracts back into the drive spool.

In other embodiments of the cord drive, the drive cord is totally hidden inside an actuator mechanism, such as a wand actuator.

In certain embodiments of this invention, a spring assisted tilt mechanism mounted on the head rail provides the required force to bias or tilt the slats in one direction, while pulling on a single tilt drive cord tilts the slats in the opposite direction, eliminating the need for two tilt cords.

Also, in some of the embodiments, the distance traversed by the drive cord to fully raise or lower the window covering is a fraction of the distance traversed by the covering itself. In some embodiments, the distance traversed by the drive cord is 65% or less of the distance traversed by the window covering, while the force required at any point to raise or lower the window covering is as close as possible to 1.5 times the weight of the window covering being raised or lowered. Furthermore, even for large window covering products, the force required at any point to raise or lower the product generally is less than 15 pounds, making it easy for anyone to use.

Large window covering products or window covering products with heavy components (such as wooden slats in a blind) may require means for transferring the larger forces required to operate the window covering. In some embodiments, V-shaped lift rods are used instead of D-shaped lift rods in order to transfer these larger forces. Furthermore, some embodiments make use of a high strength sleeve along portions of the lift rod to increase the overall strength of the lift rod without increasing the size of the individual drive components. Also, in some embodiments, gearboxes are used to increase the mechanical advantage of the applied force to assist the user in activating the window covering.

While various embodiments of the present invention are shown being used in various window covering products, such as horizontal window blinds, pleated shades, cellular products, and Roman shades, it should be obvious to those skilled in the art that the types of cord drives taught here may be used in any number of different types of mechanical devices, especially where it is desirable to have a cord drive which converts the linear motion of pulling on the cord by the user to a rotary motion.

BRIEF DESCRIPTION OF THE DRAWINGS

FIG. 72 is a partially broken away front view of the wand of FIG. 69;

FIG. 73 is a sectional view along line 73-73 of FIG. 72;

FIG. 74 is an enlarged, broken-away view of a portion of FIG. 73;

FIG. 75 is a sectional view along line 75-75 of FIG. 72;

FIG. 76 is an enlarged, broken-away view of a portion of FIG. 75;

FIG. 77 is a perspective view of an alternate embodiment of a tassel weight;

FIG. 78 is a perspective view, from a different angle, of the tassel weight of FIG. 77;

FIG. 79A is a sectional view along line 79A-79A of FIG. 78;

FIG. 79B is a top view of the tassel weight of FIG. 77;

FIG. 79C is a bottom view of the tassel weight of FIG. 77;

FIG. 79D is a front view of the tassel weight of FIG. 77;

FIG. 79E is a side view of the tassel weight of FIG. 77;

FIG. 100 is a view along line 100-100 of FIG. 99;

FIG. 102 is a view along line 102-102 of FIG. 101;

FIG. 105 is similar to FIG. 104, but showing the rotor in the lower, unlocked position relative to the rotor lock housing;

FIG. 106 is a partially exploded, perspective view of a cellular shade similar to FIG. 1, but incorporating a V-rod lift rod and high strength sleeve made in accordance with the present invention;

FIG. 107 is a detailed, perspective view of the V-rod lift rod and high strength sleeve of FIG. 106;

FIG. 108 is an end view of the V-rod lift rod of FIG. 107;

FIG. 109 is an end view of the high strength sleeve of FIG. 107;

FIG. 110 is a section view along line 110-110 of FIG. 107;

FIG. 111 is a partially exploded, perspective view of a cellular product shade similar to that of FIG. 9 but incorporating gearboxes and a spring motor assist with a transmission at either end of the lift rod;

FIG. 112 is a perspective view of the gearbox of FIG. 111;

FIG. 113 is an exploded perspective view of the gearbox of FIG. 112;

FIG. 114 is a perspective view of the gearbox of FIG. 112, as seen from a slightly different angle to highlight the snap connectors in the rear of the housing;

FIG. 115 is an exploded perspective view of the gearbox of FIG. 112, similar to FIG. 113 but with the gears interchanged in location;

FIG. 116 is a partially exploded perspective view of roller shade with a roller lock mechanism made in accordance with the present invention;

Figure 11:
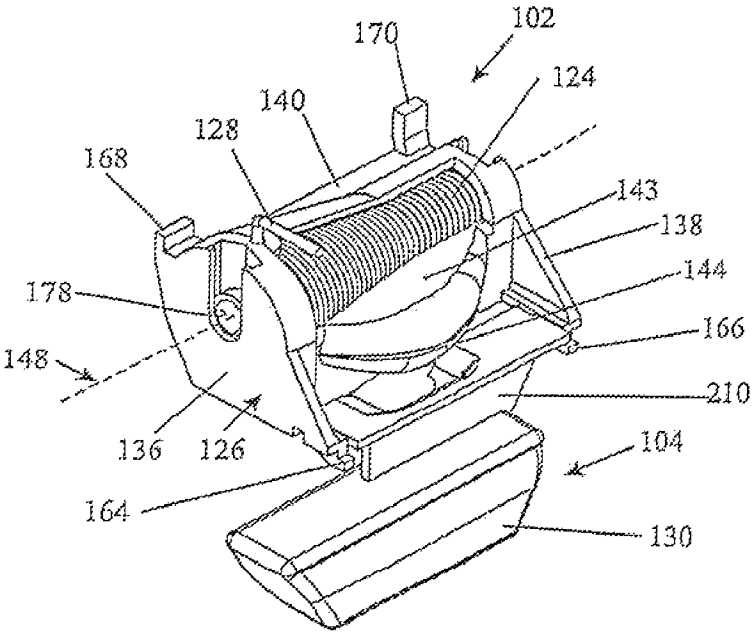
FIG. 11 is a front perspective view of the cord drive with roller lock mechanism of FIG. 1 (with the drive cord removed for clarity)
Figure 46:
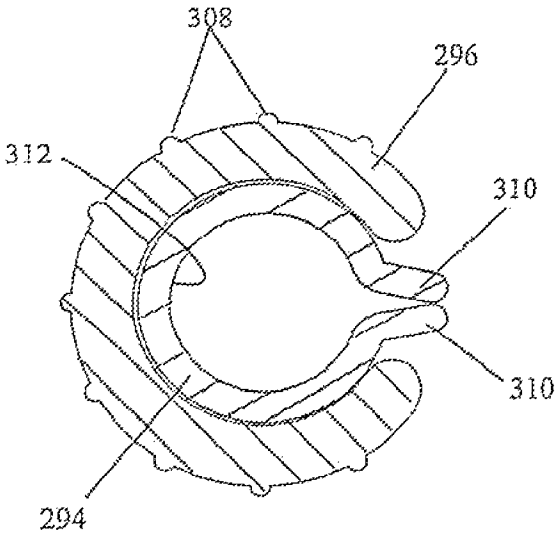
FIG. 46 is a view along line 46-46 of FIG. 42.
Figure 71:
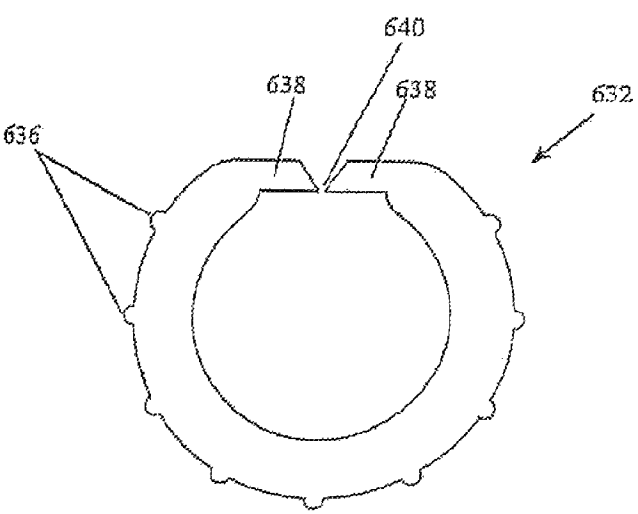
FIG. 71 is an end view of the wand extrusion of FIG. 70, showing the profile of the extrusion.
Figure 116:
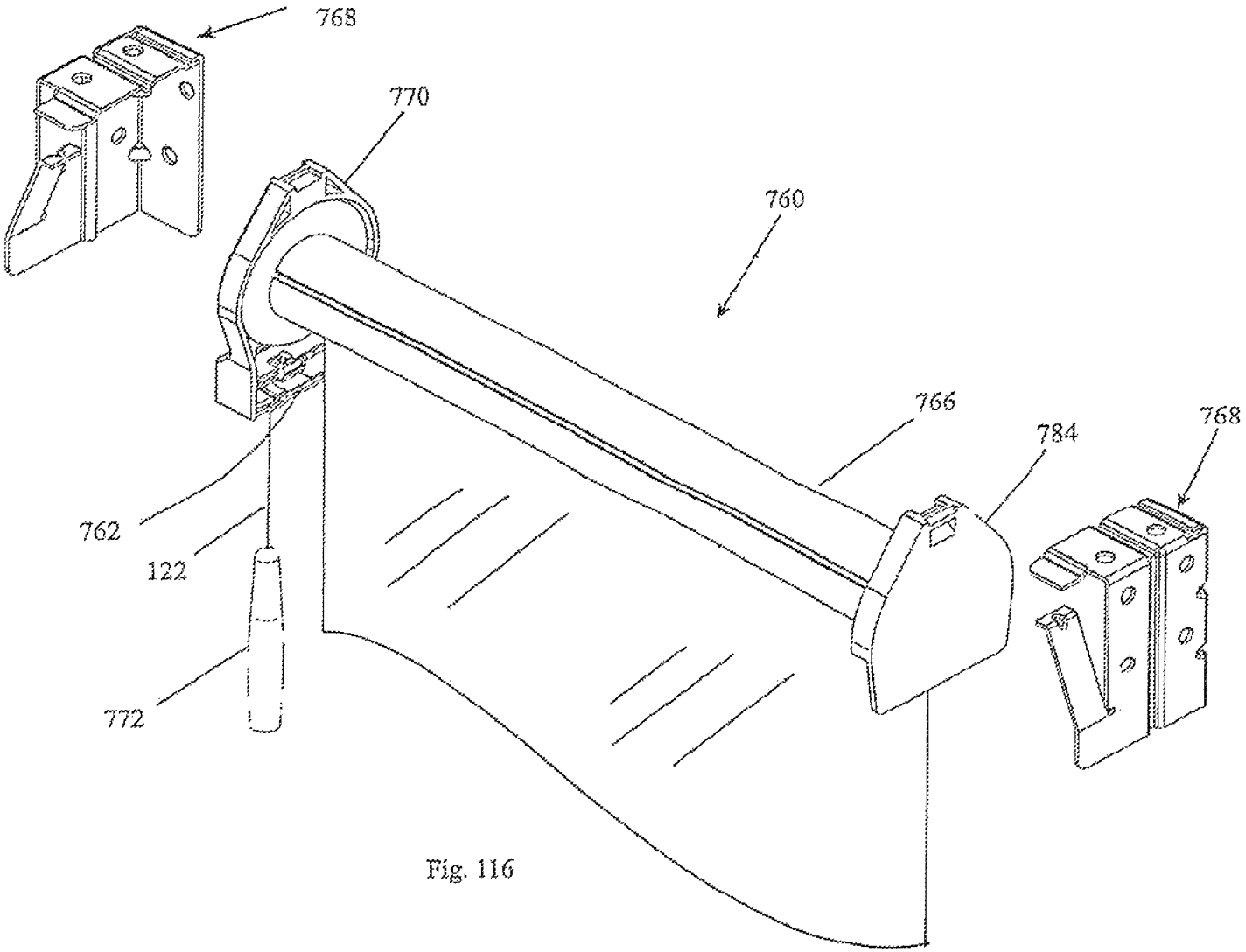
Figure 117:
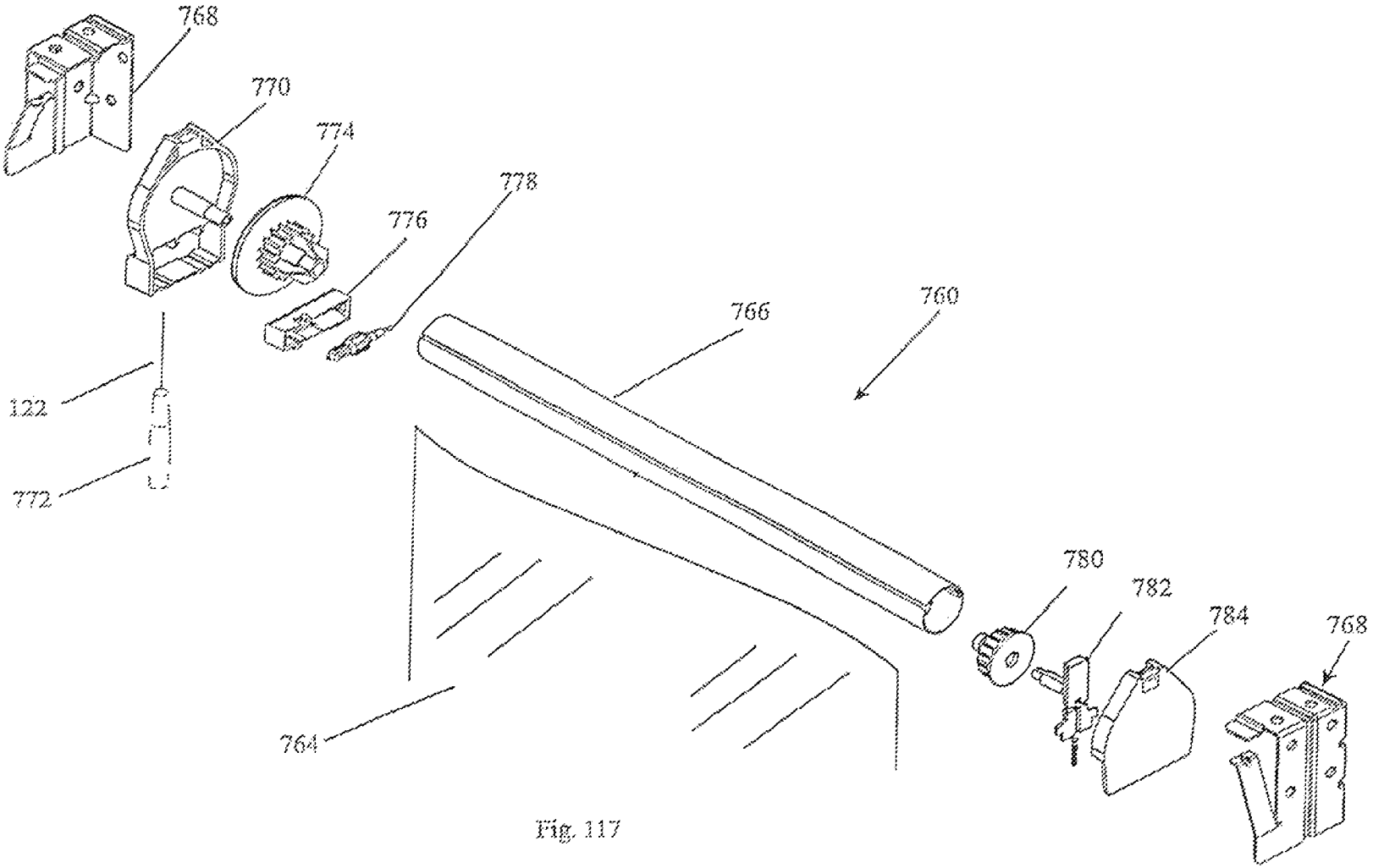
Figure 118:
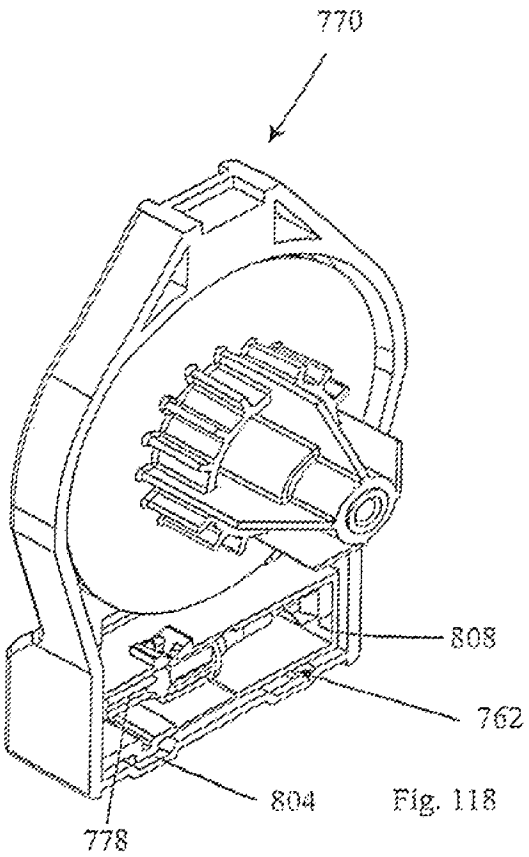
Figure 119:
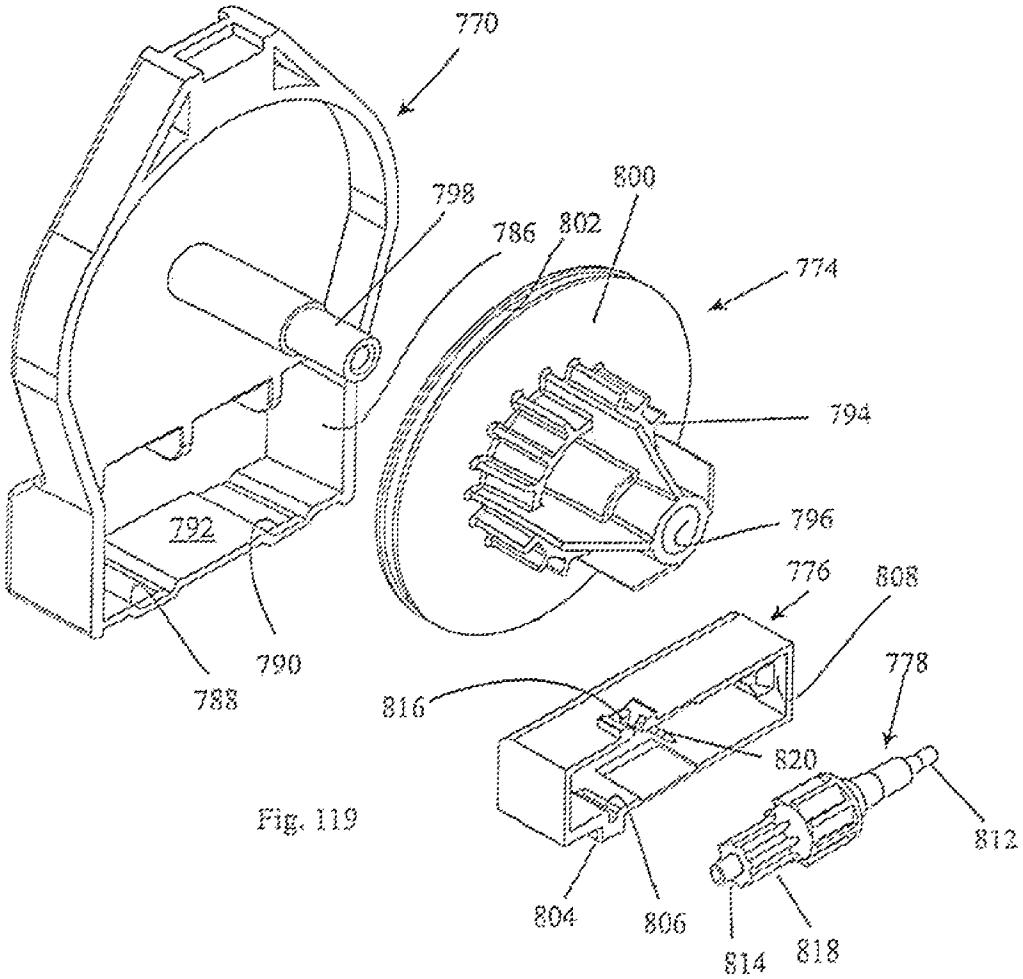
Figures 120, 121:
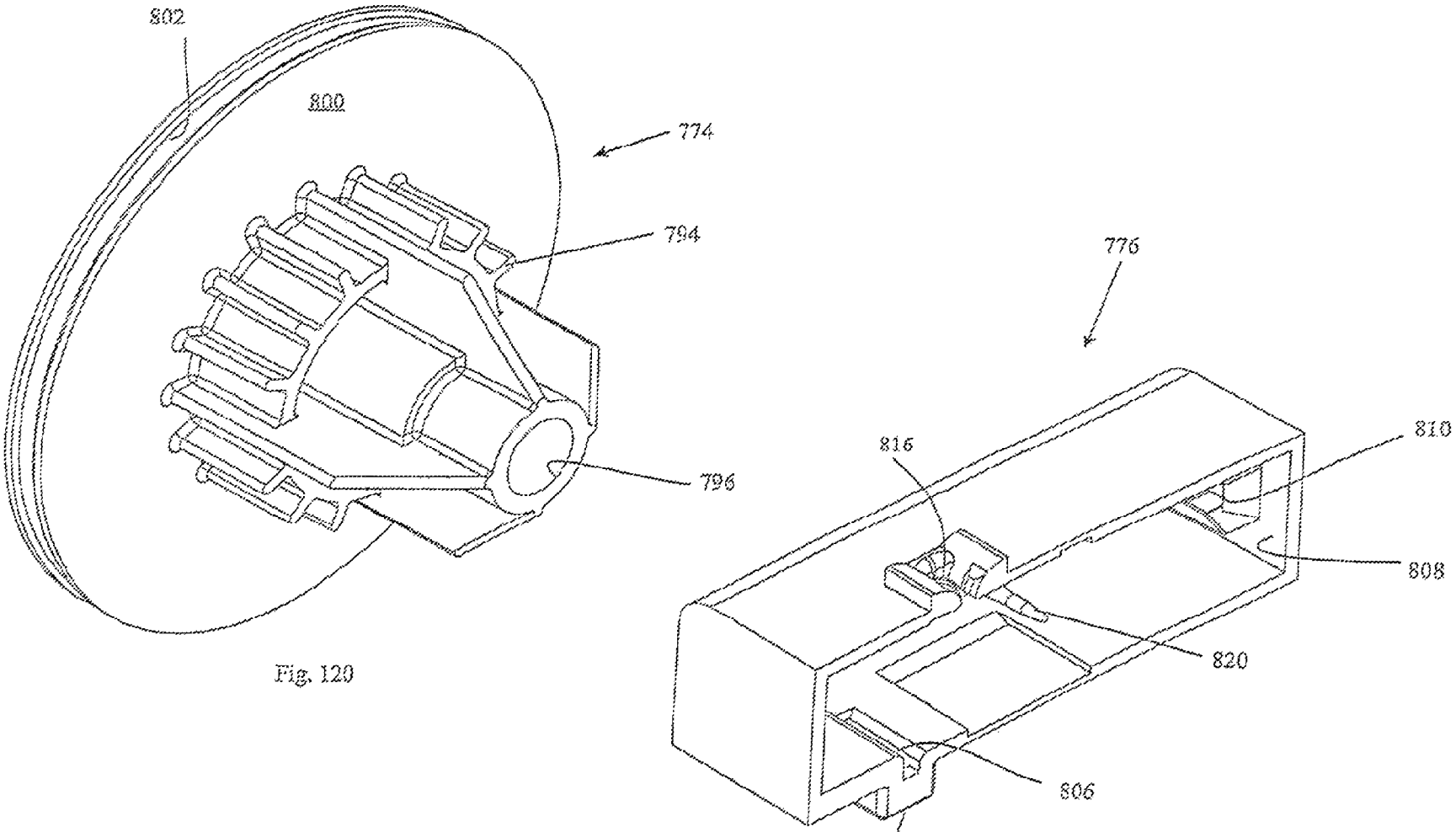
Figure 122:
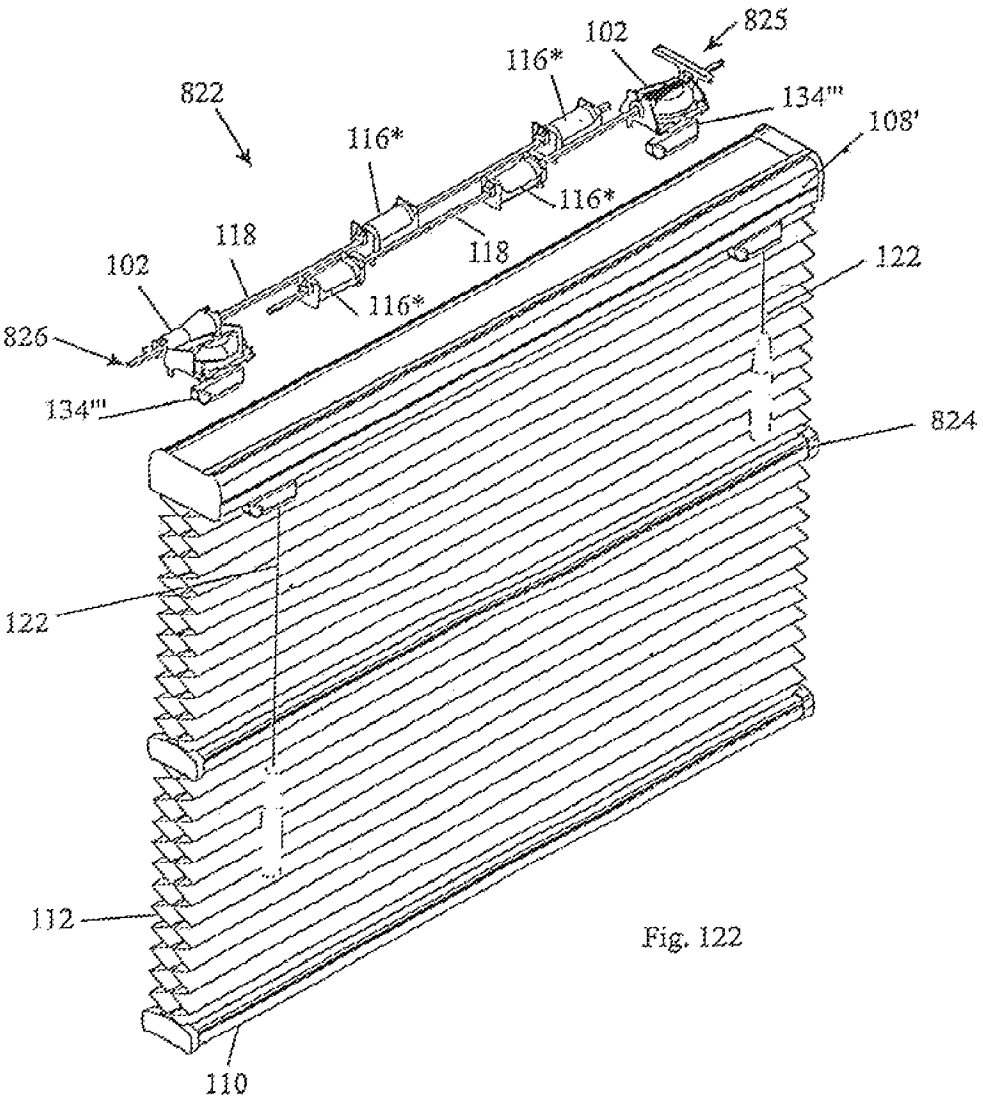
Figure 123:
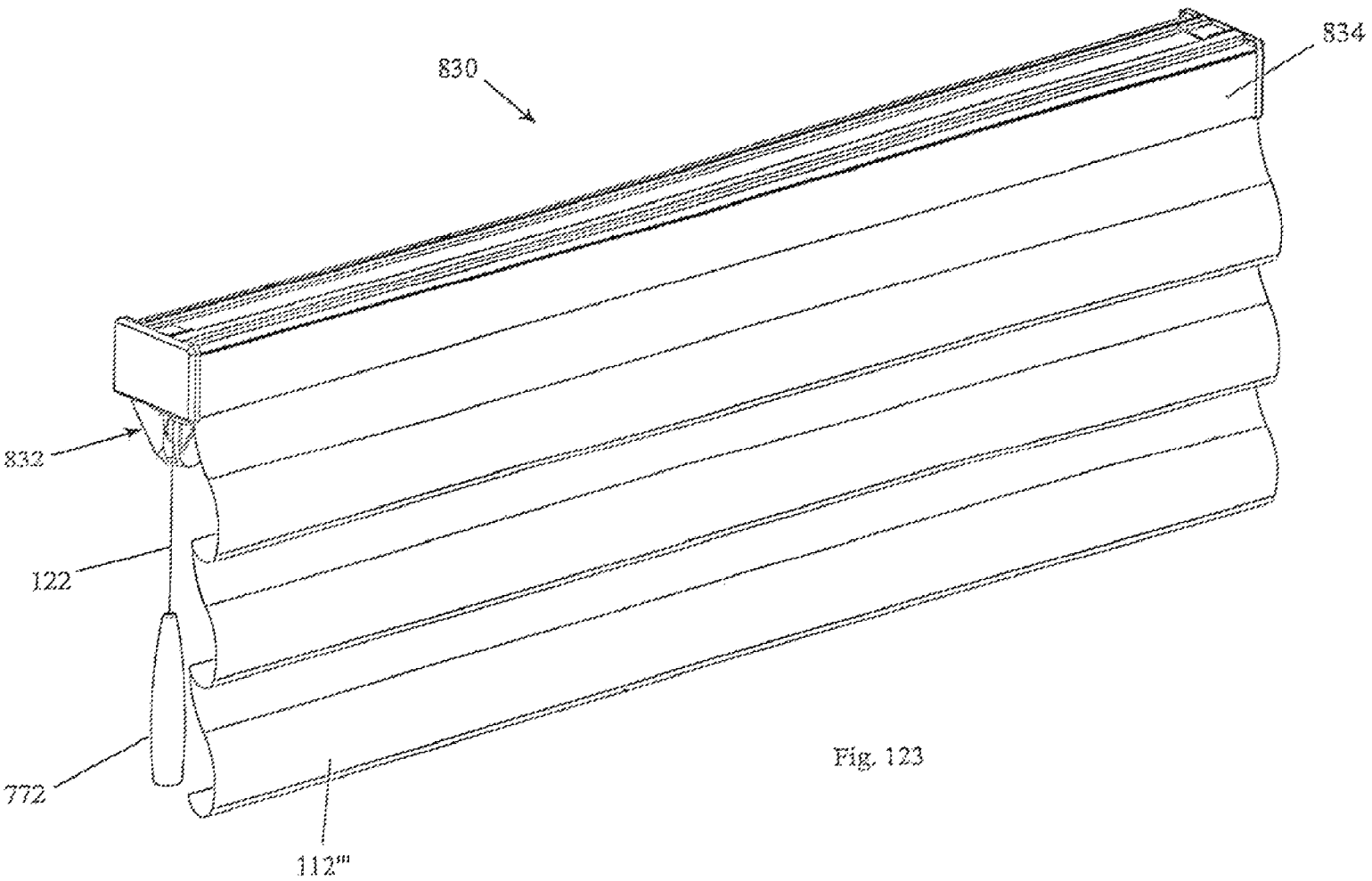
Figure 124:
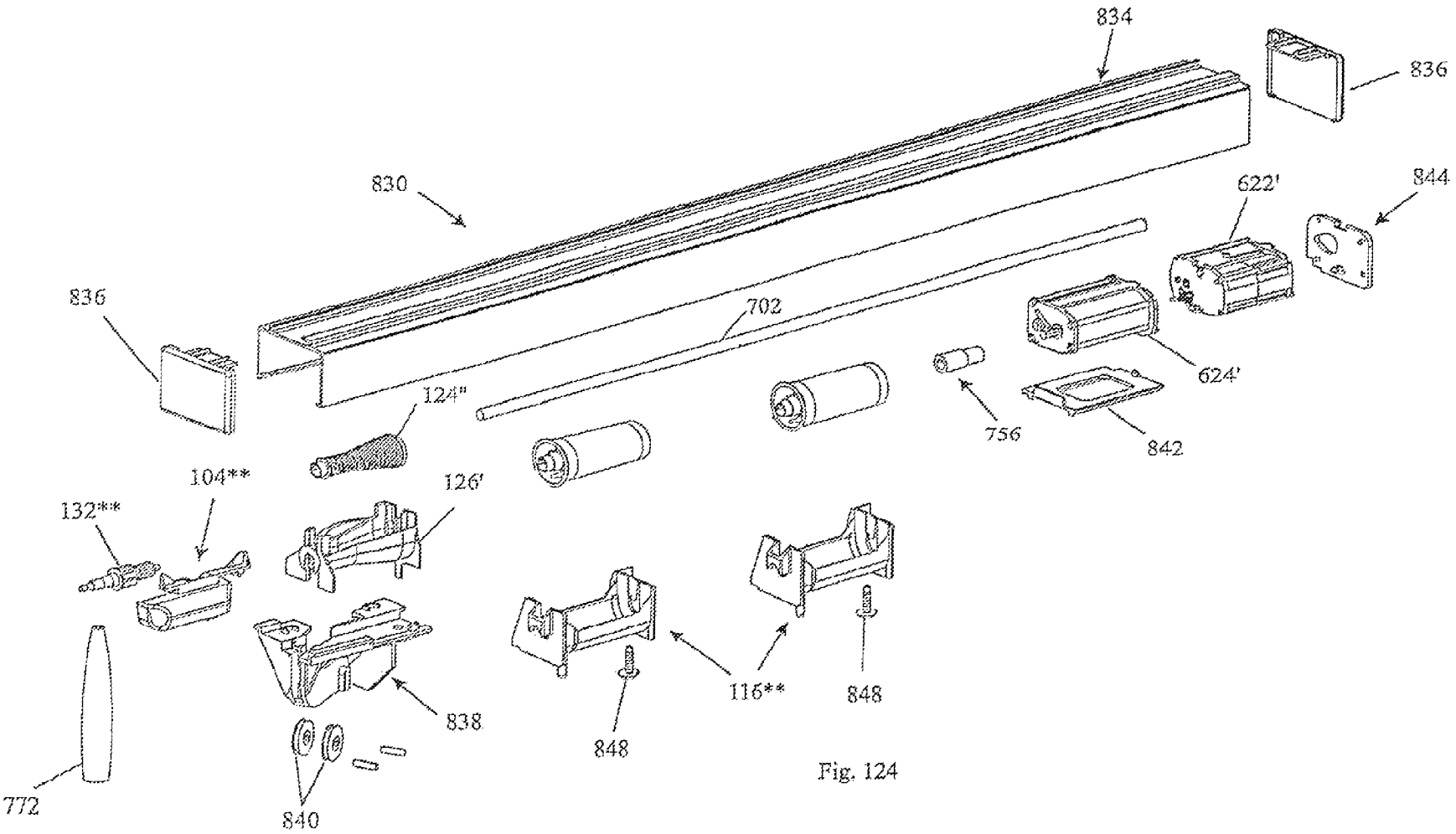
Figure 125:
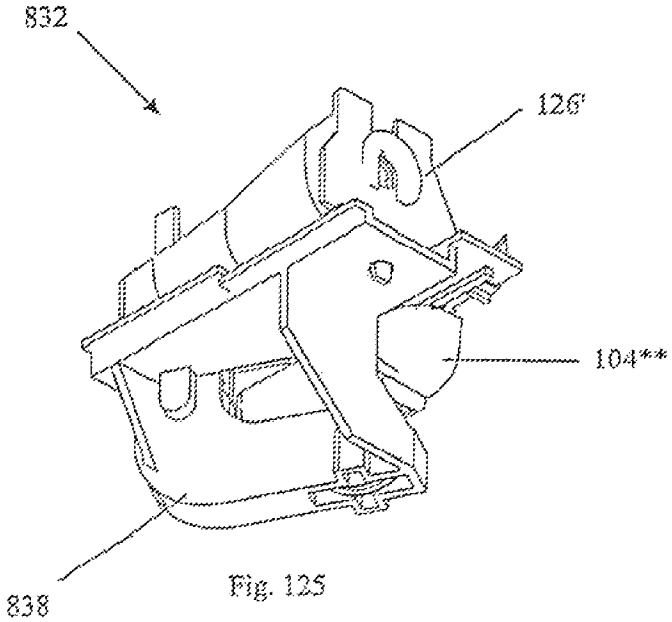
Figure 127:
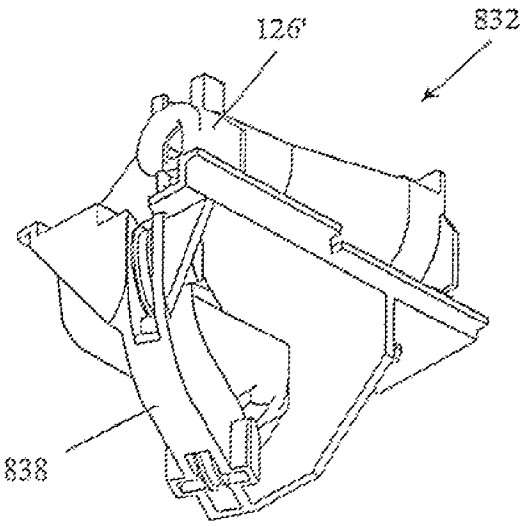
Figure 126:
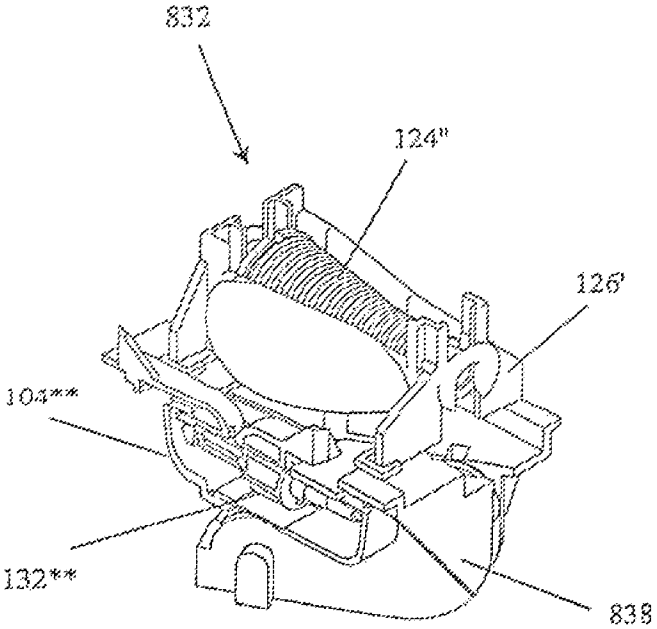
Figure 128:
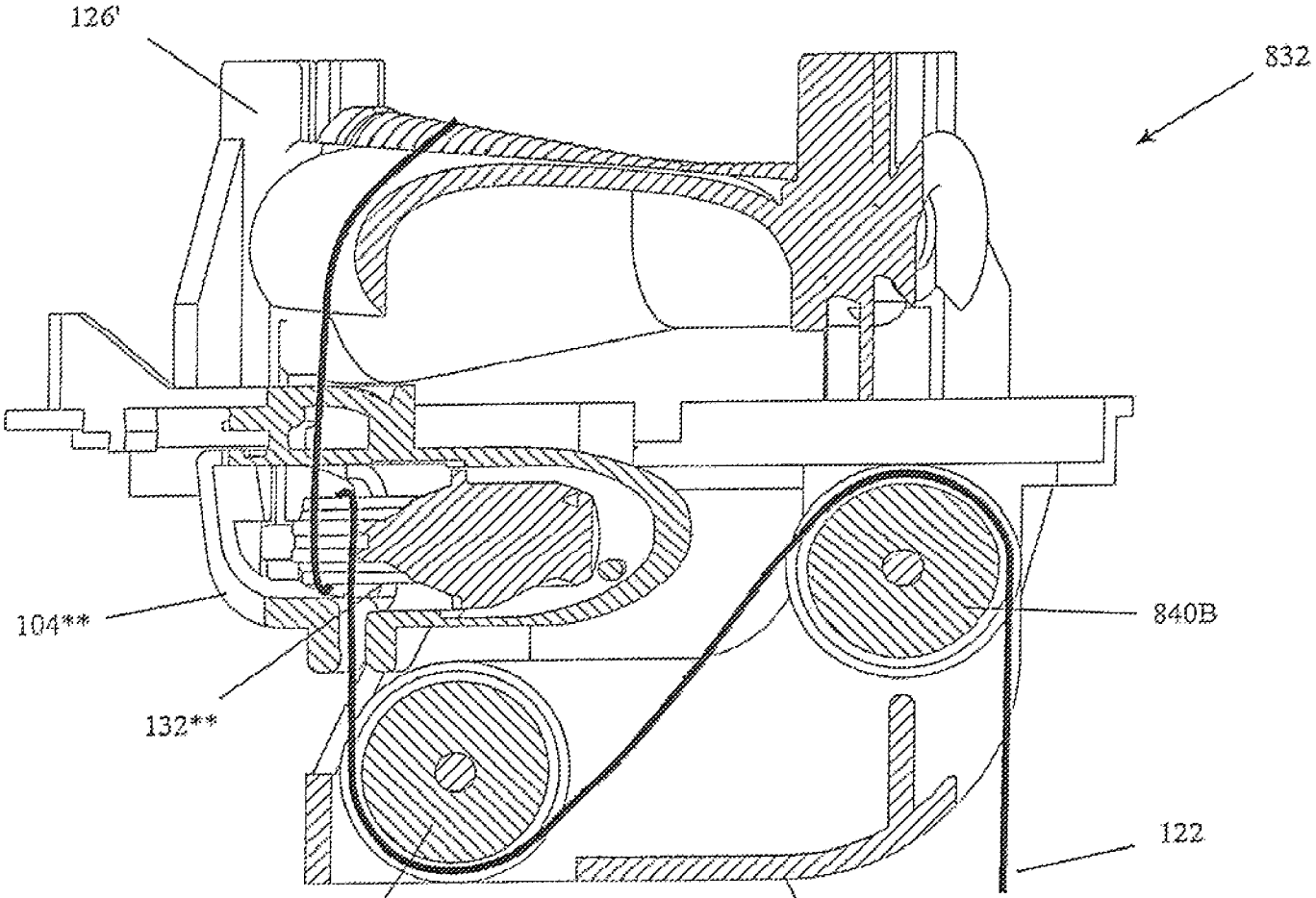
Figure 129:
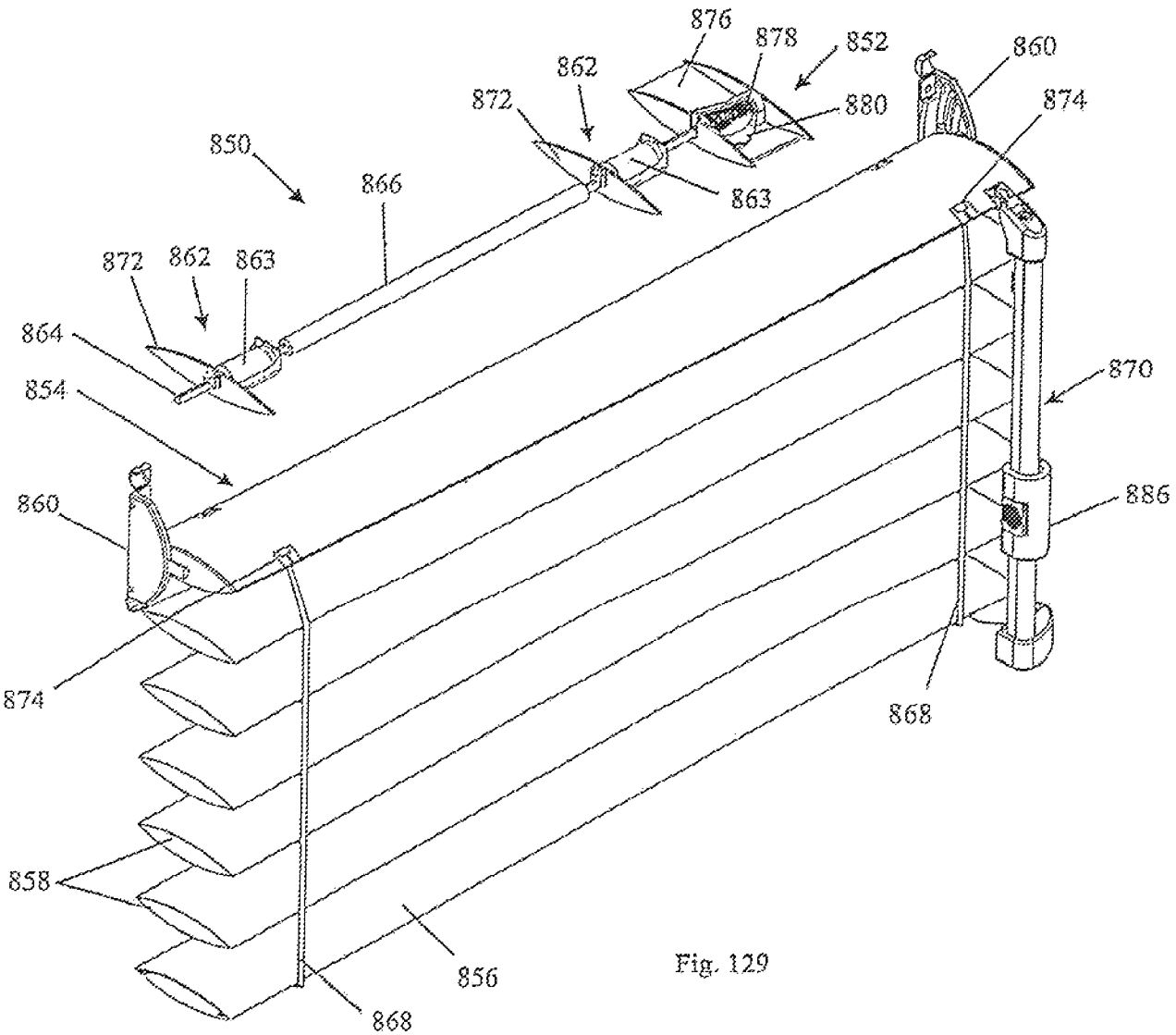
Figure 130:
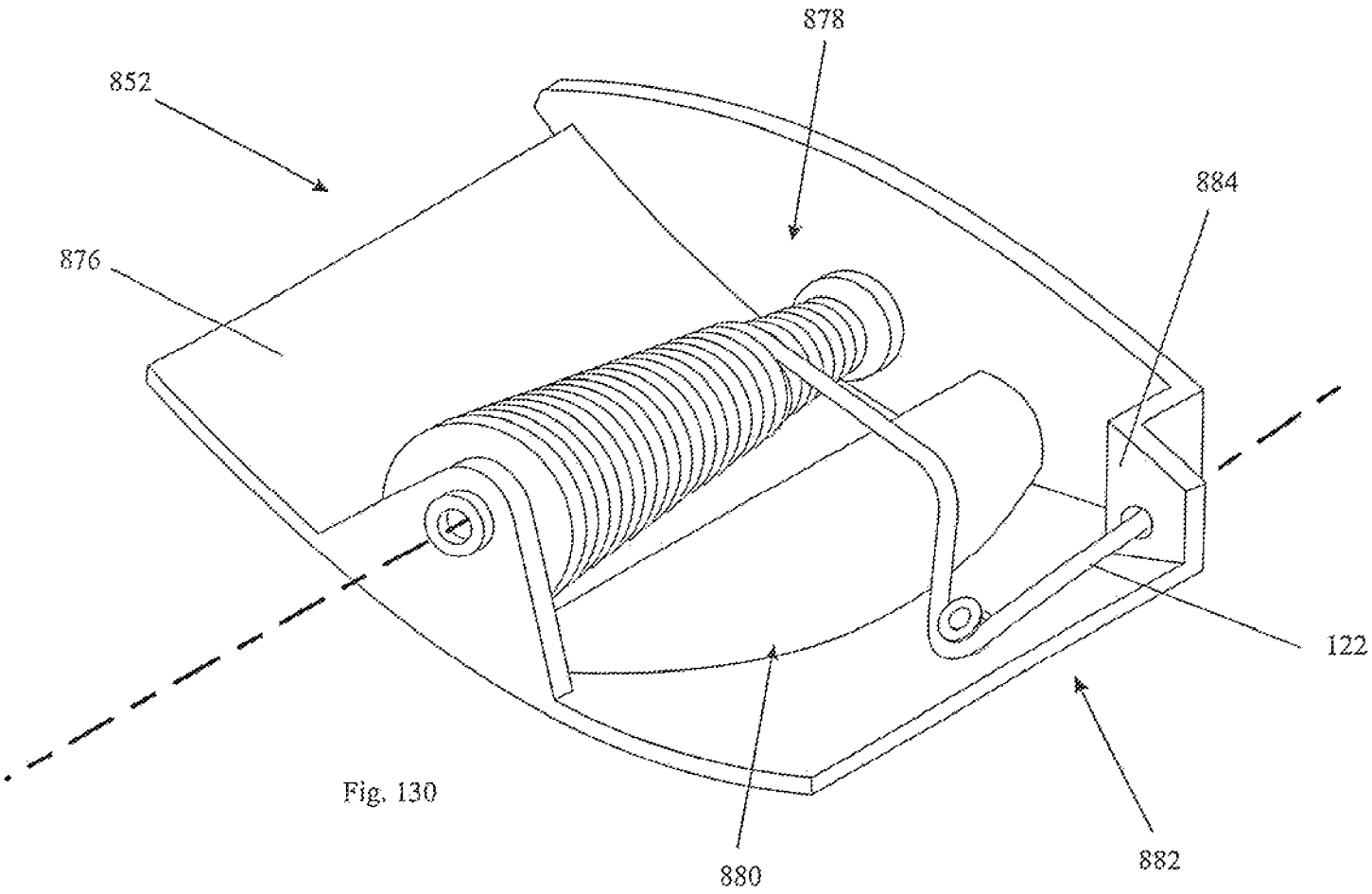
Figure 131:
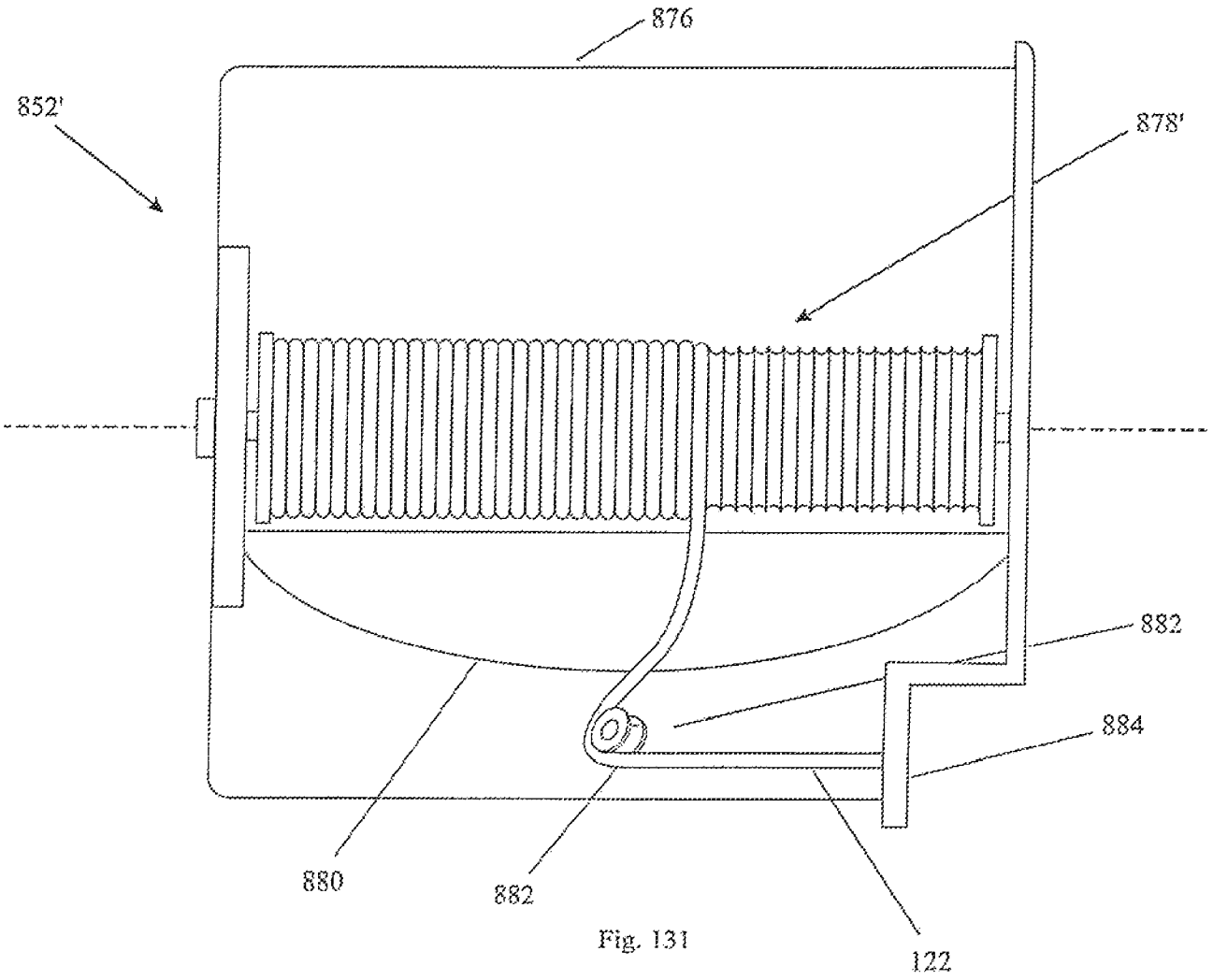
Figure 132:
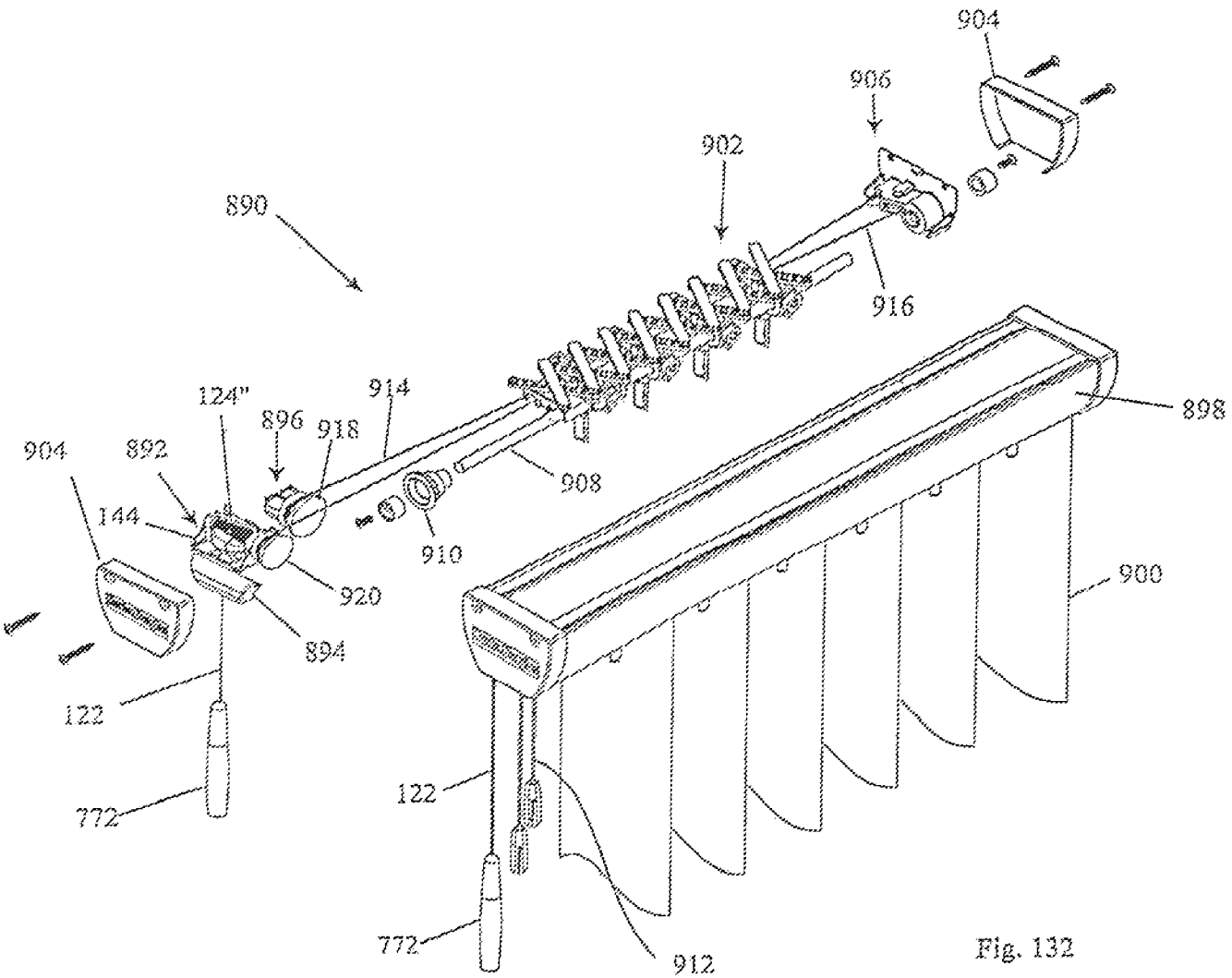
Figure 133:
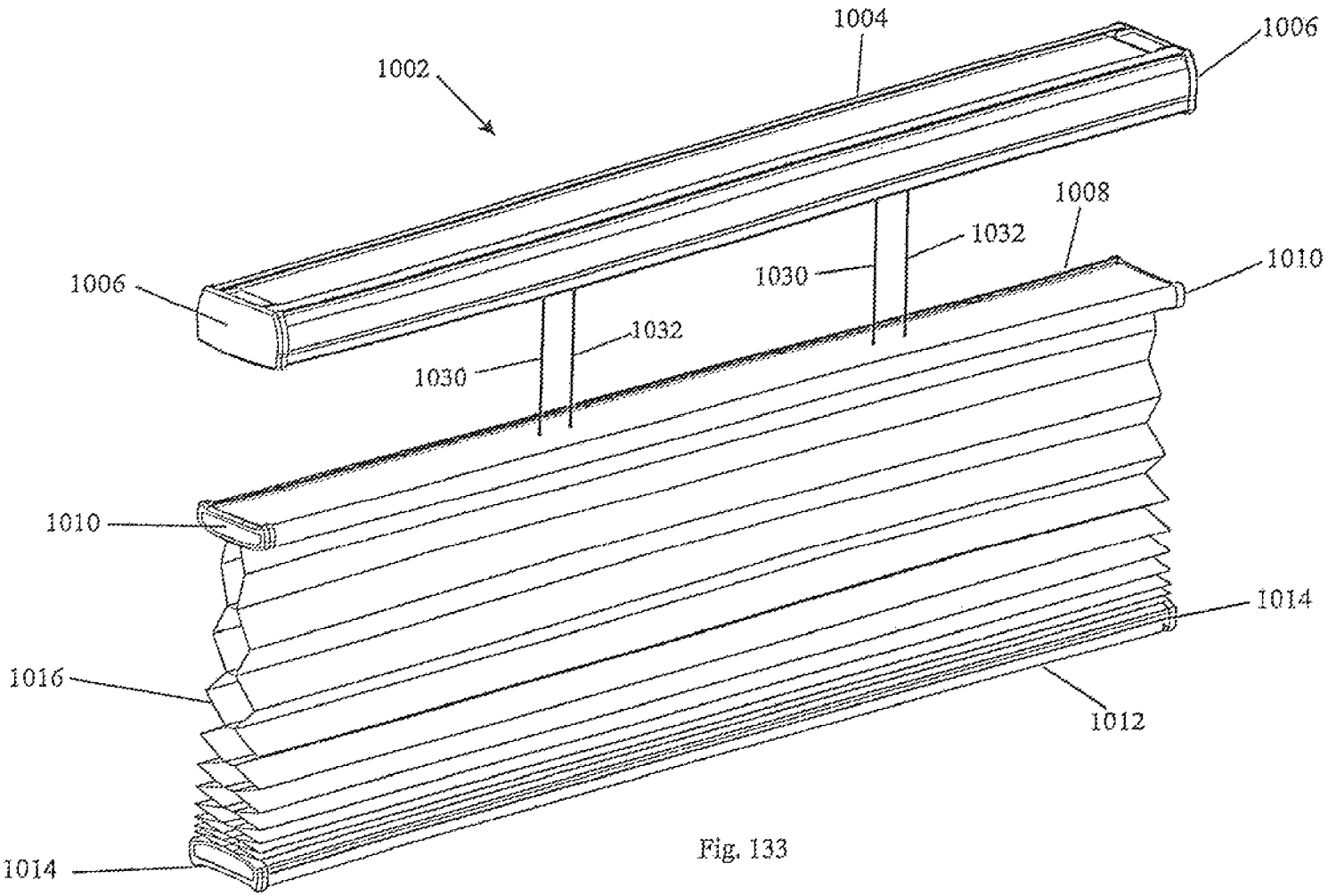
Figure 134:
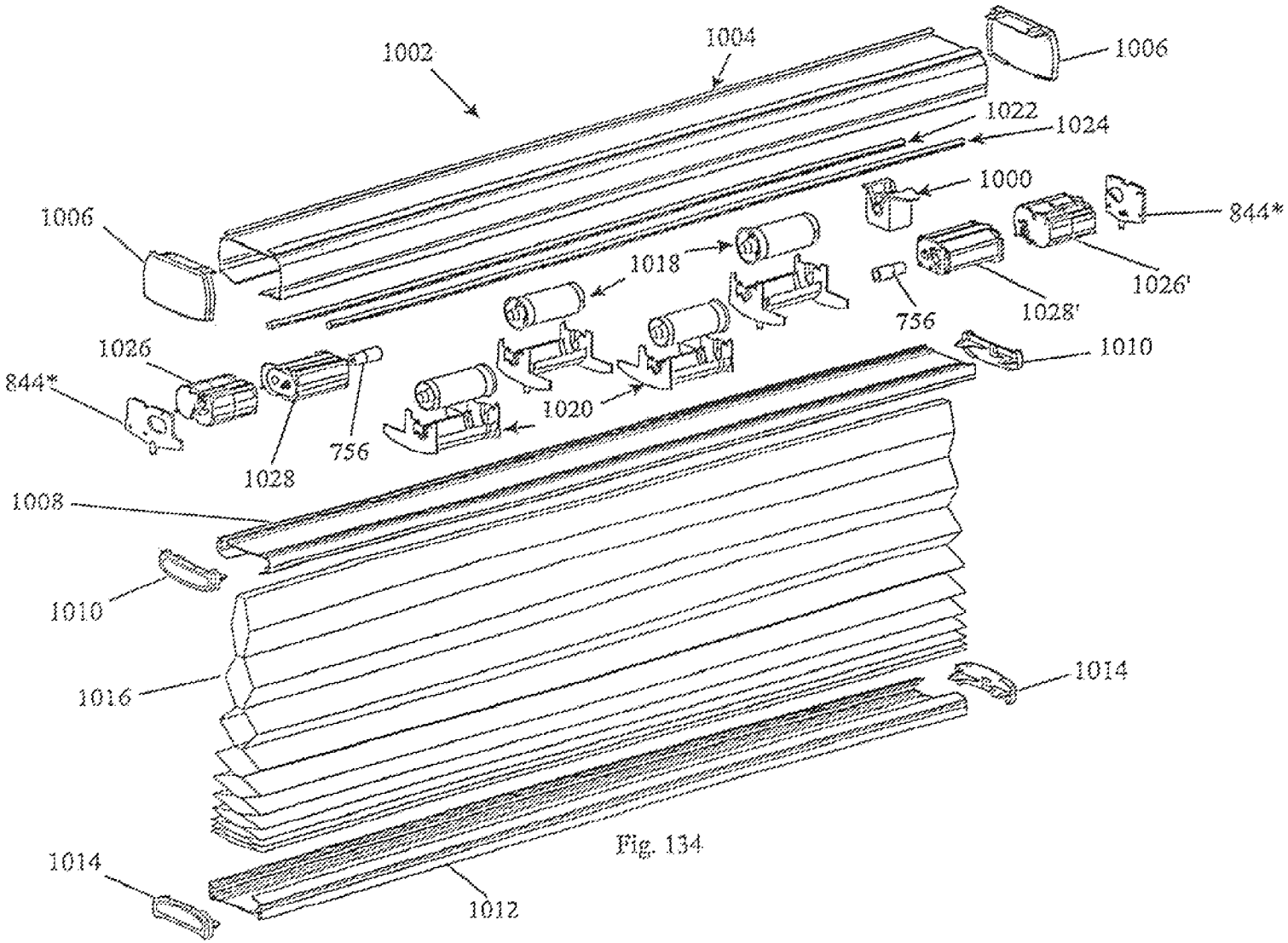
Figure 134A:
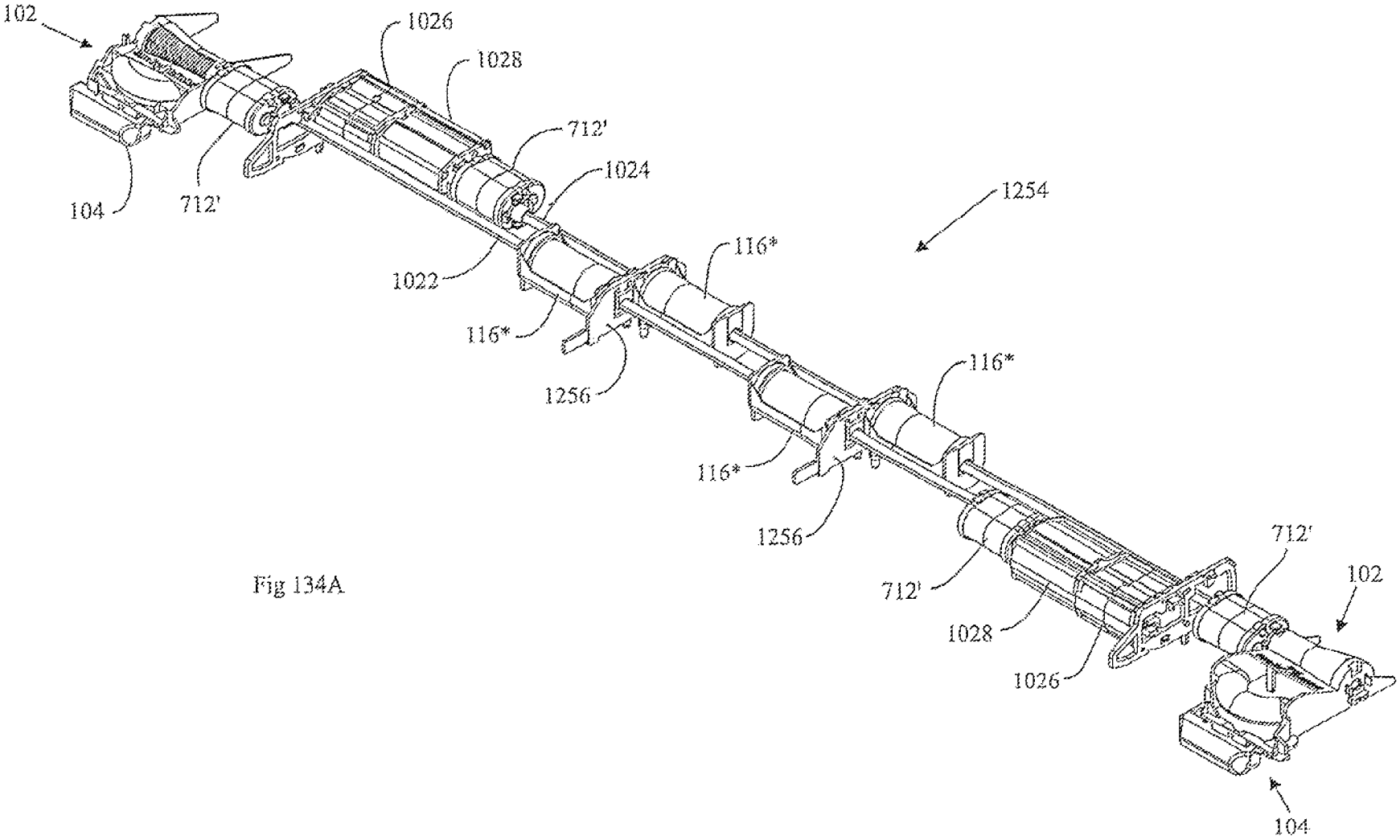
Figure 156:
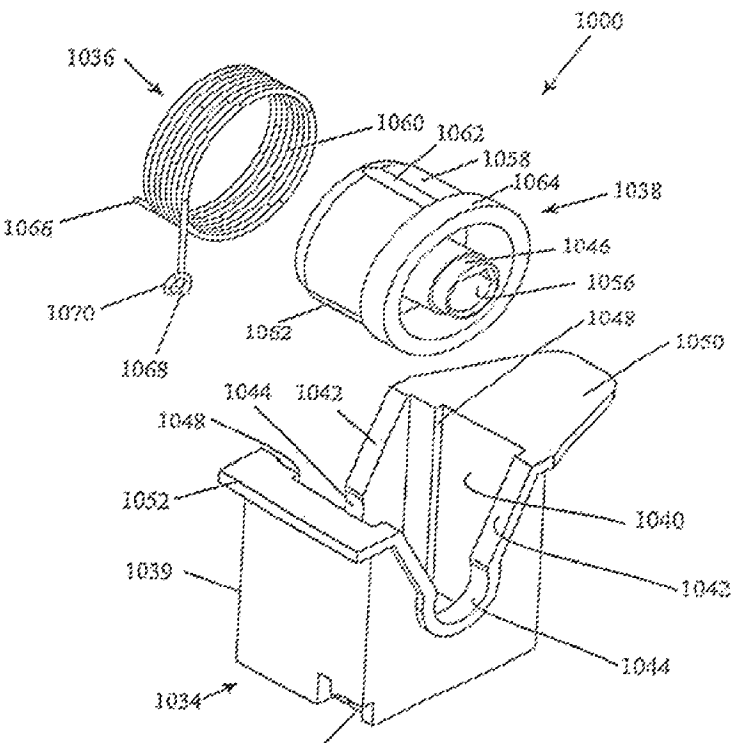
Figure 155:
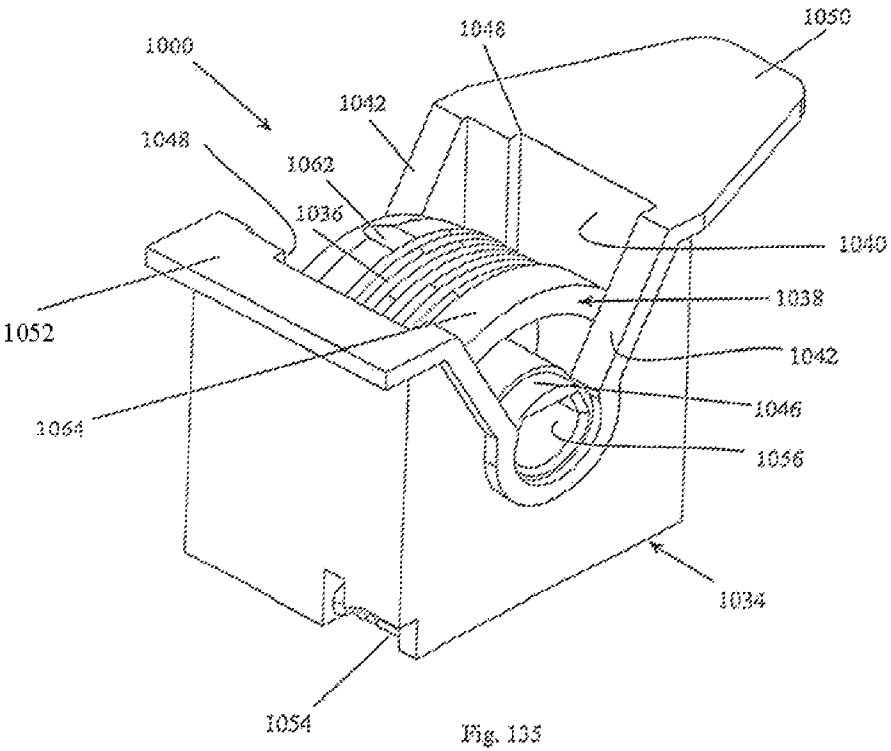
Figure 137:
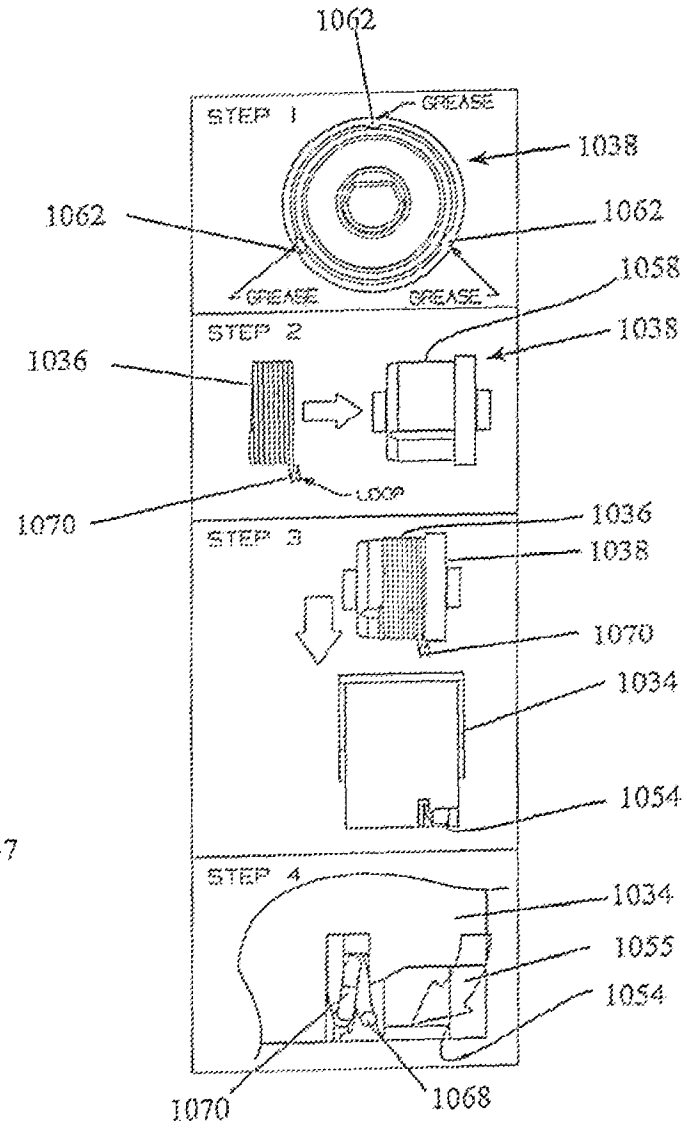
Figure 139:
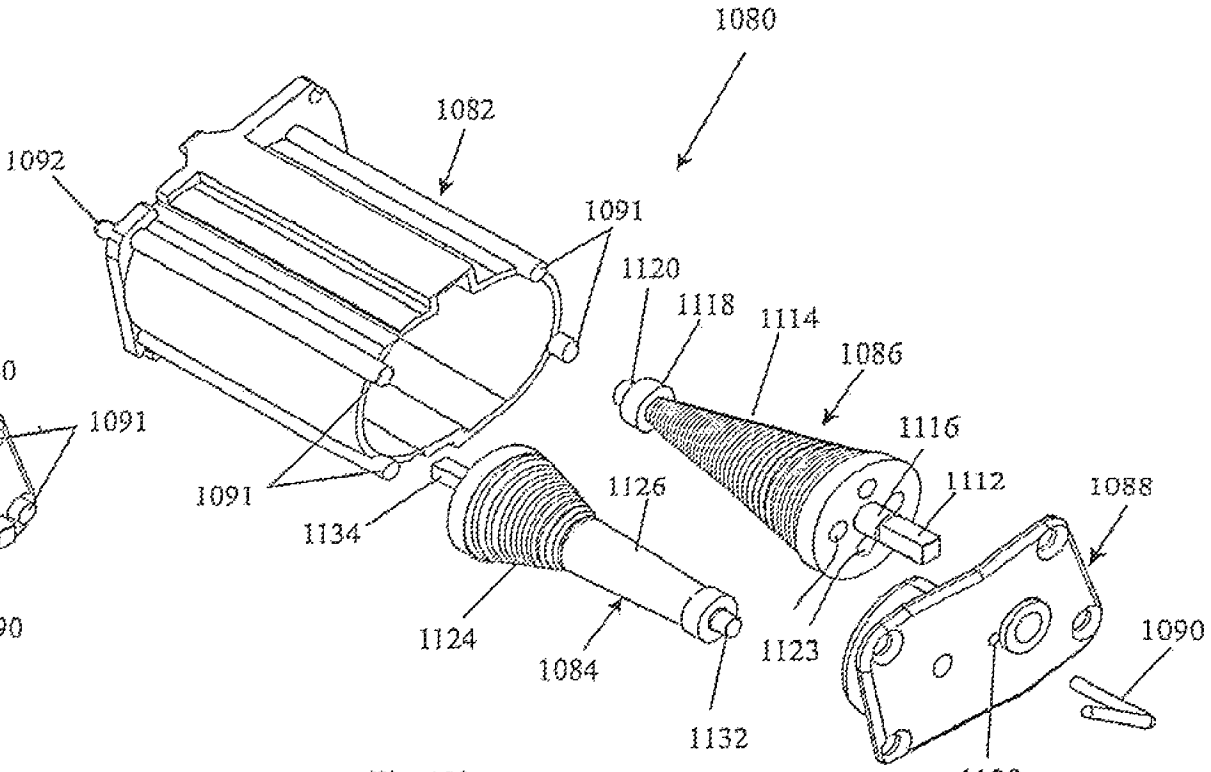
Figure 138:
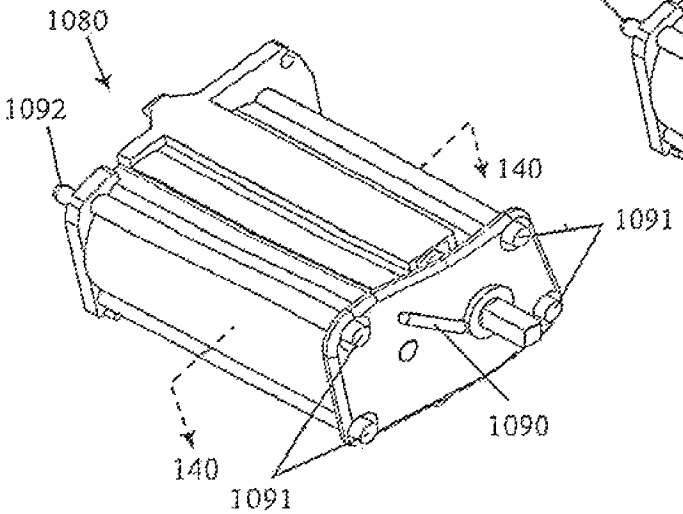
Figure 140:
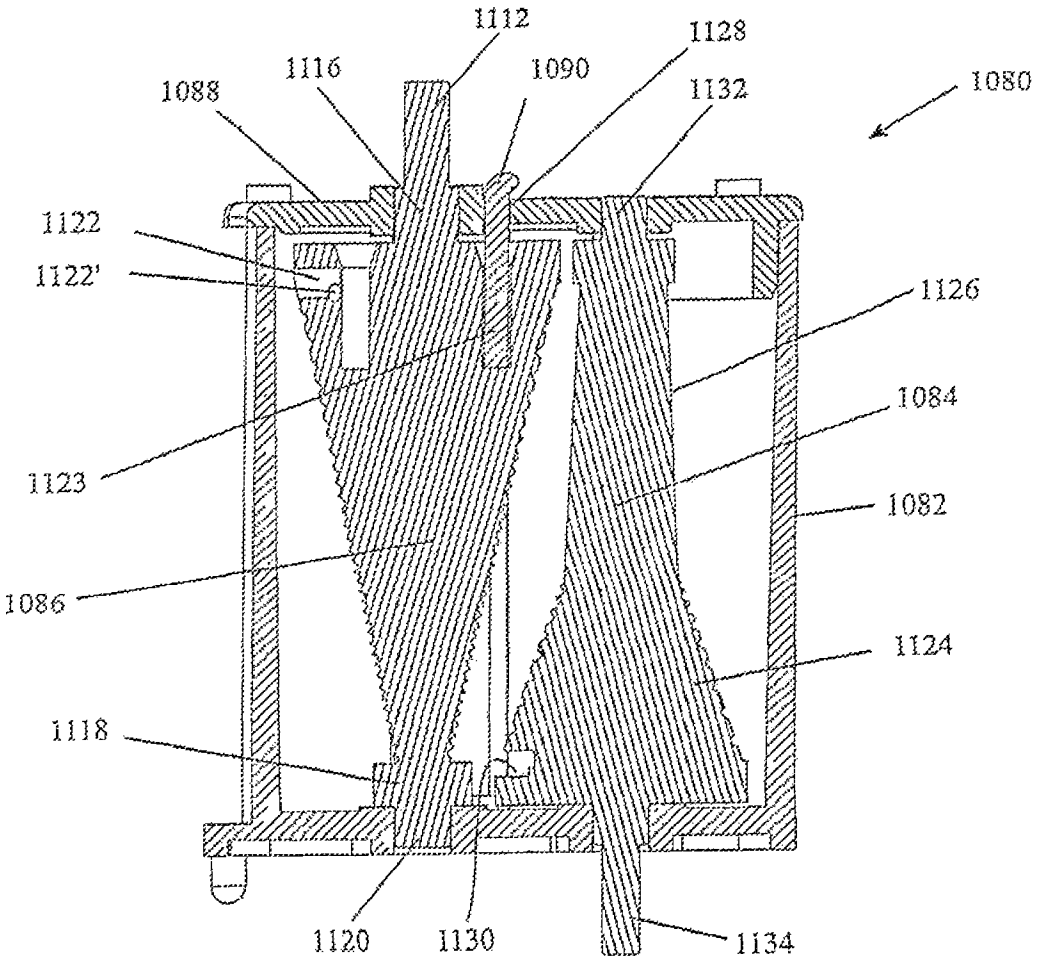
Figure 141:
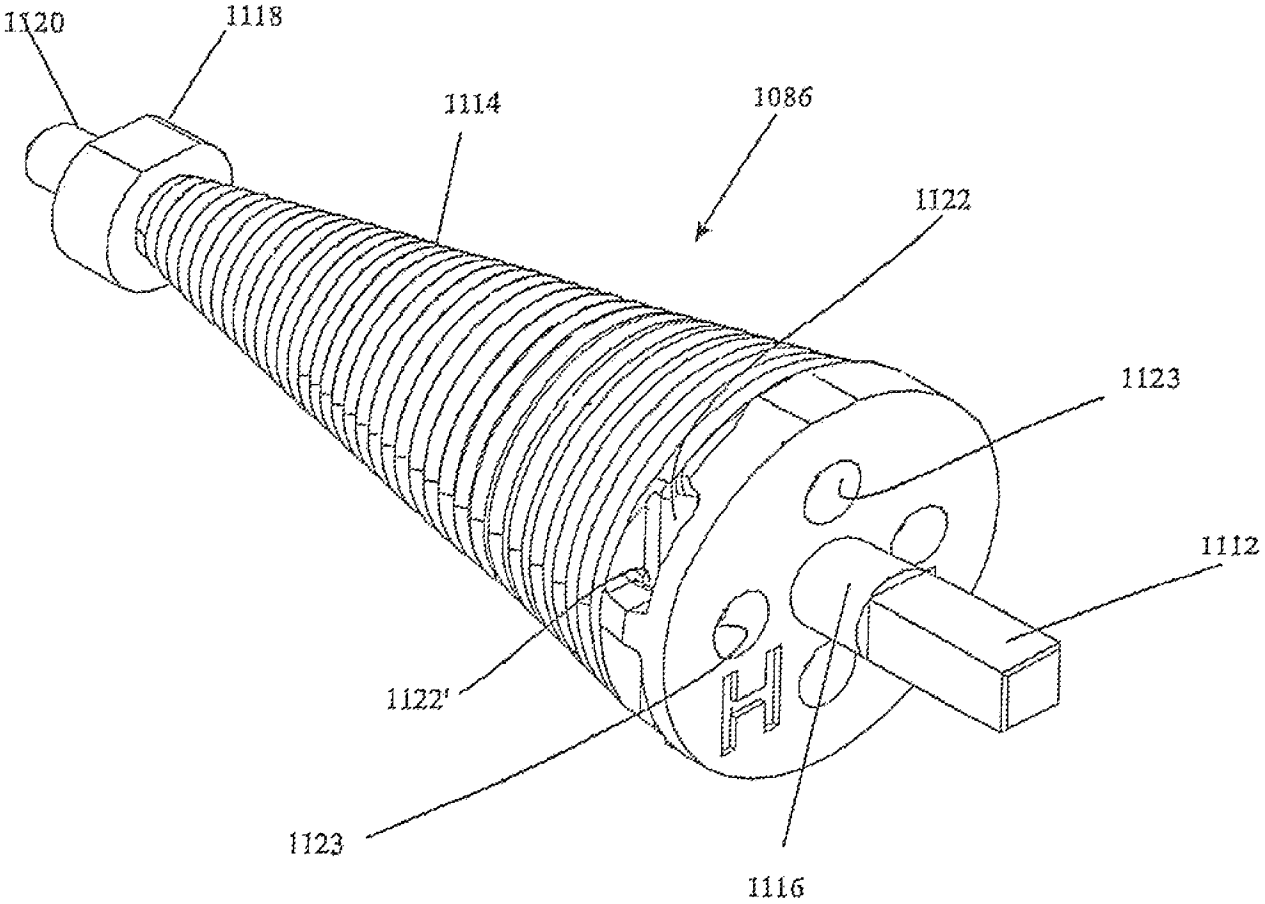
Figure 142:
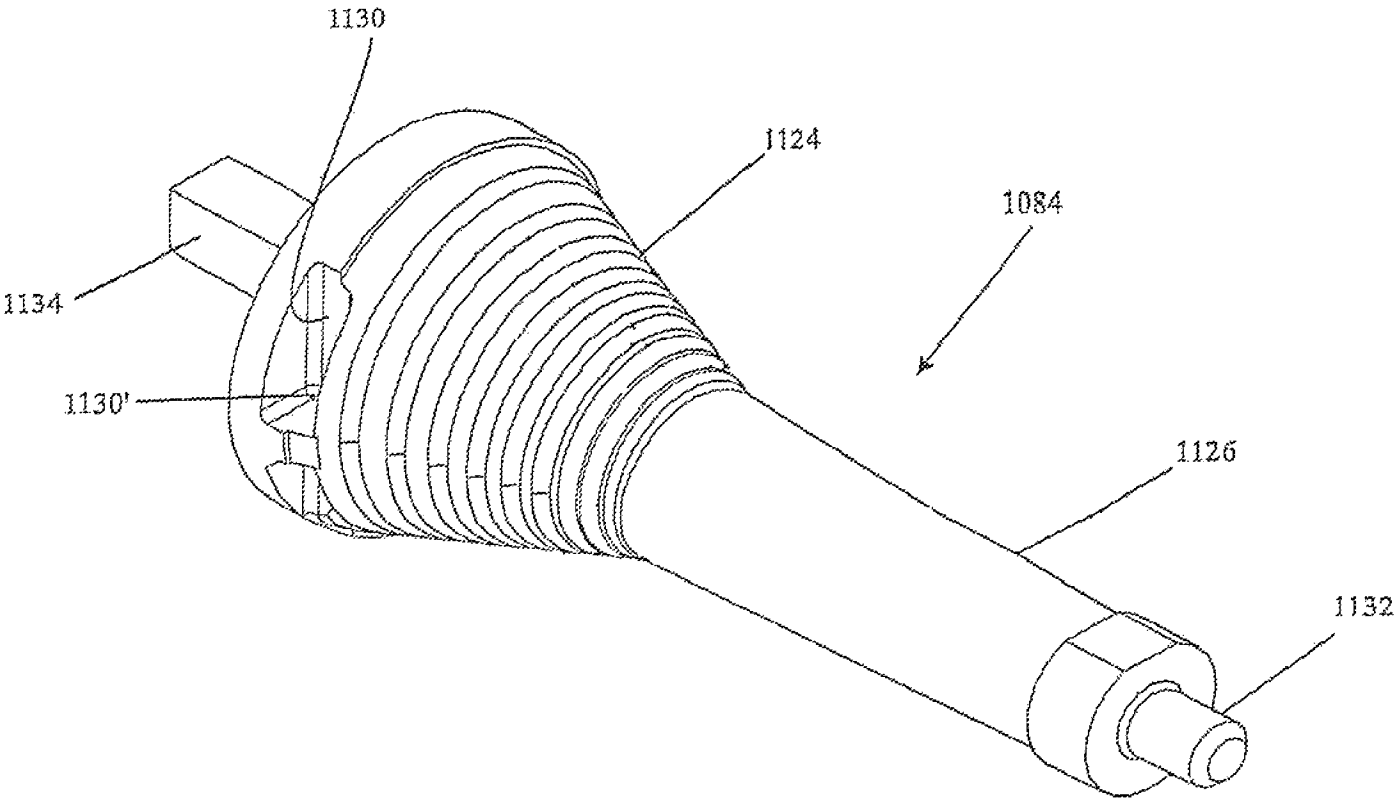
Figure 143:
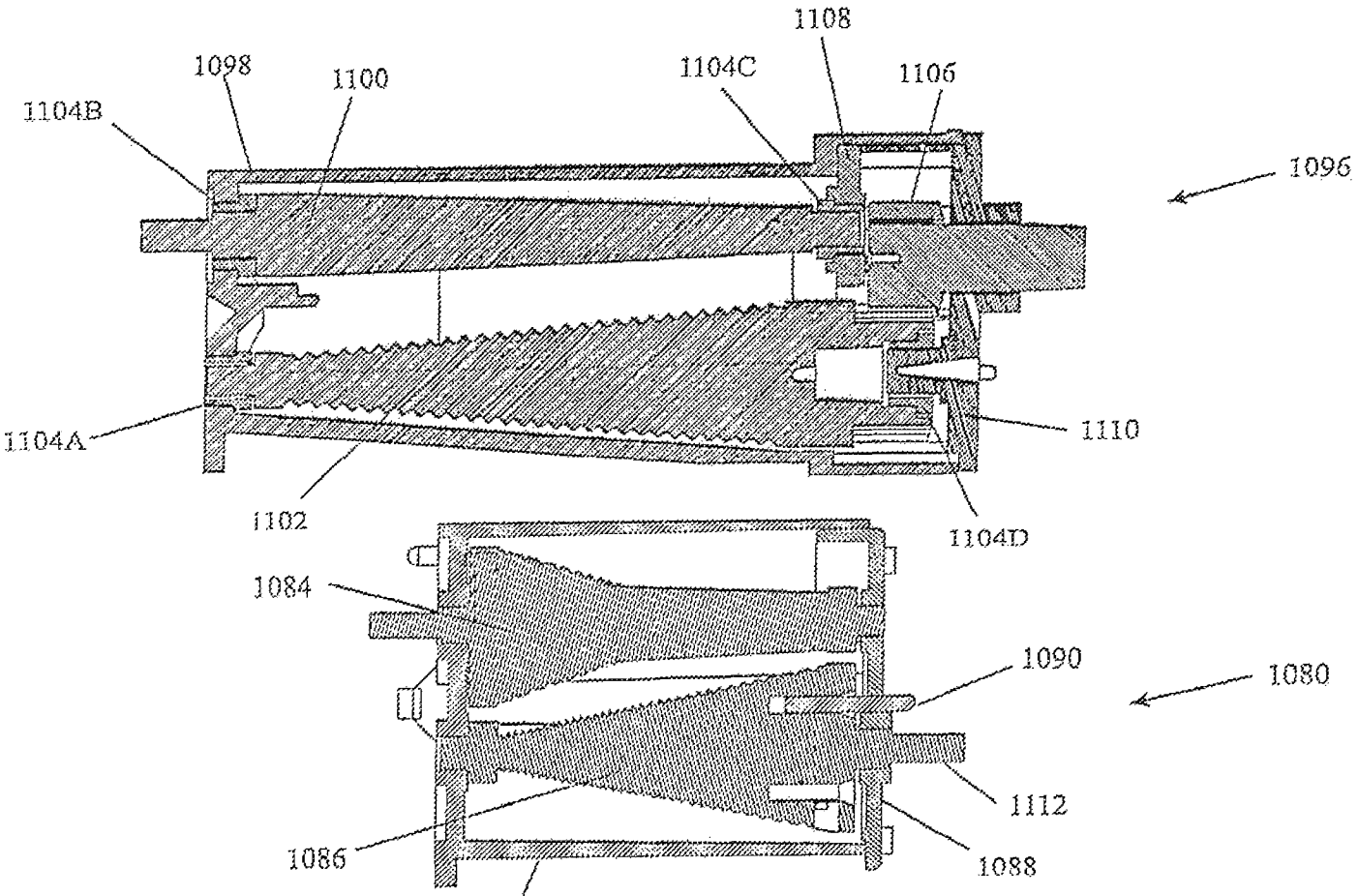
Figure 144:
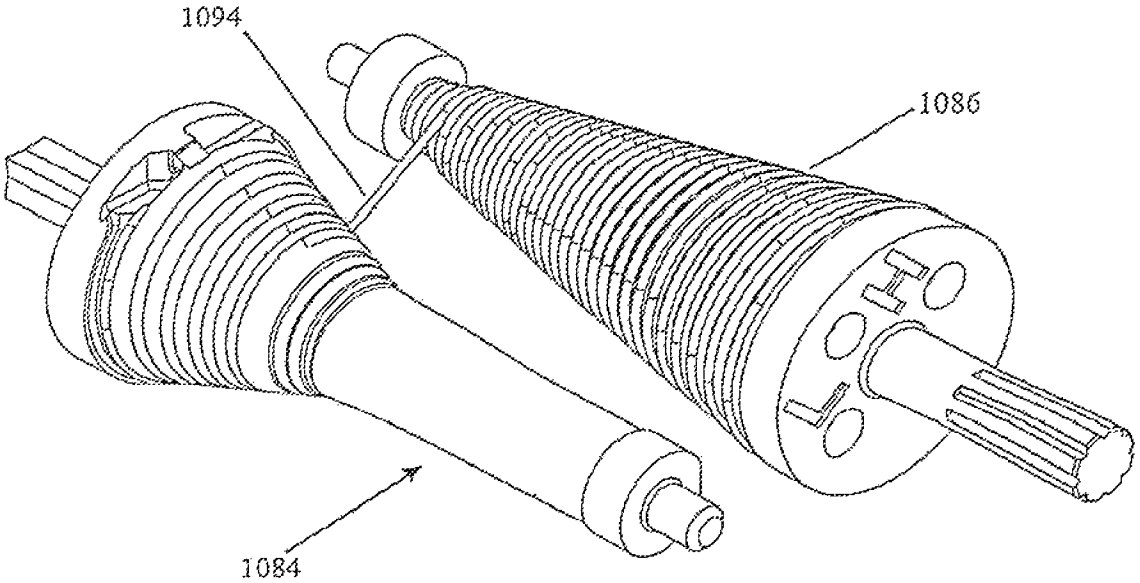
Figure 145:
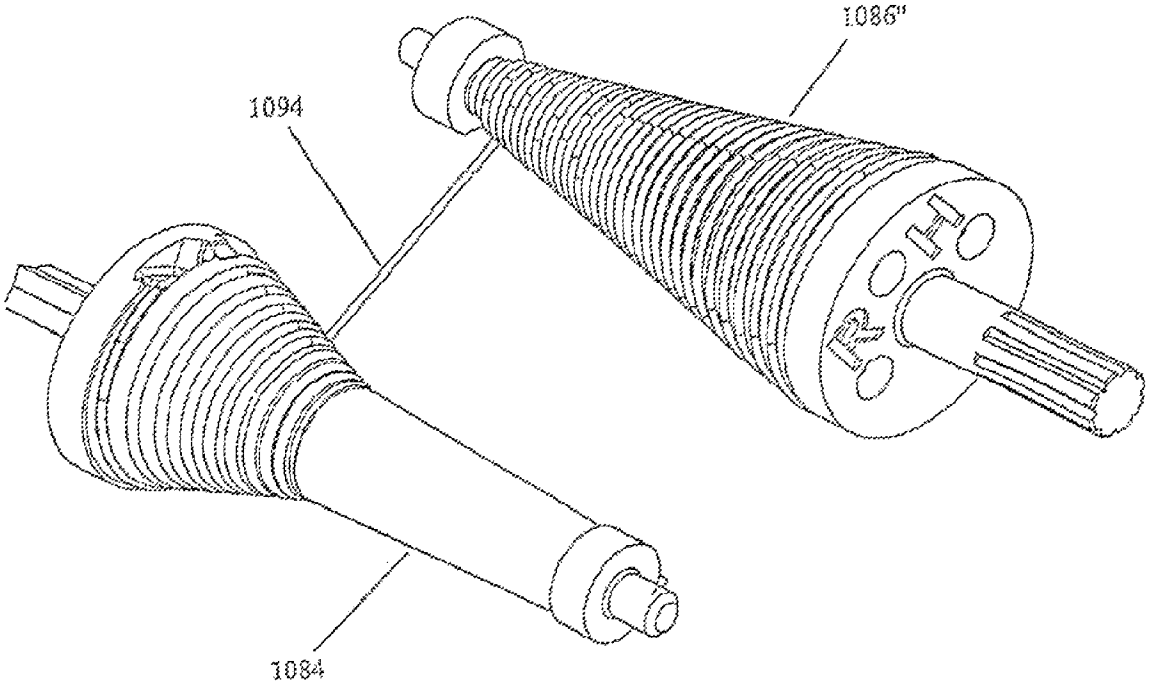
Figure 146:
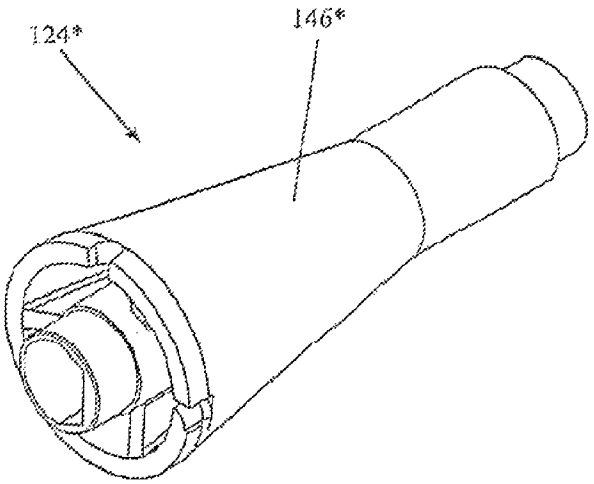
Figure 149:
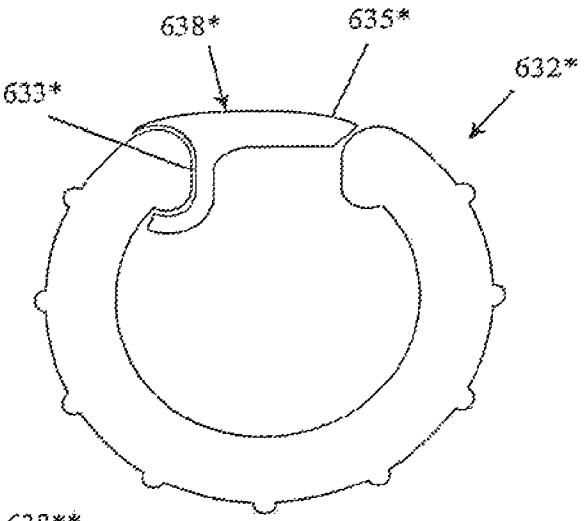
Figure 150:
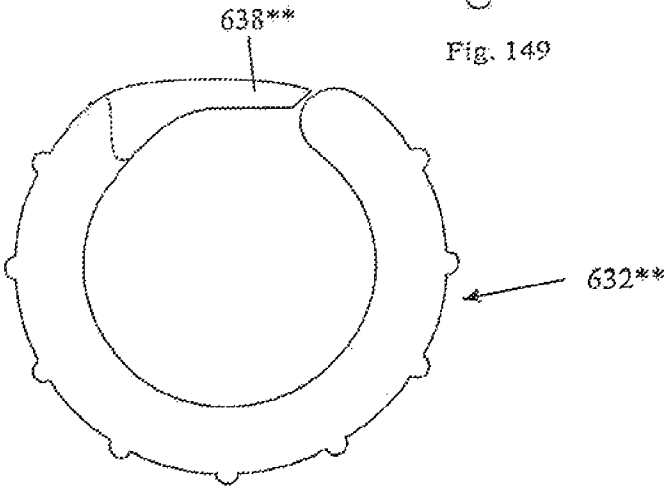
Figure 148:
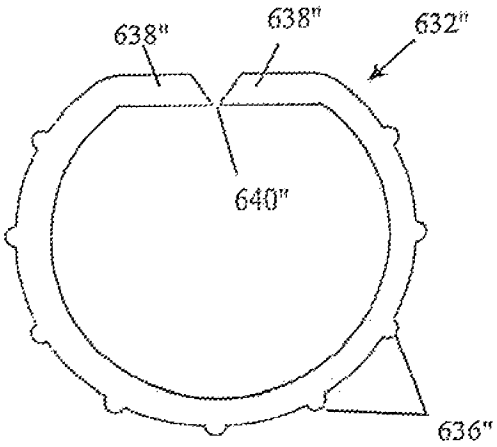
Figure 147:
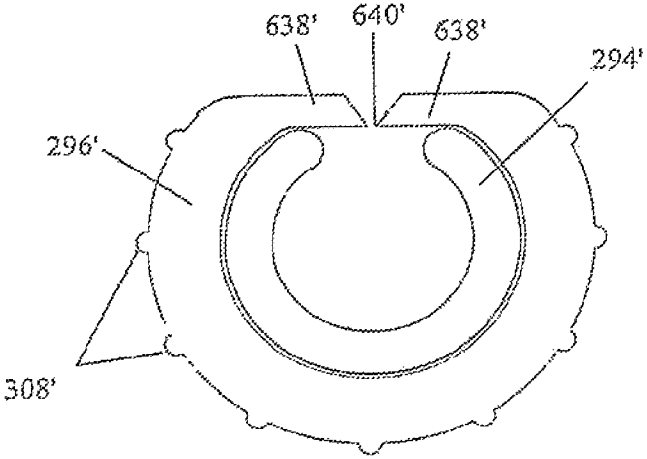
Figure 151:
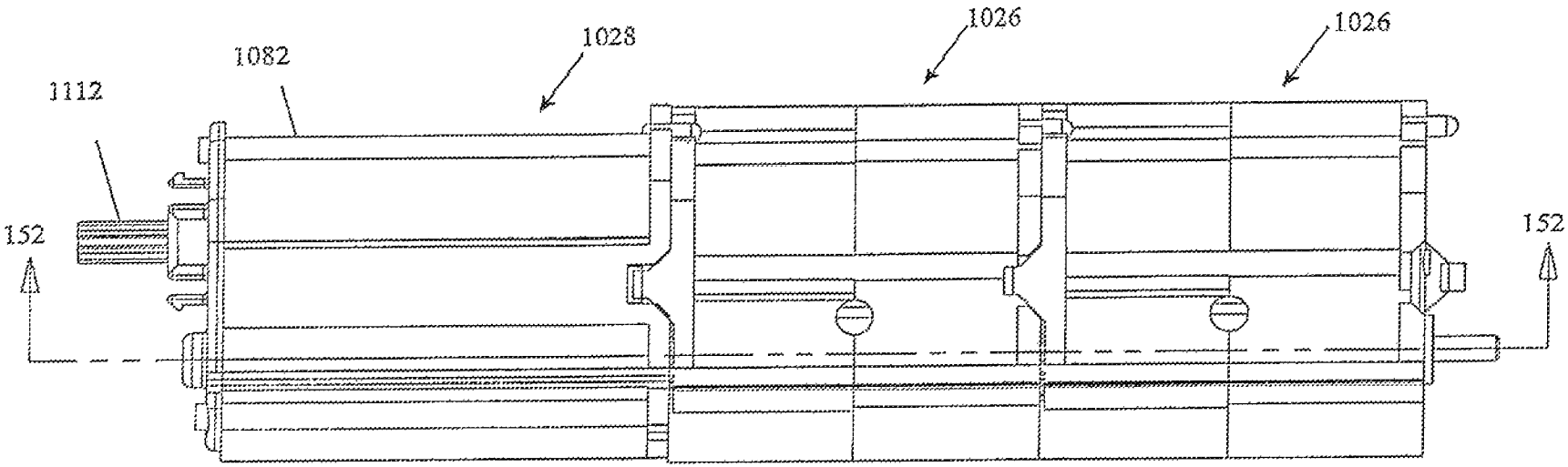
Figure 152:
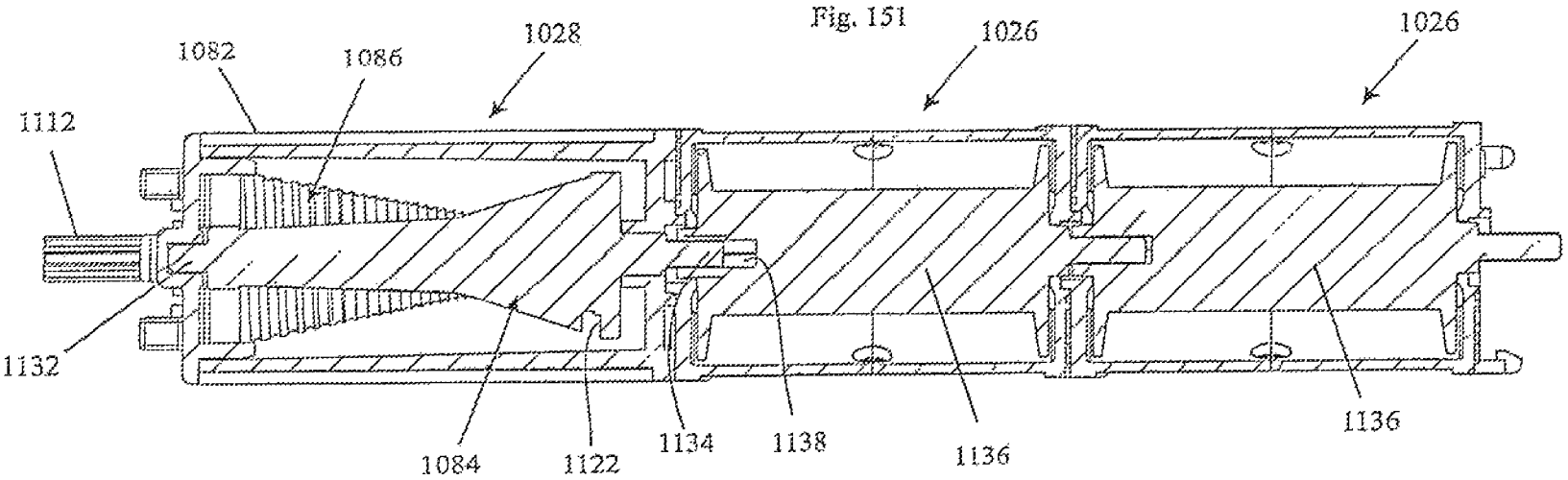
Figure 153:
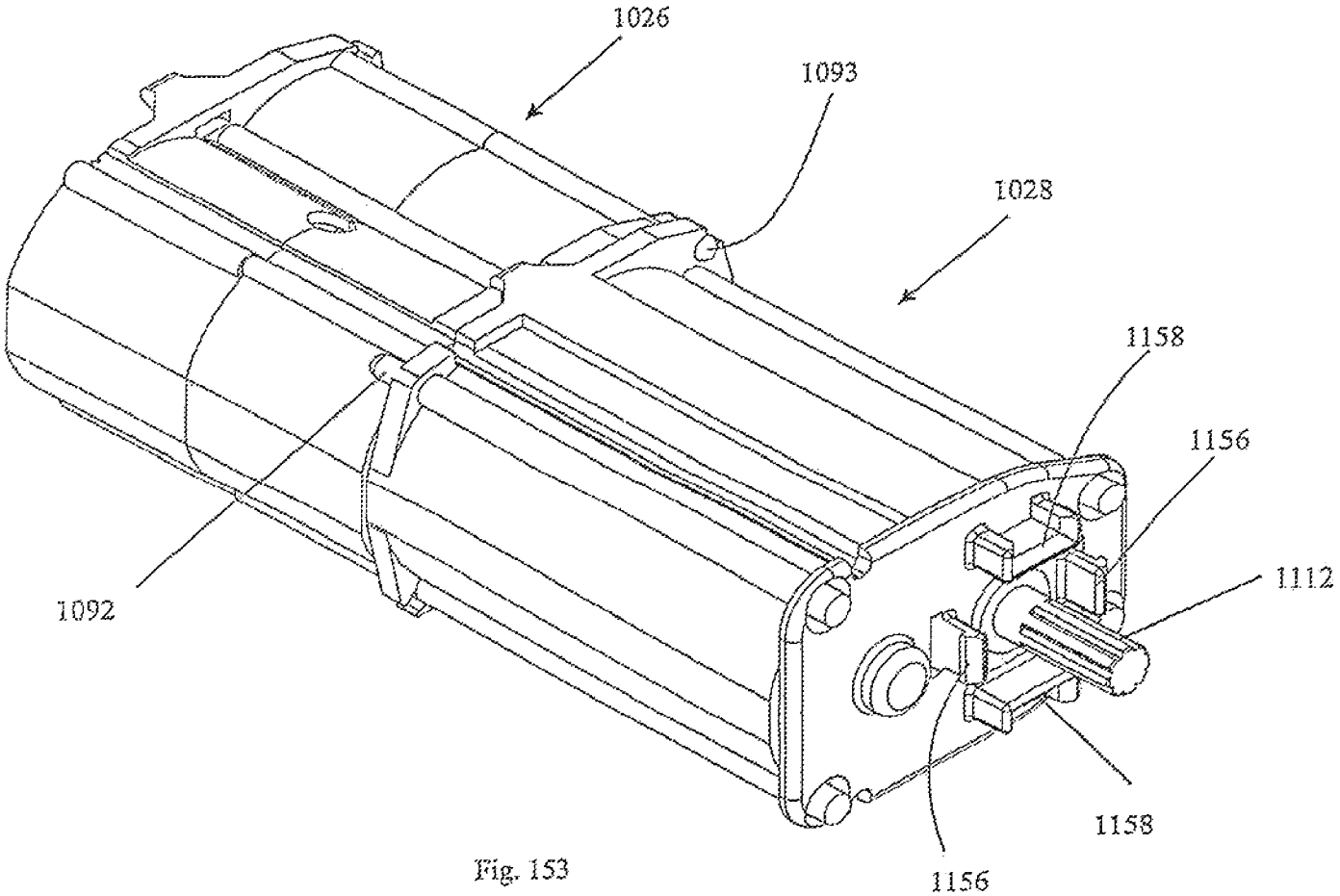
Figure 154:
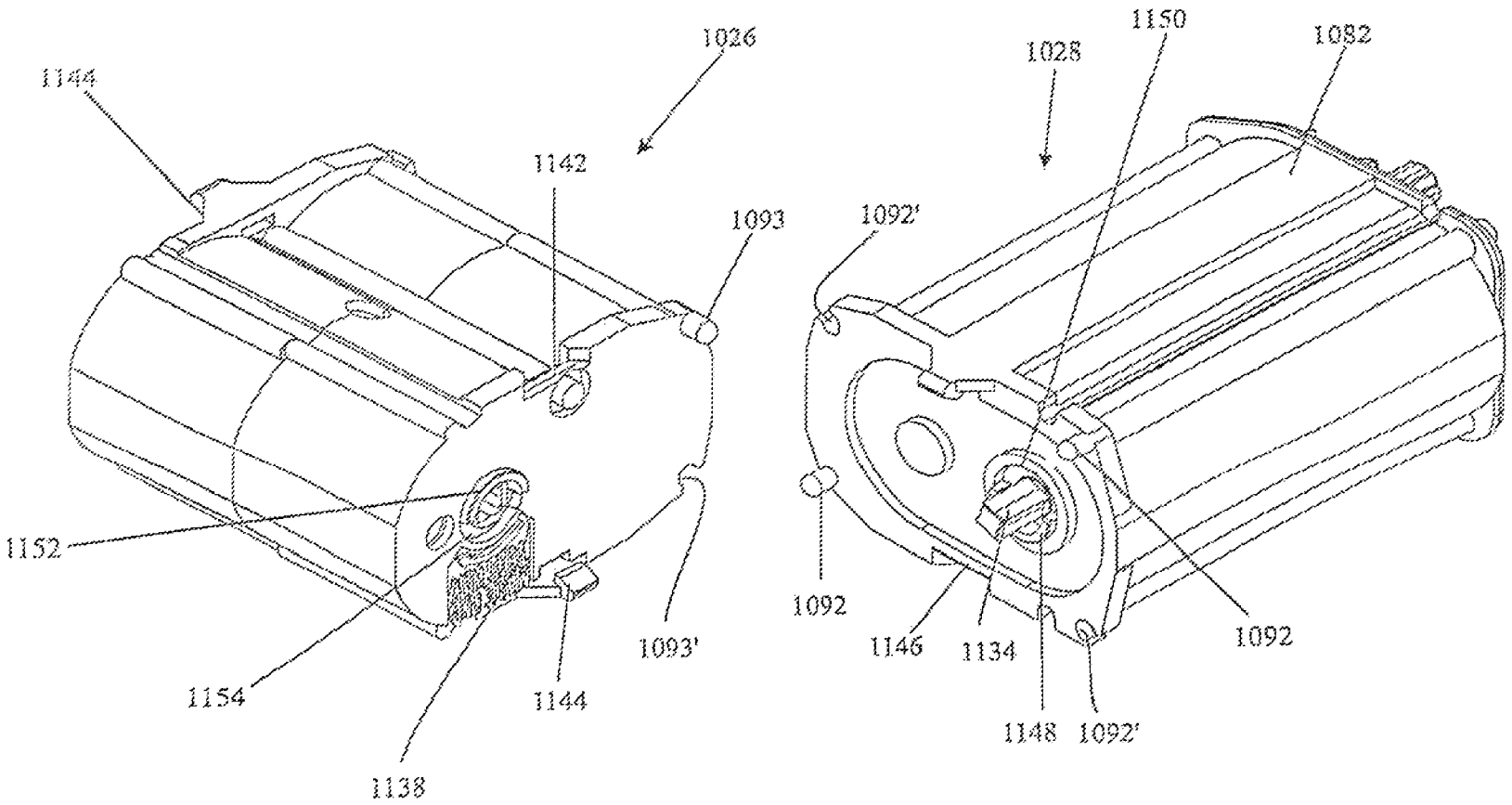
Figures 155, 156:
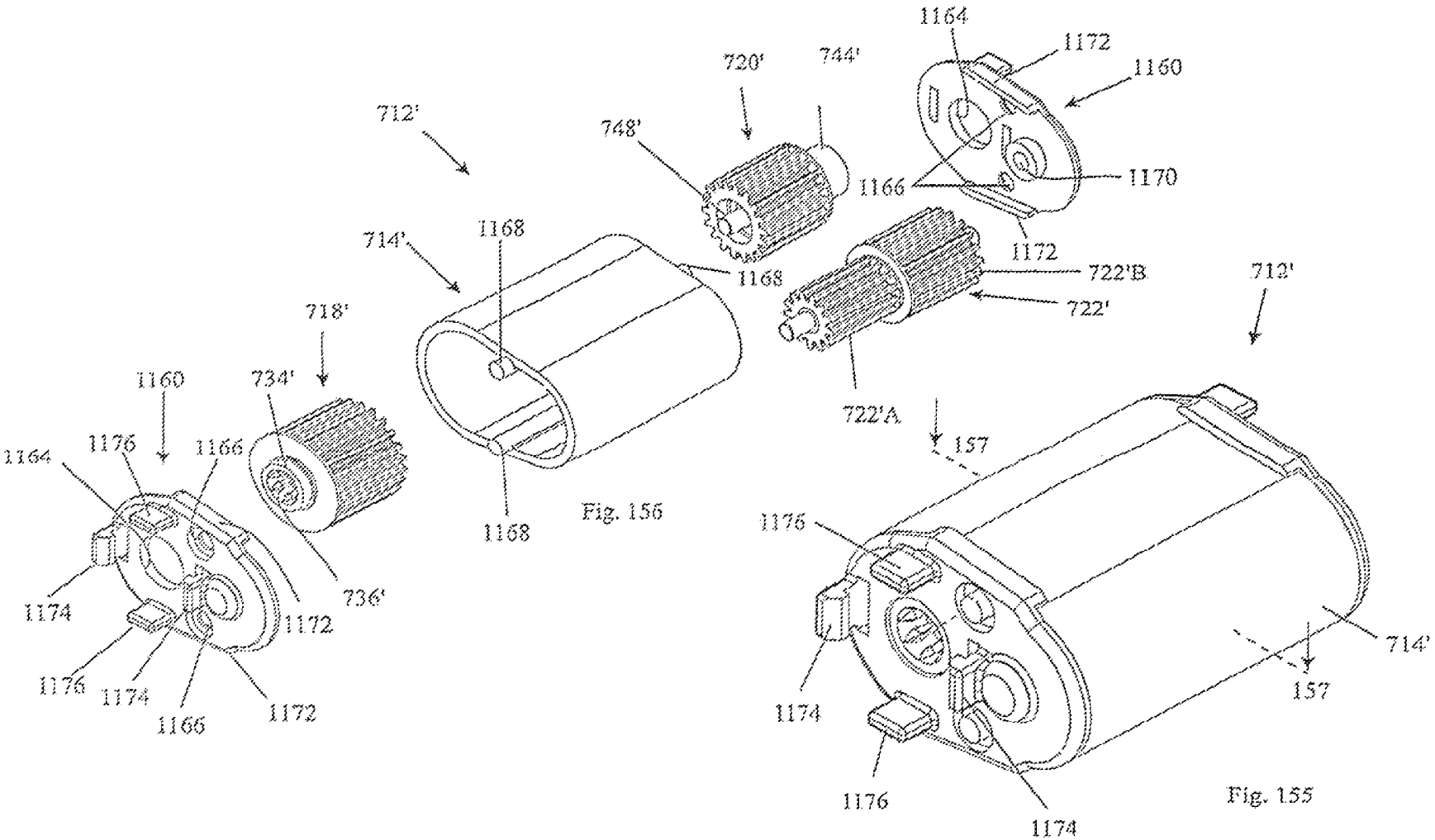
Figure 157:
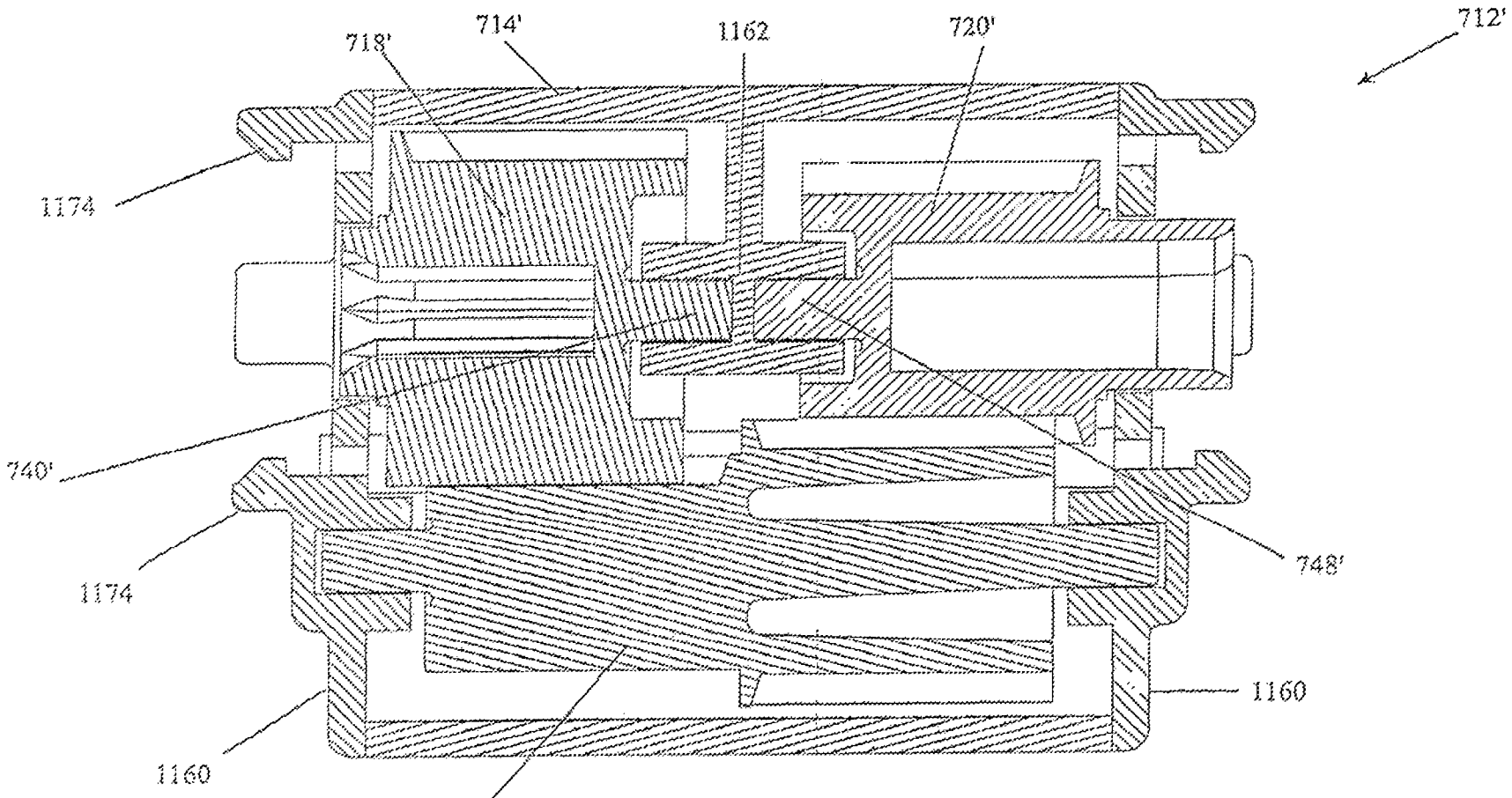
Figure 158:
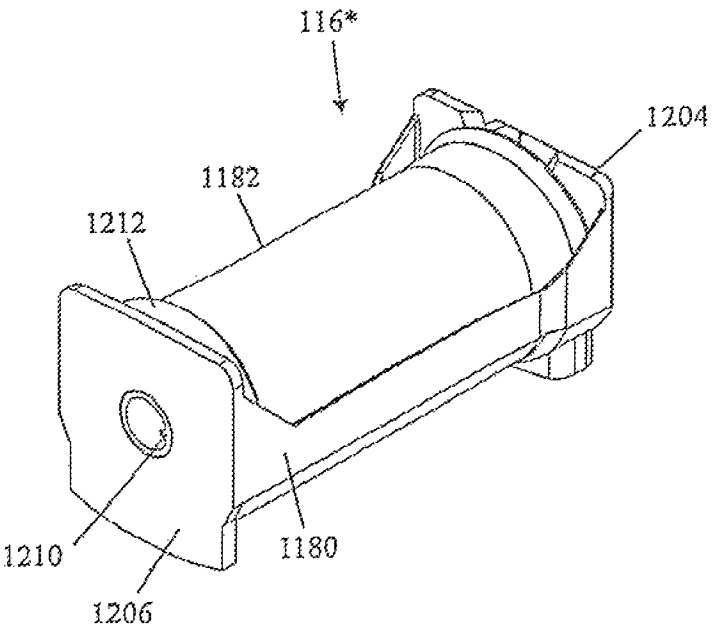
Figure 159:
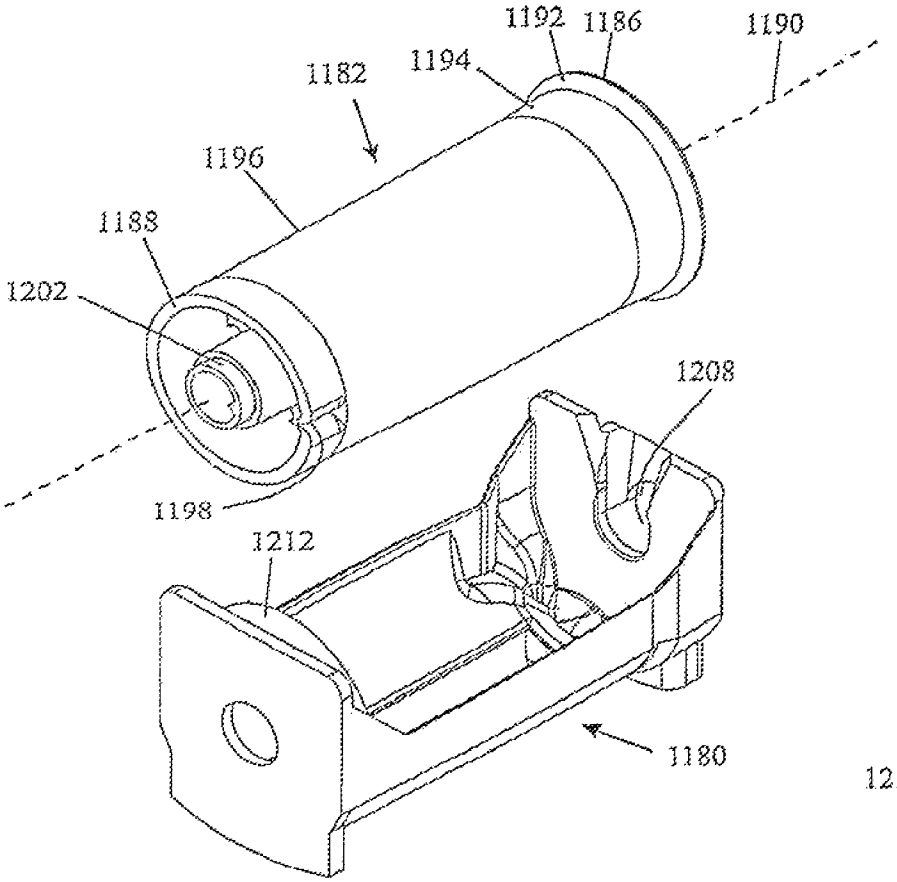
Figure 160:
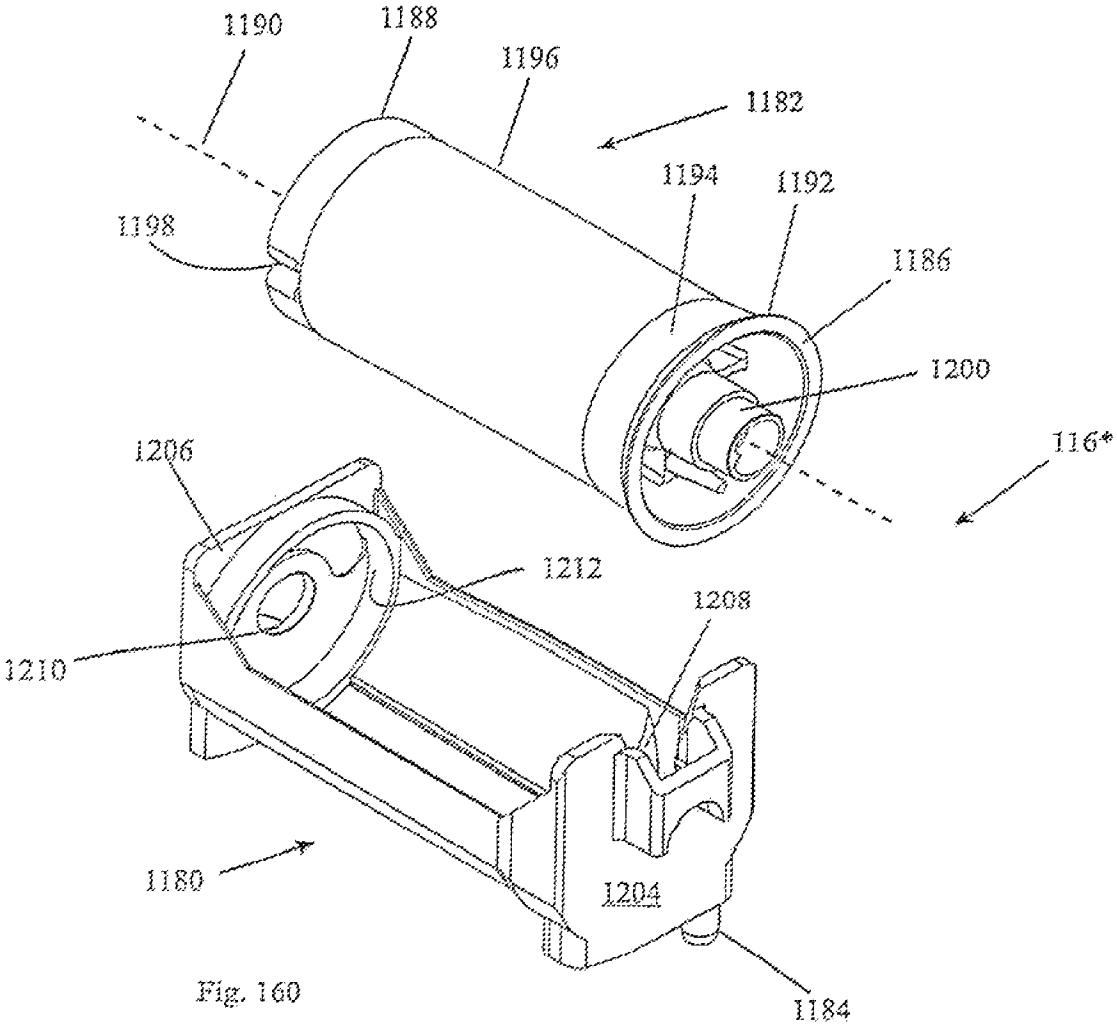
Figure 161:
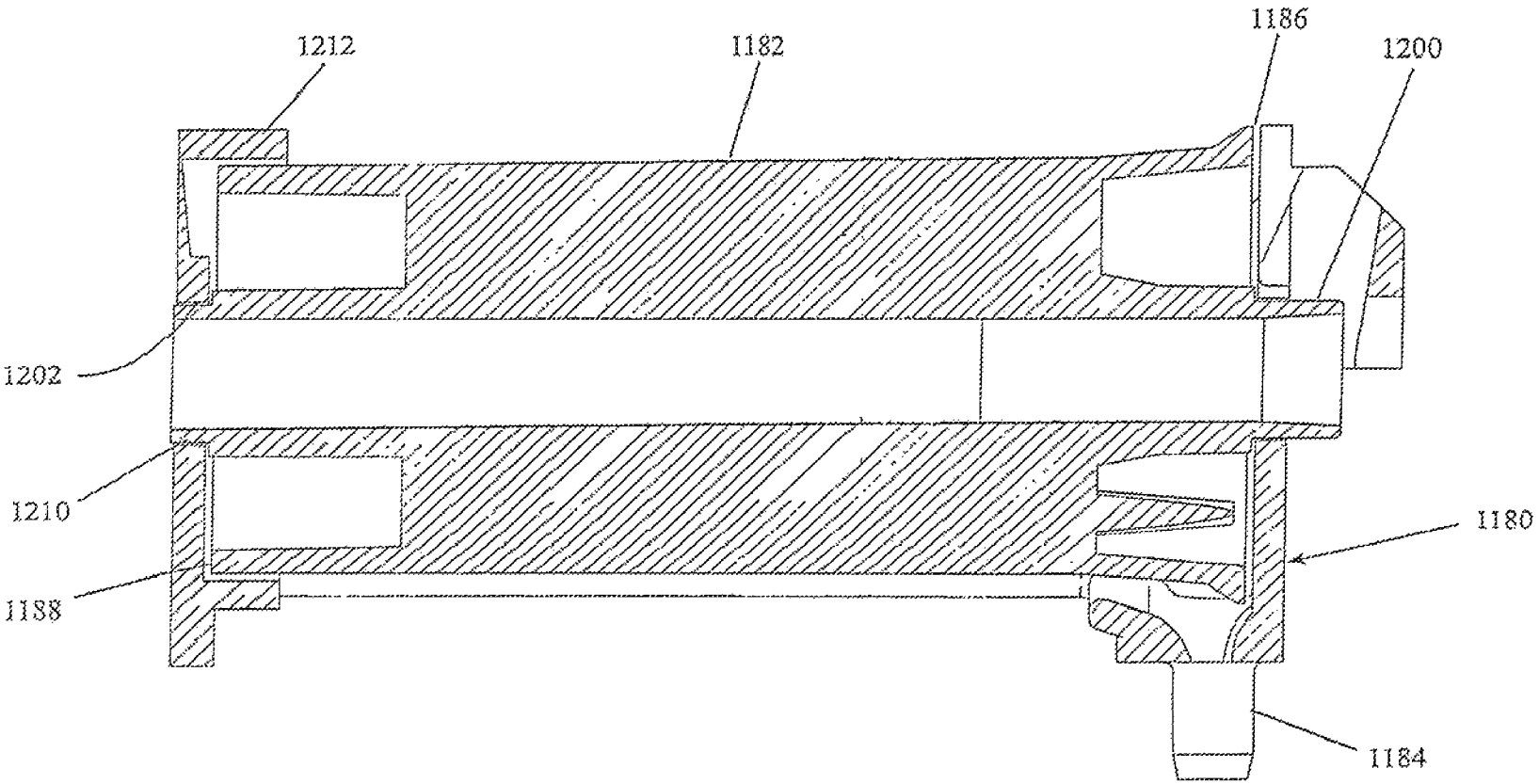
Figure 163:
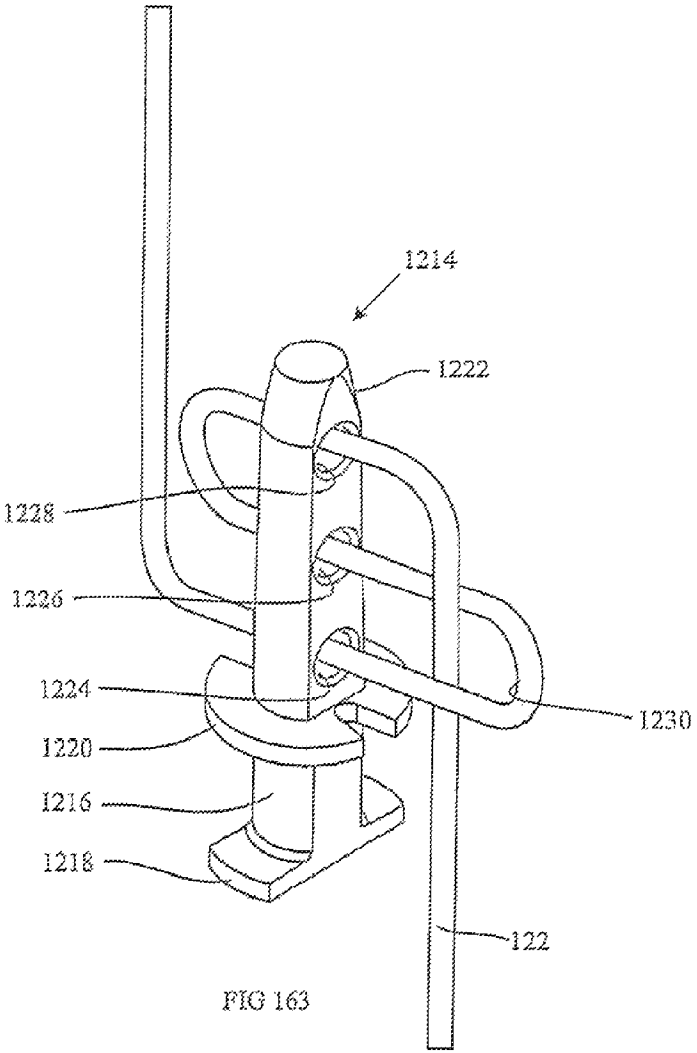
Figure 162:
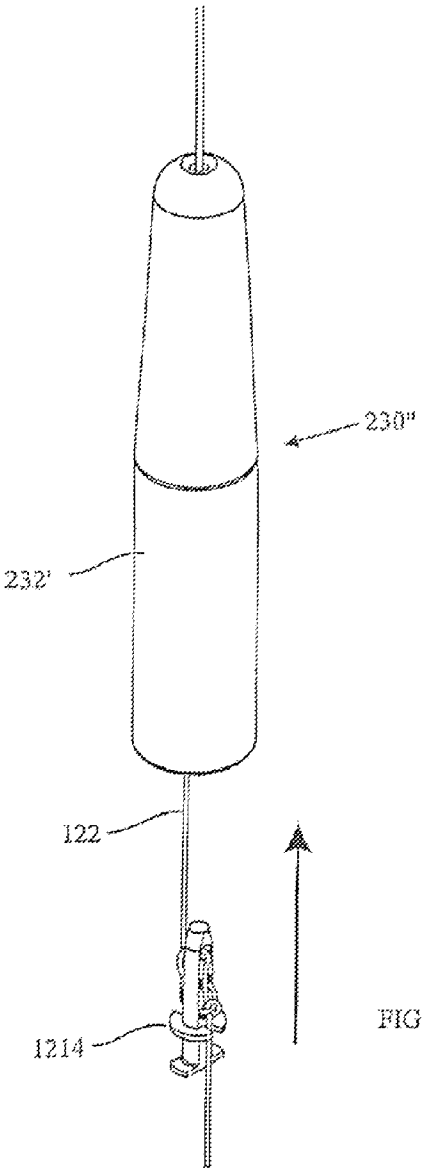
Figure 164:
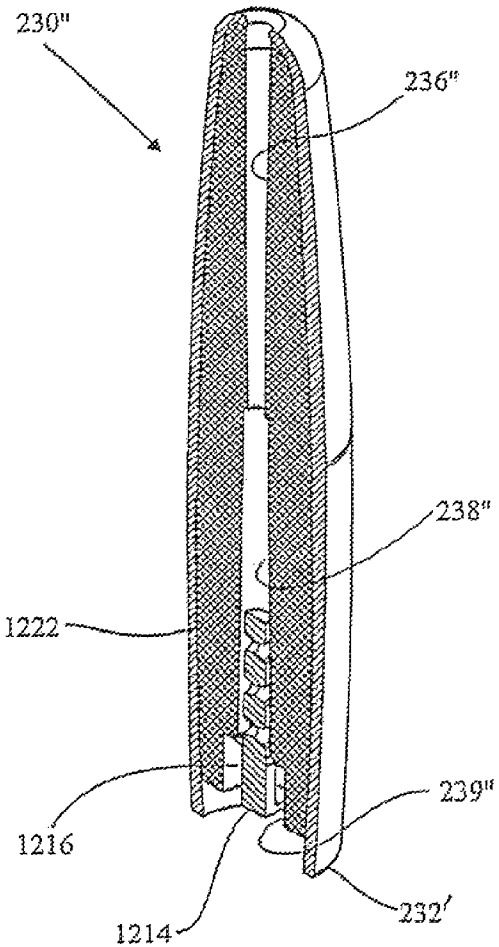
Figure 163A:
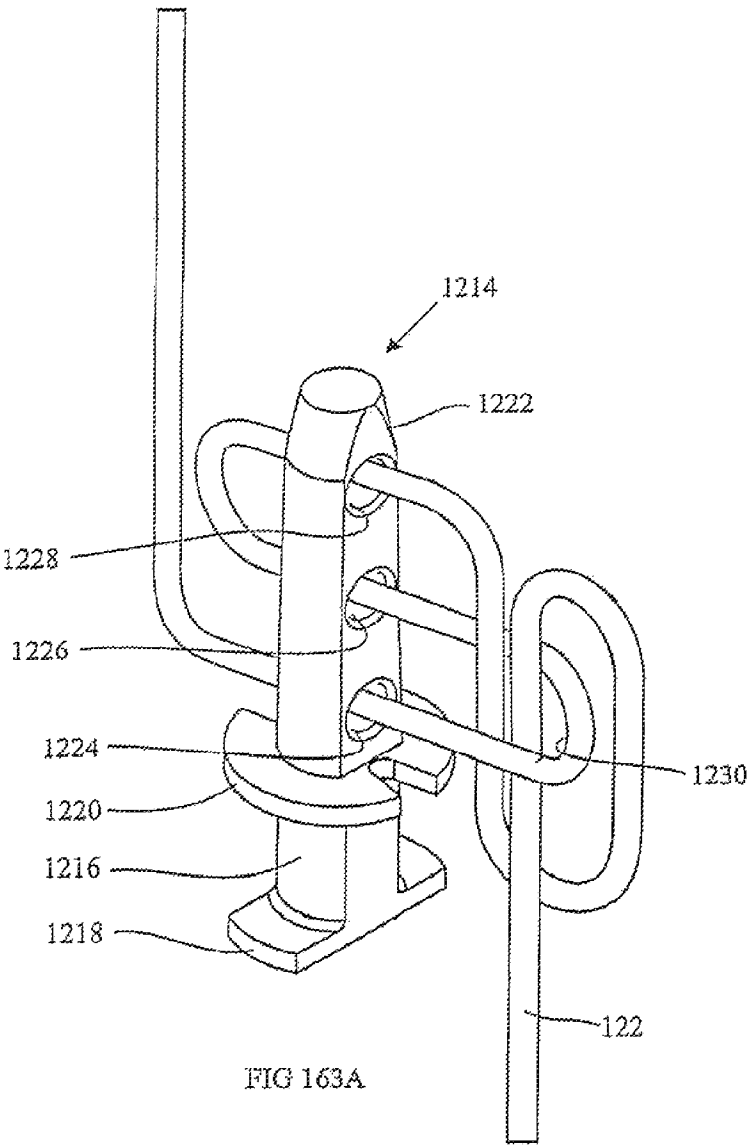
Figure 168:
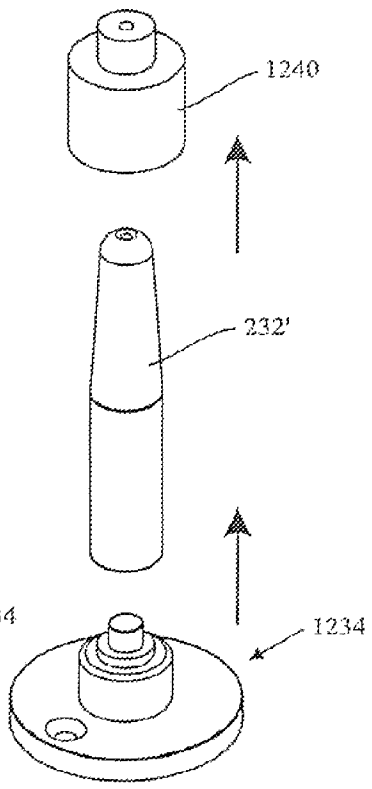
Figure 167:
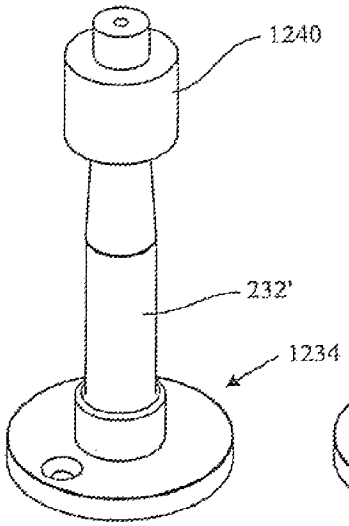
Figure 166:
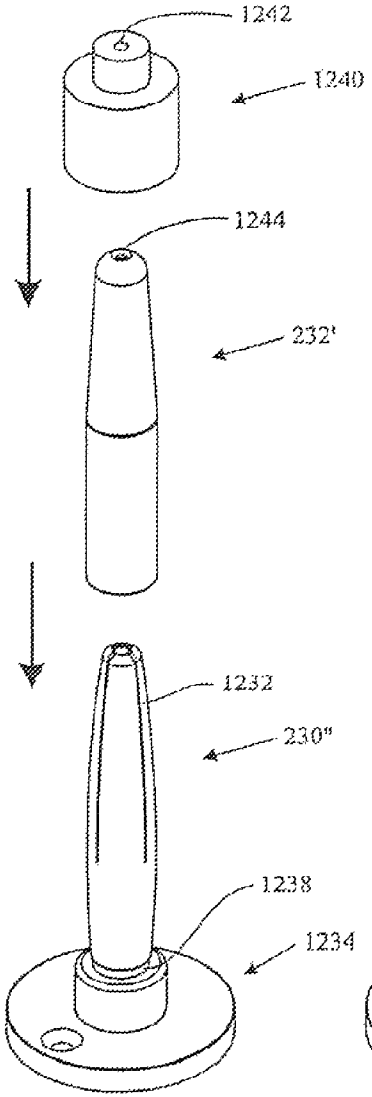
Figure 165:
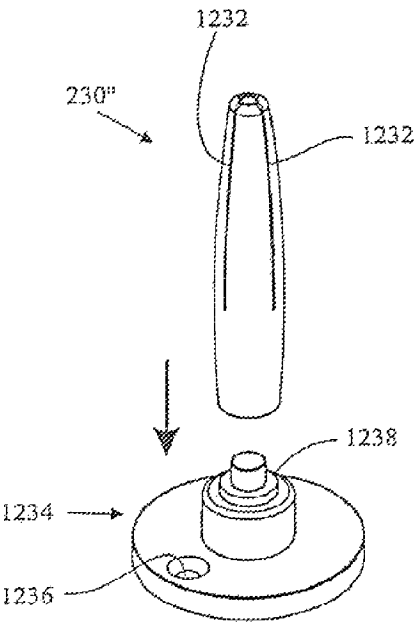
Figure 169:
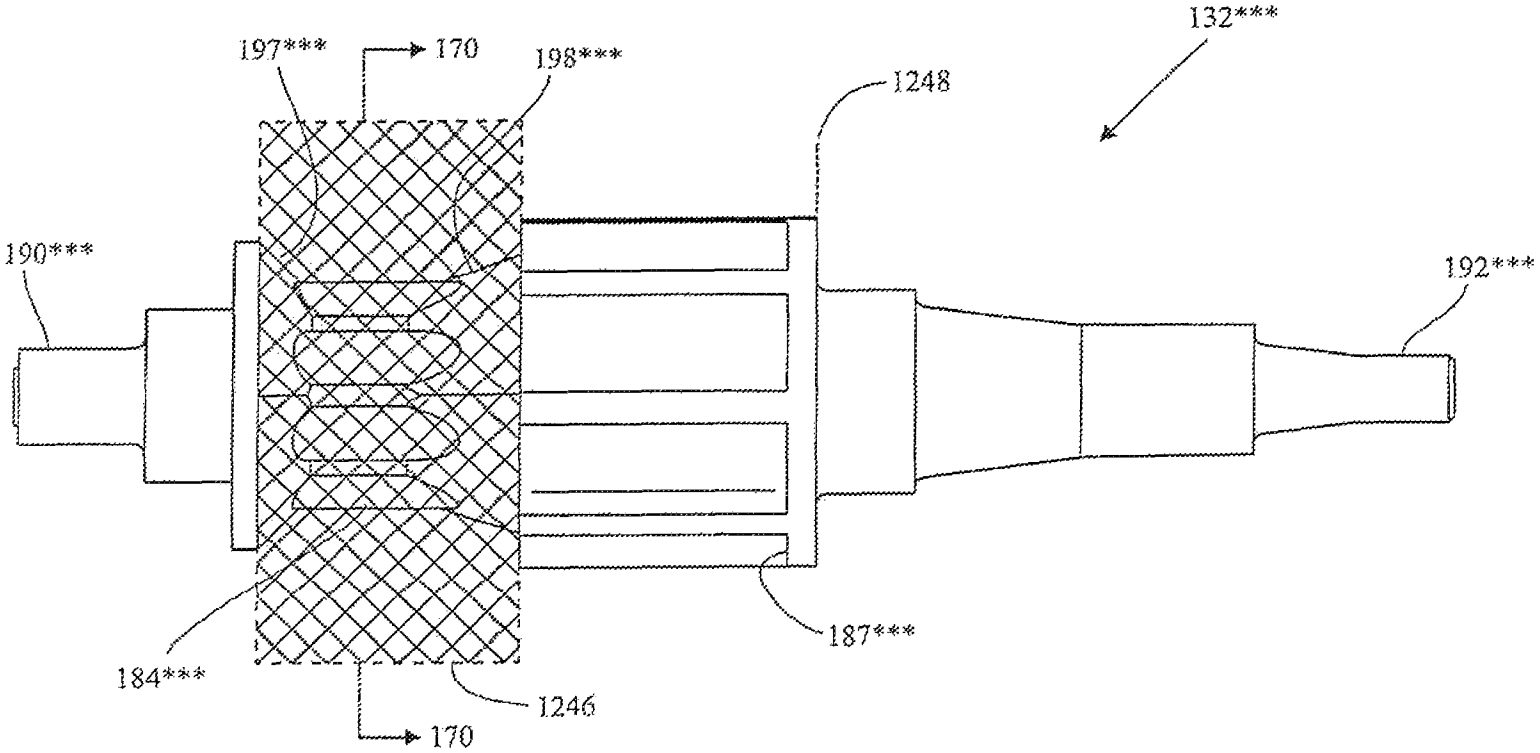
Figure 170:
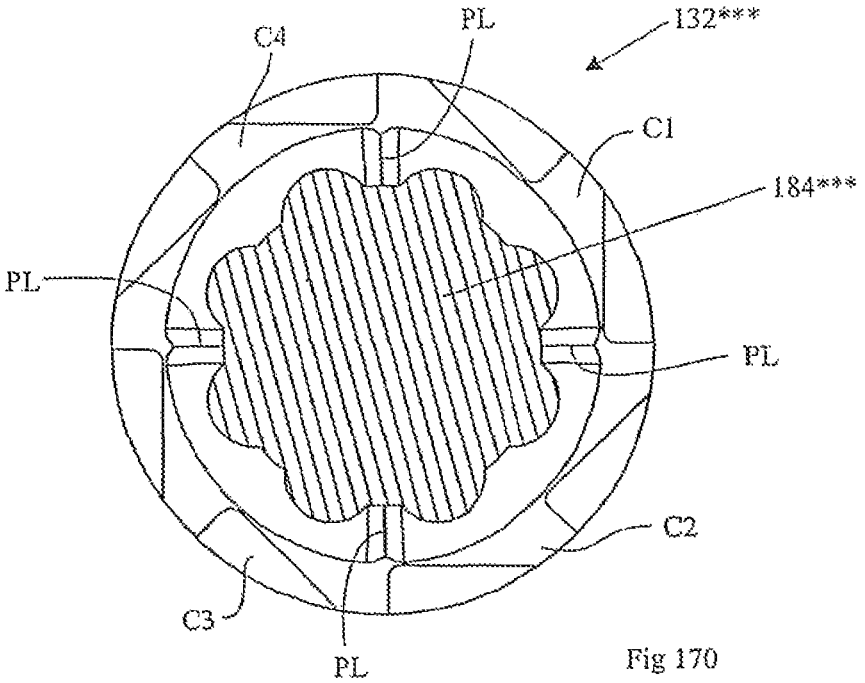
Figure 171:
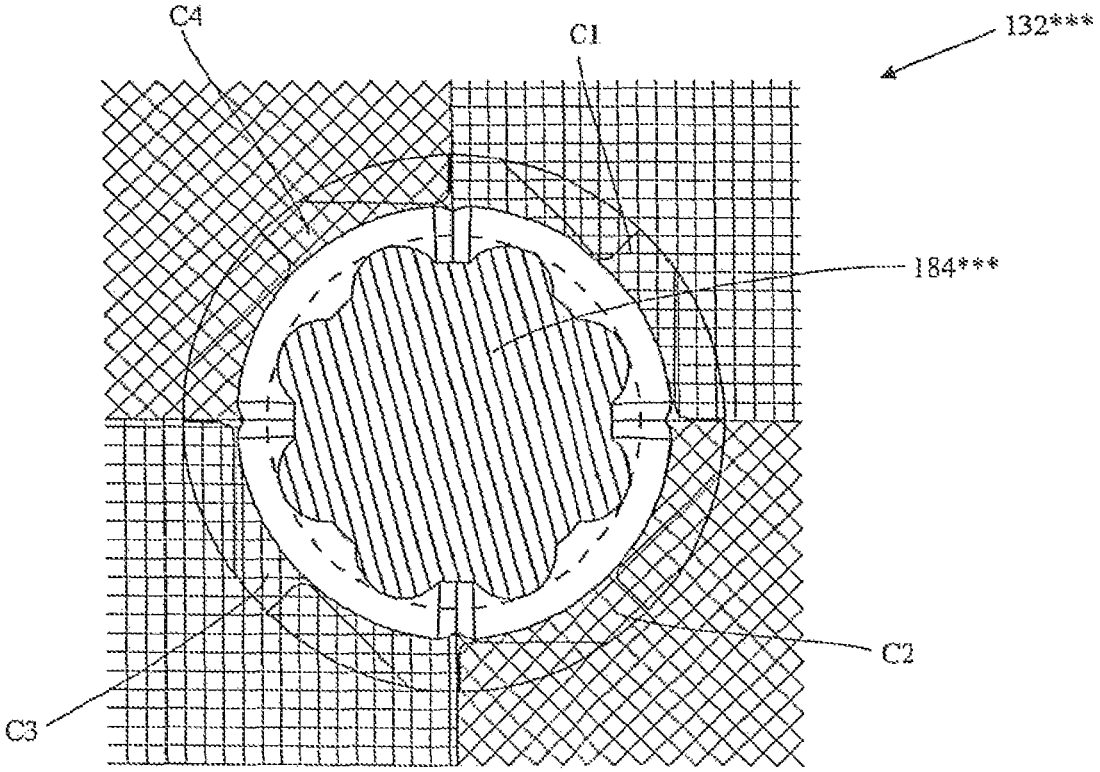
Figure 172:
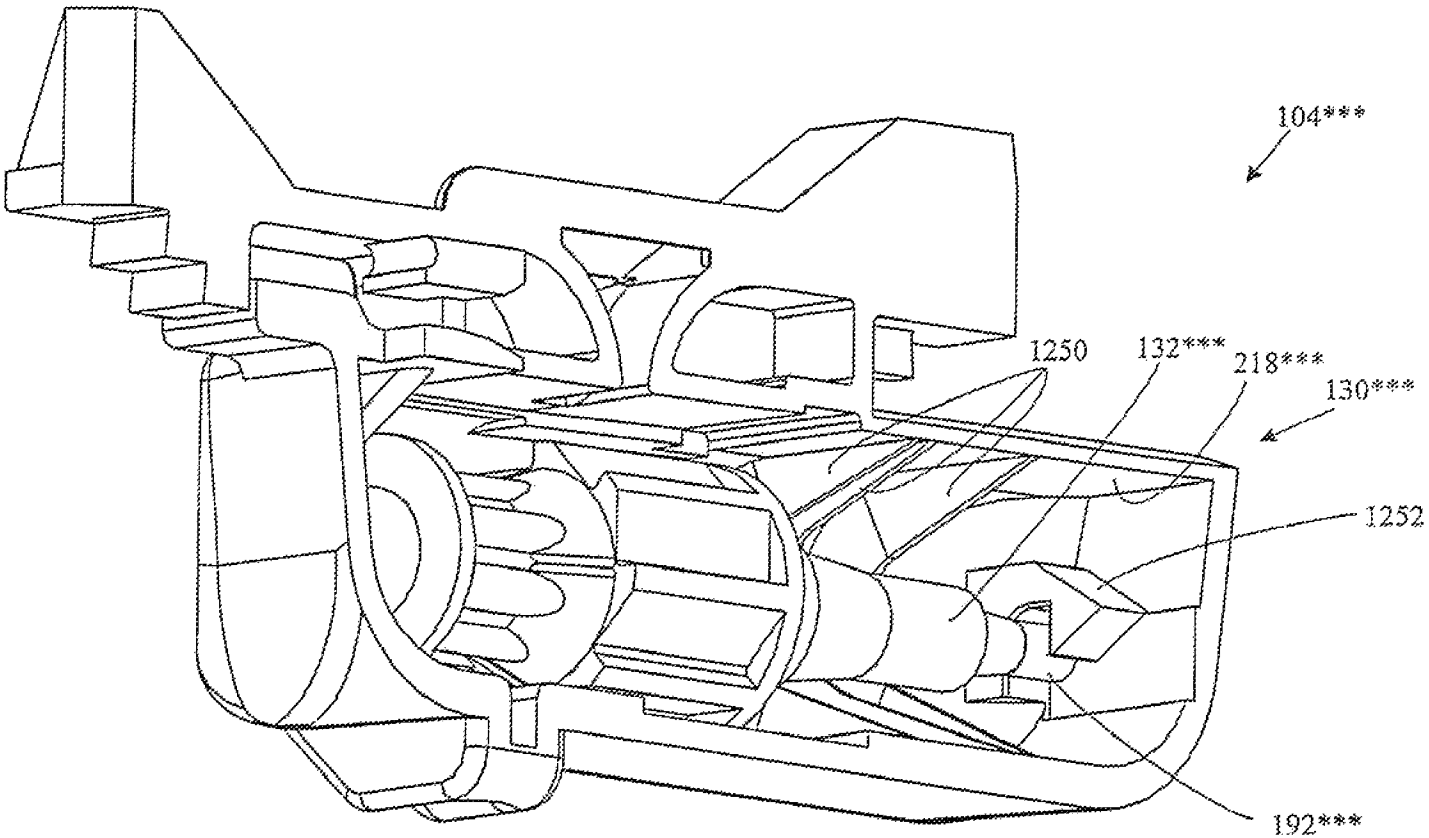
Figures 173, 174:
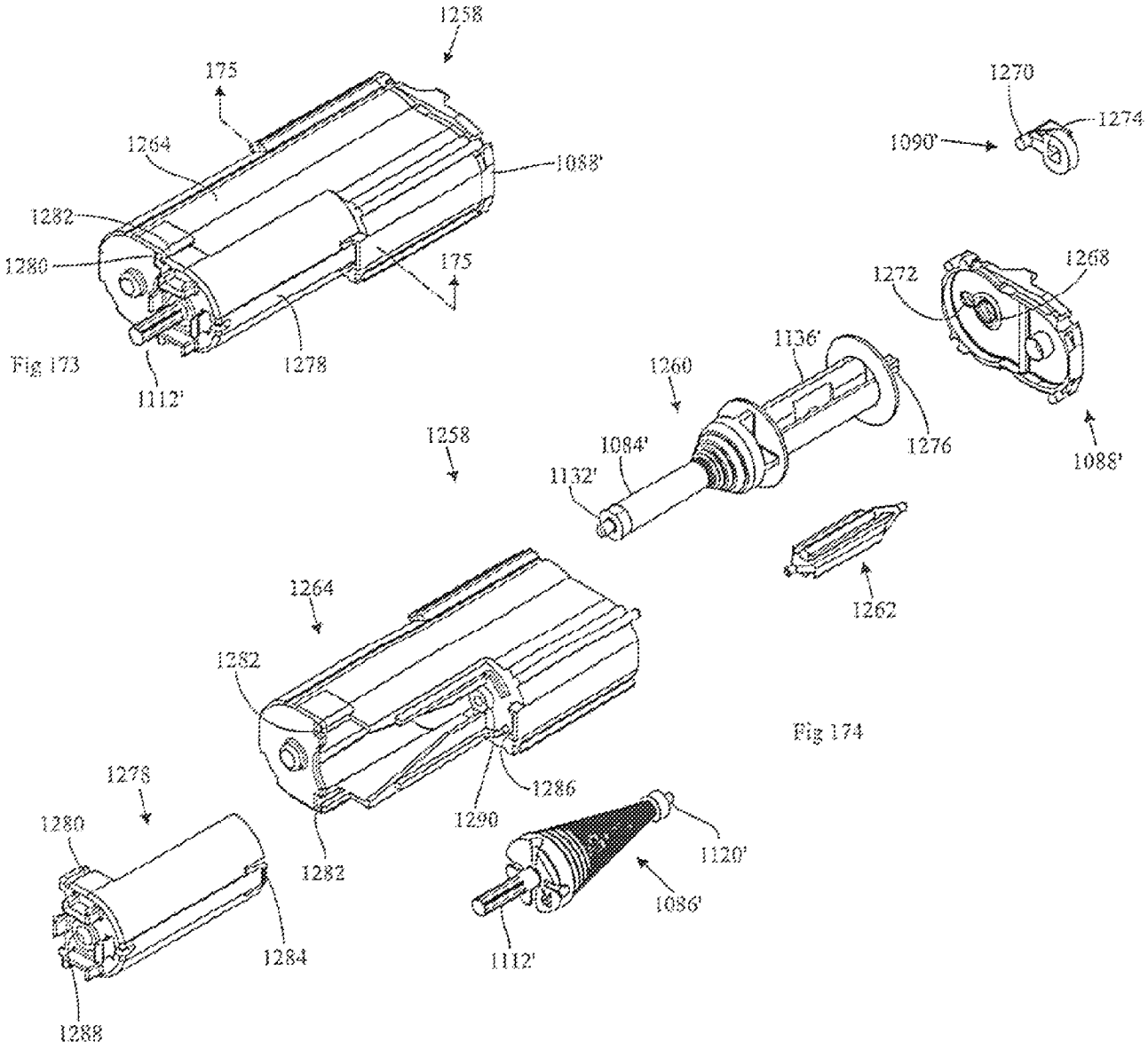
Figure 175:
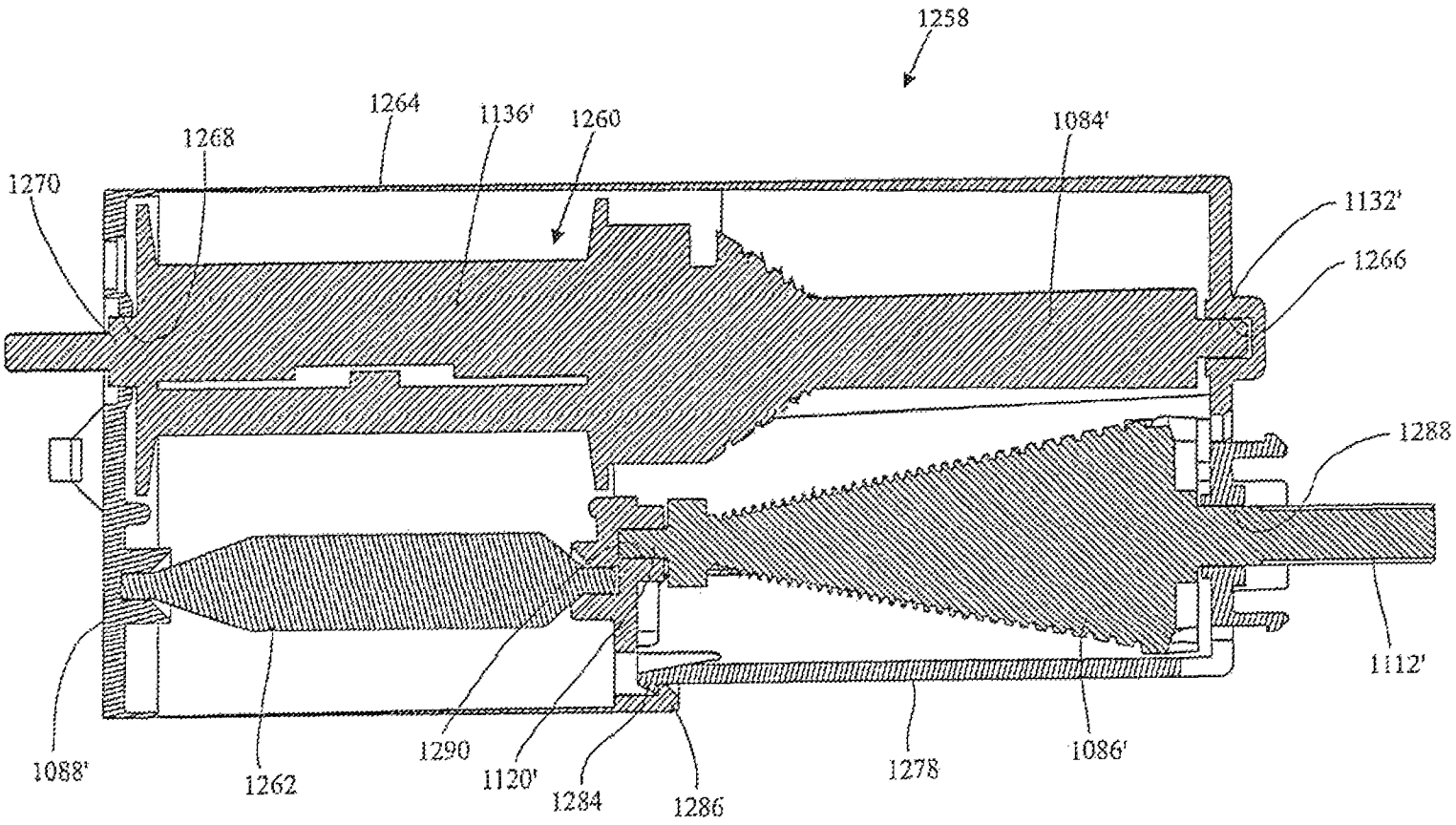
Figure 176:
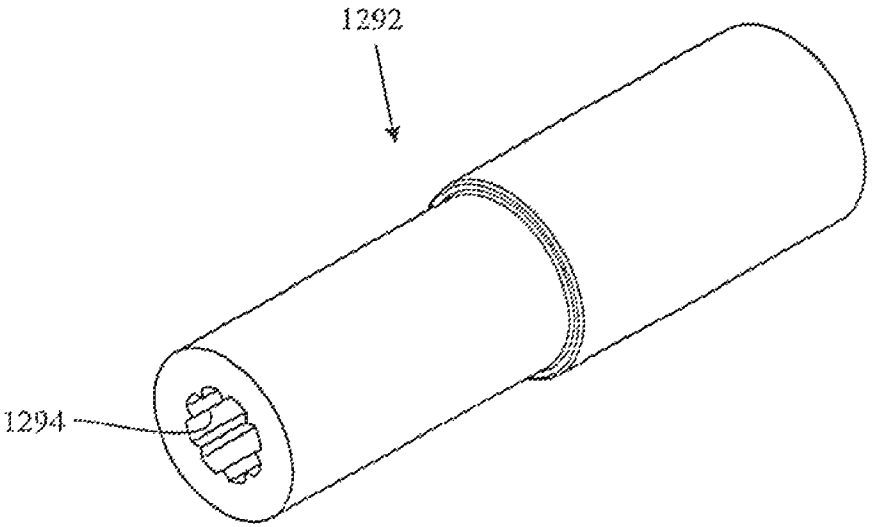
Figure 177:
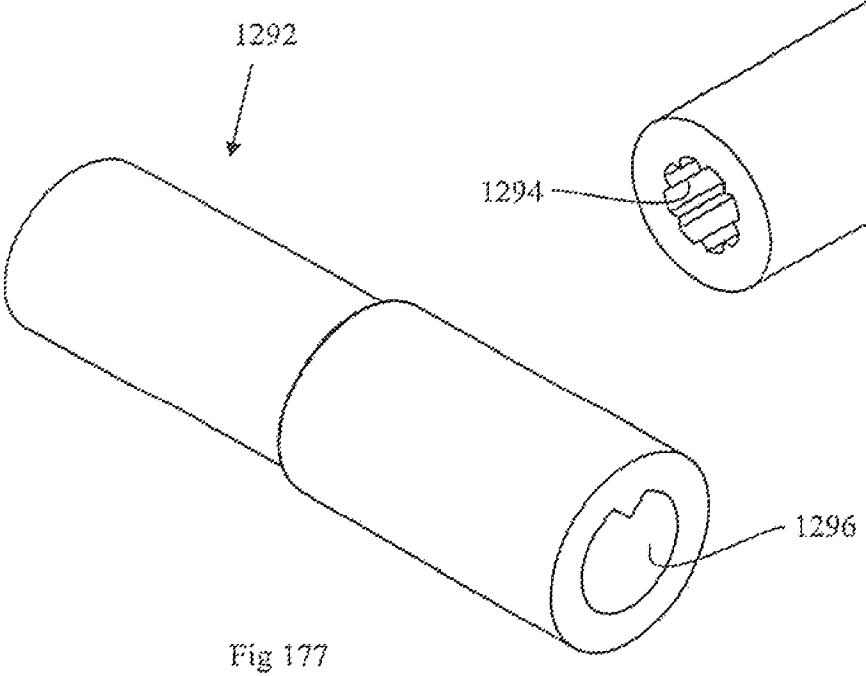
Figure 179:
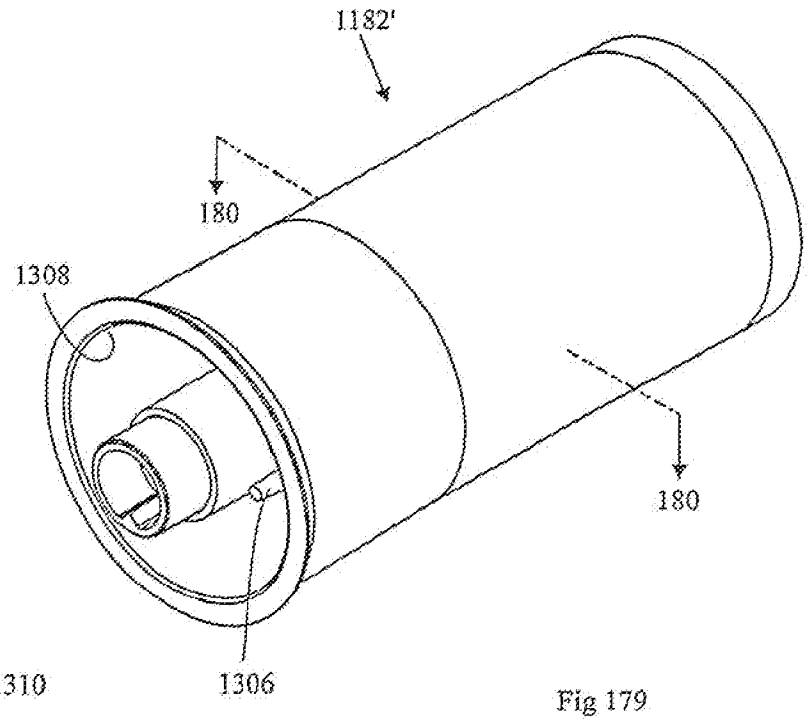
Figure 178:
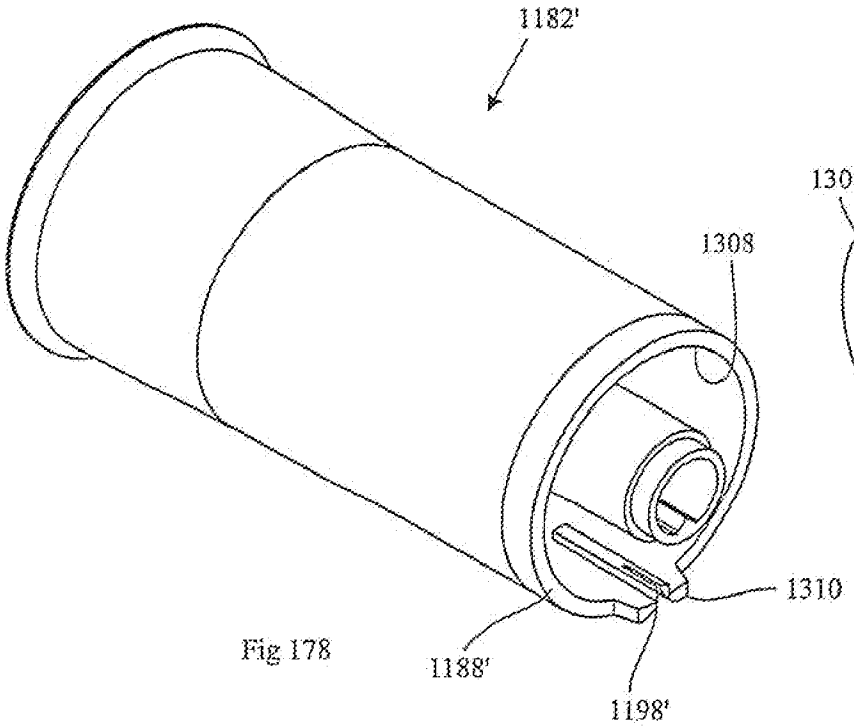
Figure 182:
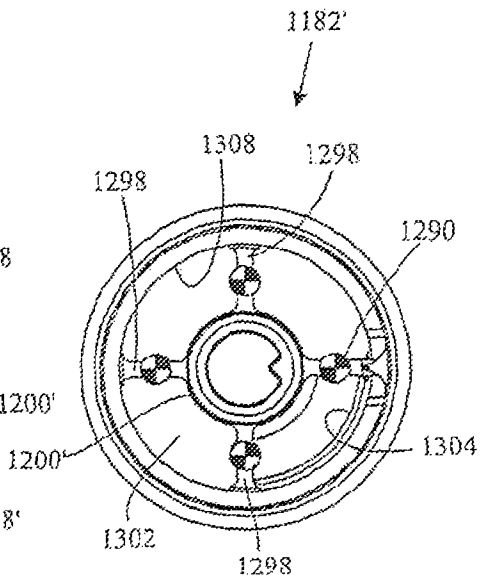
Figure 180:
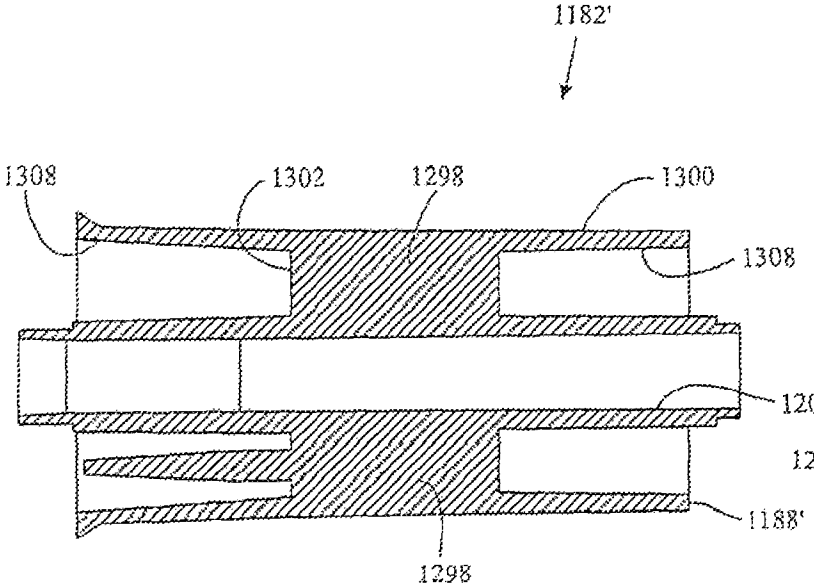
Figure 181:
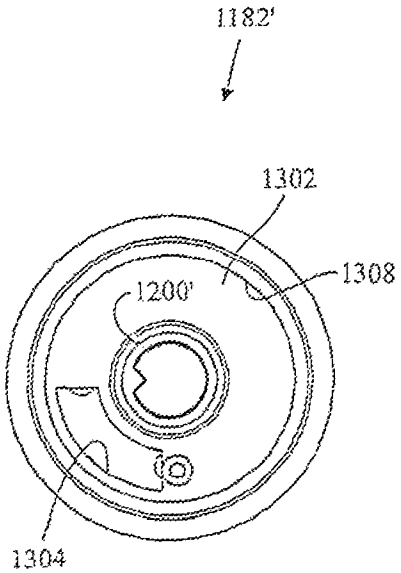
Figure 183:
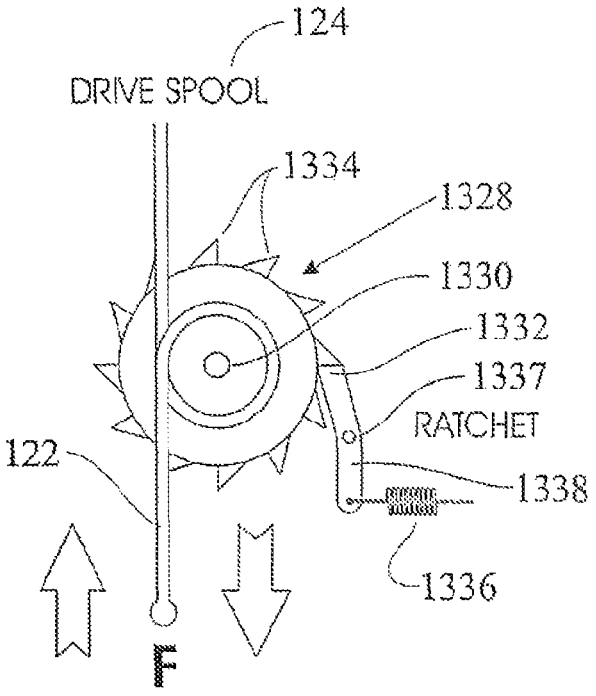
Figure 184:
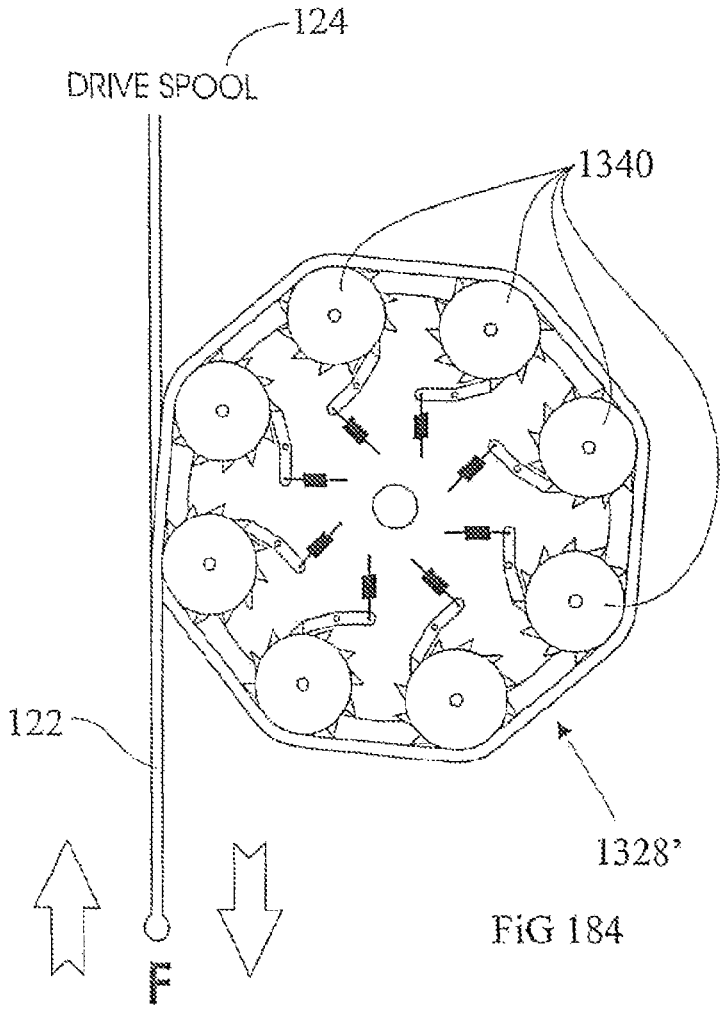
Figure 185:
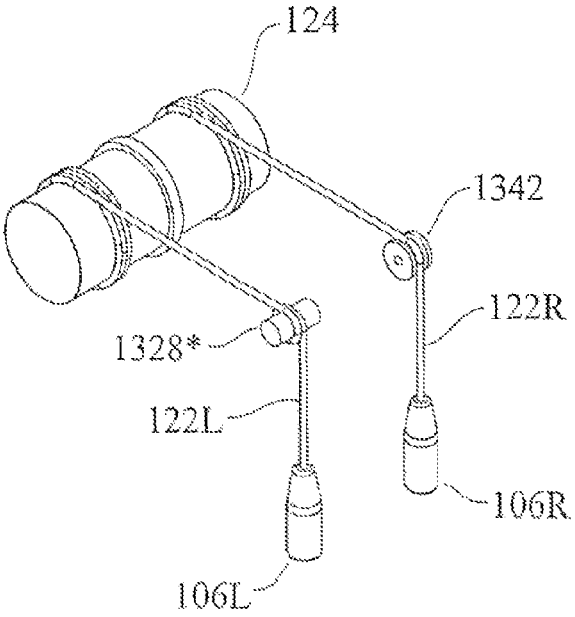
Figure 186:
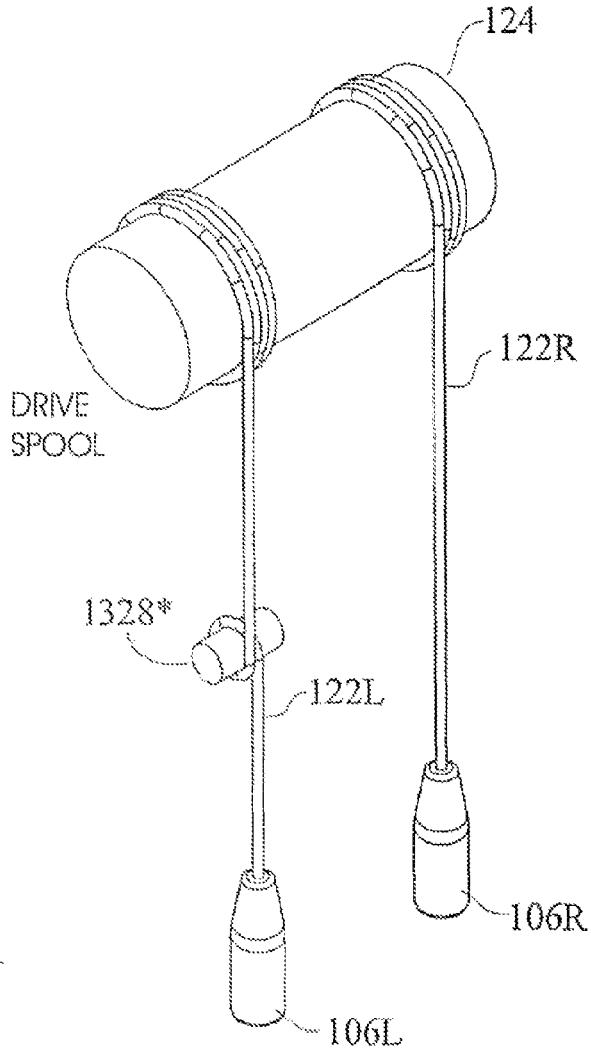
Figure 187A:
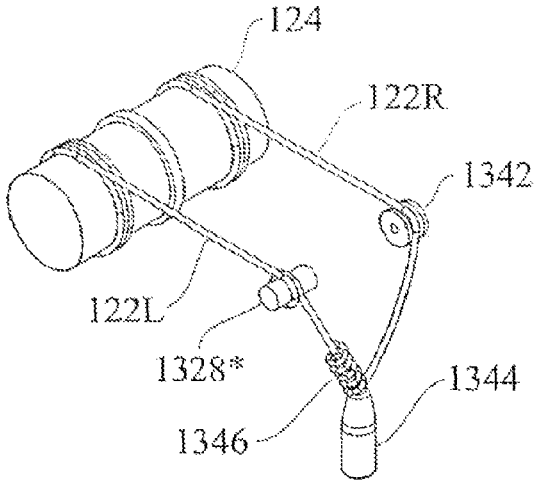
Figure 187B:
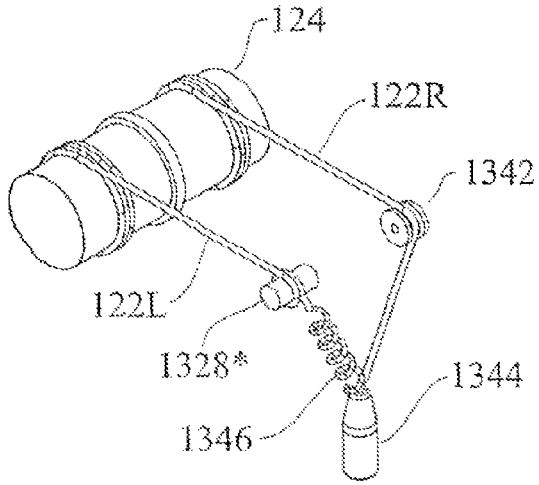
Figure 188:
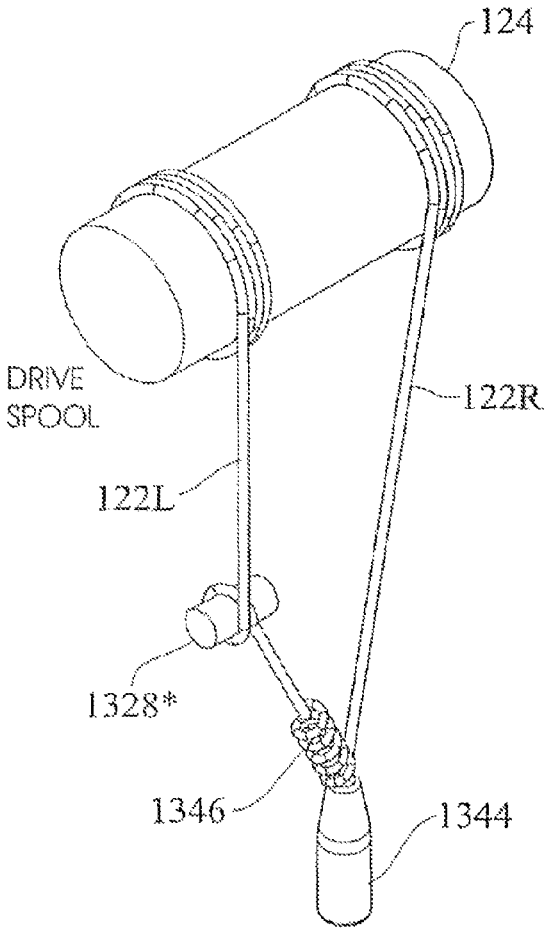
Figure 189:
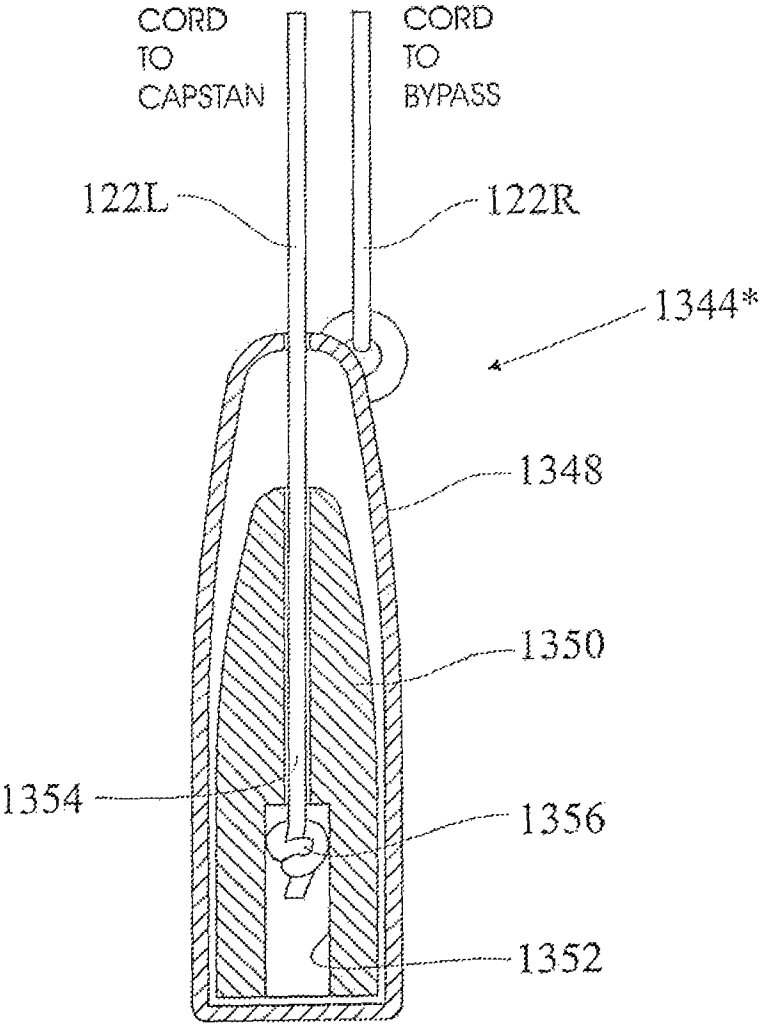
Figure 190:
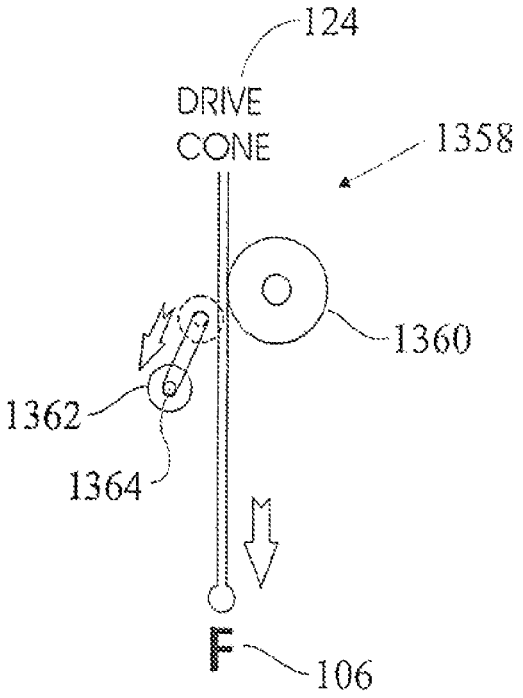
Figure 191:
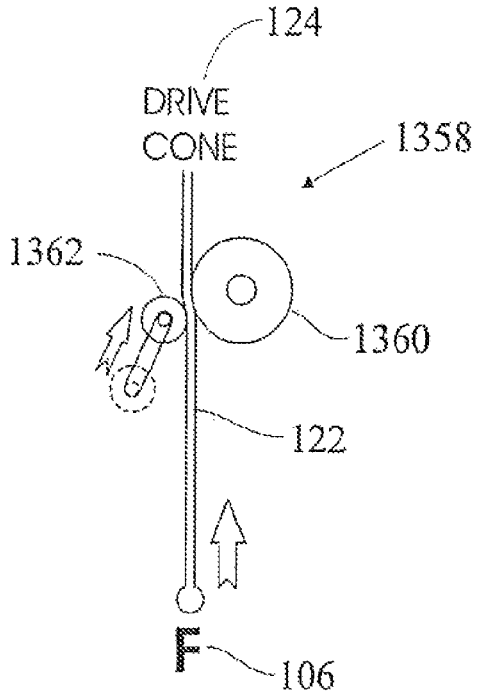
Figure 192:
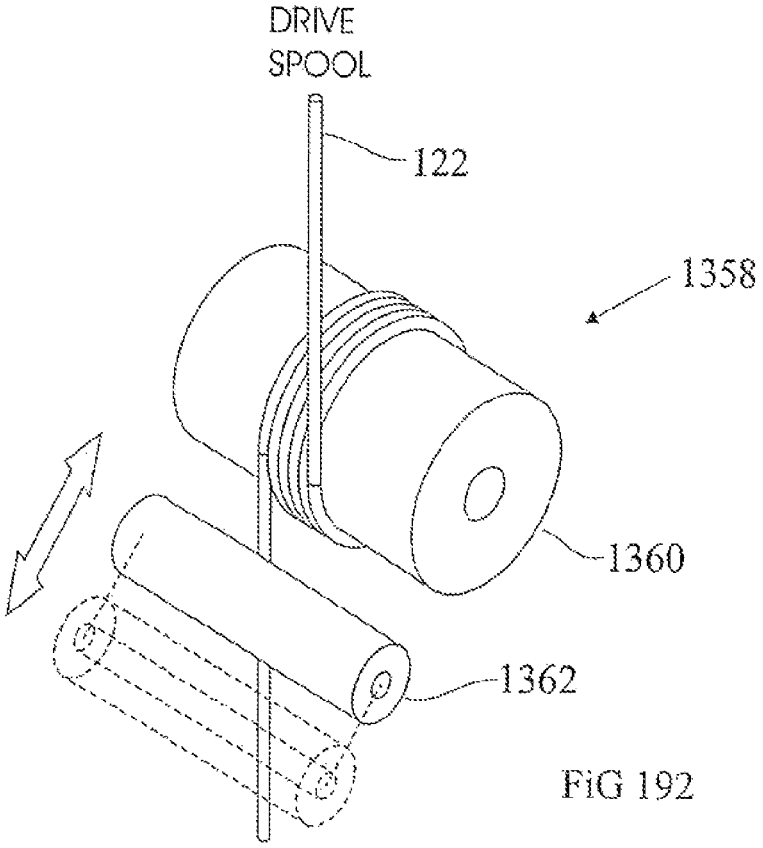
Figure 193:
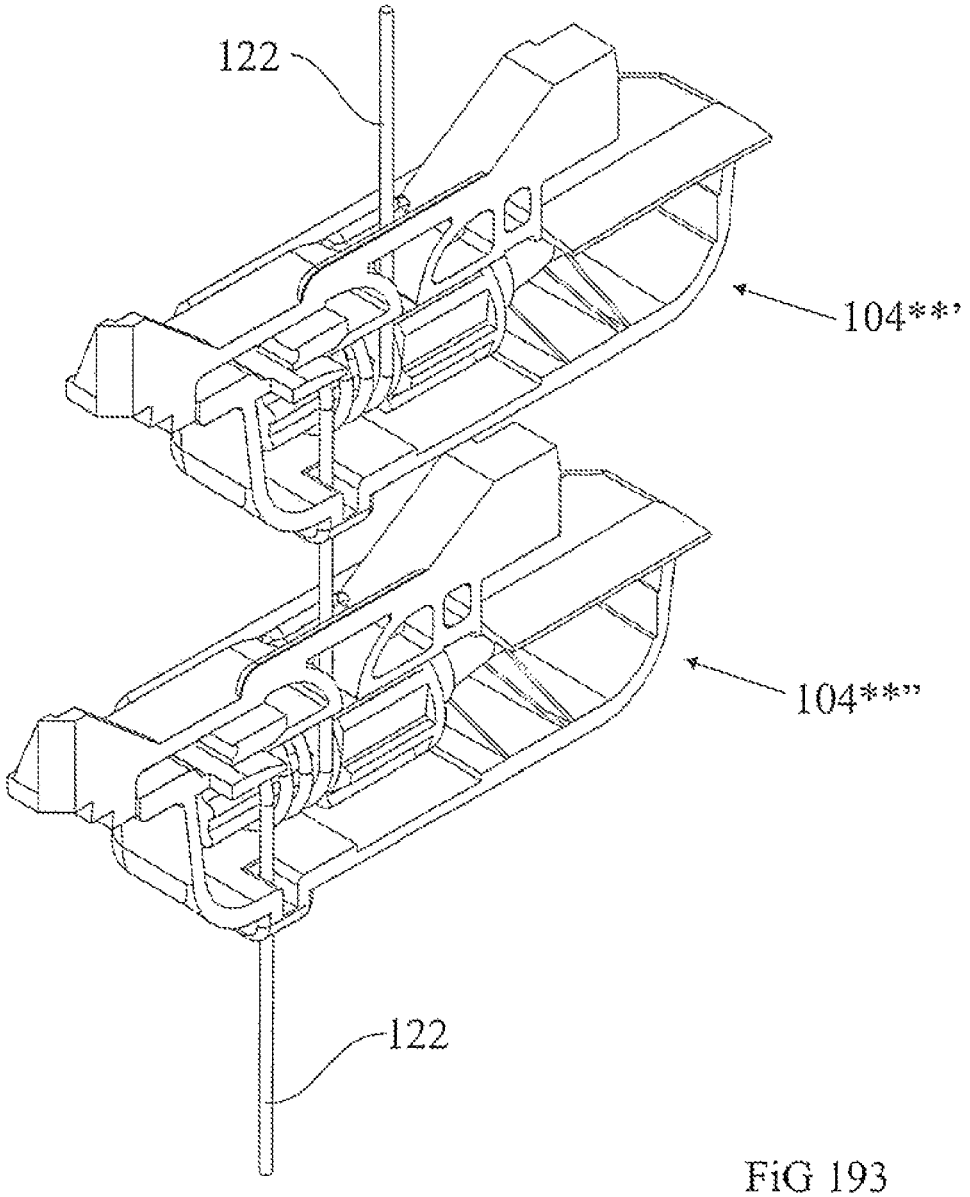

FIG. 117 is an exploded perspective view of the roller shade of FIG. 116;

FIG. 118 is a perspective view of the drive end of the roller shade of FIG. 116;

FIG. 119 is an exploded perspective view of the drive end of FIG. 118;

FIG. 120 is a perspective view of the drive spool of FIG. 119;

FIG. 121 is a perspective view of the roller lock housing of FIG. 119;

FIG. 122 is a partially exploded, perspective view of a cellular product shade having a movable middle rail, made in accordance with the present invention;

FIG. 123 is a perspective view of a Roman shade with a drive spool and roller lock mechanism made in accordance with the present invention;

FIG. 124 is an exploded perspective view of the Roman shade of FIG. 123;

FIG. 125 is a perspective view of the drive and roller lock mechanism of FIGS. 123 and 124;

FIG. 126 is a different perspective view of the drive and roller lock mechanism of FIG. 125;

FIG. 127 is yet a third perspective view of the drive and roller lock mechanism of FIG. 125;

FIG. 128 is a cutaway view of the drive and roller lock mechanism of FIG. 126;

FIG. 129 is a partially exploded, perspective view of a shutter-like blind with a drive made in accordance with the present invention;

FIG. 130 is a perspective view of the drive of FIG. 129;

FIG. 131 is a plan view of a cone drive, similar to that of FIG. 130, using a cylindrical cone;

FIG. 132 is a partially exploded, perspective view of a vertical blind with a cone drive and roller lock mechanism made in accordance with the present invention;

FIG. 133 is a perspective view of a top down/bottom up shade made in accordance with the present invention;

FIG. 134 is a partially exploded, perspective view of the shade of FIG. 133;

FIG. 134A is a perspective view of a different transport drive configuration for a top down/bottom up window covering similar to that of FIG. 133;

FIG. 135 is a perspective view of the drag brake of FIG. 134;

FIG. 136 is an exploded, perspective view of the drag brake of FIG. 135;

FIG. 137 is a schematic of the sequence of events to assemble the drag brake of FIGS. 135 and 136;

FIG. 138 is a perspective view of the transmissions of FIG. 134;

FIG. 139 is a partially exploded perspective view of transmission of FIG. 138, with the transmission cord omitted for clarity;

FIG. 140 is a sectional view along line 140-140 of FIG. 138, again with the transmission cord omitted for clarity;

FIG. 141 is a perspective view of the driven shaft of the transmission of FIG. 139;

FIG. 142 is a perspective view of the drive shaft of the transmission of FIG. 139;

FIG. 143 is a sectional view similar to that of FIG. 140, comparing the relative size and number of parts of this transmission relative to a higher friction transmission;

FIG. 144 is a perspective view of the drive shaft and the driven shaft of FIG. 139, interconnected with the transmission cord for a left hand drive transmission;

FIG. 145 is a perspective view of the drive shaft and the driven shaft of FIG. 139, interconnected with the transmission cord for a right hand drive transmission;

FIG. 146 is a perspective view of a drive cone with an unthreaded surface for use in a cone drive made in accordance with the present invention;

FIG. 147 is an end view of an alternate embodiment of wand extrusions, similar to that of FIG. 46, showing the profile of the extrusions;

FIG. 148 is an end view of another alternate embodiment of a wand extrusion, similar to that of FIG. 71, showing the profile of the extrusion;

FIG. 149 is an end view of another alternate embodiment of wand extrusions, similar to that of FIG. 46, showing the profile of the extrusions;

FIG. 150 is an end view of another alternate embodiment of a wand extrusion, similar to that of FIG. 71, showing the profile of the extrusion;

FIG. 151 is a plan view of a transmission and two spring motors, similar to the transmission and motor shown in FIG. 134;

FIG. 152 is a view along line 152-152 of FIG. 151;

FIG. 153 is a perspective view of the left side transmission and motor of FIG. 134;

FIG. 154 is the same as FIG. 153 but with the motor and the transmission pulled apart to show how they mesh together;

FIG. 155 is a perspective view of another embodiment of a gearbox made in accordance with the present invention;

FIG. 156 is an exploded, perspective view of the gearbox of FIG. 155;

FIG. 157 is a sectional view along line 157-157 of FIG. 155;

FIG. 158 is a perspective view of one of the lift stations of FIG. 122;

FIG. 159 is an exploded, perspective view of the lift station of FIG. 158;

FIG. 160 is an, exploded, perspective, opposite-end view of the lift station of FIG. 159;

FIG. 161 is a section view of the lift station of FIG. 158;

FIG. 162 is a perspective view of another embodiment of a tassel weight with the plug outside of the tassel as it is being assembled;

FIG. 163 is a perspective view of a tassel plug which is part of the tassel weight of FIG. 162;

FIG. 163A is a perspective view of the tassel plug of FIG. 163, but depicting a different knot to tie the drive cord to the tassel plug;

FIG. 164 is a sectional view of the tassel weight and plug of FIG. 162 when in the assembled position;

FIG. 165 is a perspective view of a tassel weight and a bottom jig for aiding in sliding a tassel cover over the weight;

FIG. 166 is a perspective view of the tassel weight of FIG. 165 installed on the bottom jig, with the cover and a top jig exploded above the tassel weight;

FIG. 167 is a perspective view of the top jig of FIG. 166 installed on the cover which, in turn, is installed on the weight;

FIG. 168 is a perspective view of the completed tassel weight and cover assembly as it is removed from the top and bottom assembly jigs;

FIG. 169 is a side view of another embodiment of a roller lock made in accordance with the present invention, wherein the cross-hatched area depicts the area molded via a special four-cam arrangement;

FIG. 170 is a sectional view along line 170-170 of FIG. 169;

FIG. 171 is a sectional view, identical to that of FIG. 170, but showing the placement of the molding cams and their direction of motion when being retracted;

FIG. 172 is a perspective view of another embodiment of a roller lock housing made in accordance with the present invention, housing the roller lock of FIG. 169;

FIG. 173 is a perspective view of a combination motor and transmission assembly made in accordance with the present invention;

FIG. 174 is an exploded, perspective view of the combination motor and transmission assembly of FIG. 173;

FIG. 175 is a sectional view along line 175-175 of FIG. 173;

FIG. 176 is a perspective view of a splined adapter made in accordance with the present invention;

FIG. 177 is an opposite-end, perspective view of the splined adapter of FIG. 176;

FIG. 178 is a perspective view of a drum for a lift station, made in accordance with the present invention;

FIG. 179 is an opposite-end, perspective view of the drum of FIG. 178;

FIG. 180 is a sectional view along line 180-180 of FIG. 179;

FIG. 181 is a left end view of the drum of FIG. 179;

FIG. 182 is a right end view of the drum of FIG. 179;

FIG. 183 is a sketch of a rotating capstan arrangement with a fixed axis of rotation, which may be used instead of the shifting capstan arrangement shown in many of the cord drives, such as the cord drive of FIG. 11;

FIG. 184 is a sketch of a non-rotating capstan arrangement with a fixed axis of rotation, which also may be used instead of the shifting capstan arrangement shown in many of the cord drives, wherein the capstan itself does not rotate, but the corners of the capstan which are in contact with the drive cord do rotate;

FIG. 185 is a sketch of a fixed, non-rotating capstan arrangement, with separate tassels for raising and for lowering the blind, which also may be used instead of the shifting capstan arrangement shown in many of the cord drives;

FIG. 186 is a sketch of a fixed, non-rotating capstan arrangement, very similar to FIG. 185, except that the idler pulley has been eliminated;

FIG. 187A is a sketch of a fixed, non-rotating capstan arrangement, with a single, spring-loaded tassel for raising and for lowering the blind, which also may be used instead of the shifting capstan arrangement shown in many of the cord drives; shown with the spring in its "at rest" position and the drive cord locked against rotation about the capstan;

FIG. 187B is a sketch, similar to FIG. 187A, but shown with the spring in its extended position, allowing the bypass drive cord to be used to raise the blind;

FIG. 188 is a sketch of a fixed, non-rotating capstan arrangement, very similar to FIG. 187, except that the idler pulley has been eliminated;

FIG. 189 is a cross-sectional view of a tassel which may be used instead of the spring-loaded tassel of FIGS. 187 and 188;

FIGS. 190 and 191 are sketches of a one-way cord drag which acts as a one-way brake on the drive cord when traveling in one direction and has no restriction to motion when traveling in a second direction, and which also may be used instead of the shifting capstan arrangement shown in many of the cord drives;

FIG. 192 is a sketch of a one-way cord drag, similar to that of FIGS. 190 and 191, except that the drive cord is wrapped several times around the free-spinning roller to enhance the braking power of the device, and FIG. 193 is a perspective view of two roller lock mechanisms in series for use in heavier window treatments.

DESCRIPTION OF THE PREFERRED EMBODIMENTS

FIGS. 1 through 10 illustrate various embodiments of the present invention as it relates to horizontal coverings for architectural openings (which may hereinafter be referred to as window coverings or as blinds or shades).

Figure 1:
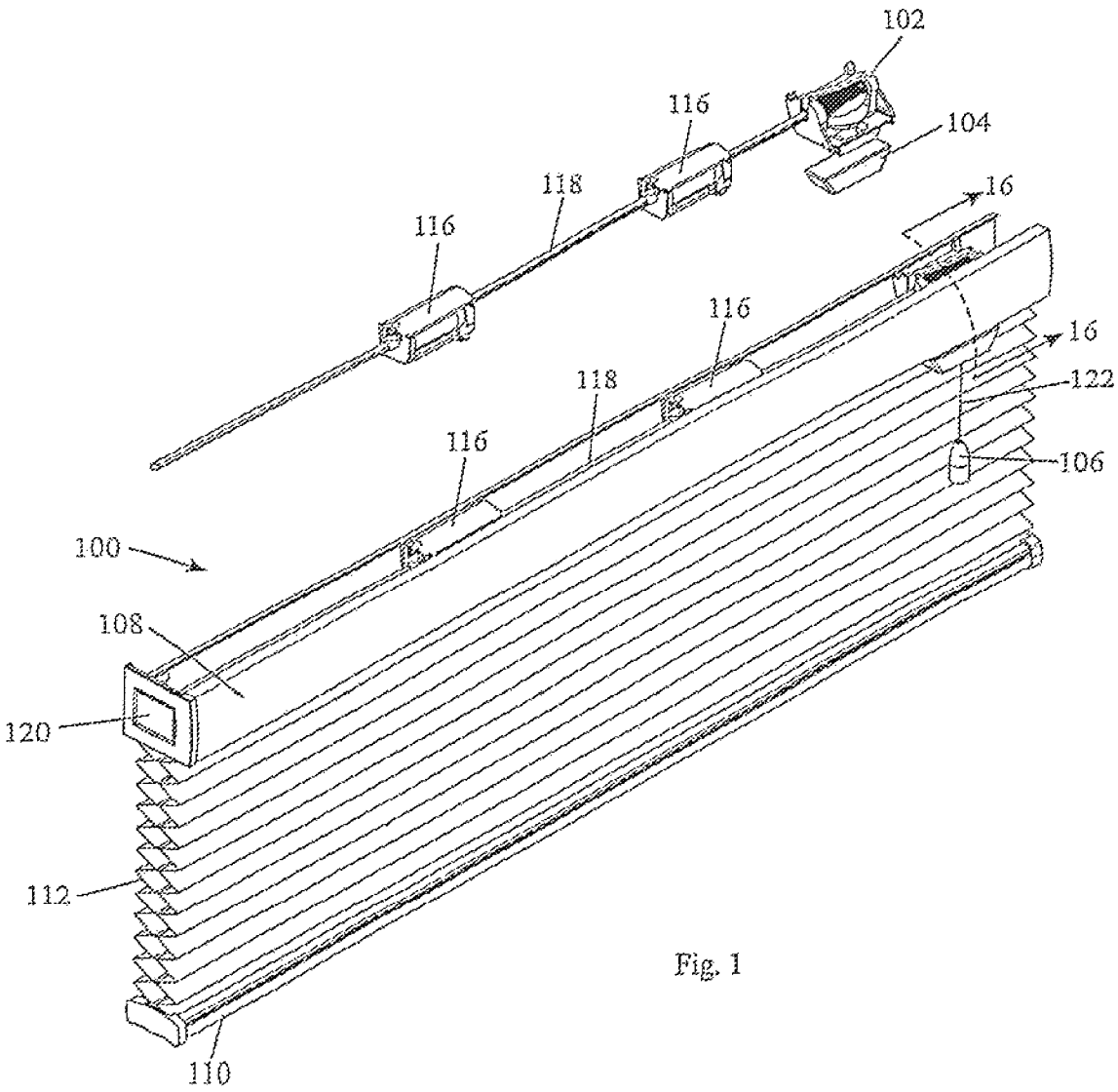
FIG. 1 is a partially exploded, perspective view of a cellular shade incorporating a cord drive with a roller lock mechanism and tassel weight made in accordance with the present invention.

FIG. 1 is a partially exploded, perspective view of a first embodiment of a cellular shade 100 utilizing a cone drive 102 with a roller lock mechanism 104 and a tassel weight 106 (illustrated in further detail in FIGS. 11 through 22) to raise or lower the shade (retracting and extending the expandable material), and to hold the shade in place where the user wants it to remain.

The shade 100 of FIG. 1 includes a head rail 108, a bottom rail 110, and a cellular shade structure 112 suspended from the head rail 108 and attached to both the head rail 108 and the bottom rail 110. Lift cords 114 (not shown in this view) are attached to the bottom rail 110 and to lift stations 116 such that when the lift rod 118 rotates, the lift spools on the lift stations 116 also rotate, and the lift cords 114 wrap onto or unwrap from the lift stations 116 to raise or lower the bottom rail 110 and thus raise or lower the shade 100. These lift stations 116 and their operating principles are disclosed in U.S. Pat. No. 6,536,503 "Modular Transport System for Coverings for Architectural Openings", issued Mar. 25, 2003, which is hereby incorporated herein by reference. End caps 120 close the ends of the head rail 108 and may be used to mount the cellular product 100 to the architectural opening.

At the right end (also referred to as the control end) of the shade 100, a cone drive 102 (described later in more detail) mounts onto the head rail 108 and engages the lift rod 118 such that, when the cone drive 102 rotates, the lift rod 118 also rotates, and vice versa. In order to raise the shade, the drive cord 122 is pulled by the user. In order to lower the shade, the tassel weight 106 is lifted slightly by the user to release the force acting on the roller lock mechanism 104. At any position, the user may let go of the tassel weight 106, locking the shade 100 in the desired position, as will be described later. The drive cord 122 may also be referred to as the control cord 122.

The preferred drive cord 122 used in these embodiments is an ultra high molecular weight (UHMW) woven or braided multi-filament cord made of polyethylene. The cord may advantageously include an inner core, preferably a 100% Polyester inner core. A cord with an inner core tends to hold its round shape much better than the same cord without an inner core. A cord without an inner core tends to flatten out under load. As may be appreciated later, as we enter into a discussion of the drive cord wrapping around a capstan with a multi-sided profile, a more round cord has a better holding force on the capstan. For a given radius on the capstan, for instance, one with an octagonal profile, a rounder cord has a smaller contact point and thus will "break" more than a flattened cord (which has a larger contact area because it is flattened), and thus the rounder cord will hold better. This also results in better repeatability of operation with a rounder cord.

Cone Drive, Roller Lock Mechanism, and Tassel Weight

FIGS. 11 through 22 depict the cone drive 102 with the roller lock mechanism 104. (Note: While the cone or spool 124 shown here has two different tapers, one steeper than the other, the cone or spool 124 may have any desired taper or combination of tapers, including zero degrees, so that the cone may have a variety of profiles, including a cylindrical profile. Use of the term "cone" herein is intended to include any of those various profiles.)

Figure 13:
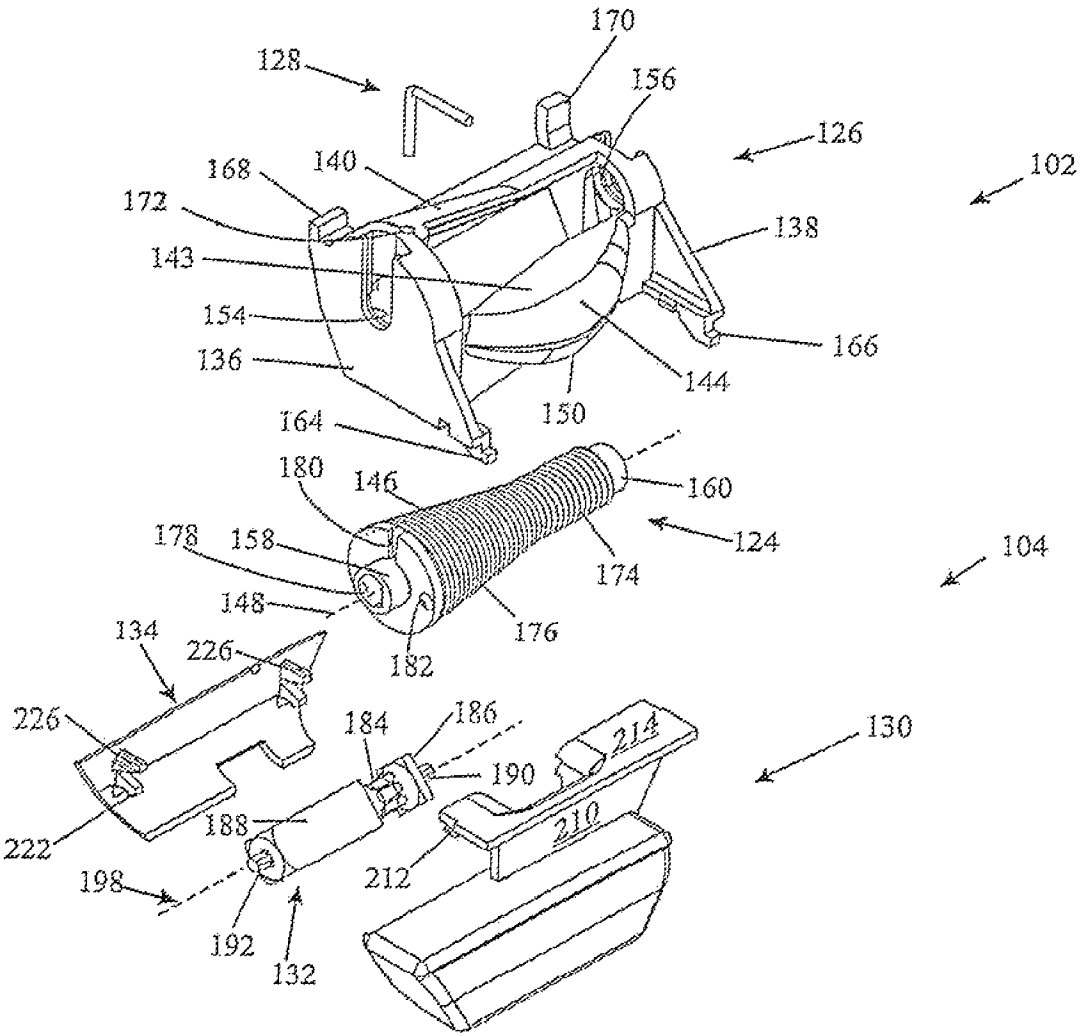
FIG. 13 is an exploded perspective view of the cord drive with roller lock mechanism of FIG. 11.

Referring to FIG. 13, the cone drive 102 includes a drive cone or drive spool 124, a cone drive housing 126, and an assembly-assist locking lever 128. The roller lock mechanism 104 includes a roller lock housing 130, a roller lock 132, and a housing cover 134.

Figure 12:
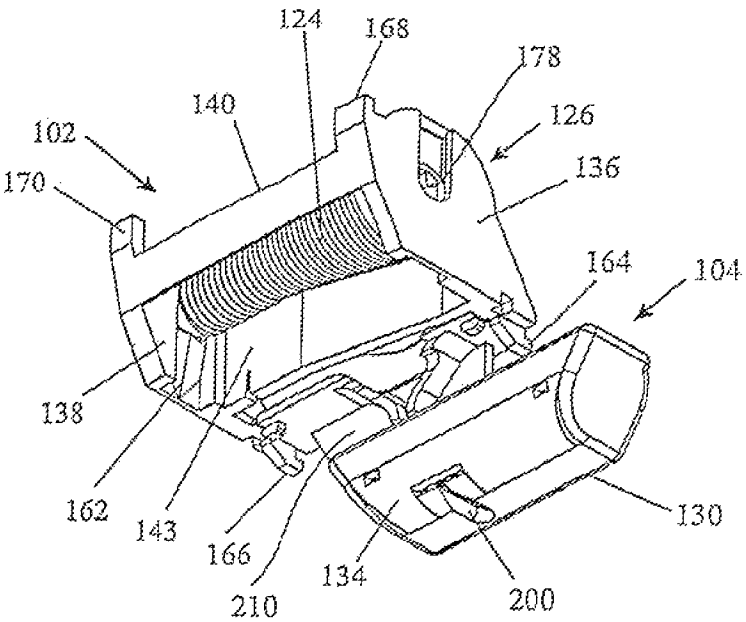
FIG. 12 is a rear perspective view of the cord drive with roller lock mechanism of FIG. 11.

Referring to FIGS. 11, 12, and 13, the housing 126 is a cradle which serves to rotatably support the drive cone 124, to guide the drive cord 122 (See FIG. 1) onto the drive cone 124, and to mount the cone drive 102 onto the head rail 108. The housing 126 includes two substantially parallel end walls 136, 138 interconnected by an upper wall 140, which has an inner surface 142 (See FIG. 16) that closely follows the profile of the outer surface 146 of the drive cone 124, such that, when they are assembled, there is a clearance of less than twice the diameter of the drive cord 122 between the outer surface 146 of the drive cone 124 and the inner surface 142 of the interconnecting upper wall 140. This feature assists in preventing the drive cord 122 from overwrapping. Note that the outer surface 146 of the drive cone 124 may be a threaded surface as shown in FIG. 13, or it may be smooth and unthreaded as described later in an alternate embodiment. When referring to a threaded surface, the less-than-two-cord diameter clearance between the threaded surface and the inner surface of the wall of the housing is measured from the root diameter of the thread on the drive cone to the inner surface of the wall of the housing, not from the top of the thread. It should also be noted that the threads only cradle the drive cord 122, not grab it. If the threads were to grab the drive cord, then it would take additional energy to insert the cord 122 into the thread and also to extract the cord 122 from the thread.

The housing 126 also includes a lower interconnecting wall 143 located along the lower front quadrant of the housing 126, and an outwardly projecting compound arcuate surface 144, which is a guide surface or control surface designed to guide the drive cord 122 onto the threaded surface 146 of the drive cone 124 in order to ensure positive tracking with no over-wrapping or under-wrapping. The preferred wrapping onto the drive cone 124 is where each new wrap of cord wraps directly adjacent to the previous wrap of cord. In the case of a threaded drive cone 124, this preferred wrapping means that the cord follows the spiral of the thread on the cone. Over-wrapping would be if the cord wraps upstream, over a previous wrap, so that there is more than one layer of cord wrapped onto the drive cone 124 in some places. Under-wrapping would be if the new wrap of cord is spaced downstream some distance away from the previous wrap, so that there are substantial bare gaps along the drive cone 124, with no cord, in between the wraps of cord. Under-wrapping may also be referred to as thread skipping, whether or not there are threads on the drive cone.

The overall design issue on the guide surface 144 is that the cord has a tendency to follow the path of least resistance, which path is determined by a combination of the degrees of turn, the apparent radius of the turn, the surface texture, and the length of the path. The resistance to movement of each thread path should nearly approximate the resistance of the thread path on either side. When this occurs, there is a nearly neutral situation, and, when there is a thread on the drive cone as in this drive cone 124, then that thread drives the cord along the guide surface 144.

If there is no thread on the drive cone, then the thread path resistance should increase slightly with each revolution in the direction of accumulating cord on the drive cone (the downstream direction), so the cord will wrap up adjacent to the previous wrap.

The guide surface 144 creates a substantially neutral influence to the translational motion of the drive cord 122, so the cord 122 passes over the guide surface 144 as it wraps onto and off of the threaded drive cone 124, following the threads of the drive cone 124 and approaching or leaving the drive cone 124 at approximately right angles to the axis of rotation 148 of the drive cone 124. It is preferred that the cord 122 approach the drive cone 124 at an angle that is within ten degrees of a right angle to the axis of rotation of the drive cone, meaning an angle between 80° and 100° to the axis of the drive cone 124. The guide surface 144 is shaped to facilitate movement of the cord so that the cord approaches and leaves the drive cone at substantially right angles to the axis of rotation of the drive cone and to facilitate translation of the drive cord along the length of the drive cone, so that each subsequent wrap of the cord is adjacent to the previous wrap, preventing overwrapping or underwrapping.

The shape of the control surface that will achieve that goal depends upon the shape of the drive cone 124 and the position of the fixed guide point (or cord emanation point) at which the cord leaves the roller lock 104, as is described later. For the drive cone 124 shown here, the radius of the control surface 144 changes along its length, both in a front view, as shown in FIG. 17, and in a top view, as shown in FIG. 18A.

Figure 17:
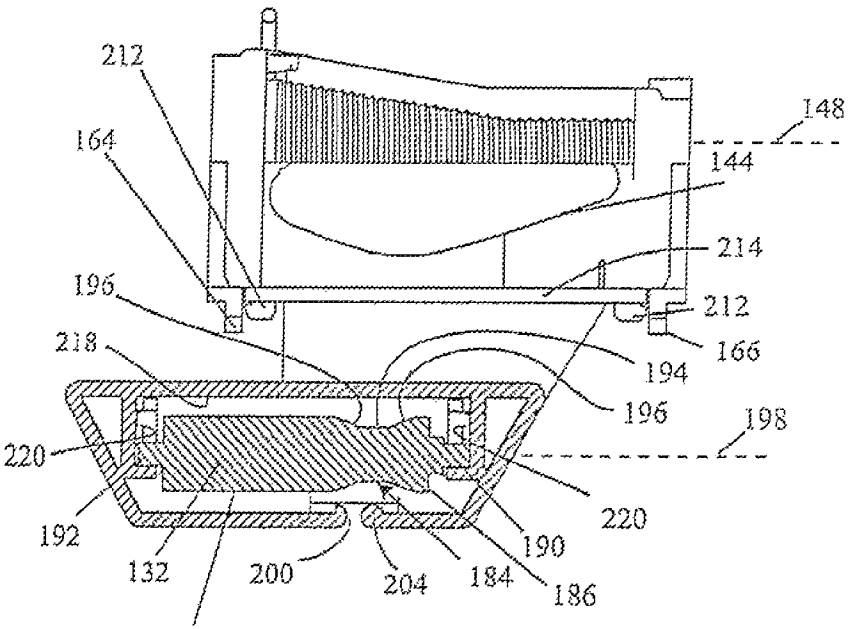
FIG. 17 is a sectional view along line 17-17 of FIG. 16 (with head rail removed for clarity)
Figure 16:
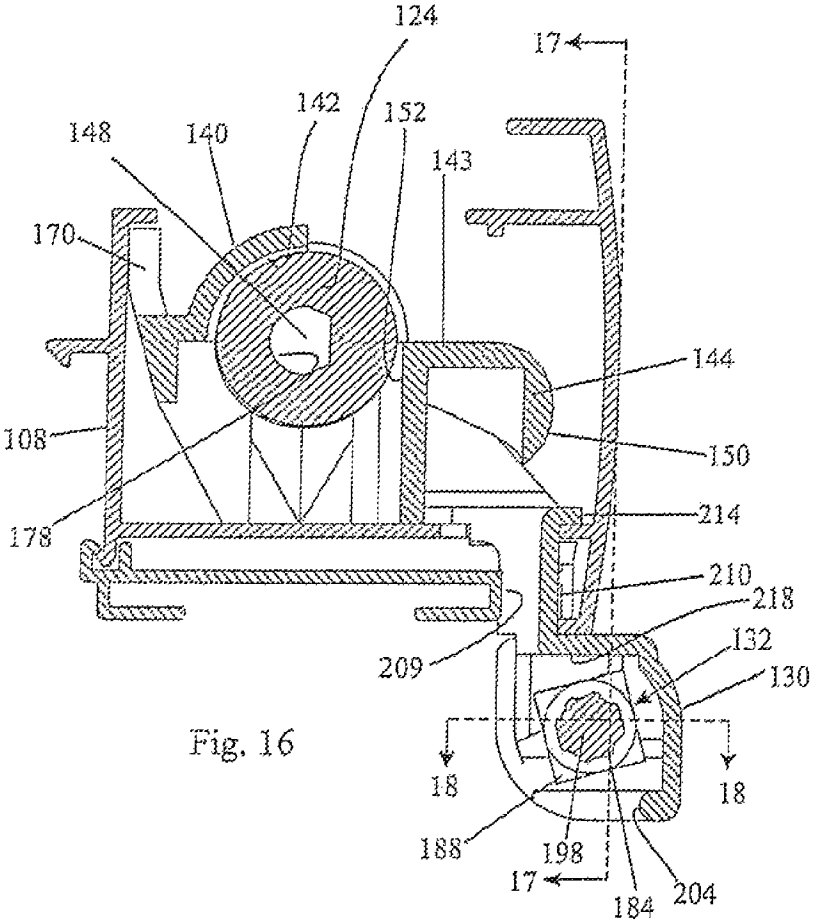
FIG. 16 is a sectional view along line 16-16 of FIG. 1 (with drive cord removed for clarity) with the roller lock in the rotating position.

As shown in FIGS. 13 and 17, from a front view, the control surface 144 is thin at its ends and gradually broadens to a thicker intermediate point. Similarly, from a top view, as shown in FIG. 18A, the guide surface 144 approaches the drive cone 124 at its ends, and projects farthest away from the drive cone 124 in the radial direction at a point that is axially aligned with the emanation point at which the cord leaves the roller lock 104. The radius of the guide surface 144 varies along its length. FIG. 16 is a view showing the radius 150 on the front of the guide surface 144. This radius 150 is generous in order to reduce the frictional losses (high frictional losses would be created with a very sharp radius), and this radius 150 also is reduced toward the ends of the guide surface 144 as seen in FIG. 13.

Figure 17C:
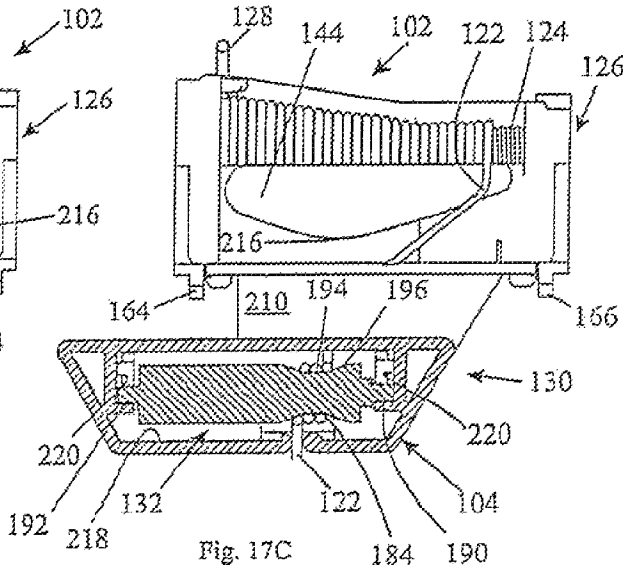
FIG. 17C is the same as FIG. 17B but showing the drive cord almost entirely wrapped onto the drive spool.

The idea is to design the guide surface 144 so that the effective radius, the line segment length, and the total number of degrees of travel that the cord 122 "sees" are roughly the same throughout its travel as it wraps onto the drive spool, progressing along the axial length of the drive spool, so the guide surface 144 has a neutral effect on the cord 122, not pulling the cord in any direction but allowing it to wrap onto the spool 124 with each subsequent wrap lying adjacent to the previous wrap. For example, as the cord 122 approaches the ends of the cone 124, it passes over the guide surface 144 at an increasing angle as seen in FIGS. 17A and 17C, which would increase the effective radius "seen" by the cord 122 if the radius of the guide surface 144 were not reduced toward those ends. By reducing the radius of the guide surface 144 toward the ends, the effective radius remains relatively constant, allowing the guide surface 144 to have a substantially neutral effect on the cord 122.

The guide surface 144 (See FIGS. 17A, 17B, and 17C) is static, meaning that it does not move relative to the housing or frame 126. The guide surface has a compound arcuate shape of varying radii in multiple directions, which guides the drive cord 122 from a specific inlet point (or fixed emanation point dictated by the upper slotted opening 206 of the roller lock housing 130 as described below) onto the threaded surface 146 of the drive cone 124. The guide surface 144 provides neutral guidance, neither pushing the cord 122 ahead of its correct longitudinal position nor dragging it behind its correct longitudinal position, but allowing the cord 122 to follow the threads on the drive cone 124, approaching and leaving the drive cone 124 at approximately right angles to the axis of rotation 148 of the drive cone 124 at all positions along the length of the drive cone 124. Since the guide surface 144 provides neutral guidance, the slight influence of the threads on the translational motion of the cord 122 is enough to ensure that the cord 122 positively tracks across the surface 146 of the drive cone 124 without any over-wraps.

Referring briefly to FIG. 18A, the inside surface 152 of the interconnecting wall 143 also closely follows the profile of the outer surface 146 of the drive cone 124 such that there is a clearance of less than twice the diameter of the drive cord 122 between the outer surface 146 of the drive cone 124 (actually the root diameter of the thread as explained earlier) and the inner surface 152 of this second interconnecting wall 143. This feature assists in preventing the drive cord 122 from over wrapping as it wraps onto and off of the drive cone 124.

The end walls 136, 138 include through openings 154, 156, which act as journaling supports for the axles 158, 160 of the drive cone 124. Referring briefly to FIG. 12, ramps 162 on the inside surface of the end walls 136, 138 and a small amount of "give" of the end walls 136, 138 allow the drive cone 124 to slide into place inside the housing 126, gradually spreading apart the end walls 136, 138 until the axles 158, 160 reach the openings 154, 156, at which point the end walls 136, 138 snap back to their original positions, locking the drive cone 124 in place, with the axles 158, 160 securely resting in those openings 154, 156.

The housing 126 also includes projecting feet 164, 166 and projecting ears 168, 170 for securely mounting the housing 126 onto the head rail 108. A small through opening 172 (See FIG. 13) at the top of the end wall 136 is used in conjunction with the assembly-assist locking lever 128 to lock the cone drive assembly 102 in order to facilitate assembly onto the window covering product 100 and to facilitate shipment, as will be described in more detail later.

Referring to FIG. 13, the drive cone 124 in this embodiment includes a cylindrical portion 174, which seamlessly transitions into a frustroconical portion 176, with axles 158, 160 at the ends of the drive cone 124, which support the drive cone 124 for rotation about the axis 148. The shape of the outer surface of the drive cone 124 is designed depending upon the type of load supported on the drive cone and how that load changes as the cord wraps onto and off of the drive cone 124. It is also desirable to have a cord stroke that is shorter than the travel of the covering, and the drive cone design enables that shorter cord stroke through an over-all average torque arm that is less than the applied torque arm of the shade on the spool. When load is light, the cylindrical portion 174 of the drive cone 124 is used, providing a mechanical disadvantage in order to get a short cord stroke, so the drive cord travels a shorter distance than does the covering. When the load increases, the tapered, conical portion 176 of the drive cone 124 is used, providing less mechanical disadvantage while sacrificing on cord stroke length.

The drive cone 124 is hollow through the middle, as are the axles 158, 160. The axles 158, 160 define a non-circular profile 178 on their interior surface, which closely matches the non-circular profile of the lift rod 118 (see FIG. 1), such that they positively engage each other as described later. One end of the drive cone 124 includes a radially-extending slotted notch 180. When the drive cone 124 is rotated so that the slotted notch 180 extends vertically upwardly, the notch 180 is aligned with the opening 172 in the housing 126, such that, when one leg of the assembly-assist locking lever 128 is inserted through the opening 172 and through the notch 180, the drive cone 124 is locked against rotation relative to the housing 126.

A small recessed hole 182 at the end of the drive cone 124 allows the drive cord 122 to be tied off and secured to the drive cone 124. The drive cord 122 is fed through the hole 182, and a knot (not shown) is tied at the end of the drive cord 122. When the drive cord 122 is pulled tight, the knot is pulled into the recessed hole 182, but the knot is too large to go through the hole 182, thereby securing the end of the drive cord 122 to the drive cone 124. Various other methods of securing the drive cord to the drive cone could be used, such as the mechanism shown in the transmission. A drive cone washer 183 (See FIG. 25) may be installed over the axle 158 so as to cover the recessed hole 182 to prevent the possibility of the cone drive housing 126 unraveling the knot as the drive cone 124 rotates in the cone drive housing 126.

As discussed earlier, the outer surface 146 of the drive cone 124 is threaded for better tracking of the drive cord 122 as it wraps onto and unwraps from the drive cone 124. As shown in FIG. 1, the non-circular cross-section axial opening 178 through the drive cone 124 receives the non-circular cross-section lift rod 118, which engages lift stations 116. The lift stations 116 have their own spools, onto which the lift cords wrap in order to raise and lower the window covering.

When the blind is fully extended, the drive cord 122 is completely wrapped (or substantially wrapped, in any event) onto the drive cone 124. Since in a blind (and in some shades, such as pleated shades and cellular products 100) the weight being raised is at a minimum when the window covering is at the bottom (fully extended) and increases as it is raised, the small diameter portion 174 of the drive cone 124 is used in the area in which the blind approaches full extension. When the force required to continue lifting the window covering exceeds a desired maximum (typically in the 12 to 15 pound range), the increasing-diameter frustroconical section 176 of the drive cone 124 comes into play to provide a mechanical advantage over the cylindrical portion, making it easier to raise the window covering (but requiring more travel, or stroke, of the drive cord 122).

Thus, the drive cord 122 is wrapped onto the drive cone 124 beginning at the large diameter end and ending at the small diameter end, so that, as a person begins pulling the drive cord 122 to unwrap the drive cord 122 from the drive cone 124 in order to lift the blind, he is first unwrapping the drive cord 122 from the small diameter, cylindrical portion 174 of the drive cone 124, and then, as the person continues to pull the drive cord 122 to lift the blind further, and the weight of the blind that is being lifted increases, the drive cord 122 begins unwrapping from the conical section 176 of the drive cone 124.

In a preferred embodiment, the lift spools of the lift stations 116 and the drive cone 124 diameters are sized so that the vertical distance traveled by the drive cord 122 (the stroke of the drive cord 122) to raise or lower the window covering is less than the vertical distance traveled by the window covering itself. Typically, the vertical distance traveled by the drive cord 122 is in the order of 65% or less of the vertical distance traveled by the window covering. This helps avoid the problem of cords dragging on the floor when the window covering is fully raised.

The drive cone 124 can also be used with shades (such as roller shades) where the weight is at a maximum at the bottom of the shade and diminishes as the shade wraps onto the rotator rail. However, in this instance, the profile of the drive cone would then likely be reversed, so that, when the shade is fully extended and the person begins pulling on the drive cord 122 to begin lifting the shade, he begins unwrapping around the largest diameter portion of the cone first and works toward the small diameter portion as the shade wraps onto the rotator rail. Alternatively, a simple spool may be used, which stacks one cord layer on top of the other, achieving the same type of mechanical advantage. As has already been mentioned, any number of cone configurations are possible, including a completely frustroconical "cone" as well as a completely cylindrical "cone", depending on the mechanical advantage desired.

As discussed in more detail later with respect to the material used for the manufacture of the roller lock 132, Ultem, a very high strength polyetherimide plastic (Ultem is a Registered Trademark of GE Polymers), is the material that has been used for the manufacture of the drive cone 124. To prevent excessive wear between the drive cone 124 and the pivot bearing supports 154, 156 of the cone drive housing 126, between 2% and 6% Teflon (Teflon is a DuPont trademark) has been added to the Ultem used in making the drive cone 124, and this provides increased lubricity between the drive cone 124 and the cone drive housing 126.

Referring to FIG. 13, the roller lock mechanism 104 uses a similar operating principle to a windlass, which is used in nautical applications to raise or lower an anchor or other weight. In a nautical application, the rode (cable or line) attached to the anchor is wound one or more times (typically several times) around the capstan (a spool-shaped cylinder that is rotated manually or by machine). One end of the rode is secured to the anchor, and the other end of the rode is tied to the boat. When the anchor needs to be raised, tension is applied to the end of the rode secured to the boat. This tightens the rode around the capstan so the rode will not slip. The capstan is then rotated, either manually or by machine, forcing the rode to wind up onto the capstan, and pulling up the anchor with it. The axis of rotation of the capstan never moves. It is common to have pawls or ratchets to lock the capstan against rotation in the opposite direction in order to easily hold the anchor where desired without having to strain to keep it there. As long as sufficient tension is kept on the end of the rode attached to the boat, the rode will not slip around the capstan, and the anchor (or other weight being hoisted) remains "locked" in that position. If the tension on the rode is relaxed (referred to as surging the capstan), the rode slips around the capstan, and the anchor or weight drops. Also, even if the tension is kept on the rode, if the capstan is unlocked (by the retraction of ratchets or pawls, for instance) and if the weight of the anchor pulling down on the rode is larger than the tension pulling it back, then the capstan will rotate to unwind the rode, and the anchor will fall.

As described in detail below, the roller lock 132, in conjunction with the housing 130 and housing cover 134, acts as a windlass, complete with capstan and locking mechanism when locking the window covering in position and when lowering the window covering (surging the capstan 184). However, when raising the window covering, the roller lock 132 does not drive the cord 122 as a windlass would; instead it becomes an idling device.

Figure 15:
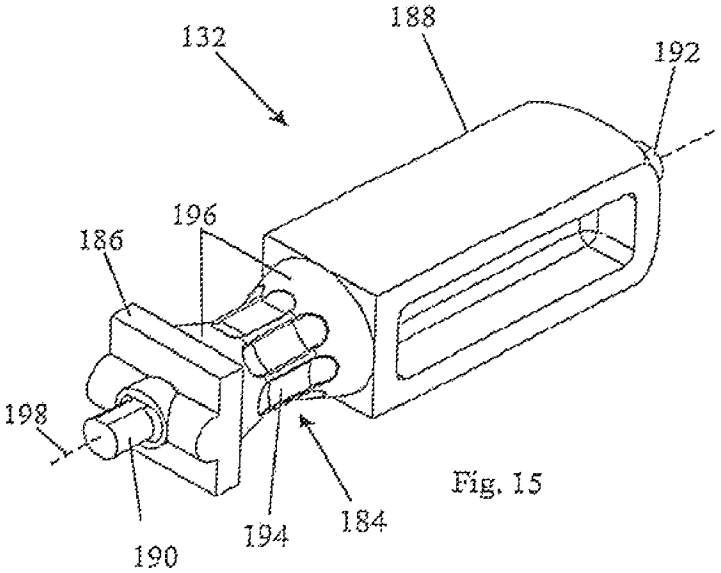
FIG. 15 is a perspective view of the rotor of the roller lock mechanism of FIG. 13.

Referring to FIG. 15, the roller lock 132 is an elongated member with a spool or capstan 184 between two square-profiled portions 186, 188, which themselves end in small diameter axle ends 190, 192. The small diameter of the axles 190, 192 serves to minimize rotational friction as well as thrust friction. The axle ends 190, 192 are aligned so as to permit the roller lock 132 to rotate about an axis of rotation 198. The spool 184 has a generally octagonally-shaped profile 194 with generous radii to avoid fraying the drive cord 122. The tight angles formed by the octagonally-shaped profile exceed the natural bend of the drive cord 122, which gives the spool 184 more holding power than would be present in a spool with a circular profile.

Note that the spool or capstan 184 could have a completely circular profile, a hexagonal profile, or other profiles. As the number of sides in a polygonal profile increases, the profile approaches that of a circular profile, with a consequent reduction of the braking force of the capstan 184 on the cord 122. To counter this effect, it is possible to texture the surface of the capstan 184 (such as by knurling or sandblasting the surface), but this tends to increase the cord wear significantly. Alternatively, the number of surfaces in the profile may be decreased such that the angle over which the cord 122 must wrap increases. For the octagonally-profiled capstan 184, the cord wraps around eight (8) 45 degree angles, which provides more braking power than wrapping over a smooth, circular-profiled capstan. Reducing the number of surfaces, for example, to a square-profiled capstan (resulting in four 90 degree angles), or to a triangularly-profiled capstan with three 120 degree angles, results in more braking power but also a higher probability of wear and fraying of the drive cord 122.

Several materials may be used for the manufacture of the roller lock 132, including, but not limited to, die cast aluminum or zinc, brass, and stainless steel. However, it is important that the coefficient of friction between the drive cord 122 and the capstan 184 be repeatable (consistent). In the preferred embodiment, the material chosen is Ultem, a very high strength polyetherimide plastic (Ultem is a Registered Trademark of GE Polymers), for its good (not necessarily low) coefficient of friction, repeatability, and low cost relative to many metals. Rather than using a low-coefficient-of-friction material for the roller lock 132 (which would work against the braking objective of the capstan 184 against slippage of the cord 122), the material of the housing 130 may be chosen to have the low coefficient of friction to provide minimal frictional losses between the roller lock 132 and the housing 130. Another advantage to Ultem is that it does not discolor the drive cord.

The drive cord 122 extends down from the drive cone 124 to the capstan 184 and then is wrapped around the capstan or spool 184 (typically up to four times, most likely only two or three times) around the middle, "octagonal" portion of the capstan 184, and then extends down from the capstan 184, terminating in the tassel weight 106, as shown in FIG. 1. As one pulls on the tassel weight 106 of the drive cord 122 to raise the window covering product 100, the drive cord 122 has a tendency to "walk" along the length of the capstan 184 as it causes the capstan 184 to rotate. To minimize this tendency and to deal with it, the ramped or tapered sides 196 of the capstan 184 preferably are steep enough to cause the wraps to slide down, away from the sides 196 and onto the octagonal portion 194, but not so steep so as to cause an over-wrap condition. Generally, the ramped sides 196 should form an angle of between 15 and 60 degrees with the axis of rotation 198 of the roller lock 132, and preferably between 30 and 45 degrees.

Figure 14:
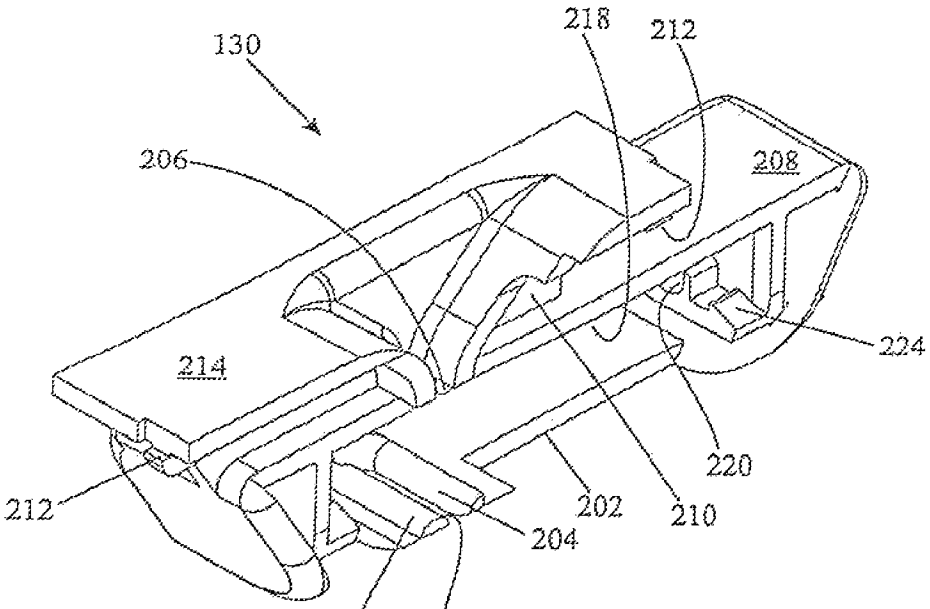
FIG. 14 is a perspective view of the main housing of the roller lock mechanism of FIG. 13.

Referring to FIGS. 13 and 14, the roller lock housing 130 serves the multiple functions of mounting the roller lock mechanism 104 onto the head rail 108, providing a lower drive cord inlet location for the free end of the drive cord which is advantageous to the operation of the roller lock 132, providing an upper drive cord inlet location which is advantageous to the operation of both the roller lock 132 and the cone drive 126, and providing support for rotation of the roller lock 132 about its axis of rotation 198 while allowing the axis of rotation 198 to shift vertically. In addition, the housing 130 locks the roller lock 132 against rotation when the axis of rotation 148 of the roller lock 132 has shifted to its upper position, as is explained in more detail below. Finally, the housing 130 takes up the thrust loads generated and transmitted to the roller lock 132 by the cord wraps sliding down the ramped surfaces 196 of the capstan 184.

Referring to FIG. 14, the roller lock housing 130 includes a lower slotted opening 200 on its lower wall 202, through which the drive cord 122 passes in and out from the roller lock 132 to the tassel weight 106. This lower slotted opening 200 has generous radii 204 both above and below the wall 202 to avoid fraying the drive cord 122. The slotted opening 200 also allows the operator to pull on the drive cord 122 either straight down, or at an angle away from the window covering product 100.

As seen in FIG. 17, the slotted opening 200 places the drive cord 122 adjacent to the left tapered side 196 of the capstan 184, so that, as the drive cord 122 wraps onto the capstan 184 from the free end of the cord 122, the wraps are preferentially formed on the left tapered side 196 and then slide down to the right, onto the octagonal portion 194 of the capstan 184.

Referring again to FIG. 14, the roller lock housing 130 also includes an upper slotted opening 206 on its upper wall 208, through which the drive cord 122 passes between the capstan 184 and the drive cone 124. The upper slotted opening 206 flares out to a mounting platform 214 designed to go through an opening 209 (See FIG. 16) in the head rail 108, and engage the head rail 108, snapping in place with the aid of the vertical wall 210 and the ears 212 projecting from the platform 214. This upper slotted opening 206 locates the exit area of the drive cord 122 from the capstan 184 and, at the same time, serves to locate the feed point (fixed emanation point) of the drive cord 122 onto the guide surface 144 of the cone drive 102, as seen in FIGS. 17A, 17B, and 17C.

Figure 17B:
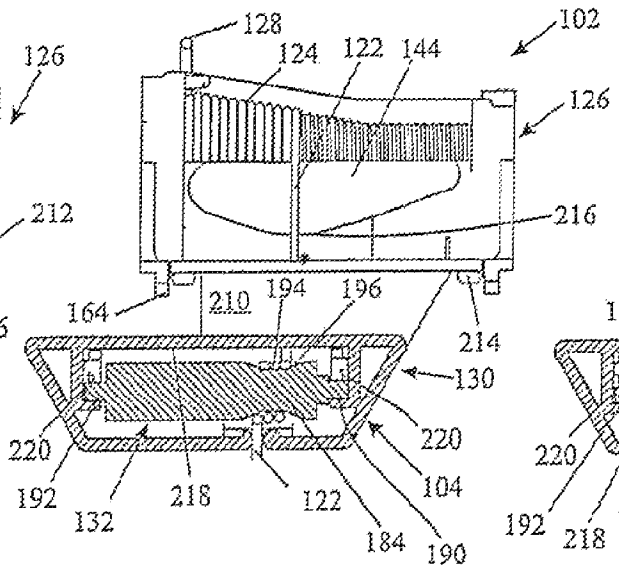
FIG. 17B is the same as FIG. 17A but showing the drive cord wrapped further along the drive spool.
Figure 17A:
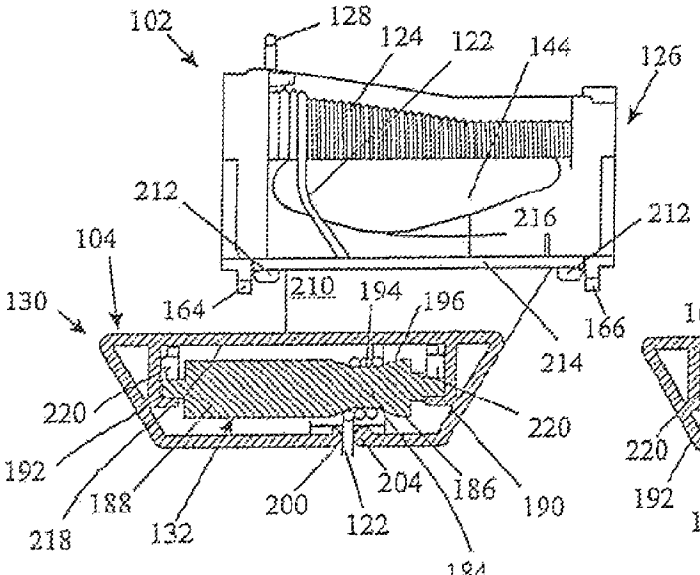
FIG. 17A is the same as FIG. 17 but showing the drive cord wrapping around the roller lock mechanism and just starting to wrap onto the drive spool.

While this upper slotted opening 206 is not shown in FIGS. 17A, 17B, and 17C, it is located such that it is axially aligned with the point 216 (See FIG. 17B) of the guide surface 144 (Note that the term "axially aligned with the point" means that it lies on a plane that is perpendicular to the axis and includes the point.). The point 216 is where the guide surface 144 projects radially outwardly the farthest from the axis of the drive spool. This upper slotted opening 206 is also axially aligned with the point at which the octagonal surface 194 of the capstan 184 intersects with the right tapered side 196 of the capstan 184 so that, when the drive cord 122 is unwrapping from the drive cone 124 and wrapping onto the capstan 184, the wraps form onto the right tapered side 196 and then slide down leftwardly, onto the octagonal portion 194 of the capstan 184, with each new wrap pushing the previous wrap to the left as it slides down the tapered side 196, thereby preventing over-wraps. So, as the cord wraps onto the capstan 184 from its free end, where the tassel weight 106 is located, it wraps onto the left end of the capstan 184, and, as the cord 122 wraps onto the capstan 184 from the drive cone 124, it wraps onto the right end of the capstan 184.

Figure 16A:
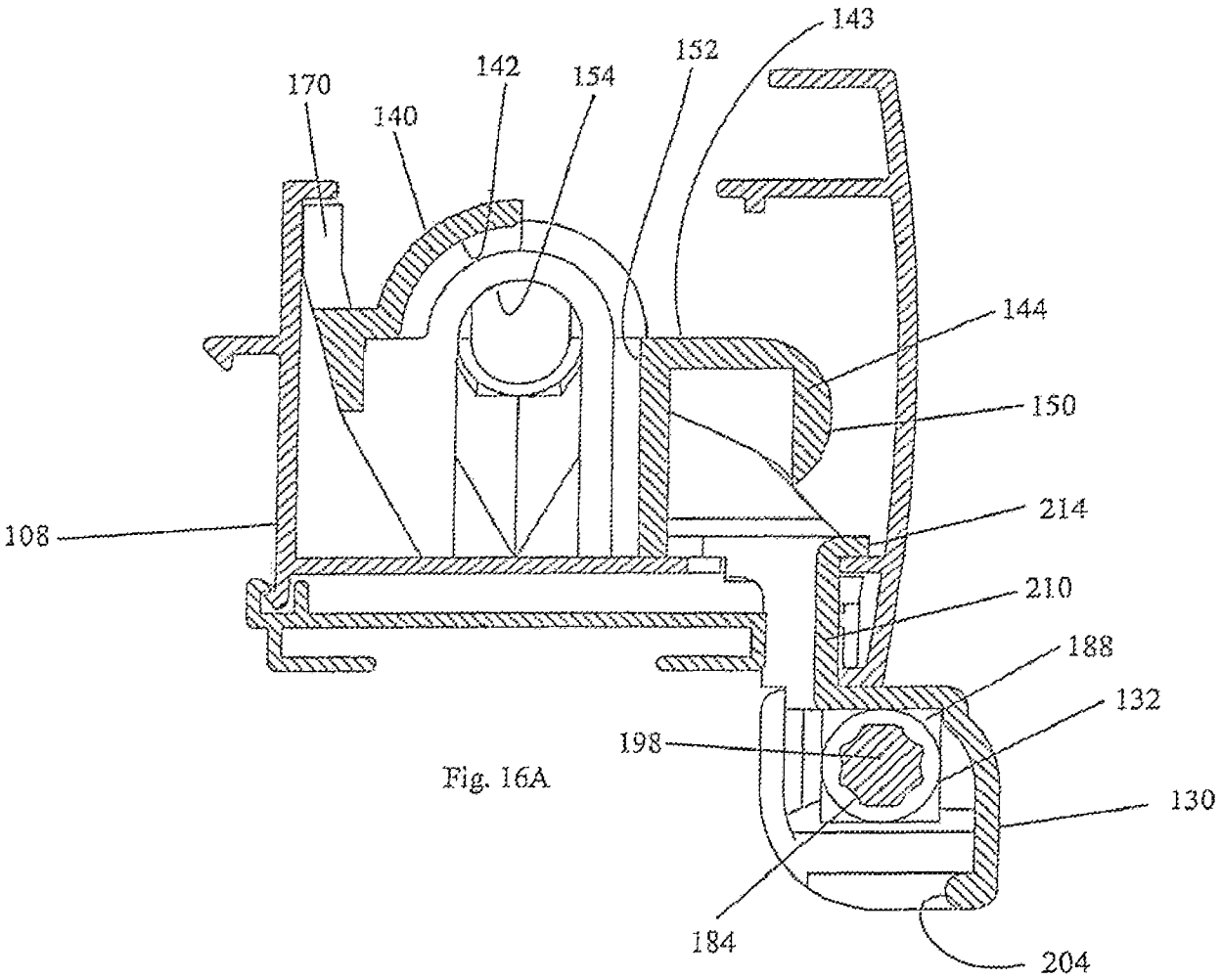
FIG. 16A is similar to FIG. 16 but depicting the roller lock in the non-rotating position.

The roller lock housing 130 forms a rectangular cavity 218 to accommodate the roller lock 132 (See FIG. 17), with vertically-elongated, slotted pockets 220 at each end, which receive the axle ends 190, 192 of the roller lock 132. Both of the slotted pockets 220 allow the ends 190, 192 of the roller lock 132 to shift upwardly, so the roller lock 132 is able to shift vertically up or down along these slotted pockets 220 from a first, lowered position, in which the roller lock 132 is free to rotate, to a second, raised position, parallel to the first position, but in which the roller lock 132 abuts a stop which restricts it from rotating. When the roller lock shifts vertically upwardly along the slotted pockets 220, shifting the axis 198 of the roller lock 132 upwardly, parallel to itself, as shown in FIG. 16A, then the square-profiled portions 186, 188 of the roller lock 132 impact against the upper inside wall of the cavity 218, which serves as a stop, preventing the roller lock 132 from rotating relative to the housing 130. The purpose for mounting the roller lock 132 for selective rotation, in which it is allowed to rotate freely in one position and is prevented from rotating in the other position is explained later.

Looking at FIG. 13, the cover 134 ensures that the roller lock 132 does not fall out of the cavity 218. The hooks 222 on the cover 134 engage the inner ends of the ramps 224 of the housing 130 (seen best in FIG. 14) to snap the cover 134 to the housing 130. The projections 226 on the cover 134 cooperate with the housing 130 (See also FIG. 18) to complete the slotted openings 220, along which the axles 190, 192 slide vertically from the lower, freely-rotating position to the upper, restricted (or locked) position.

FIGS. 19 through 22 depict in detail the tassel weight 106 of FIG. 1. As may be appreciated from FIG. 20, the tassel weight 106 includes the weight itself 230 and the cover 232, which encloses the weight 230. The weight 230 is ellipsoid in shape and typically metallic, weighing between two and four ounces in the present embodiment. The upper end 234 has some of the material removed to create a cavity 236. A countersunk opening 238 in the side of the weight 230, proximate the upper end 234, connects to the cavity 236. The end of the drive cord 122 (not shown in this view) is threaded through the cavity 234 and into the countersunk opening 238. An enlargement, such as a knot, is tied to the end of the drive cord 122 and is trapped in the countersunk opening 238, unable to be pulled through the small passage between the countersunk opening 238 and the cavity 236, thereby securing the drive cord 122 to the weight 230.

Figure 22:
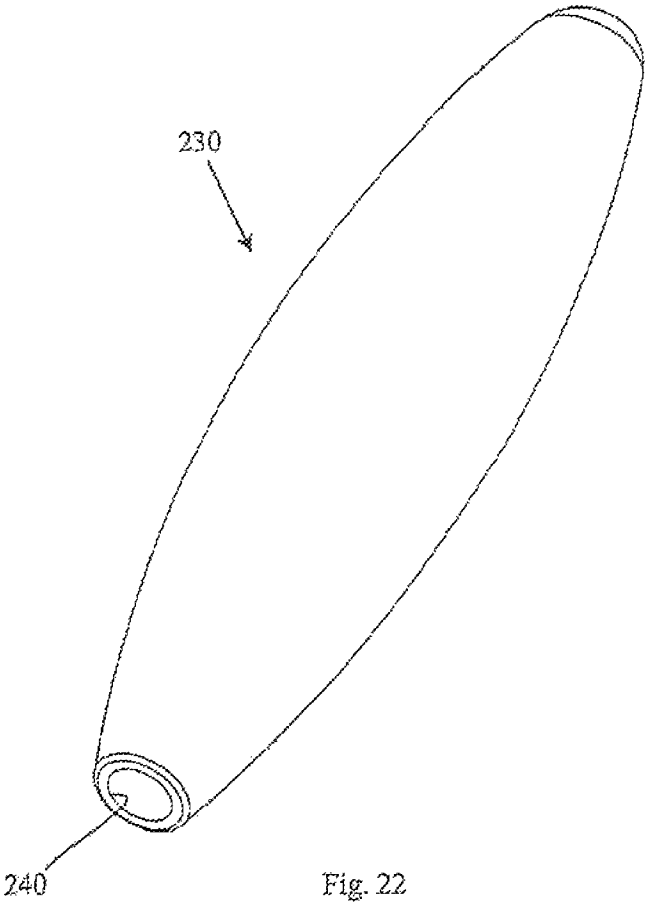
FIG. 22 is a perspective view of the cover portion of the roller lock tassel weight of FIG. 20.
Figure 21:
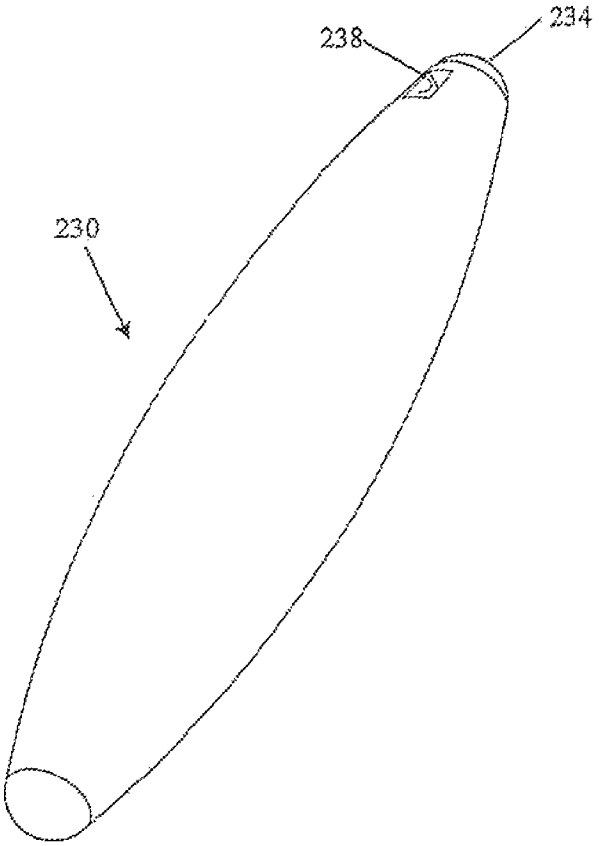
FIG. 21 is a perspective view of the weight portion of the roller lock tassel weight of FIG. 20.

Referring to FIG. 22, the cover 232 has the same general shape as the weight 230 but is hollow. The cover 232 is made from a soft, low durometer material such as a soft rubber, and has one open end 240 and a small through opening 242 at the opposite end. The cover 232 is installed over the weight 230 as a sock is installed over a foot. The soft cover 232 helps protect fragile surfaces, such as window panes and glass tabletop surfaces from accidental damage from the hard metal weight 230. The end of the drive cord 122 is threaded through the top opening 242 and then is tied off to the weight 230 as has already been described.

FIGS. 77-82 depict an alternative embodiment of a weight 230' and cover 232'. In this embodiment, the weight 230' (See FIGS. 77-79) has a bore 236' extending the full length of the weight 230' and a countersunk bore 238' at its lower end to accommodate a knot or other enlargement of the drive cord 122 as it is tied off to the weight 230'.

Figure 81:
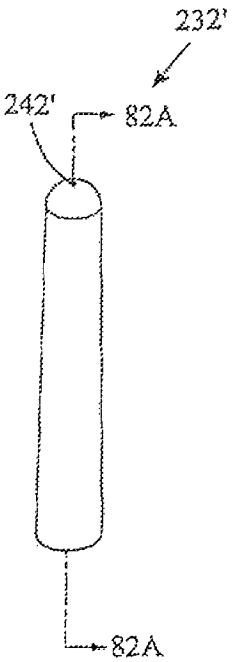
FIG. 81 is a perspective view, from a different angle, of the tassel weight cover of FIG. 80.
Figure 80:
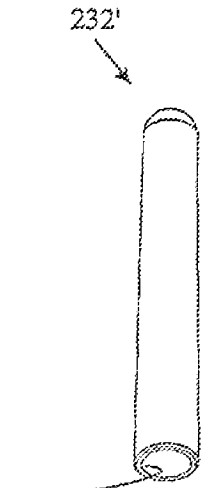
FIG. 80 is a perspective view of an alternate embodiment of a cover for a tassel weight.
Figure 82A:
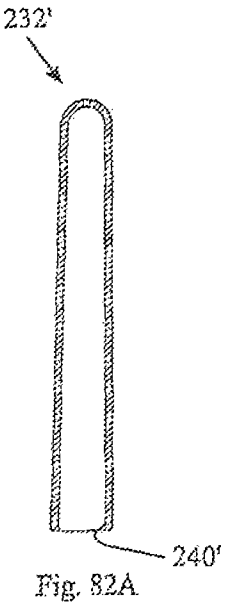
FIG. 82A is a sectional view along line 82A-82A of FIG. 81.
Figure 82B:
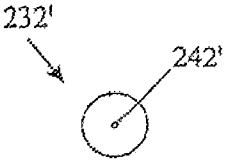
FIG. 82B is a top view of the tassel weight cover of FIG. 80.
Figure 82D:
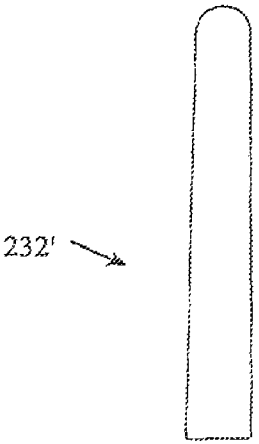
FIG. 82D is a side view of the tassel weight cover of FIG. 80.
Figure 82C:
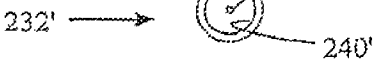
FIG. 82C is a bottom view of the tassel weight cover of FIG. 80.

Referring to FIGS. 80-82, the cover 232' has the same general shape as the weight 230' but is hollow, is made from a soft, low durometer material such as a soft rubber, and has one open end 240' and a small through opening 242' at the opposite end. The cover 232' is installed over the weight 230' in the same manner as the cover 232 is installed over the weight 230 described above.

FIGS. 162-164 depict an alternative embodiment of a tassel weight 230" and a tassel plug 1214. This embodiment 230" allows for a quick and easy adjustment of the length of the drive cord 122 and ensures that the drive cord 122 will not slip through the weight 230". This is accomplished through the use of the tassel plug 1214, shown in detail in FIG. 163.

The tassel plug 1214 includes a spool portion 1216 characterized by two end flanges 1218, 1220, and a semi-cylindrical portion 1222 extending axially upwardly from the second flange 1220. This semi-cylindrical portion 1222 defines three radially-extending through holes 1224, 1226, 1228. The drive cord 122 is threaded through the first hole 1224, then threaded back through the middle hole 1226, and finally threaded forward through the last hole 1228. Before tightening the drive cord 122 onto the tassel plug 1214, the end of the cord 122 is fed through the loop 1230 formed by the cord 122 as it exits the first hole 1224 and turns to enter the second hole 1226. Once the drive cord 122 is tightened against the tassel plug 1214, the cord 122 holds tight to the tassel plug 1214, and no slippage of the cord 122 occurs.

FIG. 163A shows an alternate routing of the cord 122 in order to form a different knot to secure the cord 122 to the tassel plug 1214. This knot is very similar to the knot depicted in FIG. 163, except that one more loop is added. As the cord 122 exits the loop 1230, it is routed back around so that it goes through the loop 1230 a second time. This holds the cord 122 even more tightly to the plug tassel 1214.

As may be appreciated in FIG. 164 (where the drive cord 122 has been removed for clarity), the weight 230" defines a through cavity 236" and a countersunk hole 238", similar to the weight 230' shown in FIG. 79A. The countersunk hole 238" snugly receives the semi-cylindrical portion 1222 of the tassel plug 1214. A second, larger countersunk hole 239" receives the spool portion 1216 of the tassel plug 1214. Note that any excess length of the drive cord 122 can be wound around the spool portion 1216 such that the cord 122 is available in case it needs to be lengthened, yet it does not extend beyond the weight 230".

The installation of the cover 232' onto the weight 230" can be facilitated by using pressurized air and a jig as shown in FIGS. 165-168. In a preferred embodiment, the weight 230" is modified to have a plurality of flutes or slots 1232 which extend longitudinally along the outside surface of the weight 230". These flutes 1232 extend approximately two thirds of the length of the weight 230", starting at the top. Four of these flutes 1232, equidistantly spaced from each other, have been found to be sufficient.

A bottom jig 1234 defines a hole 1236 for securing the jig 1234 to a base via a screw. The bottom jig 1234 also includes a projection 1238 to locate and close off the bottom end of the countersunk hole 239" (seen in FIG. 164), and at the same time support the weight 230" in an upright position as shown in FIG. 166.

A top jig 1240 defines a cylindrical cavity to receive the top end of the cover 232'. A through opening 1242 connects to the inside of this cylindrical cavity and lines up with the hole 1244 at the top end of the cover 232'. The top jig 1240 is threaded (or otherwise modified) at the through opening 1242 to receive a line of pressurized air (not shown). This line of pressurized air preferably includes controls to regulate the amount and the pressure of the pressurized air admitted through the opening 1242.

The operator places the cover 232' over the top of the weight 230" which is resting on the bottom jig 1234. The operator then presses the cover 232' down as far as it will go. The operator then places the top jig 1242 over the top of the cover 232' and connects the pressurized air line at the hole 1242 of the jig 1240. Pressurized air is admitted through the hole 1242 in the jig 1240 and through the hole 1244 in the cover 232', passing along the flutes 1232. Any air that enters the central opening 236" cannot escape through the bottom of the weight 230", because the bottom opening 239" is blocked by the bottom jig 1234. The air therefore passes along the flutes 1232 and pressurizes the cover 232', expanding it enough that the operator can easily push it further until it fully envelops the weight 230", as shown in FIG. 167. The top jig 1242 not only directs the pressurized air to the inside of the cover 232'; it also secures the top end of the cover 232' and provides a means for pushing down on the cover 232' without squeezing the sides of the cover 232', which would deter from the smooth gliding of the cover 232' over the weight 230". The flutes 1232 provide even air distribution around the outside surface of the weight 230" to assist in the smooth gliding of the cover 232' over the weight 230". The flutes 1232 may extend into the central opening 236" of the weight, if desired; however it is not necessary.

Once the cover 232' is installed over the weight 230", the top jig 1240 is removed and the weight 230" is also removed from the bottom jig 1234 as shown in FIG. 168.

Assembly:

Having described the individual components, the assembly of the cone drive 102 with roller lock mechanism 104 and tassel weight 106 is as follows (with reference to FIGS. 1 and 11-22):

One end of the drive cord 122 is tied off to the drive cone 124 at the countersunk opening 182 shown in FIG. 13, and the cord 122 is then wrapped onto the drive cone 124. The drive cone 124 is snapped into its housing 126, with the drive cord 122 leaving the housing 126 through the opening defined between the upper wall 140 and the second interconnecting wall 143. The drive cone 124 is oriented so that the slotted notch 180 is aligned with the opening 172 in the housing 126, and one leg of the assembly-assist lever 128 is then inserted to lock the cone 124 against rotation relative to the housing 126. The housing is then mounted onto the head rail 108 at the opening 209 by engaging the feet 164, 166 through the opening 209 and snapping the ears 168, 170 into the profile of the head rail 108, as shown in FIG. 16.

The drive cord 122 is then wrapped several times (typically between two and four times) around the capstan 184, and the roller lock 132 is then assembled onto its housing 130, and the cover 134 is snapped in to hold the roller lock 132 in place, making sure that the drive cord 122 is properly threaded through both the upper 206 and lower 200 slotted openings.

The assembled roller lock mechanism 104 is then mounted through the opening 209 in the head rail 108, where it snaps into place and thus provides a pathway for the drive cord 122 from inside the head rail 108 to the outside. The free end of the drive cord 122 is then tied off to the tassel weight 106 as has already been described, with the tassel weight 106 at a height which is convenient for the operator.

The rest of the window covering is assembled as already known in the industry. One end of the lift rod 118 is inserted into the hollow axle 158 of the cone 124. The internal, non-circular profile 178 of the axle 158 matches that of the lift rod 118 so that, as the lift rod 118 rotates, so does the cone 124 and vice versa. The lift stations 116 are mounted on the head rail 108 and also are connected to the lift rod 118 such that, when the lift rod 118 rotates, so do the lift drums of the lift stations 116, and vice versa. The lift cords 114 (which are the driven cords in this embodiment, driven by the drive spool 124) are connected to the lift drums of the lift stations 116 at one end, and to the bottom rail at the other end, such that, when the lift drums rotate in one direction, the lift cords 114 wrap onto the lift drums and the window covering 100 is raised, and when the lift drums rotate in the opposite direction, the lift cords 114 unwrap from the lift drums and the window covering 100 is lowered. Once the mechanism is assembled, the locking lever 128 is removed, enabling the drive cone 124 to rotate so the mechanism can function.

Alternate Assembly:

An alternate and preferred method of assembly is practically identical to that described above, except that the drive cord 122 is not wrapped onto the drive cone 124 at the outset. Instead, the drive cord 122 is left unwrapped from the drive cone 124, and the assembly is connected as described above, with the main difference being that the window covering is in the fully raised position (and thus the lift cords are wound up fully on the lift spools of the lift stations 116). Once assembled, the locking lever 128 is removed, the window covering is fully lowered and, as it lowers, the drive cord 122 wraps onto the drive cone 124 for the first time.

The practical effect of this alternate assembly method is that maximum use is made of the leverage offered by the larger diameter of the frustroconical portion 176 of the drive cone 124 for all lengths of window coverings. For instance, for a relatively short window covering, the number of wraps of the drive cord 122 on the drive cone 124 may be such that all the wraps lie on the frustroconical portion 176, even when the window covering is in the fully lowered position. Less force (albeit over a longer stroke) is thus required to raise the window covering than if the drive cord 122 had been wrapped onto the full length of the drive cone 124 when the window covering was in the fully lowered position (as described in the first assembly method) and the drive cord 122 started unwinding from the cylindrical portion 174 of the drive cone 124. Note that this alternate method of assembly may also apply to all other embodiments of a cone drive assembly disclosed in this specification.

Operation:

As the operator pulls on the tassel weight 106 with enough force to begin raising the window covering, he pulls the roller lock 132 down so that it is in its lowered position within the cavity 218, in which it is able to rotate freely about its axis of rotation 198, as seen in FIG. 16. Pulling further on the tassel weight 106 causes the roller lock 132 to rotate as the drive cord 122, which is wrapped around the capstan 184, tightens around the capstan 184 and forces it to rotate. As the capstan 184 rotates, existing wraps of drive cord 122 on the capstan 184 come off the capstan 184 at the left end (from the perspective of FIG. 17), while new wraps are formed on the capstan 184 on the right end as the drive cord 122 unwraps from the drive cone 124, so the roller lock 132 rotates freely, presenting no opposition to raising the window covering (or to moving the covering opposite to the direction in which it would be moved by the force of gravity). The unwrapping of the drive cord 122 from the drive cone 124 causes rotation of the drive cone 124, and consequent rotation of the lift rod 118 and thus also rotation of the lift drums of the lift stations 116. As the drive cord 122 unwraps from the drive cone 124, the lift cords (driven cords) 114 wrap onto their respective lift drums, raising the bottom rail 110 of the window covering.

The force of gravity is always acting on the window covering, trying to lower the window covering, which would unwrap the lift cords 114 from the lift drums of the lift stations 116, rotating the lift drums and the lift rod 118, rotating the drive cone 124, and causing the drive cord 122 to wrap onto the drive cone 124. As soon as the operator releases the tassel weight 106, the force of gravity comes into play, with the weight pulling on the lift cords 114 causing the lift drums, lift rod, and drive cone 124 to rotate, pulling up on the drive cord 122 and pulling up on the roller lock 132, since the force of gravity of the blind acting to pull the drive cord 122 upwardly is greater than the downward force exerted by the tassel weight 106 (which is typically only 2 to 4 ounces). This causes the drive cord 122 to move upwardly, as it begins to wrap onto the drive cone 124, which causes the roller lock 132 to shift to its upper position, as seen in FIG. 16A. The flat surfaces of the square-profiled portions 186, 188 of the roller lock 132 then impact against the upper wall of the cavity 218, which functions as a stop, and the roller lock 132 is prevented from rotating relative to the housing 130.

In this embodiment, the force of the tassel weight 106 is sufficient to keep the drive cord 122 sufficiently tight around the capstan 184 that the drive cord 122 cannot slip around the capstan 184. Since the roller lock 132 cannot rotate, and the cord 122 cannot slip around the capstan 184, the cord 122 cannot move, and the roller lock mechanism 106 effectively locks the window covering in place at the point where the operator released the tassel weight 106, so the covering does not fall downwardly due to the force of gravity.

The roller lock mechanism 104 is designed to have a locking ratio of tassel weight 106 to load which is in the range of between 10/1 and 40/1, with the preferred objective being a 25/1 locking ratio. This means that, in the preferred embodiment, given a 4 ounce tassel weight 106, the roller lock mechanism 104 will lock against slippage of an upwardly pulling force of 100 ounces. There is an upper limit, because, as one approaches the higher locking ratios, one impairs the free falling feature of being able to lower the window covering by simply relieving the load (lifting up on the tassel weight 106). At the higher locking ratios, the weight of the cord 122 and the system friction could be enough to inhibit the lowering of the window covering.

As can be seen in FIG. 193 with respect to yet another embodiment of a roller lock braking mechanism, it may be desirable to install roller lock braking mechanisms 104 in series with each other in order to achieve a higher locking ratio. In this instance, the drive cord 122 goes through a first roller lock brake 104' and then through a second roller lock brake 104**", and then downwardly to a tassel weight (not shown). The two roller lock brakes in series function in the same way as a single roller lock except that they lock against slippage against a much larger force for a given tassel weight. For instance, if both of these roller locks 104**' and 104" are designed with a 25/1 locking ratio, and the tassel weight hanging off of the second roller lock 104" is a 4 ounce weight, then, as indicated above, the lower roller lock brake 104**" will lock against slippage of an upwardly pulling force of 100 ounces. This means that the lower roller lock brake 104**" increases the tension of the drive cord on the upper roller lock brake 104**, functioning as if it were a 100 ounce tassel weight hanging off of the upper roller lock brake 104**', thereby increasing the braking force of the upper roller lock brake 104**** so the combined mechanism will lock against slippage of an upwardly pulling force of 2,500 ounces. It also follows that more than two roller lock mechanisms may be installed in series to achieve even higher load-locking capacities, if desired.

Referring back to FIGS. 1 and 13, when the operator wishes to lower the window covering, he may surge the capstan 184 by picking up the tassel weight 106, thus easing up on the force holding the cord 122 tight around the capstan 184. The cord 122 then slips around the capstan 184 as the force of gravity (the load) acting to lower the window covering 100 pulls up on the drive cord 122, causing it to wrap up onto the drive cone 124. As long as the operator is lifting the tassel weight 106, allowing the cord 122 to slip around the capstan 184, the window covering 100 will continue to lower gradually by gravity, wrapping the drive cord 122 onto the drive cone 124 as the lift cords unwrap from their lift drums.

As soon as the operator releases the tassel weight 106 again, the tassel weight 106 again tightens the cord 122 around the capstan 184, locking the window covering in place at the point where the operator released the weight 106. Thus, the operator controls the lowering of the window covering by lifting the weight 106 to allow the covering to lower by gravity and then by releasing the weight 106 to stop the lowering motion.

Only a relatively small force is required to engage the cord 122 onto the capstan 184 such that no slippage occurs. In the present embodiment, a weight of less than 4 ounces can hold the cord 122 taut onto the capstan 184 even against a 15 pound force acting in the opposite direction to lower the window covering. As explained below with respect to a second embodiment involving a locking dog, this is an important consideration, as only a small frictional force is required of the locking dog to hold the window covering locked in place, and this small force is not enough to fray the drive cord 122.

Figure 2:
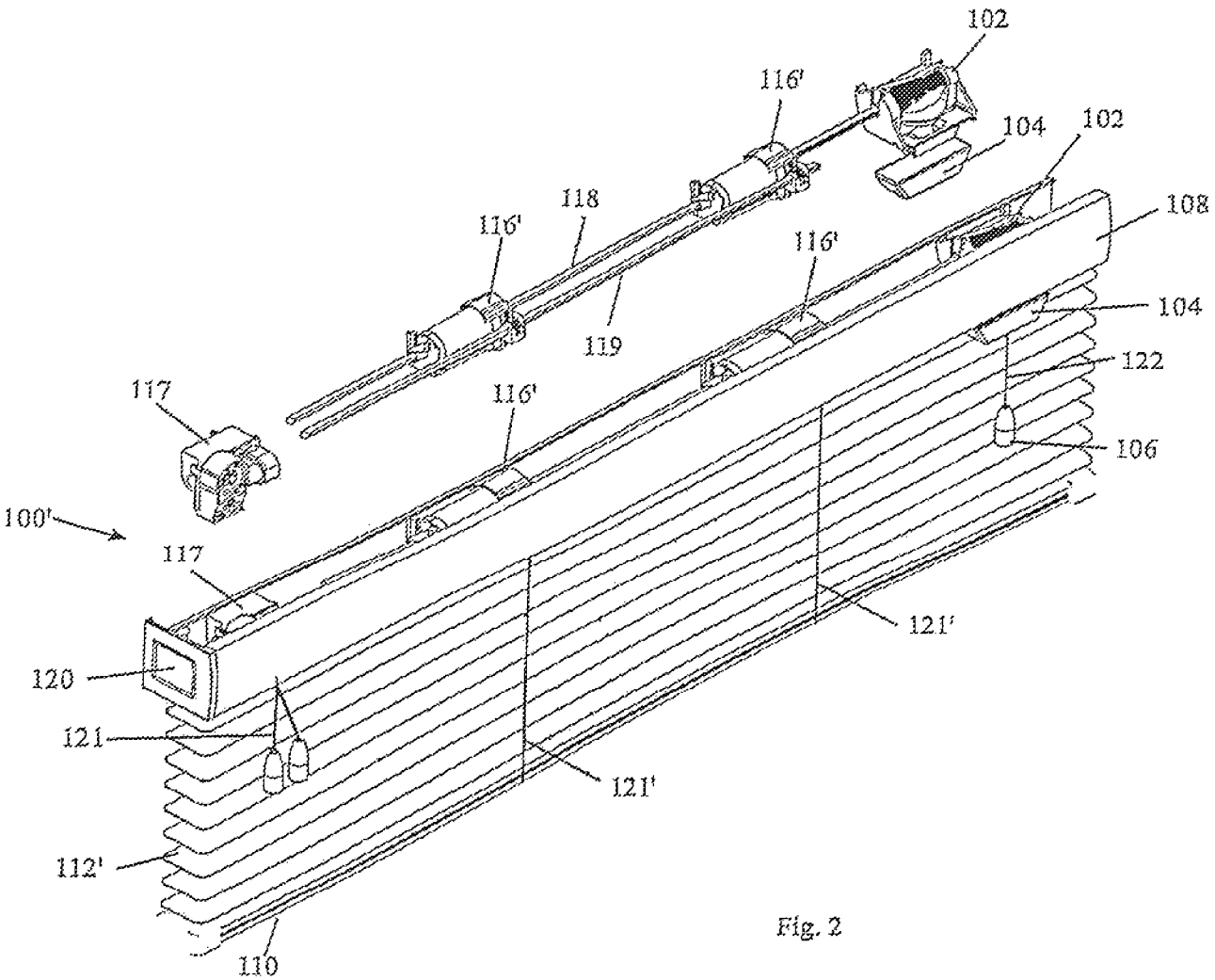
FIG. 2 is a partially exploded, perspective view of a Venetian blind using the cord drive, roller lock mechanism, and tassel weight of FIG. 1.

FIG. 2 shows another embodiment of a window covering 100' made in accordance with the present invention. In this embodiment, the window covering is a blind 100', and it includes elements already described with respect to the cellular product 100, such as the cone drive 102, the roller lock mechanism 104, the tassel weight 106, the lift rod 118 and lift and tilt stations 116' mounted in the head rail 108. This blind also includes a tilter mechanism 117, a tilt rod 119 extending parallel to the lift rod 118, and tilt cords 121. Pulling on the tilt drive cords 121 causes rotation of the tilt rod 119, which raises and lowers tilt cords 121' on the front and back of the slats to tile the slats open and closed, as disclosed in the referenced U.S. Pat. No. 6,536,503, "Modular Transport System for Coverings for Architectural Openings", which is incorporated herein by reference.

The operation of the cone drive 102 with roller lock mechanism 104 and tassel weight 106 in this embodiment is identical to that already described for the cellular product 100.

Figure 3:
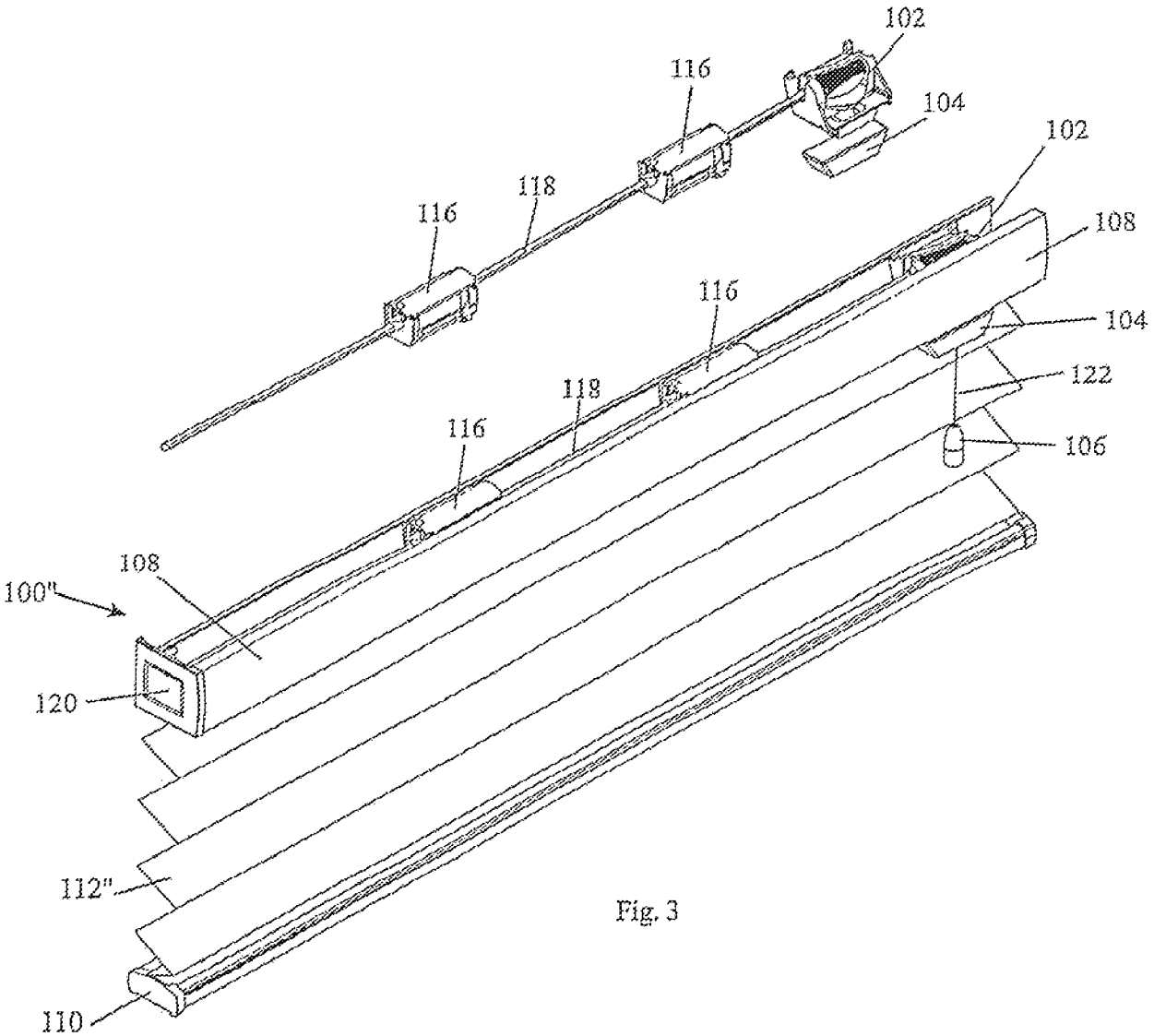
FIG. 3 is a partially exploded, perspective view of a pleated shade using the cord drive, roller lock mechanism, and tassel weight of FIG. 1.

FIG. 3 shows another embodiment of a window covering 100" made in accordance with the present invention. In this embodiment, the window covering is a pleated shade 112", and it includes the same elements already described with respect to the cellular product 100, except that, instead of a cellular shade structure 112, this shade 100" has a pleated shade structure 112". Other than this difference, the pleated shade 100" operates in the same manner as the cellular product 100 described earlier.

Figure 4:
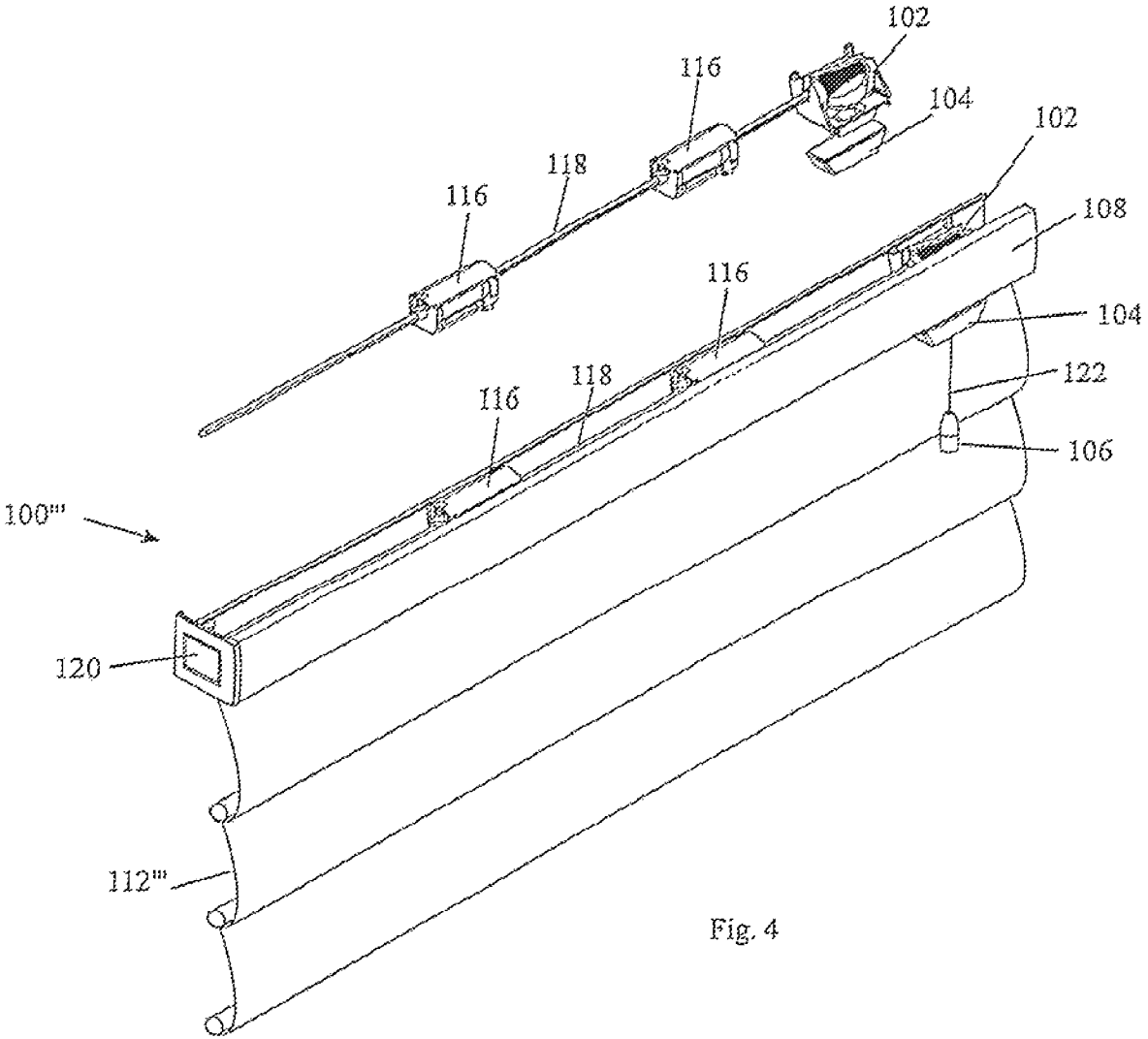
FIG. 4 is a partially exploded, perspective view of a Roman shade using the cord drive, roller lock mechanism, and tassel weight of FIG. 1.

FIG. 4 shows another embodiment of a window covering made in accordance with the present invention. In this embodiment, the window covering 100'" is a Roman shade, and it includes the same elements already described with respect to the cellular product 100, except that, instead of a cellular shade structure 112, this shade 100'" has the characteristic Roman shade structure 112'". Other than this difference, the Roman shade 100'" operates in the same manner as the cellular product 100 described earlier.

Figure 5:
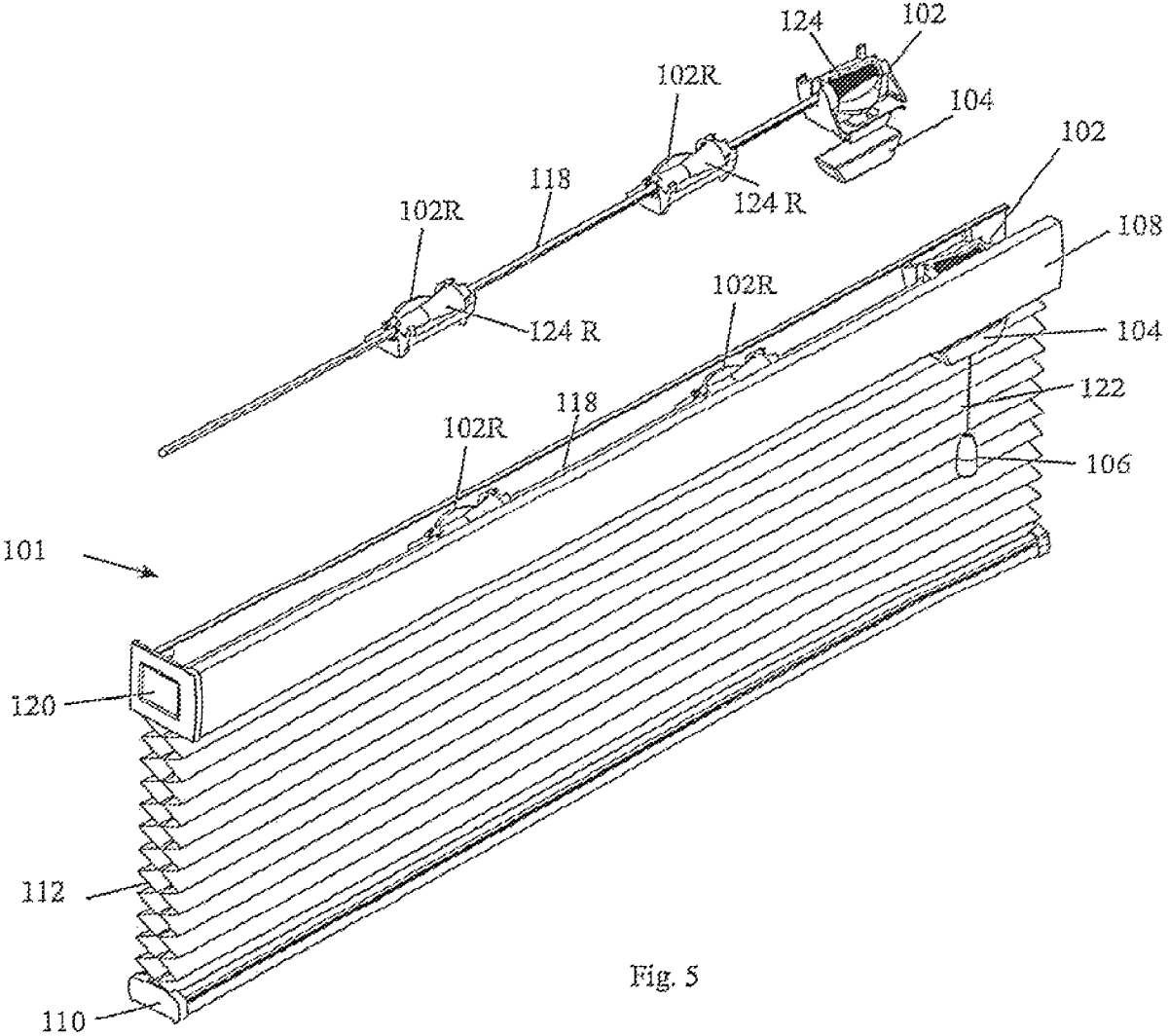
FIG. 5 is a partially exploded, perspective view of a cellular shade, similar to that of FIG. 1, but using a different type of lift station.

FIG. 5 shows another embodiment of a window covering made in accordance with the present invention. In this embodiment the window covering 101 is also a cellular product, and it includes some of the same elements already described with respect to the first covering 100, except that tapered cone drives 102R are used in the lift stations instead of cylindrical spools. The operation of this window covering 101 is quite similar to that described for the first embodiment 100. Note that the cone drives 102R in the lift stations of this embodiment are identical to the cone drive 102 described earlier for the first embodiment, but they are flipped around 180 degrees on the lift rod 118, so their small diameter end faces left rather than right, and they serve as lift stations instead of serving as a cord drive.

In this embodiment shown in FIG. 5, one end of each lift cord 114 (not shown in this view) is secured to its respective lift cone 124R at its respective lift station 102R. In a typical installation, when the window covering 101 is fully lowered, the drive cord 122 is fully (or at least substantially) wrapped onto the drive cone 124 at the right end of the head rail 108 while the lift cords 114 are fully (or substantially) unwrapped from their respective lift cones 124R. The lift cords 114 are wrapped onto their respective lift cones 124R in the opposite direction (counter-wrapped) from the direction in which the drive cord 122 is wrapped onto the drive cone 124, so that, as the operator pulls on the tassel at the free end of the drive cord 122, the drive cord 122 unwraps from the drive cone 124, rotating the lift rod 118 in one direction, and causing the lift cords to wrap up onto their lift cones to raise the blind. Then, as the operator lifts up on the tassel weight, allowing the drive cord 122 to surge the capstan 184, the weight of the blind causes the lift cords 114 to unwrap from their lift cones 124R, rotating the lift rod 118 in the opposite direction, and causing the drive cord 122 to wrap up onto the drive cone 124.

Except for using tapered drives 102R instead of cylindrical drives, this cellular product 101 operates in the same manner as the cellular product 100 described earlier. As will be described later with respect to other embodiments of a cone drive, the drive cone 124 and lift cones 102R need not necessarily have a frustroconical portion 176 and a cylindrical portion 174. The cone may be all frustroconical or may be all cylindrical or it may indeed have other profiles (such as a stepped cylindrical profile or a concave or a convex parabolic profile) in order to obtain the desired combination of stroke and force required to raise or lower the window covering.

Cone Drive, Roller Lock Mechanism, and Locking Dog

Figure 7:
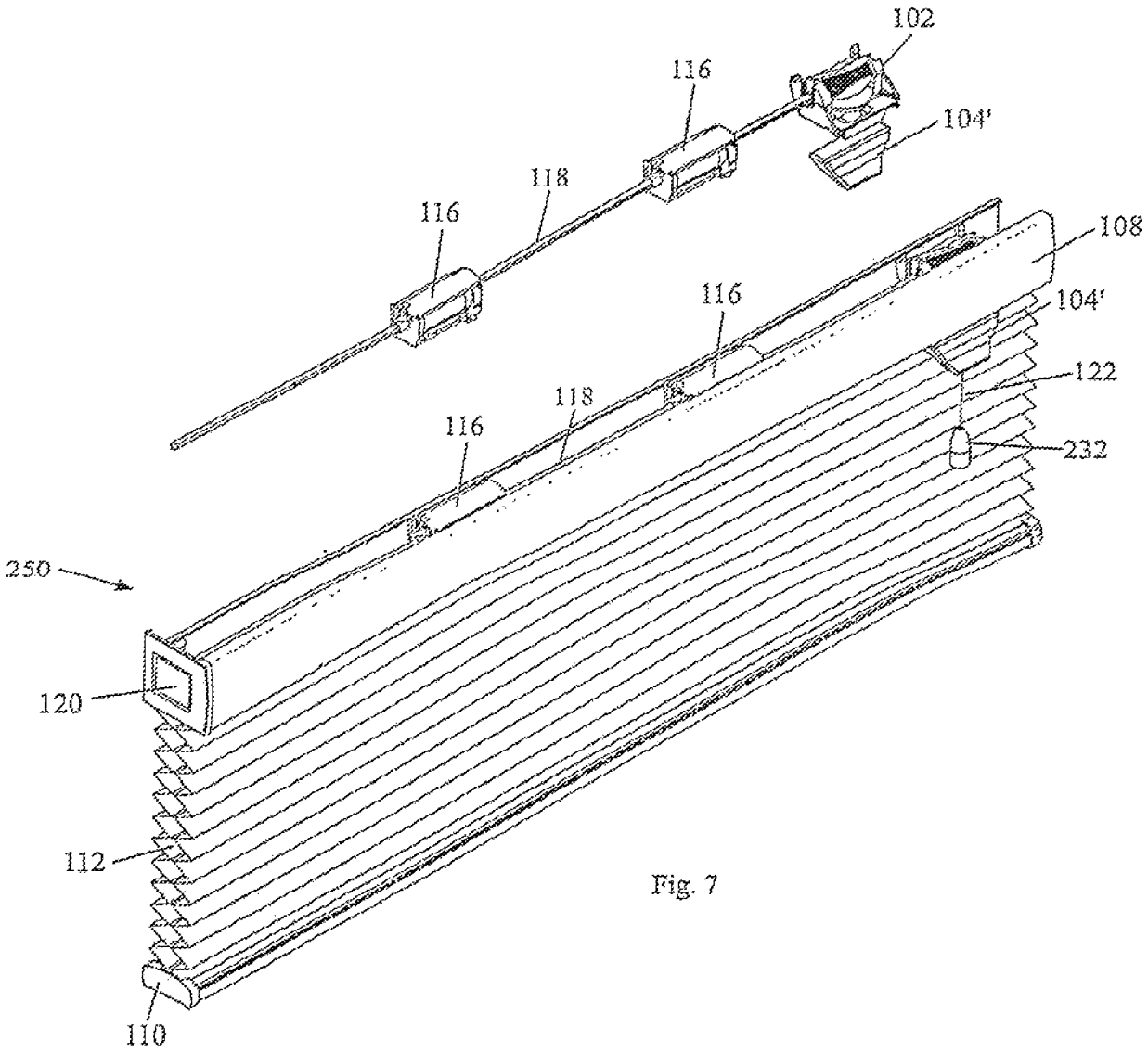
FIG. 7 is a partially exploded, perspective view of a cellular shade incorporating a cord drive with a roller lock and a locking dog mechanism made in accordance with the present invention.

FIG. 7 shows another embodiment of a window covering 250 made in accordance with the present invention. In this embodiment, the window covering is also a cellular product, and it includes the same elements already described with respect to the cellular product 100 of FIG. 1, except that the tassel weight 232 is lightweight, so that its weight is insufficient to prevent the cord from surging the capstan, and the roller lock brake 104' now includes a locking dog in series with it, as described below, which provides the additional tension on the drive cord to prevent the cord from surging the capstan.

Figure 24:
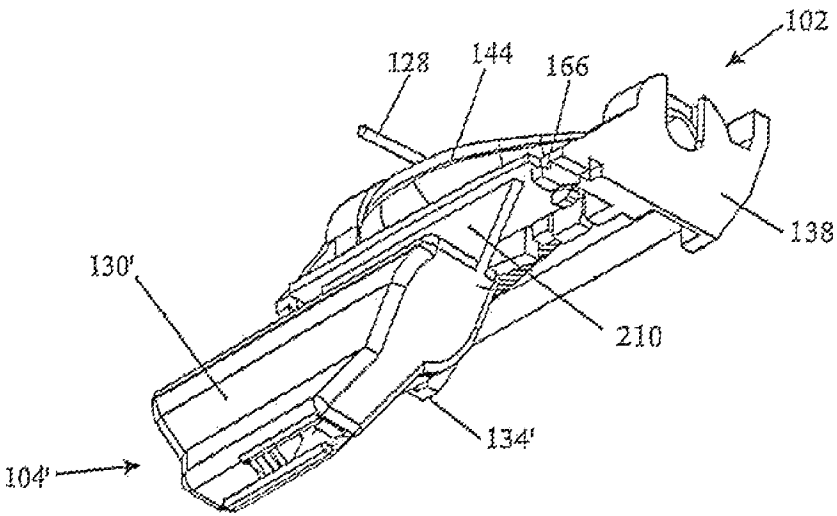
FIG. 24 is a rear perspective view of the cord drive with roller lock mechanism and locking dog of FIG. 23.
Figure 23:
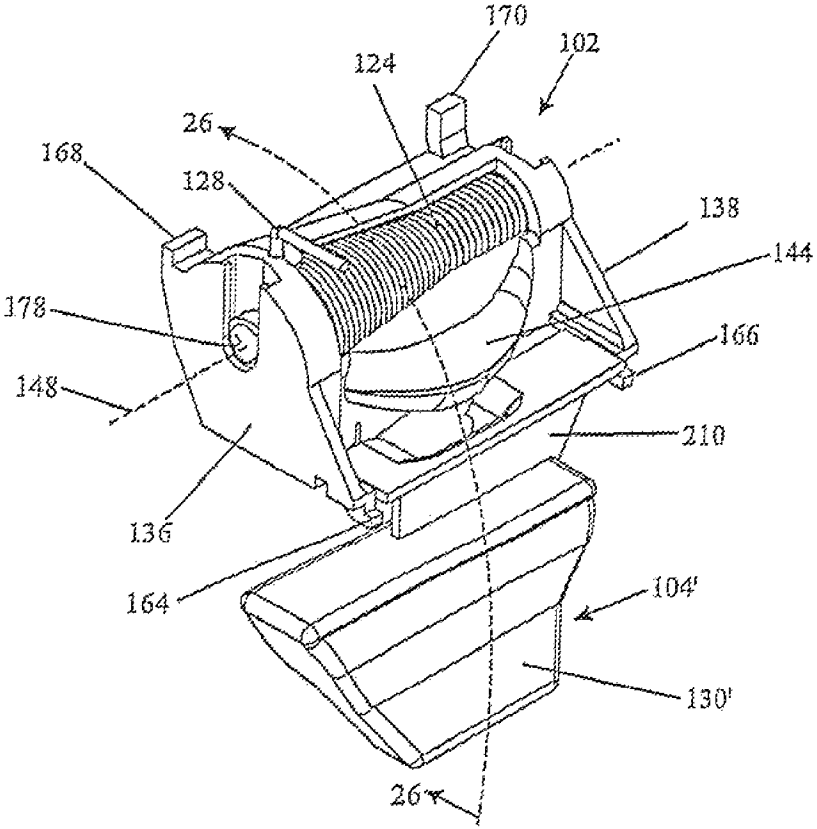
FIG. 23 is a front perspective view of the cord drive with roller lock mechanism and locking dog of FIG. 7 (drive cord removed for clarity)
Figure 25:
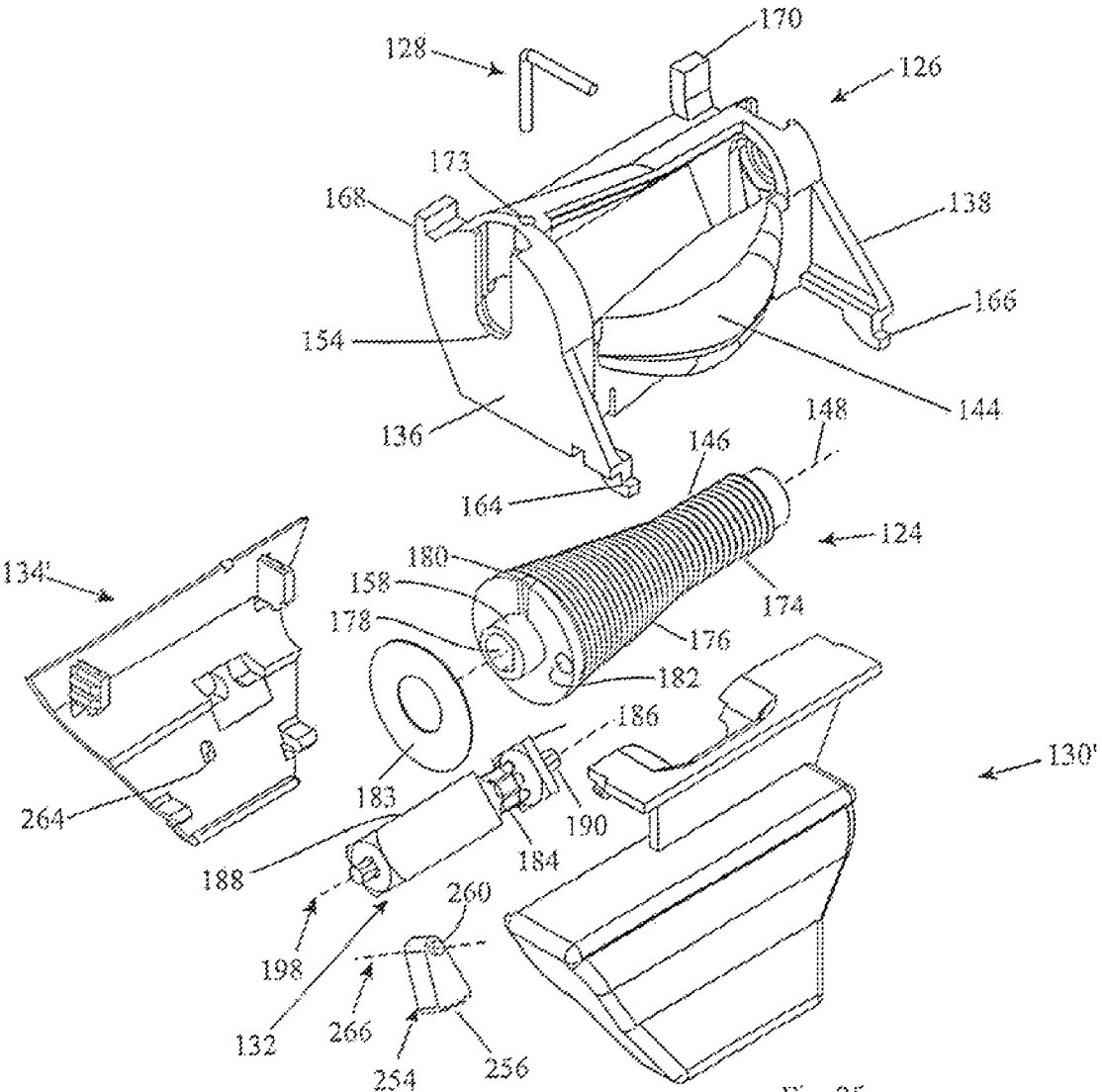
FIG. 25 is an exploded perspective view of the cord drive with roller lock mechanism and locking dog of FIG. 23.
Figure 28:
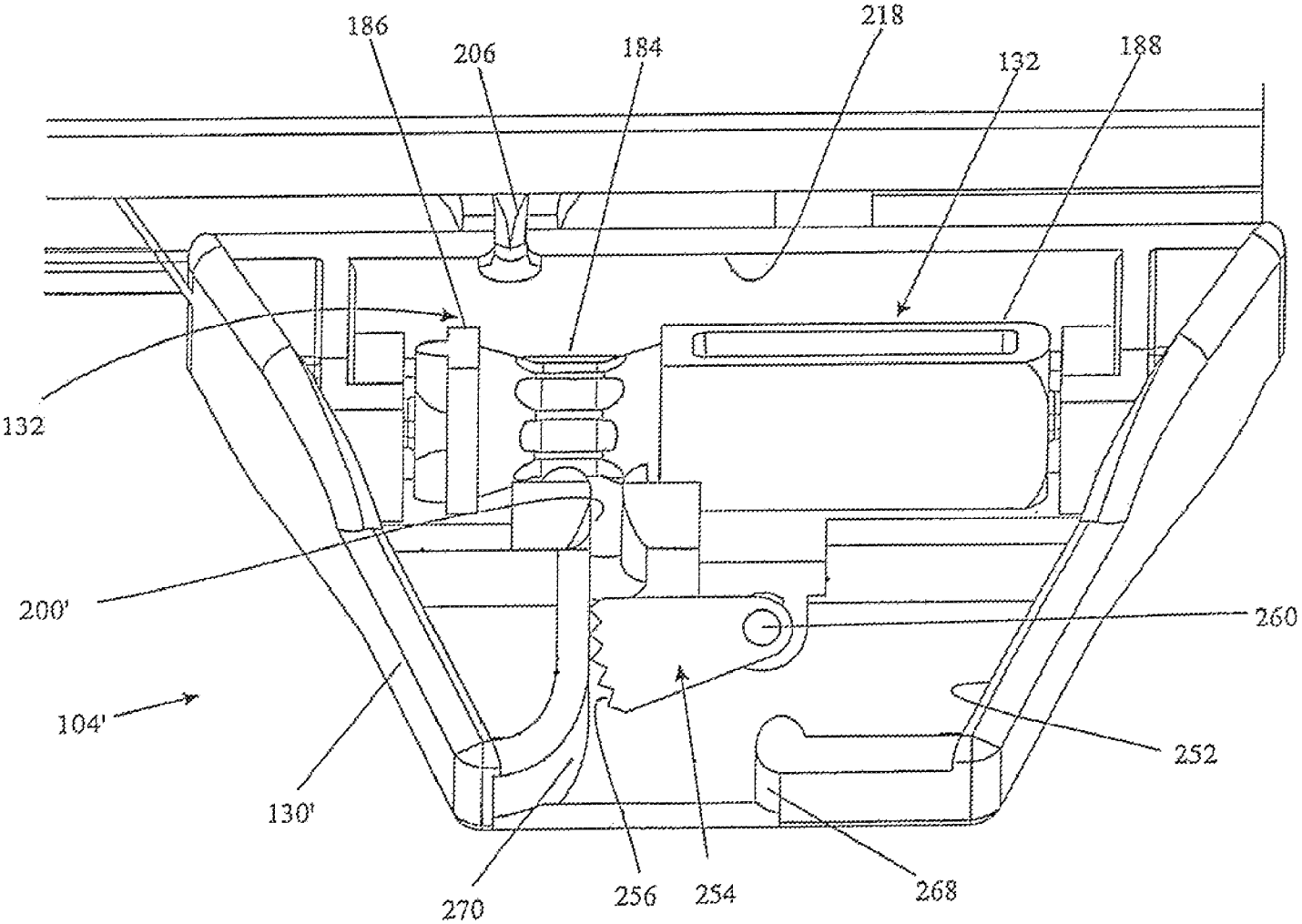
FIG. 28 is the same as FIG. 27 but with the locking dog in the "locked" position.
Figure 29:
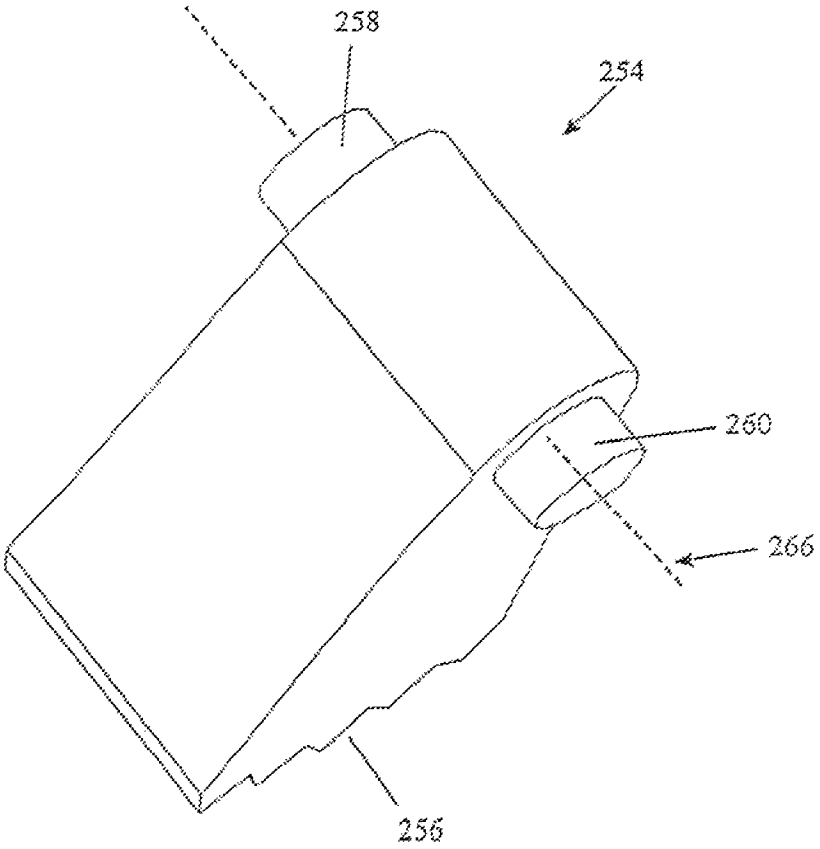
FIG. 29 is a perspective view of the locking dog of FIGS. 24-28.
Figure 31:
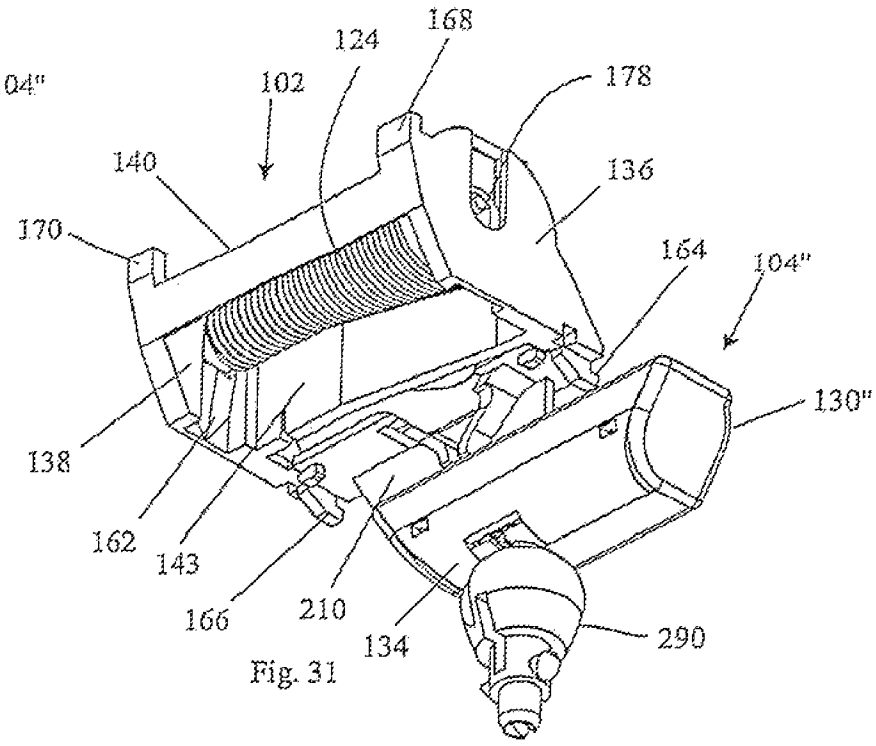
FIG. 31 is a rear perspective view of the cord drive of FIG. 30.

As may be appreciated from FIGS. 23, 24, and 25, the housing 130' and the housing cover 134' of the roller lock mechanism 104' differ from the housing 130 and the cover 134 of the roller lock mechanism 104 of FIG. 13 in that the embodiment of FIG. 23 has an additional cavity 252 (See FIG. 28), appended to the bottom of the roller lock mechanism 104', to house a locking dog 254. The locking dog 254 (See FIG. 29) is wedge-shaped and includes a toothed edge 256 at one end and short axles 258, 260 extending laterally at the other end.

Figure 26:
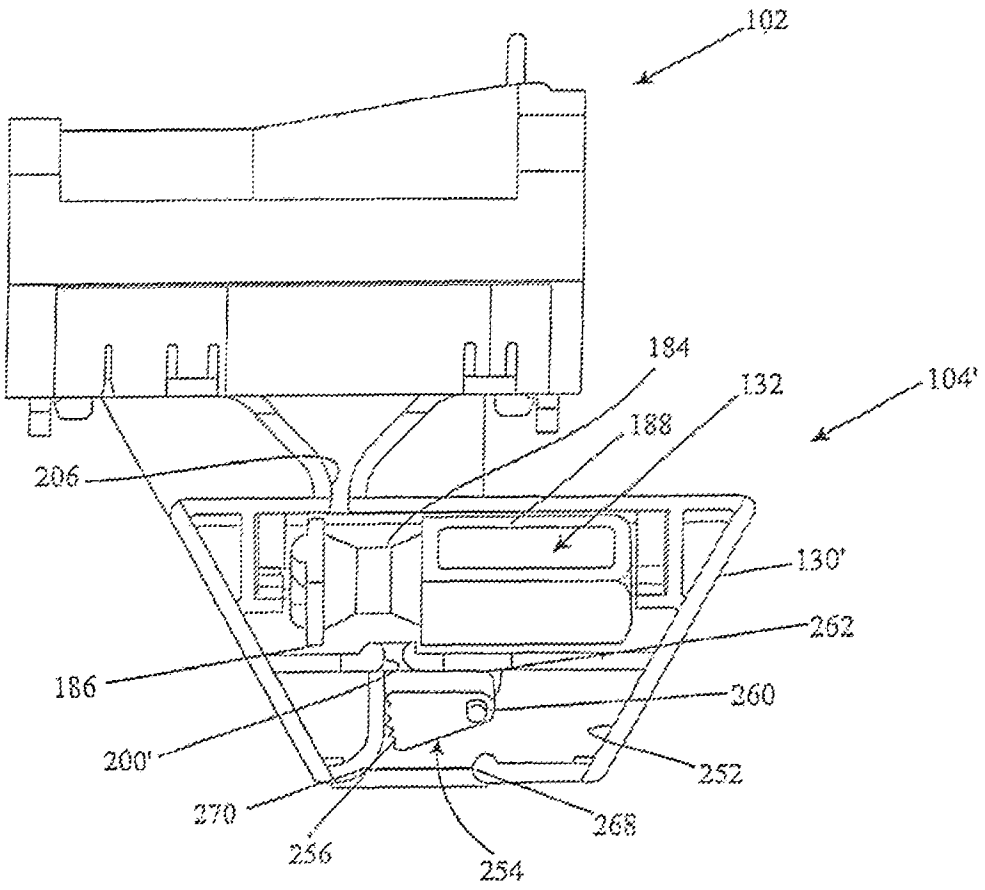
FIG. 26 is a sectional view along line 26-26 of FIG. 23 (cross hatching removed for clarity)

Referring to FIG. 26, the housing 130' defines a hole 262 within the cavity 252. An aligned matching hole 264 is shown in the cover 134' in FIG. 25. These axially-aligned holes 262, 264 receive the axles 258, 260 respectively of the locking dog 254, allowing the dog 254 to rotate about its axis of rotation 266. FIG. 26 shows the locking dog 254 in the locked position, in which it pinches the cord 122 (not shown) against the wall 270.

Figure 27:
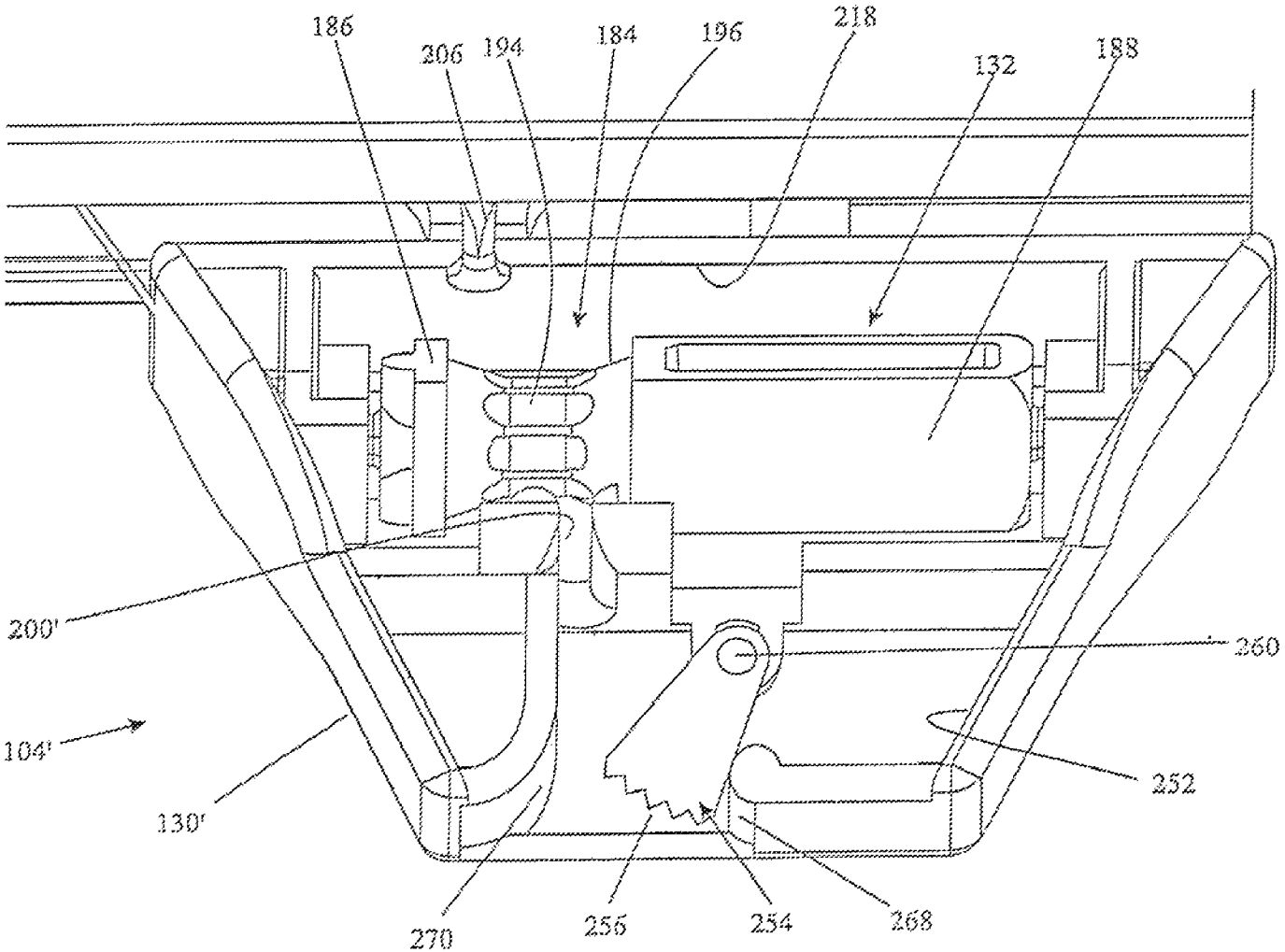
FIG. 27 is an enlarged and detailed, broken away view of the roller lock and locking dog mechanism of FIG. 26, but with the locking dog in the "unlocked" position.

FIG. 27 shows the dog 254 in more detail in the disengaged position, with the dog 254 resting against the generously-radiused drive cord inlet guiding surface 268. A second, generously-radiused drive cord inlet guiding surface 270 also serves to guide the drive cord 122 (not shown in this view) toward the slotted opening 200', which acts to place any incoming wraps of the drive cord 122 onto the tapered surface 196 of the capstan 184, as has already been described.

The operation of the window covering 250 is similar to the operation of the window covering 100 described earlier. If the operator pulls on the drive cord 122, the cord 122 unwraps from the drive cone 124; the roller lock 132 is pulled down to the position where it freely rotates about its axis of rotation 198, the drive cord 122 wraps and unwraps around the capstan 184, and the drive cord 122 exits along the cord inlet guide surface 270, between the wall 270 and the locking dog 256.

However, if the operator releases the drive cord 122, the roller lock 132 shifts to its raised position where it is no longer free to rotate, but the cord 122 is able to slip around the capstan 184, allowing the window covering to lower itself by gravity in a controlled, slow manner. The friction of the drive cord 122 as it slips around the capstan 184 and the inherent system friction slow down the lowering of the window covering, and the system acts exactly as if the operator had raised the tassel weight 106 in the first embodiment 100, with the added benefit that the operator may now walk away and, since there is no longer a sufficient tassel weight pulling down on the cord 122, the system will not lock in place but will continue to lower the window covering until it is fully lowered.

Should the operator wish to lock the window covering in place at any point between the fully raised and fully lowered positions, he pulls the end of the drive cord 122 to the right, bringing the cord 122 into contact with the locking dog 254, and then lets loose of the drive cord 122. The friction between the toothed surface 256 of the locking dog 254 and the cord 122 causes the cord 122 to pick up the dog 254, which rotates clockwise about its axis of rotation 266 to the raised position shown in FIGS. 26 and 28. This pinches the cord 122 between the dog 254 and the wall 270 of the housing 130', providing a braking force which increases the tension exerted by the drive cord on the capstan 184 and thereby prevents the cord 122 from slipping any further. The dog 254 only applies a relatively small braking force to the drive cord that does not tend to fray the drive cord 122, since the bulk of the required force to keep the cord 122 from slipping is provided by the cord 122 being wrapped around the capstan 184. This differs from a conventional locking dog found in the prior art, which must lock the drive cord with sufficient force to keep the cord from slipping against the full force working to pull down on the window covering, since there is no cord wrapped around a capstan to take off some of this load.

Pulling down on the drive cord 122 then releases the dog's grip on the cord 122, and the dog 254 returns to its disengaged position (as shown in FIG. 27) until it is once again engaged by the user. With the dog 254 released, the operator may then pull the drive cord 122 to raise the blind or release the drive cord 122 to allow the blind to lower slowly, in a controlled manner, by gravity. It should be noted that, for certain size window coverings, it may be desirable to have some additional weight attached to the end of the drive cord 122 to provide additional system friction (by increasing the braking action of the roller lock mechanism 104') to ensure that the window covering lowers relatively slowly, in a controlled manner, when the drive cord 122 is released and the locking dog 254 is not engaged.

It may also be noted that the locking dog 254 may be omitted from this embodiment, and a heavier tassel weight 106 may be added instead, with the end result being a cone drive and roller lock mechanism which is functionally identical to the cone drive 102 and roller lock mechanism 104 of FIG. 1.

Cone Drive, Roller Lock Mechanism, and Wand Operator

Figure 8:
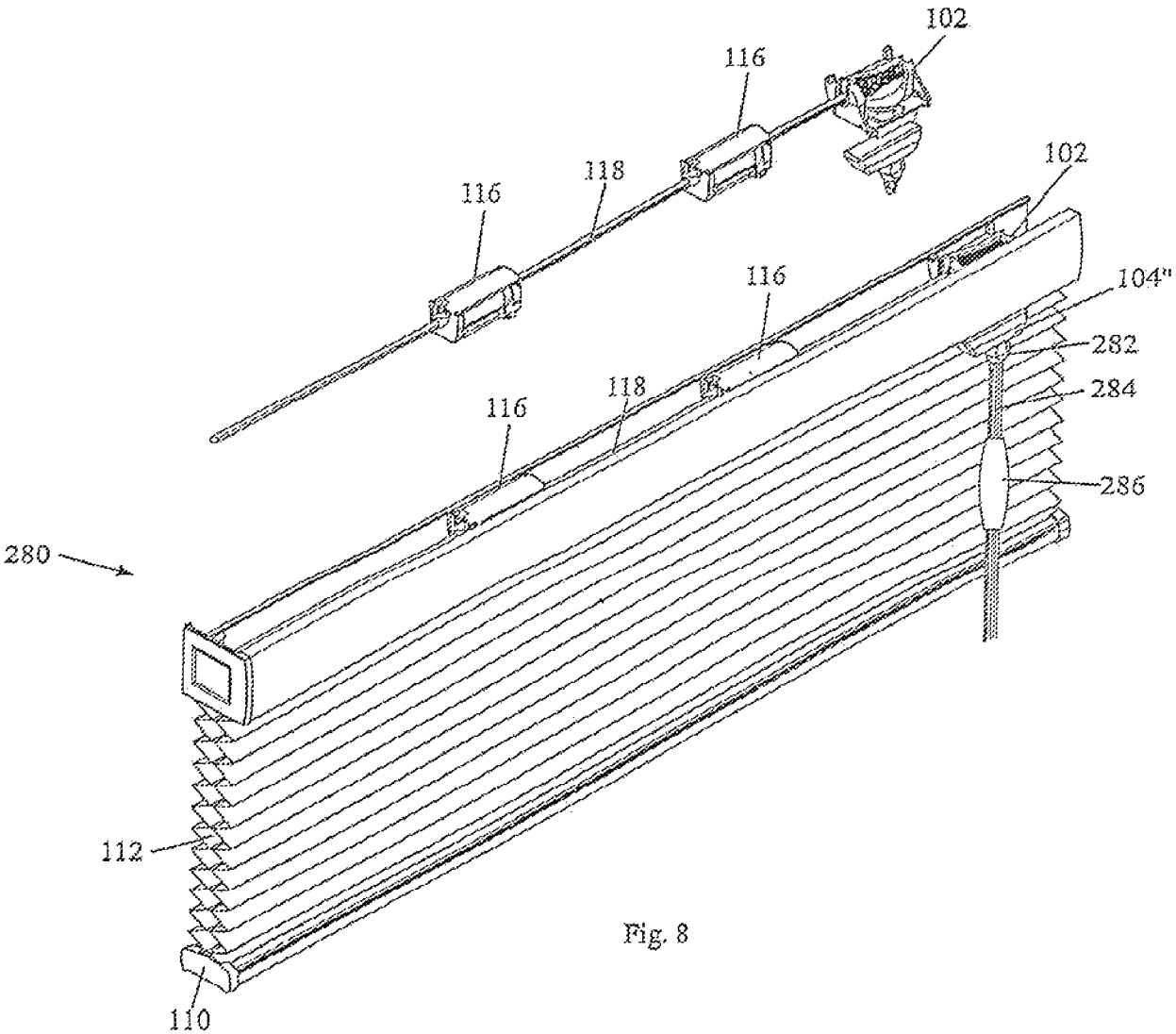
FIG. 8 is a partially exploded, perspective view of a cellular shade similar to the shade of FIG. 7 but using a wand actuator for the cord drive.

FIG. 8 shows another window covering, which is a cellular product 280, and it includes the same elements already described with respect to the cellular product 100 of FIG. 1, except that the tassel weight is no longer present, and the roller lock mechanism 104" now includes a ball 282 for a ball and socket joint from which extends a wand assembly 284, which encloses the free end of the drive cord 122 so that the cord 122 is no longer loose or exposed. A wand handle 286 allows the operator to pull on, lift, or lock the drive cord 122 as described below. The details of this embodiment are shown in FIGS. 30-47.

Figure 35A:
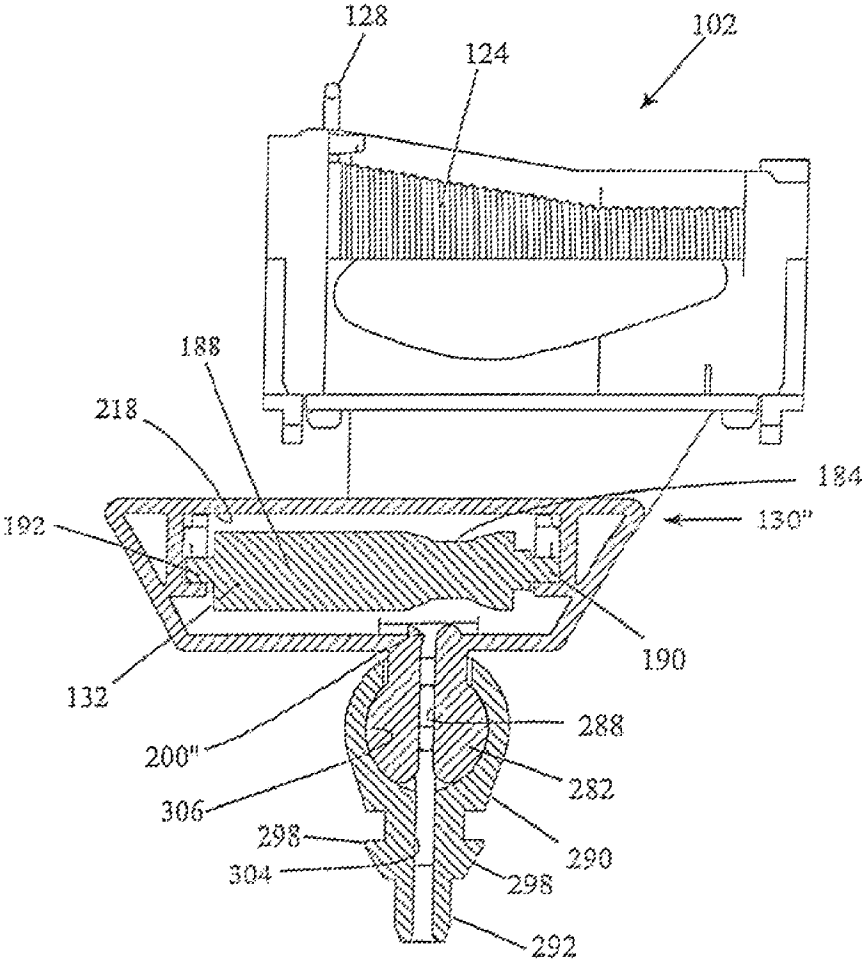
FIG. 35A is a sectional view along line 35A-35A of FIG. 35.
Figure 35:
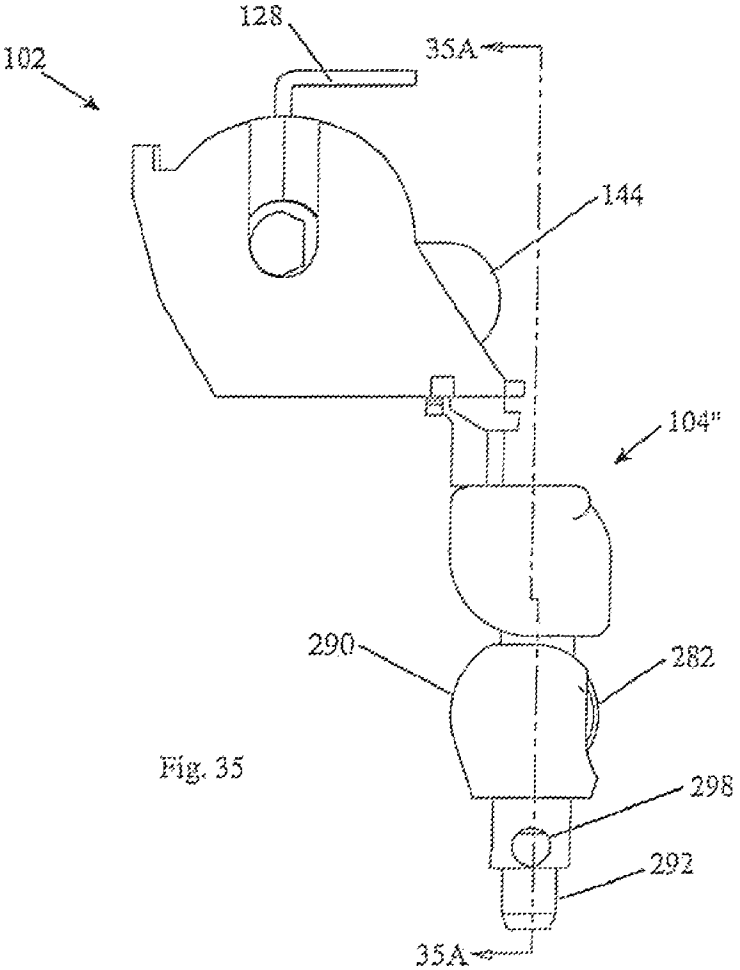
FIG. 35 is a left end view of the cord drive with roller lock mechanism and wand actuator of FIG. 30.

As may be appreciated from FIGS. 30-33, the housing 130" of the roller lock mechanism 104" differs from the housing 130' of the previously described roller lock mechanism 104' in that, instead of the locking dog, a ball 282 is appended to the bottom of the housing 130". As seen in FIG. 35A, the ball 282 defines an internal pathway or passageway 288 through the ball 282. As described in more detail later, the drive cord 122 is fed through this passageway 288 to enter the cavity 218 via the slotted opening 200", which corresponds to the opening 200 in the previously described roller lock mechanism 104.

Figure 37:
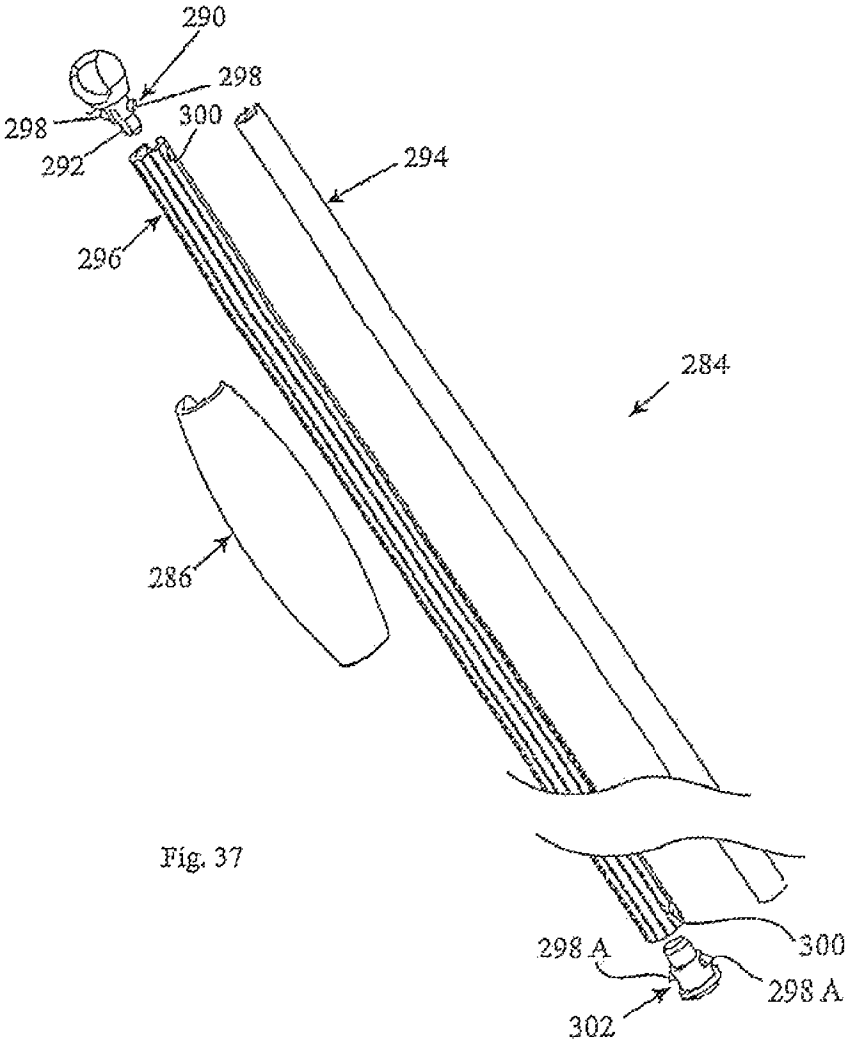
FIG. 37 is an exploded perspective view of the wand of FIG. 36.
Figure 36:
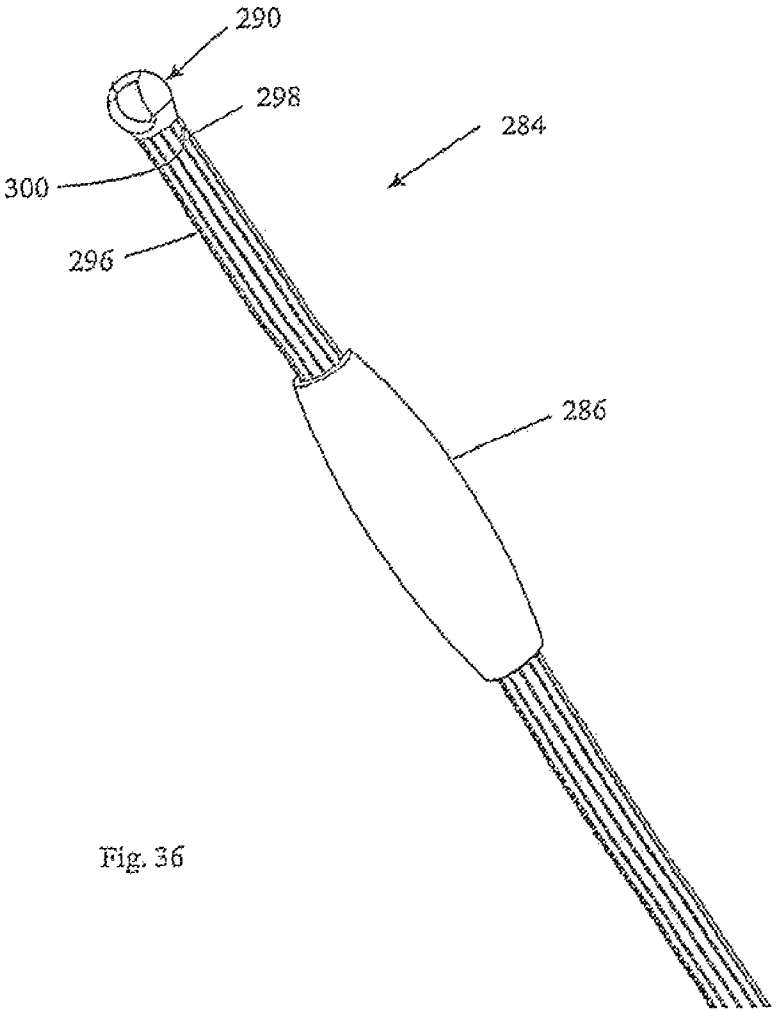
FIG. 36 is a perspective view of the wand of FIG. 8.

Referring to FIGS. 34-37, a socket 290 is sized and designed to receive the ball 282 into its cavity 306 with a snap fit, which allows the socket 290 to swivel about the ball 282. The socket 290 includes a stem 292 designed to receive inner and outer wand extrusions 294, 296 (See FIG. 37). The stem 292 has two opposed, tapered projections 298, which are received in holes 300 at the upper end of the outer wand extrusion 296 (as seen in FIGS. 36 and 37) to attach the wand assembly 284 to the socket 290 and thus to the ball 282 of the roller lock mechanism 104".

As shown in FIG. 37, a wand end plug 302, having tapered projections 298A similar to the tapered projections 298 of the socket 290, is installed at the lower end of the wand assembly 284 to hold the wand assembly 284 together and to finish off the bottom of the wand assembly 284.

As seen in FIG. 35A, a passageway 304 extends through the stem 292 of the socket 290 and into its ball retaining cavity 306 and is aligned with the passageway 288 in the ball 282, so that the drive cord 122 (not shown in this view, but shown in FIG. 43) extends through the ball 282, through the socket 290, and into the wand assembly 284 as described later.

Referring to FIGS. 36 and 37, the wand assembly 284 includes the socket 290 (already described above), an outer wand extrusion 296, an inner wand extrusion 294, a wand handle 286, and a lower end plug 302.

Figure 39:
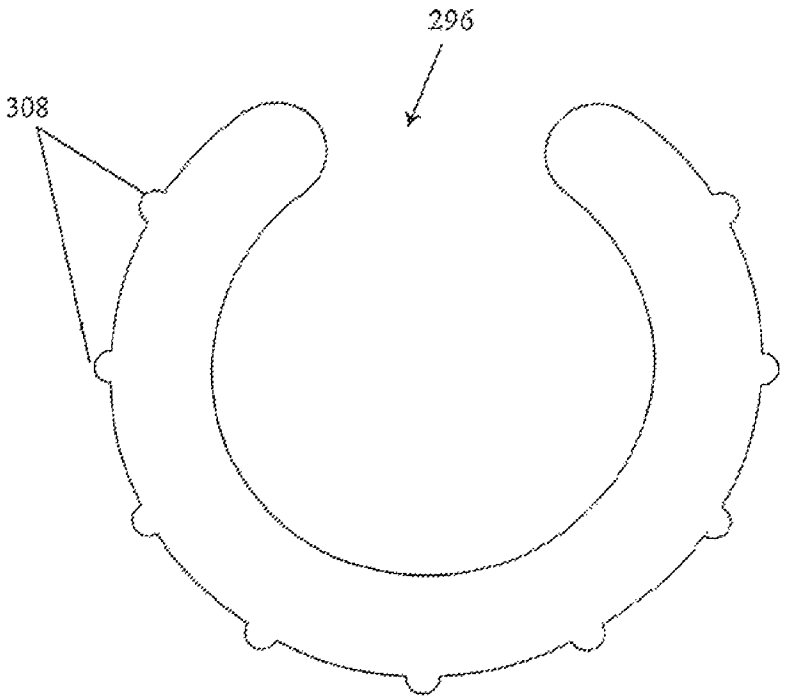
FIG. 39 is an end view of the wand extrusion of FIG. 38, showing the profile of the extrusion.
Figure 38:
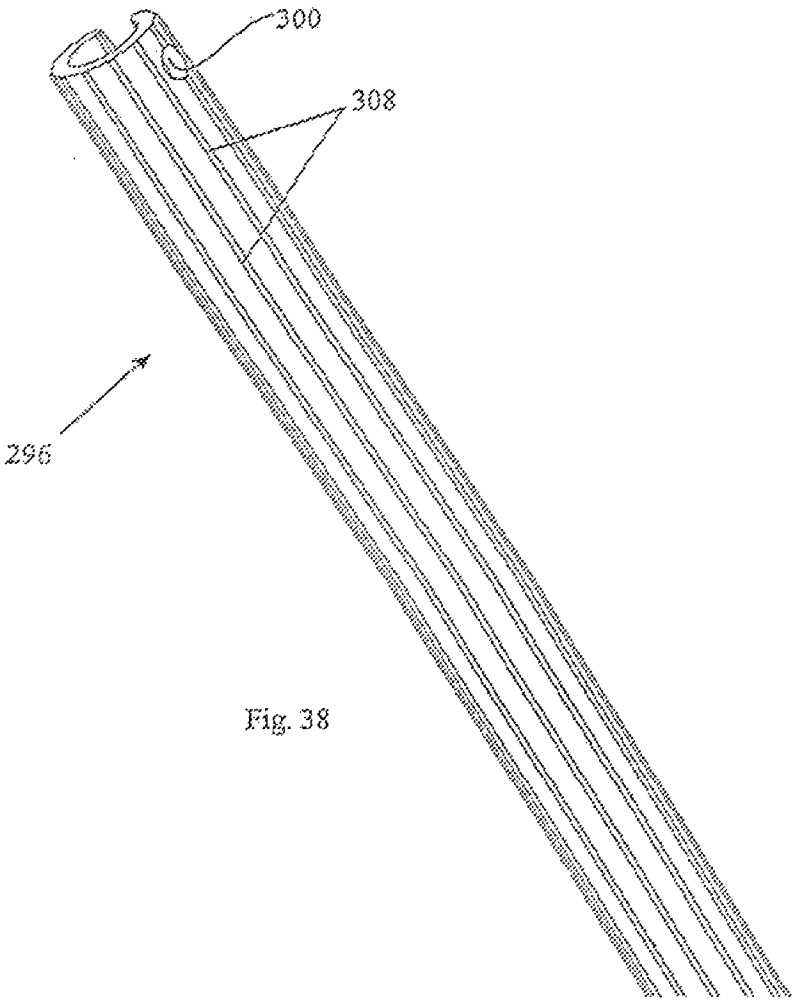
FIG. 38 is a perspective view of the outer wand extrusion of FIG. 37.

FIGS. 38 and 39 show the outer wand extrusion 296 in more detail. The outer wand extrusion 296 has a "C" shaped profile and a plurality of outwardly-directed, longitudinally-extending ribs 308. In a preferred embodiment, the outer wand extrusion 296 may be made from a clear plastic material so that matching its color to different colors of window coverings does not become an issue. The ribs 308 are present to provide contact points for the handle 286 as it slides along the length of the outer extrusion 296, as may be seen in FIG. 47, and as will be explained in greater detail later, so as to minimize frictional losses between the handle 286 and the outer extrusion 296, and to keep the handle 286 from marring or scratching the majority of the surface of the outer extrusion 296.

Figure 41:
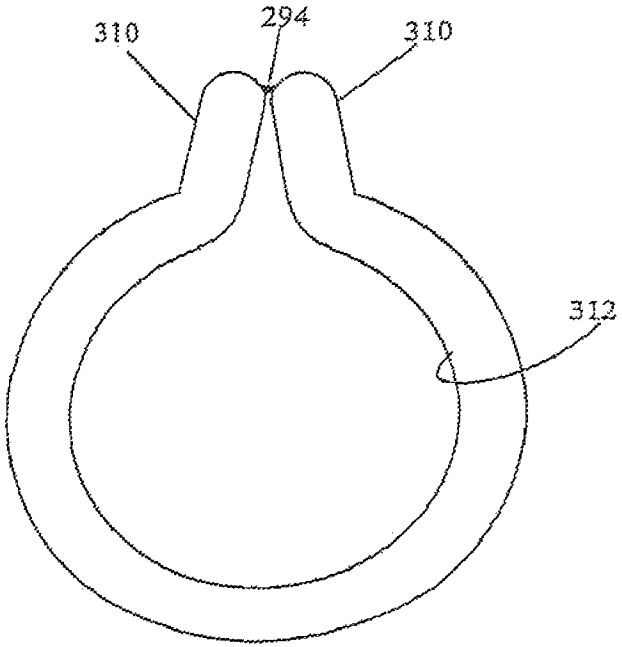
FIG. 41 is an end view of the inner wand extrusion of FIG. 40, showing the profile of the extrusion.
Figure 40:
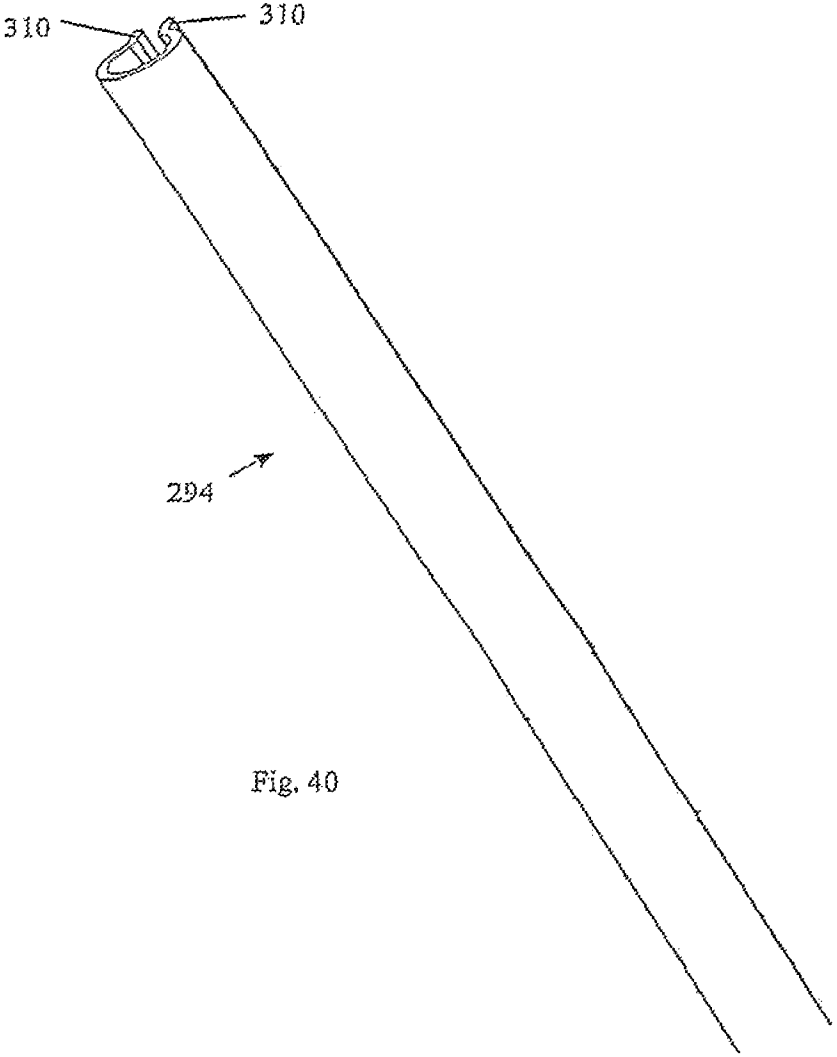
FIG. 40 is a perspective view of the inner wand extrusion of FIG. 37.

FIGS. 40 and 41 show the inner wand extrusion 294 in more detail. The inner wand extrusion 294 has a modified "C" shaped profile with two longitudinally-extending, outwardly-projecting legs 310 at the ends of the "C". In a preferred embodiment, the inner extrusion 294 preferably is made of a clear elastic material and, when assembled inside the outer extrusion 296, the inner extrusion 294 is slightly compressed as shown in FIG. 46, with the legs 310 pressed into contact with each other and defining an elongated cavity 312 which extends the length of the wand assembly 284.

FIGS. 42-45 and 47 show the handle 286, defining a longitudinally-extending cavity 314 open at both ends, and forming an outer cylindrically-shaped portion 316 along its midsection. This outer cylindrically-shaped portion 316 is also open at both ends, and a short web or bridge 318 projects inwardly from the outer cylindrical portion 316, connecting it to an inner cylindrical portion 320. The inner cylindrical portion 320 defines an axial through opening 322 through which the drive cord 122 is threaded. A knot or other enlargement (See FIG. 43) is tied to the lower end of the drive cord 122 after it is threaded through the opening 322 to tie off the drive cord at the handle 286, preventing the lower end of the drive cord 122 from being pulled upwardly through the opening 322. Thus, when the handle 286 is pulled down, the end of the drive cord 122 is pulled down with it. When the handle is raised, the drive cord 122 is free to follow it up as well, as described later.

Assembly:

To assemble the wand 284, the lower end of the drive cord 122, which leaves the roller lock and is threaded through the ball 282 and socket 290, is then threaded through the opening 322 in the handle 268 and is tied off as described earlier. The handle 286 is then slid over one end of the inner extrusion 294 such that the two projecting legs 310 of the inner extrusion 294 hug the sides of the web 318 of the handle 286, and the inner cylindrical portion 320 of the handle 286 is received inside the elongated cavity 312 of the inner extrusion 294.

Figure 47:
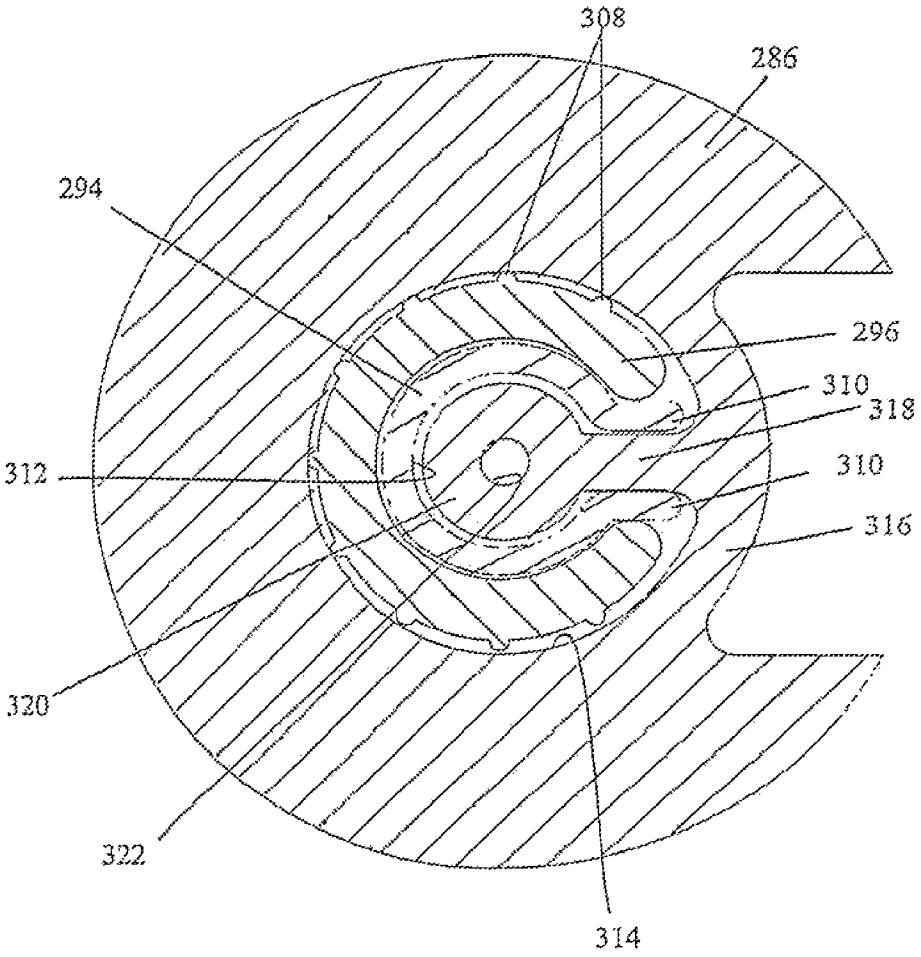
FIG. 47 is a view along line 47-47 of FIG. 42.

Next, as shown in FIG. 47, the assembled inner extrusion 294 and handle 286 are slid over one end of the outer extrusion 296, such that the projecting legs 310 of the inner extrusion 294 extend through the opening in the "C" shaped profile of the outer extrusion 296, and the ribbed outer surface of the outer extrusion 296 lies inside the cavity 314 of the handle 286. Finally, the wand assembly 284 is installed to the socket 290 and to the bottom end plug 302 with the tapered projections 298 snapping through their respective holes 300, and the socket 290 is snapped onto the ball 282 of the roller lock mechanism 104".

Figure 43:
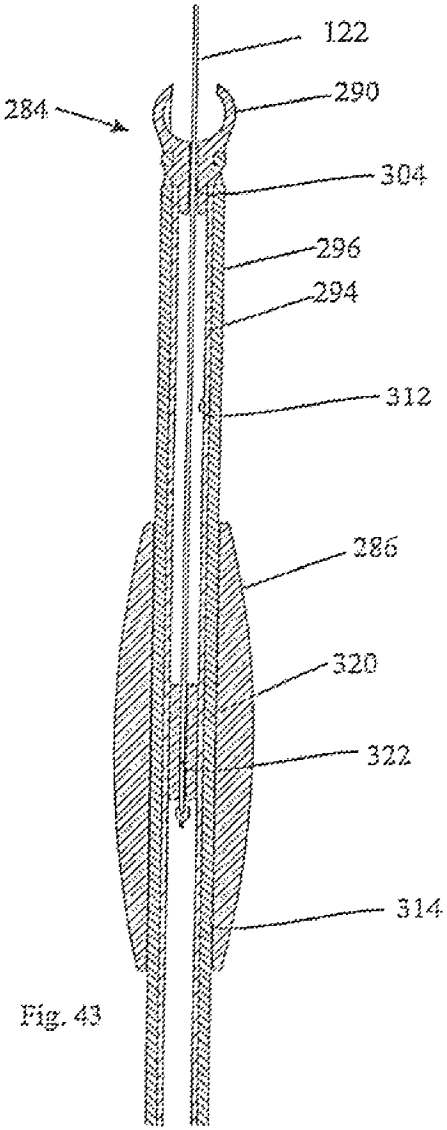
FIG. 43 is a sectional view along line 43-43 of FIG. 42.
Figure 42:
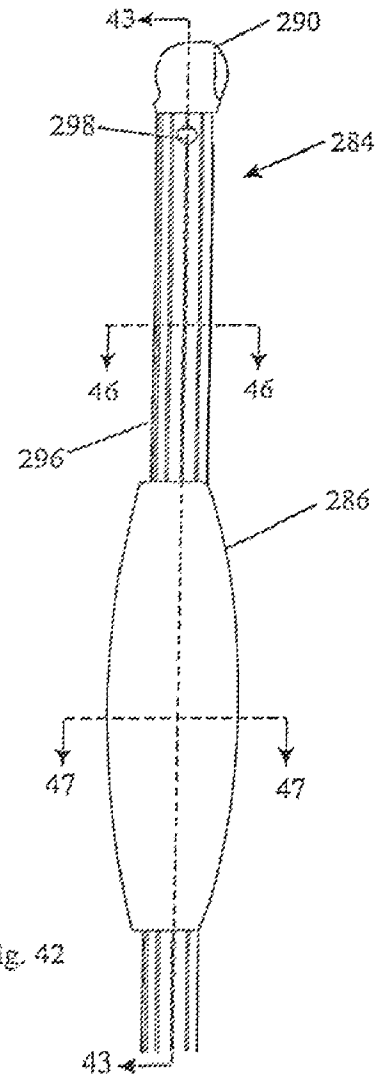
FIG. 42 is a broken away, front view of the wand of FIG. 8.
Figure 45:
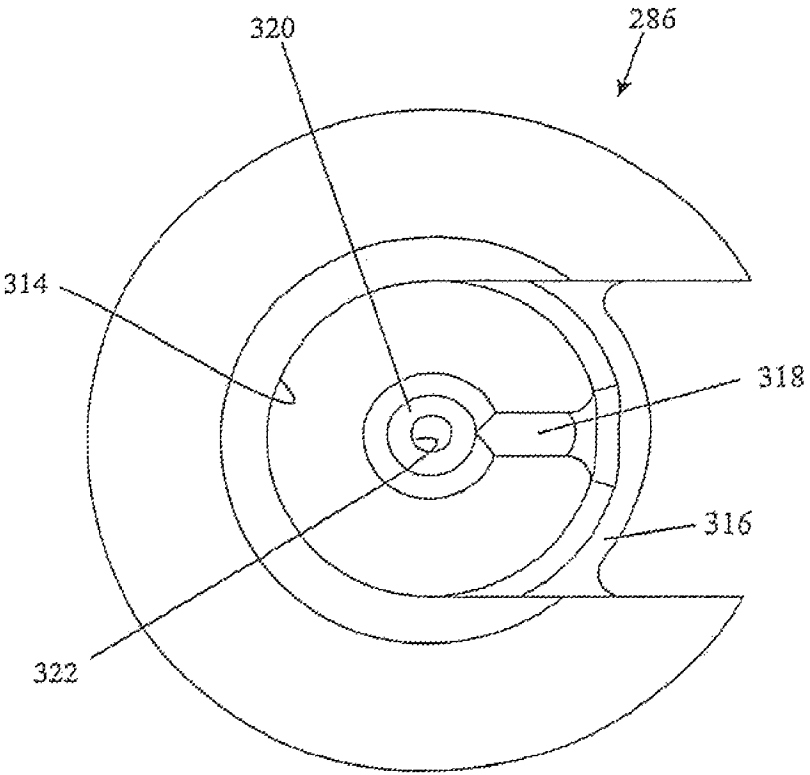
FIG. 45 is a sectional view along line 45-45 of FIG. 44 (cross-hatching lines removed for clarity)
Figure 44:
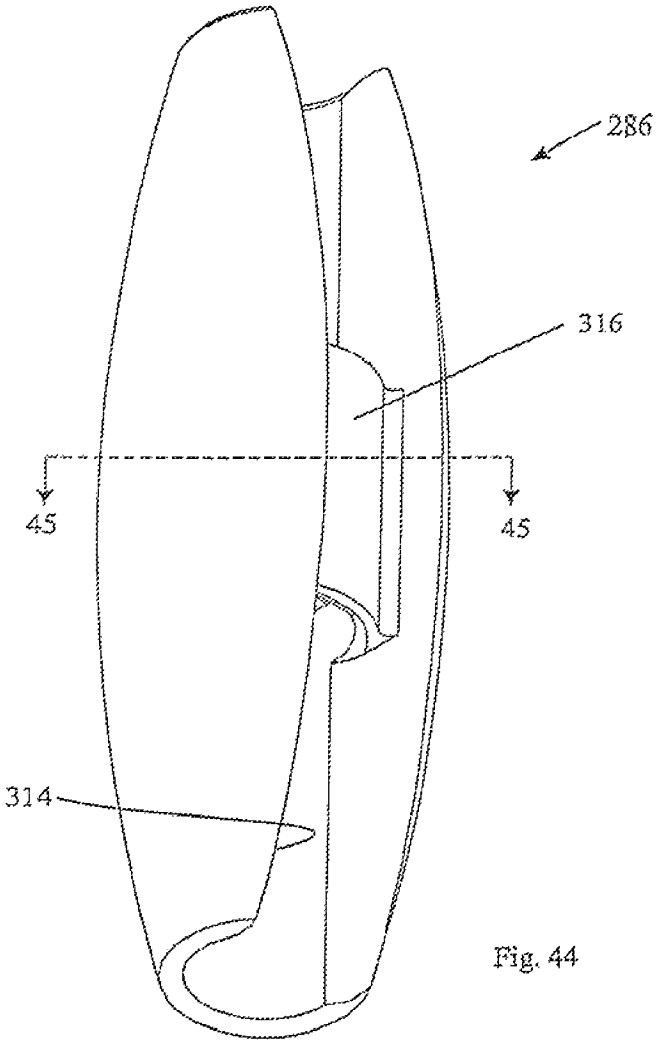
FIG. 44 is a perspective view of the wand handle of FIG. 37.

As can be seen in FIG. 43, the wand assembly 284 defines a continuous passageway 322, 312, 304 allowing the drive cord 122 to extend from the handle 286 to the roller lock brake mechanism 104". As the handle 286 is pulled down by the operator, the web 318 of the handle pushes apart the projecting legs 310 of the inner extrusion 294, displacing them just far enough apart for the handle 286 to slide through. Since the drive cord 122 is tied off to the bottom of the inner cylindrical portion 320 of the handle 286, the cord 122 is also pulled down, having an effect similar to pulling on the tassel weight 106 in the first window covering embodiment 100 discussed earlier.

Pulling down on the handle 286 causes the roller lock 132 to shift down, allowing it to rotate freely. The drive cord 122 wraps onto and unwraps from the capstan 184 as the roller lock 132 rotates, and the cord 122 unwraps from the drive cone 124, causing the drive cone 124 and the lift rod 118 to rotate. This causes the lift drums of the lift stations 116 to rotate, raising the window covering as already described. Note that the operator must overcome the frictional resistance to movement of the handle 286 along the length of the wand assembly 284; this frictional resistance is due mostly to the contact of the projecting legs 310 of the inner extrusion 294 on the web or bridge 318 of the handle 286 and provides a second brake in series with the roller lock brake 104".

If the operator releases the handle 286, the aforementioned frictional resistance (braking force) increases the tension exerted by the drive cord on the first brake 104". In this way, it functions to increase the braking force of the first brake 104" as described earlier with respect to other mechanisms. It prevents upward movement of the handle 286 and of the cord 122, which is tied off to the handle 286. So, as the gravitational pull of the window covering rotates the lift rod 118 in a direction to allow the window covering to be lowered, causing the drive cone 124 to pull upwardly on the drive cord 122, the frictional resistance of the handle 286 tightens the drive cord 122 around the capstan 184, and the capstan 184 shifts upwardly to its locked position, to prevent the window covering from being lowered.

However, if the handle 286 is raised by the operator, this has the same effect as when the operator lifts up on the tassel weight 106 in the earlier embodiments discussed. Namely, the drive cord 122 is able to slide around the raised capstan 184 (to surge the capstan), allowing the window covering to lower itself by gravity, and winding the lift cord 122 onto the drive cone 124. In this embodiment, the drive cord 122 remains enclosed by the cone drive 102, the roller lock mechanism 104", and the wand assembly 284, so it is not loose or exposed. It should be noted that, while this description refers to inner and outer extrusions, and those elements preferably are made by an extrusion process, those terms are not intended to be used to restrict the invention to elements being made by extrusion. Those elements could alternatively be made by casting or by other known processes as well.

Alternate Embodiments of Wand Assembly

FIGS. 69-76 show an alternative embodiment of a wand assembly 630 made in accordance with the present invention. This wand assembly 630 may be used instead of the wand assembly 284 of FIGS. 8 and 37. This alternate wand assembly 630 is very similar to the first embodiment 284, with the main differences being the absence of the inner wand extrusion 294 and a slightly different outer wand extrusion 632. The other components, including the socket 290, the handle 286, and the bottom plug 302 remain unchanged in both wand embodiments 284, 630.

Figure 70:
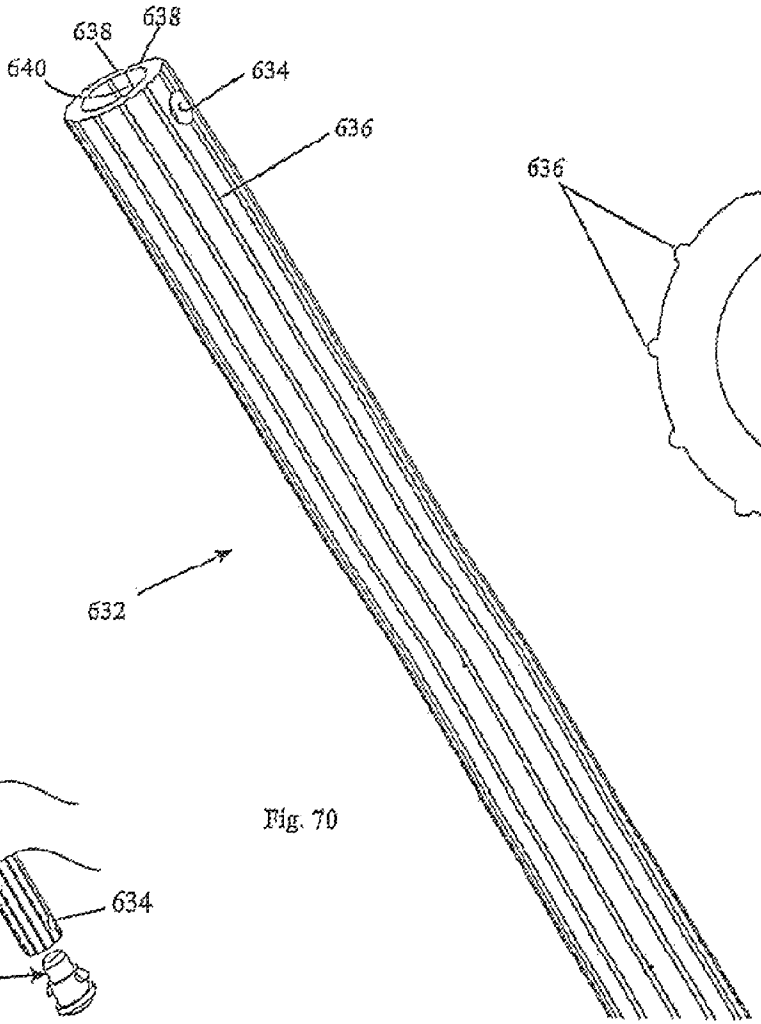
FIG. 70 is a perspective view of the wand extrusion of FIG. 69.
Figure 69:
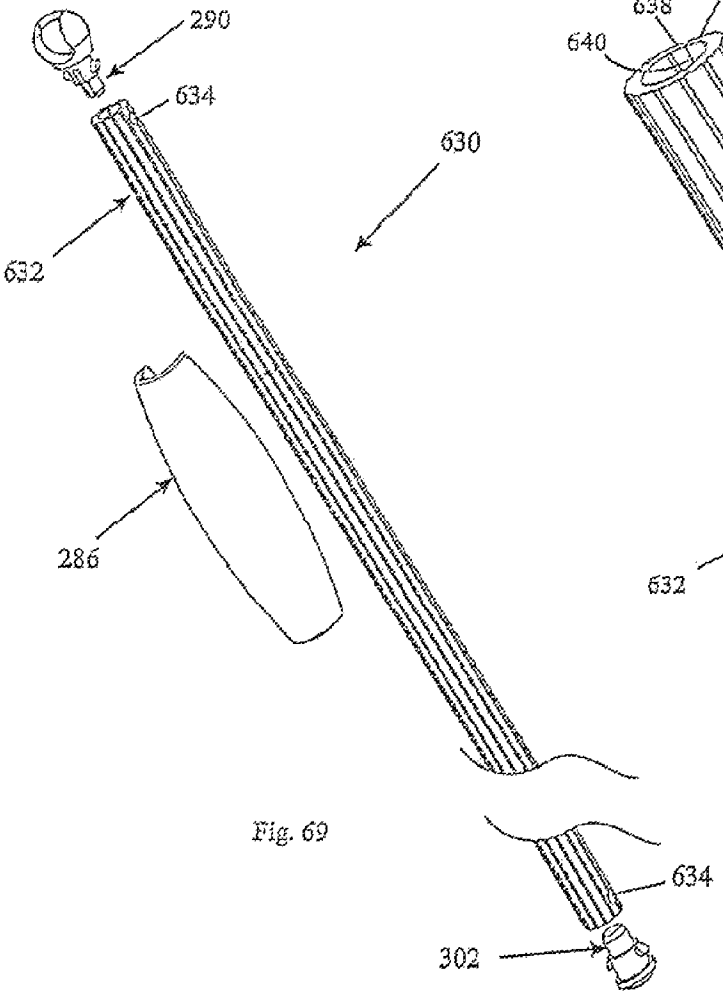
FIG. 69 is an exploded, perspective view of another embodiment of a wand, similar to that of FIG. 37.

Referring to FIGS. 70 and 71, the wand extrusion 632 is also quite similar to the outer wand extrusion 296, including the holes 634 proximate the ends in order to attach the socket 290 and the bottom plug 302, and including the longitudinally extending outer ribs 636. The wand extrusion 632 has a "C" shaped profile, with the ends of the "C" closed off by tangentially-extending, elongated finger portions 638. This wand extrusion 632 preferably is a dual durometer extrusion. The "C" shaped portion of the extrusion preferably is made of a rigid PVC material with a higher durometer, and the enclosing finger portions 638 preferably are made from a flexible PVC with a lower durometer (softer and more flexible than the "C" shaped portion). A longitudinally-extending slit 640 is formed between the ends of the finger portions 638. The wand extrusion 632 may be extruded as a completely enclosed extrusion, with the slit 640 being cut after the part 632 is extruded.

As may be appreciated from FIGS. 72 through 76, the dual durometer, single wand extrusion 632 effectively serves the function of both the inner wand extrusion 294 and the outer wand extrusion 296 of the first wand 284. As the handle 286 slides up and down along the length of the wand 630, the inner wall of the handle's cavity 314 slides along the ribbed outer wall of the extrusion 632, and the handle's web 318 slides along the slit 640, pushing the finger portions 638 aside as the handle 286 travels along the extrusion 632. The finger portions 638 provide a frictional resistance to the movement of the handle 286, thus acting as a weight, the force of which must be overcome by the operator to move the handle 286 along the length of the wand 630. As the web 318 of the handle 286 passes by, the finger portions 638 of the wand extrusion 632 flex back toward each other (See FIG. 74), keeping the drive cord 122 inside the wand 632. In comparing FIG. 47 of the earlier embodiment of a wand 284 to FIG. 75 of this embodiment 630, one notices the absence of the axial through opening 322 in the cylindrical portion 320. In fact, the opening 322 is optional in either embodiment. If the opening 322 is absent, the drive cord 122 may be looped around and cinched down with a slip knot around the cylindrical portion 320 of the handle 286, such that the cord 122 cinches around the bridging section 318.

Embodiments of Alternate Wand Assemblies

FIG. 147 shows an inner wand extrusion 294' and an outer wand extrusion 296'. In this embodiment, the outer wand extrusion 296' is made from a softer durometer material than the more rigid, C-shaped inner wand extrusion 294'. The fingers 638' of the outer wand extrusion 296' come together at a longitudinal slit 640', extending the length of the outer wand extrusion 296'. These fingers 638' clamp down on the bridge 318 (See FIG. 47) of the handle 286 in much the same manner that the projections 310 on the inner wand extrusion 294 clamp down on the same bridge 318 in the wand 286 described earlier.

FIG. 148 shows a single wand extrusion 632", similar to the wand extrusion 632 of FIG. 71. However, in this embodiment, the fingers 638" are not made of a softer durometer than the rest of the extrusion. Instead, the entire extrusion 632" is made from a single material with walls which are thin enough to flex outwardly to make room for the bridge 318 of the handle 286 as the handle traverses up and down along the length of the extrusion 632".

FIG. 149 shows a single wand extrusion 632*, similar to the wand extrusion 632 of FIG. 71. However, in this embodiment 632*, the ends of the C-shaped extrusion are bulbous, and the fingers 638" are replaced with a flexible, snap-on flapper 638* which has an internal contour 633* that mates with one of the bulbous ends of the extrusion 632*. The snap-on flapper 638* extends substantially the full length of the single wand extrusion 632*. The flapper 638* is made from a softer durometer material than the single wand extrusion 632*. The contoured end 633* of the flapper 638* snaps onto the single wand extrusion 632*, and the other end 635* defines a flexible finger 635*, which is displaced by the bridge 318 of the handle 286 as the handle 286 traverses up and down along the length of the single wand extrusion 632*, in much the same manner as the fingers 638 are displaced in the wand embodiment 630 described earlier.

FIG. 150 shows another single wand extrusion 632**, similar to the wand extrusion 632* of FIG. 149. However, in this embodiment 632, the flapper 638 is a low-durometer appendage which is co-extruded directly with the higher-durometer single wand extrusion 632. This wand extrusion 632 with its co-extruded flapper 638** functions in the same manner as the wand extrusion 632* with the snap-on flapper 638* described above.

Cone Drive with Lever Lock Mechanism

Figure 6:
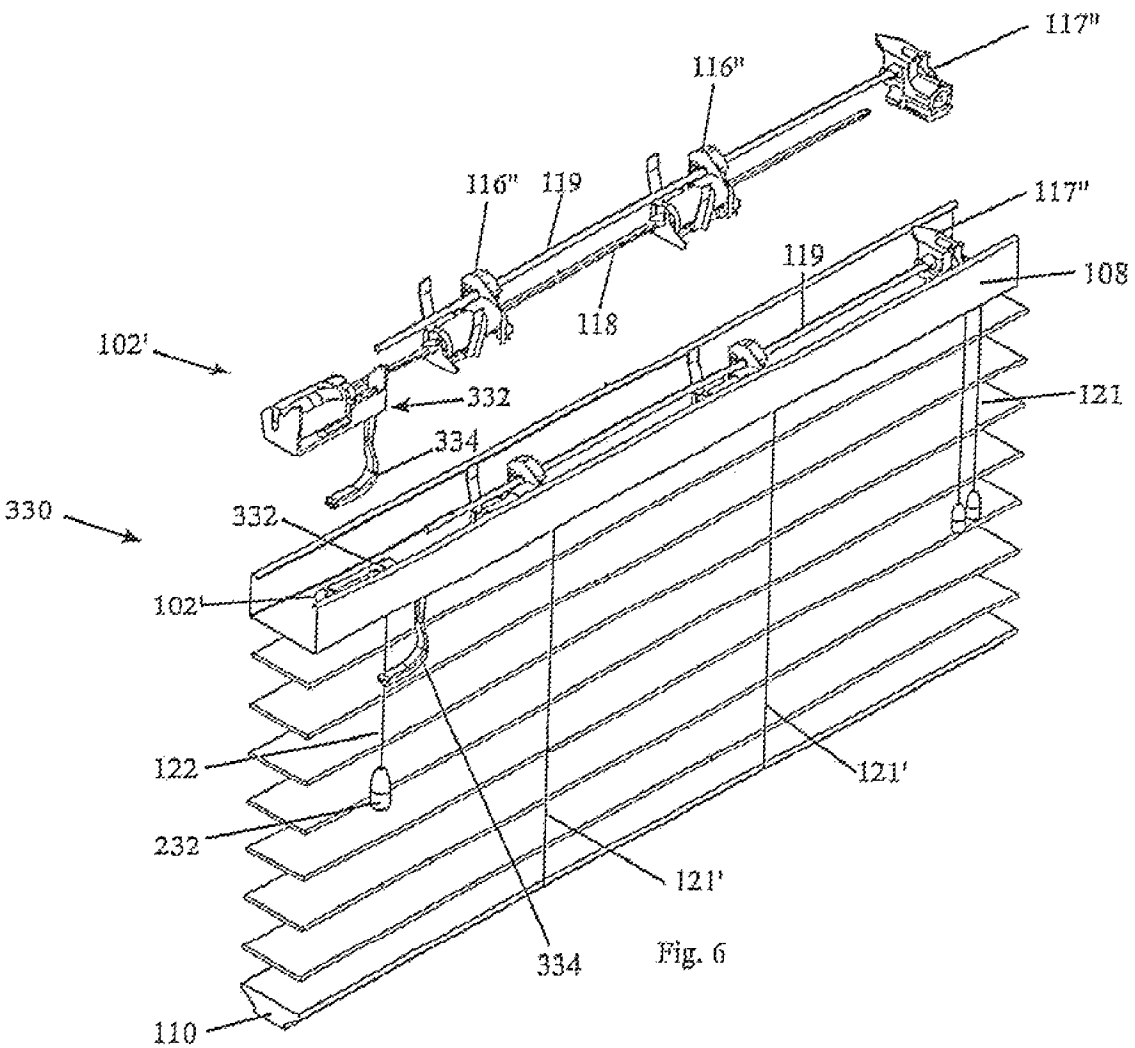
FIG. 6 is a partially exploded, perspective view of a blind incorporating a cord drive with a lever lock mechanism made in accordance with the present invention.

FIG. 6 shows an embodiment of another window covering made in accordance with the present invention. In this embodiment, the window covering is a blind 330, and it includes a cone drive 102', which is very similar to the cone drive 102 described earlier, but which also includes a lever lock mechanism 332 to replace the roller lock mechanism and tassel weight of the embodiments described earlier.

In this embodiment, the drive cord 122 is threaded through the end of the locking arm 334 such that, when the operator pulls on the drive cord 122, the locking arm 334 disengages the lever lock mechanism 332 and the cone drive 102' is able to rotate to raise or lower the slats of the blind 330 via the lift rod 118 and the lift stations 116". However, when the drive cord 122 is released, it causes the locking arm 334 to engage the lever lock mechanism 332, locking the blind 330 in the desired position as described below. This window covering 330 also includes lift and tilt stations 116" and a tilt drive mechanism 117", all of which are described in U.S. Pat. No. 6,536,503 "Modular Transport System for Coverings for Architectural Openings" referenced earlier.

Figure 49:
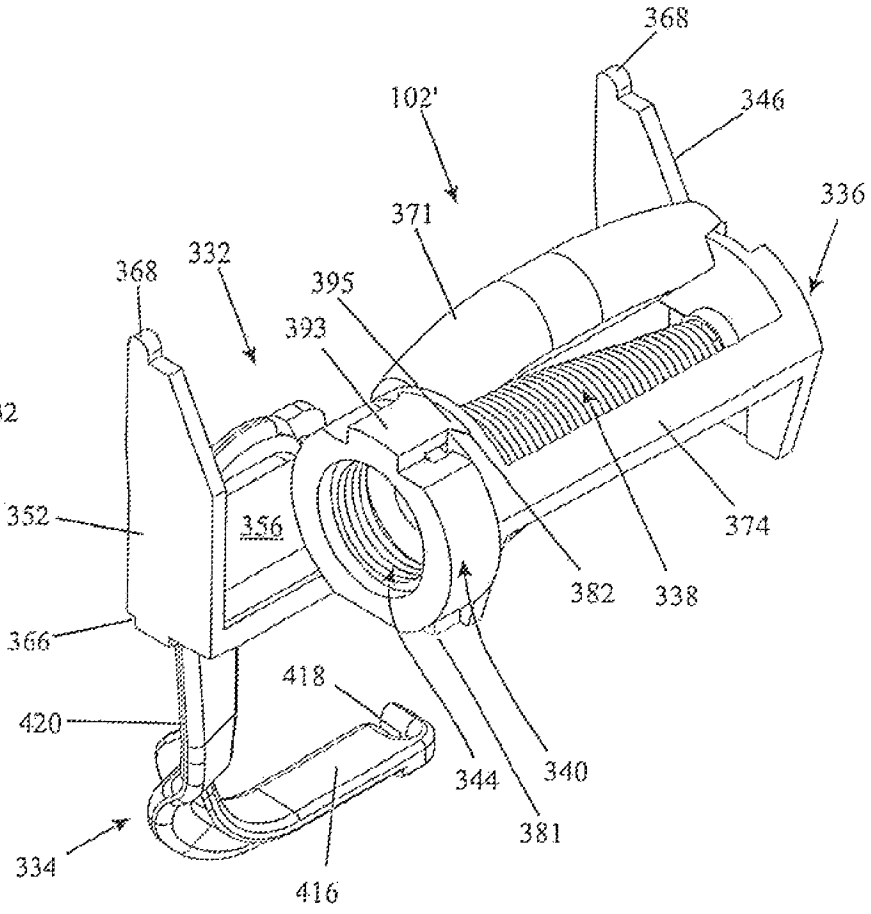
FIG. 49 is a rear perspective view of the cone drive with lever lock of FIG. 48.
Figure 48:
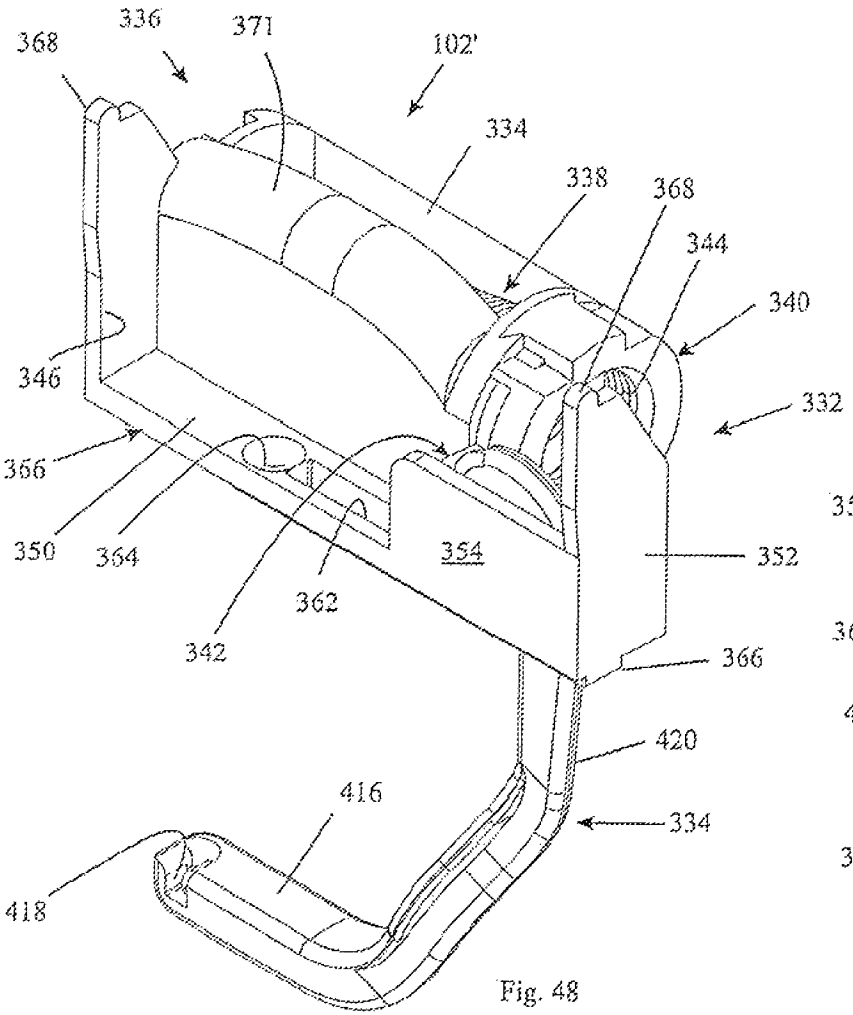
FIG. 48 is a front perspective view of the cone drive with lever lock of FIG. 6 (drive cord removed for clarity)
Figure 50:
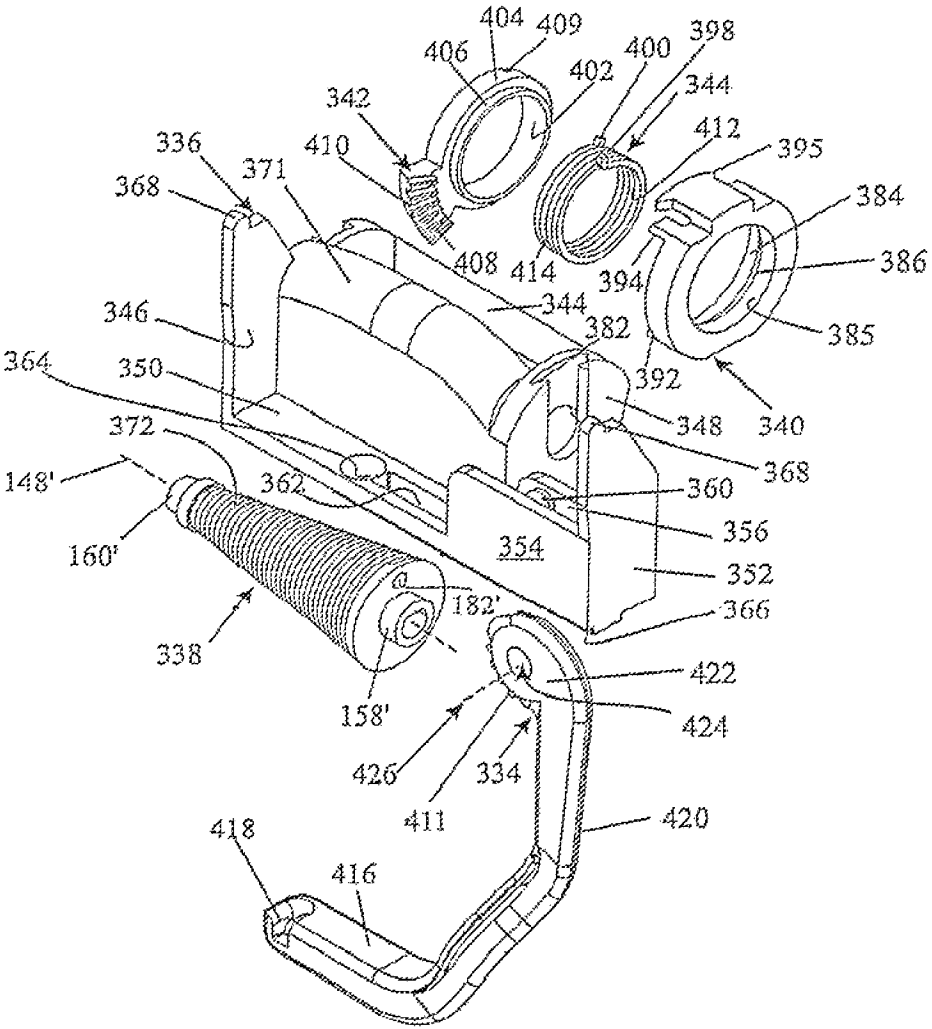
FIG. 50 is an exploded perspective view of the cone drive with lever lock of FIG. 48.

The details of the cone drive 102' with lever lock mechanism 332 are shown in FIGS. 48-56. Referring to FIGS. 48-50, the assembly includes a cone drive housing 336, a drive cone 338, a lock spring housing 340, a lock spring housing gear 342, a lock spring 344, and a locking arm 334 (as well as the drive cord 122 as shown in FIG. 6).

Figure 52:
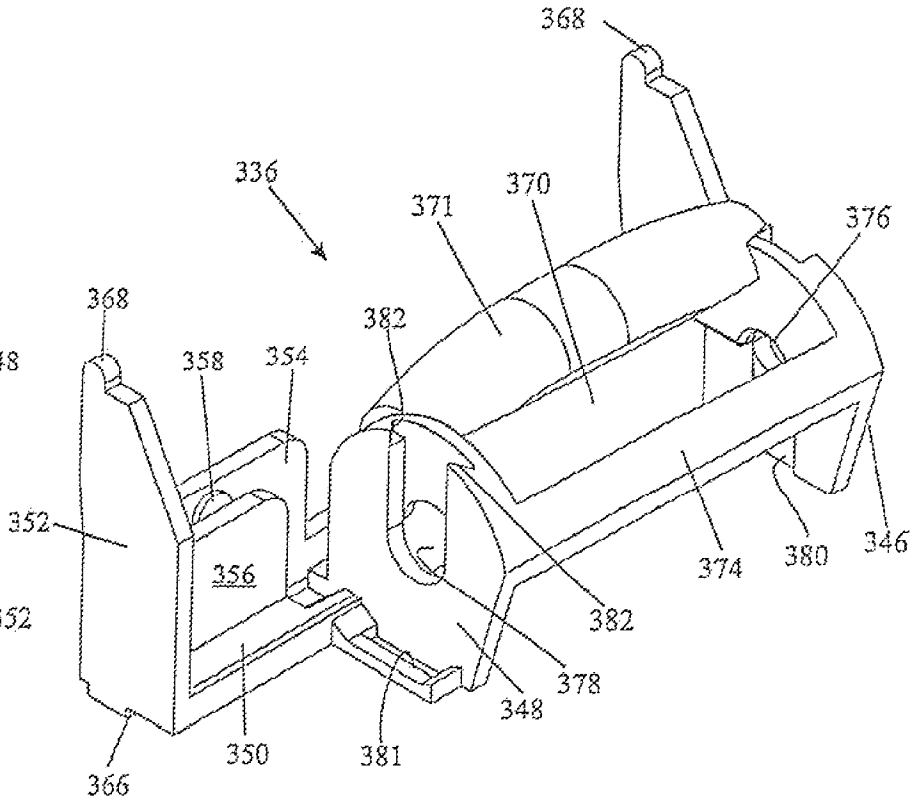
FIG. 52 is a rear perspective view of the cone drive housing of FIG. 51.
Figure 51:
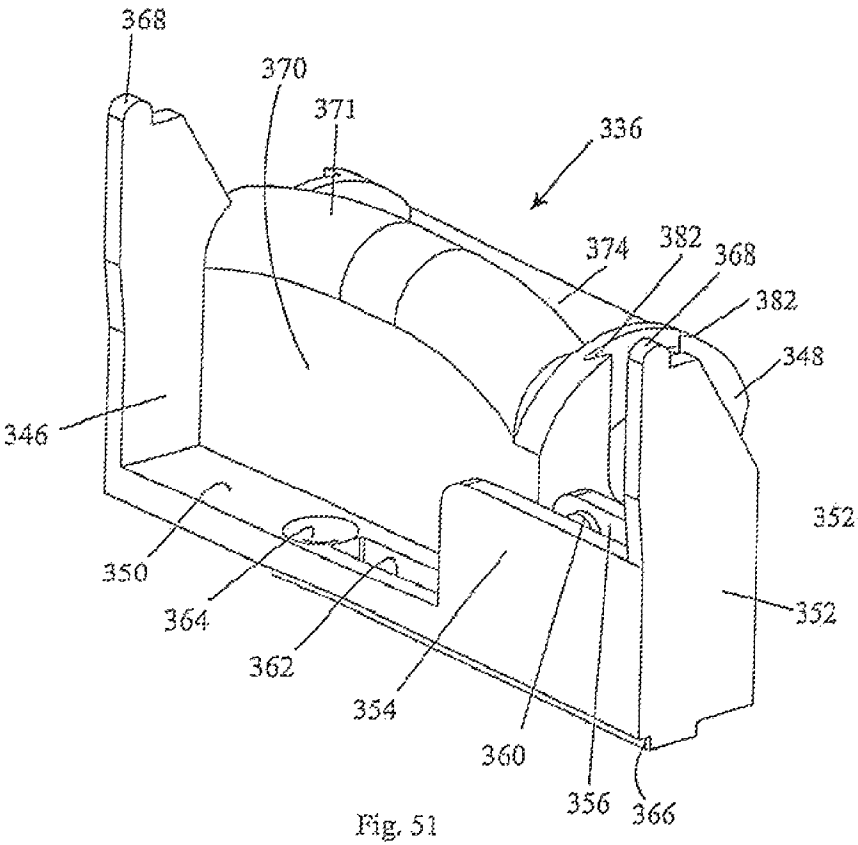
FIG. 51 is a front perspective view of the cone drive housing of FIG. 50.

FIGS. 51 and 52 show the cone drive housing 336, which is quite similar to the housing 126 (See FIG. 13) of the first cone drive 102 described in earlier embodiments. The housing 336 includes left and right end walls 346, 348 with an interconnecting bottom wall 350. The bottom wall 350 extends beyond the right wall 348 of the housing 336, terminating in a third upright wall 352. Between this third upright wall 352 and the right end wall 348 lie two longitudinally-extending upright walls 354, 356, defining opposed, inwardly projecting axles 358, 360, which rotationally support the locking arm 334 as described in more detail later. A slotted opening 362 extends through the bottom wall 350 and extends longitudinally from the third upright wall 352 to approximately the midpoint of the bottom wall 350. Adjacent the end of the slotted opening 362 opposite the third upright wall 352, a through hole 364 provides a passageway and a guide for the drive cord 122 as described below. The bottoms of the slotted opening 362 and of the through hole 364 define a rectangularly-shaped lip or flange 366, which cooperates with the ears 368 to allow the housing 336 to snap onto the head rail 108.

A second interconnecting wall 370 defines an arcuate guide surface 371, which corresponds to the guide surface 144 of the housing 126 of the first cone drive 102. This surface 371 is located along the front top quadrant of the housing 336, and it guides the drive cord 122 so as to provide as close as possible to a neutral influence to the translational motion of the drive cord 122 as the cord 122 wraps onto or unwraps from the threaded surface 372 of the drive cone 338, as has already been described with respect to the guide surface 144 of the first cone drive 102. A third interconnecting wall 374 provides added strength to the housing 336.

As was the case with the housing 126 of the first cord drive 102, this housing 336 includes openings 376, 378 in the end walls 346, 348 for rotatingly supporting the axles 158', 160' of the drive cone 338 about its axis of rotation 148' (See FIG. 50), and ramps 380 (See FIG. 52) to assist in sliding the axles 158', 160' of the drive cone 338 into the housing 336.

Referring to FIG. 52, a trough 381 at the bottom of the right end wall 348 and "V" shaped flanges 382 at the top of the same end wall 348 receive corresponding members of the lock spring housing 340 for securely mounting the lock spring housing 340 as will be described later.

Figure 53:
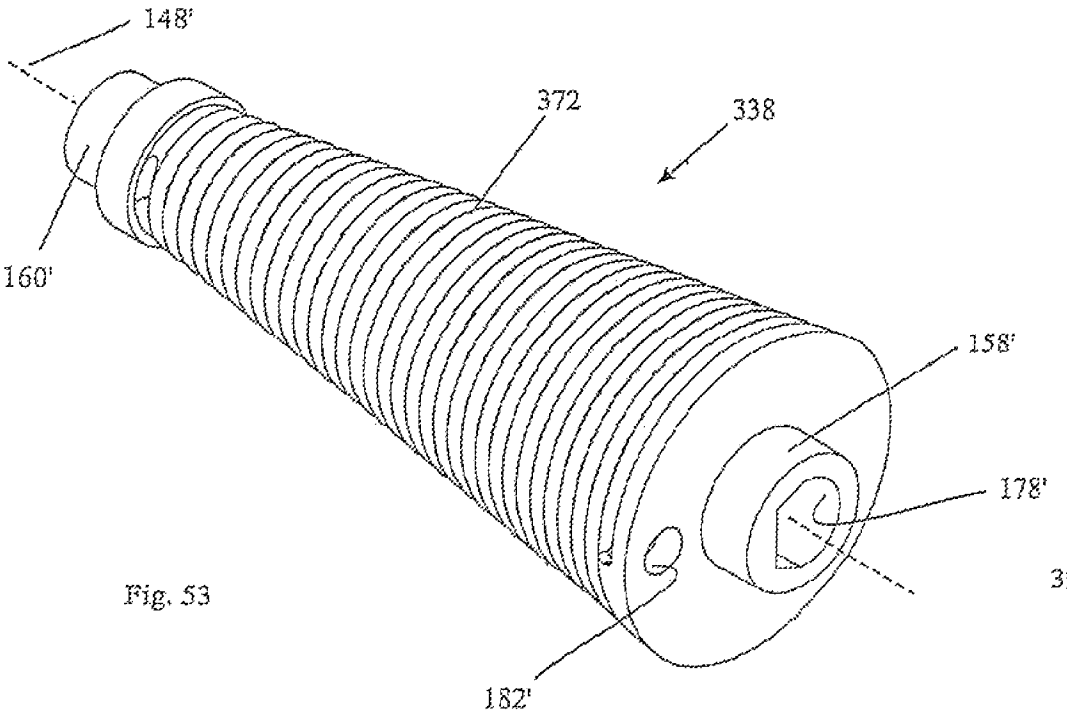
FIG. 53 is a perspective view of the drive cone of FIG. 50.

FIG. 53 shows the drive cone 338, which is very similar to the first drive cone 124 of the cone drive 102 described earlier, including the axles 158', 160' with non-circular internal profiles 178' and the countersunk drive-cord-tie-off hole 182'. As is appreciated in this view, the threaded surface 372 is frustroconical in shape along its entire length, with no cylindrical portion 174 as was found in the first drive cone 124 shown in FIG. 13. However, the profile of the surface 372 of the drive cone 338 could be whatever is needed, depending on the weight of the window covering at various stages of its travel and the amount of outside force deemed acceptable to raise or lower the window covering. As was explained earlier, the drive cones 336, 124 need not necessarily have threads on their outer surfaces 372, 146 respectively; though the threaded surfaces assist in preventing the cord 122 from overwrapping by guiding the cord 122 longitudinally.

If these surfaces 372, 146 are modified to remove the threads, as shown, for instance, in FIG. 146 which depicts a drive cone 124*(with an unthreaded surface 146*) which may be used instead of the drive cone 124, it may be advantageous to have a coating or covering on the surfaces (such as a rubber sleeve) to provide increased friction and resistance to slipping or sliding of the drive cord 122 down the tapered surface of the drive cone. A gripping surface may be applied effectively and inexpensively by putting shrink tubing over the cone and then heating the tubing so it clings tightly to the surface of the cone.

Figure 54:
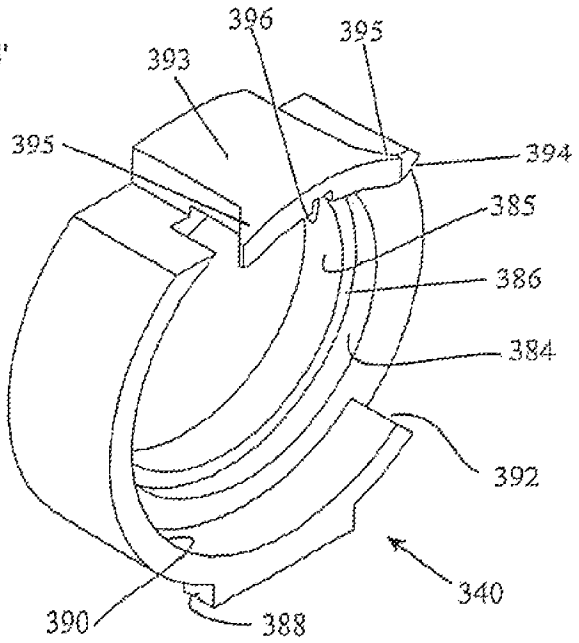
FIG. 54 is a perspective view of the lock spring housing of FIG. 50.

FIG. 54 is an opposite end perspective view of the lock spring housing 340 of FIG. 50. The lock spring housing 340 is essentially a short cylinder with a first inner surface 384 defining a first inside diameter and a second inner surface 385 defining a smaller inside diameter, with a step or flange 386 between these two inner surfaces 384, 385. The lock spring housing 340 also includes a semicircular lip 390, which defines first and second limit stops 392, 394 to limit the rotation of the housing gear 342 as explained below.

A tangentially-extending, rectangular projection 388 at the bottom of the lock spring housing 340 cooperates with the trough 381 (See FIG. 52) to mount and secure the lock spring housing 340 to the cone drive housing 336. An arm 393 on the lock spring housing 340 has "V" shaped projections 395, which slide into the slot formed by the correspondingly "V" shaped flanges 382 in the cone drive housing 336 when the parts 340, 336 are assembled, to hold them securely together (See FIG. 49). An axially-extending slotted groove 396 on the inside of the arm 393 receives a first end 398 of the spring 400 as explained in more detail below.

Figure 55:
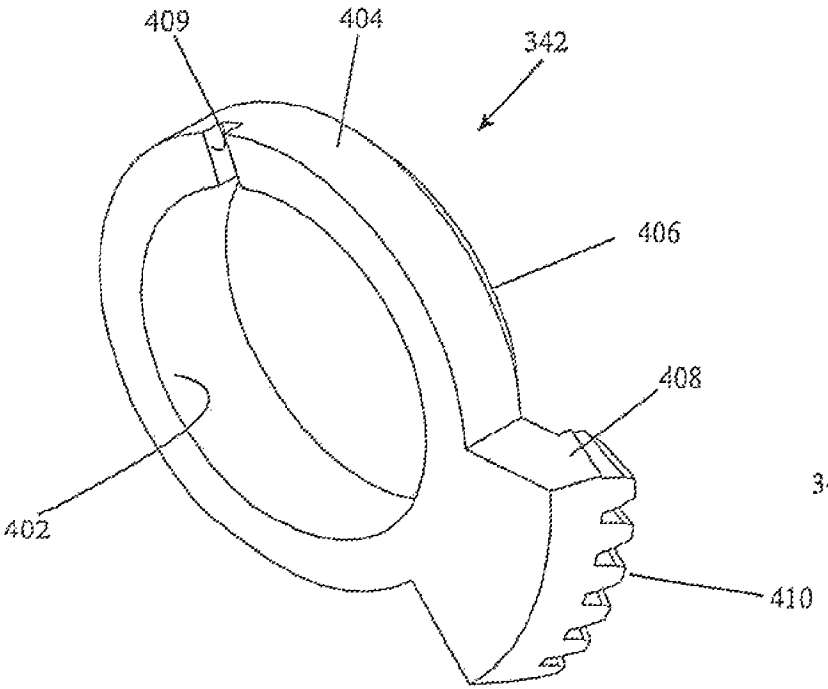
FIG. 55 is a perspective view of the lock spring housing gear of FIG. 50.

FIG. 55 is an opposite end perspective view of the lock spring housing gear 342 of FIG. 50. This housing gear 342 is essentially a ring with an inner surface 402 defining an inside diameter, an outer surface 404 defining an outside diameter sized to rest inside the semi-circular lip 390 of the lock spring housing 340, and another outer surface 406 having a smaller outside diameter than the first outer surface 404 and sized to just fit inside the larger inside diameter surface 384 of the lock spring housing 340. A geared tooth projection 408 extends radially from the first outside diameter surface 404 for a short arc-segment, and the geared teeth 410 are sized and designed to engage the geared teeth 411 on the locking arm 334 (shown in FIG. 50). As seen in FIG. 55, a slot 409 extends radially along a first face of the housing gear 342 between the inside diameter surface 402 and the outside diameter surface 404, and this slot 409 receives the second end 400 of the spring 344 as described later.

Figure 56:
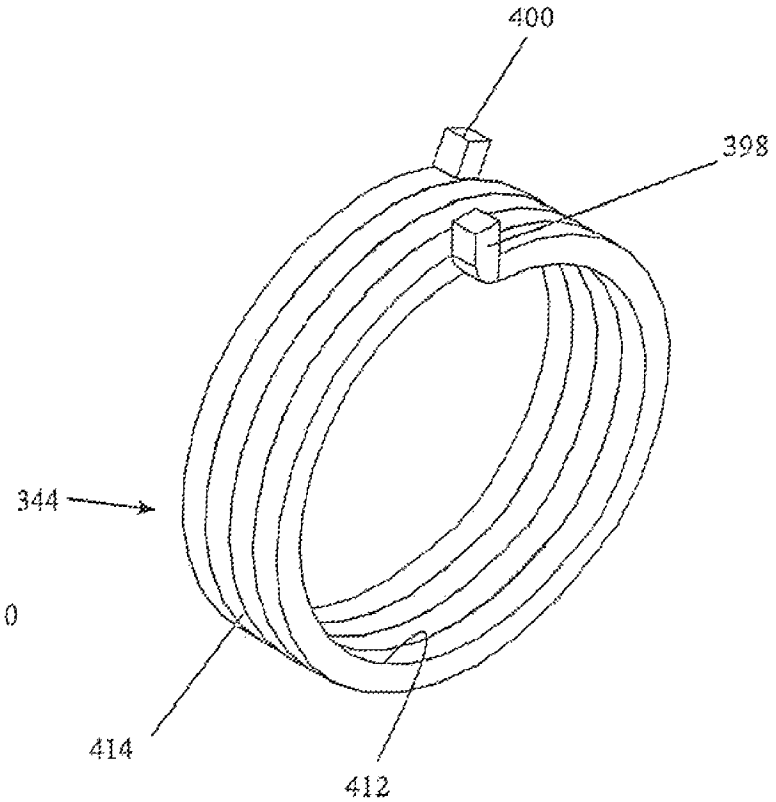
FIG. 56 is a perspective view of the lock spring of FIG. 50.

FIG. 56 is an enlarged view of the lock spring 344 of FIG. 50. It is a tightly coiled spring defining an inside surface 412 and an outside surface 414, and having first and second radially extending ends 398, 400. As explained in more detail later, the spring 344 clamps around the axle 158' of the drive cone 338 to prevent its rotation when the spring 344 is in its "relaxed" state and releases the axle 158', permitting the drive cone 338 to rotate, when the spring 344 is in its tensioned state.

Referring back to FIG. 50, the locking arm 334 is an "L" shaped member having two interconnected legs 416, 420, with the short leg 416 defining a generously-radiused through opening 418 proximate its free end. The long leg 420 terminates in a flat, semi-circular surface 422, which defines a through opening 424 and includes geared teeth 411 along a portion of its outer circumference. The long arm 420 and the semi-circular surface 422 slide between the walls 354, 356 of the cone drive housing 336 such that the locking arm 334 extends through the slotted opening 362, and the axles 358, 360 of the cone drive housing 336 snap into the two sides of the opening 424 of the locking arm 334, allowing the locking arm 334 to rotate about its axis of rotation 426 relative to the cone drive housing 336.

Assembly:

To assemble the cone drive with lever lock mechanism 102', one end of the drive cord 122 is secured to the drive cone 338 by tying a knot or other enlargement at the end of the drive cord 122, then threading the drive cord 122 through the countersunk hole 182' such that the knot or enlargement rests inside the hole 182'. The drive cord 122 is then wrapped around the threaded surface 372 of the drive cone 338. The cone 338 is snapped into the housing 336 so that the axles 158', 160' of the cone 338 extend through the respective holes 376, 378 of the housing 336. The drive cord 122 extends over the guide surface 371 and is then threaded through the opening 364 in the base wall 350 of the housing 336.

Next, the spring 344 is assembled to the lock spring housing gear 342 such that the outside diameter surface 414 of the spring 344 is proximate the inside diameter surface 402 of the housing gear 342 and the end 400 of the spring 344 is engaged in the slot 409 of the housing gear 342. The assembled housing gear 342 and spring 344 are then assembled onto the lock spring housing 340 such that:

- the larger outside diameter surface 404 of the housing gear 342 rests inside the semi-circular lip 390 of the lock spring housing 340,
- the smaller outside diameter surface 406 of the housing gear 342 rests inside the larger inside diameter surface 384 of the lock spring housing 340,
- the first end 398 of the spring is engaged inside the slotted groove 396 of the lock spring housing 340, and
- the geared tooth projection 410 of the housing gear 342 rests between the limit stops 392, 394 of the lock spring housing 340.

This assembly, including the lock spring housing 340, the spring 344, and the lock spring housing gear 342, is mounted onto the portion of the axle 158' which extends beyond the vertical wall 348 of the cone drive housing 336. It may be necessary to push down slightly (rotate) the lock spring housing gear 342 relative to the lock spring housing 340 so as to move the second end 400 of the spring 344 counter-clockwise, to force the spring 344 to "open" (uncoil) enough for the inside diameter surface 412 of the spring 344 to slide over the axle 158' of the drive cone 338. The "V" shaped projections 395 on the lock spring housing 340 slide into the slot formed behind the correspondingly "V" shaped flanges 382 in the cone drive housing 336, and the rectangular projection 388 at the bottom of the lock spring housing 340 falls into the trough 381 for a secure mounting of the lock spring housing 340 onto the cone drive housing 336.

The locking arm 334 is assembled onto the cone drive housing 336 as described earlier, such that the axles 358, 360 of the cone drive housing 336 snap into the opening 424 of the locking arm 334, and the geared teeth 411 of the locking arm 334 mesh with the geared teeth 410 of the lock spring housing gear 342. The drive cord 122 is threaded through the opening 418 at the end of the short leg 416 of the L-shaped locking arm 334, extends up through the hole 364, over the guide surface 371, and wraps onto the drive cone 338, and the entire assembly is mounted onto the head rail 108 such that the rectangular lip 366 at the bottom of the cone drive housing 336 fits into a corresponding hole in the bottom of the head rail 108, and the upwardly-projecting ears 368 of the cone drive housing 336 snap in against the head rail's profile. The free end of the cord 122 then extends through to a tassel weight 232 (as shown in FIG. 6) and is tied off to secure it to the tassel weight 232.

As the operator pulls on the drive cord 122, he also pulls on the short leg 416 of the locking arm 334, since the cord 122 goes through the opening 418 at the end of the locking arm 334. This causes the locking arm 334 to rotate in a counter-clockwise direction (as seen from the vantage point of FIG. 6) about its axis of rotation 426 to its extended position. Since the teeth 411 of the locking arm 334 are meshed with the geared teeth 410 of the lock spring housing gear 342, as the locking arm 334 rotates, it causes the lock spring housing gear 342 to rotate about its axis of rotation (which coincides with the axis of rotation 148' of the drive cone 338).

As the lock spring housing gear 342 rotates, its slot 409, which is engaged with the second end 400 of the spring 344, causes that end 400 of the spring 344 to rotate. The first end 398 of the spring 344 is received in the slotted groove 396 of the lock spring housing 342 and is thus unable to move. Thus, the rotation of the end 400 of the spring 344 causes the inside diameter of the spring 344 to increase, causing the spring 344 to release its grip on the axle 158' of the drive cone 338, so the drive cone 338 can rotate freely. The operator may then pull on the drive cord 122 to raise the blind or allow the drive cord 122 to wind up onto the drive cone 338 as the blind lowers by gravity.

When the drive cord 122 is released, releasing the lever arm 334, the spring 344 returns to its "at rest" position, retracting the lever arm 334 and allowing the spring 344 to again contract and grip the axle 158' of the drive cone 338, preventing rotational motion of the drive cone 338. This locks the window covering 330 so it is neither raised nor lowered upon release of the drive cord 122 by the operator. The lock spring housing gear 342 need only rotate through a small arc, defined by the distance between the two limit stops 392, 394 of the lock spring housing 340, to move the spring from a locking position to a release position.

The operator need only keep enough tension on the drive cord 122 to cause the arm 334 to rotate counter-clockwise to its extended position in order to free the drive cone 338 for rotation about its axis of rotation 148'. If the operator pulls hard enough on the drive cord 122, the cord 122 begins unwrapping from the drive cone 338, causing the drive cone 338 to rotate, and causing the lift rod 118 and tilt stations 116" to rotate to raise the window covering 330. However, if the operator eases up on the drive cord 122 while still maintaining enough tension on the drive cord 122 to keep the locking arm 334 extended, then the weight of the window covering causes the window covering to lower, unwrapping the lift cords from the lift drums of the lift and tilt stations 116", causing the lift rod 118 and drive cone 338 to rotate, and wrapping the drive cord 122 onto the drive cone 338.

Tilter Mechanism with Roller Lock

Figure 10:
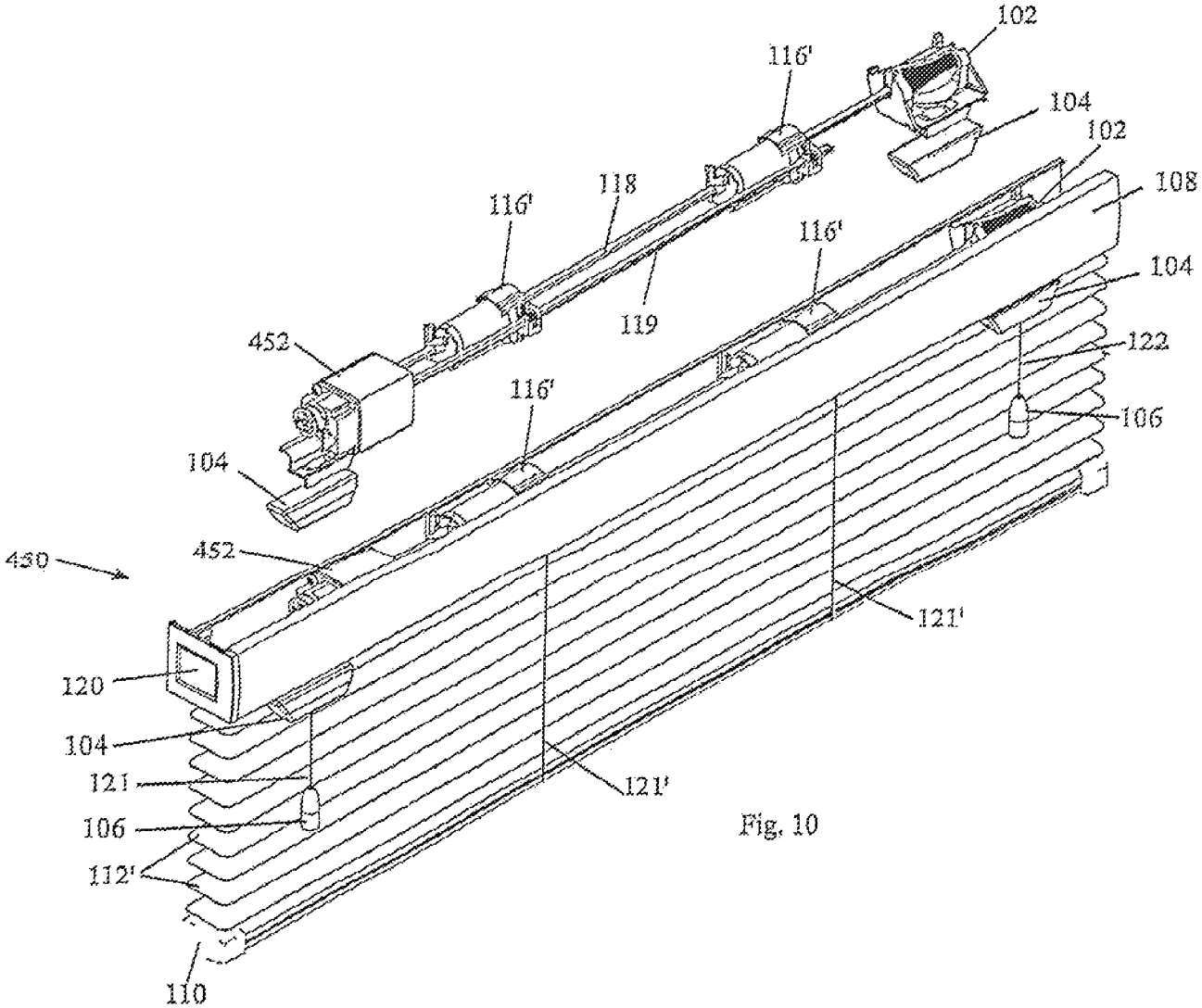
FIG. 10 is a partially exploded, perspective view of a blind incorporating a cord drive with roller lock and tassel weight similar to FIG. 2 but with a spring assist tilt mechanism.

FIG. 10 shows an embodiment of a blind 450, which includes the same elements already described with respect to the blind 100' of FIG. 2, except that the tilter mechanism 117 is replaced by a new tilter mechanism 452 using a roller lock 104. This mechanism allows the use of a single tilt drive cord 121 instead of the two-tilt-cord configuration of FIG. 2. A biasing means (in this embodiment a relatively weak coiled spring) in the tilter mechanism 452 biases the blinds toward the tilted closed position in one direction (say, for instance, the tilted-closed-room-side-up position). The operator pulling on the tilt drive cord 121 acts against the force of the weak spring to open the blind or even to tilt it fully closed in the opposite direction (tilted-closed-room-side-down, for instance), as is described in more detail below. The spring is typically relatively weak and is used to tilt the blind closed to a certain point to provide privacy but not necessarily to provide full light closure. By pulling on the tilt drive cord 121, the user can open the blind or fully close it, which requires an additional force to overcome the weight of the blind. A locking mechanism (the roller lock 104 described earlier is shown in this embodiment) keeps the slats 112' tilted at the desired position when the cord 121 is released and allows the spring to rotate the tilt drum in the opposite direction when the tassel weight on the tilt drive cord is lifted, allowing the tilt drive cord to surge its capstan.

This blind 450 has a high degree of symmetry when arranged as shown here. The drive end and the tilter end look like mirror images of each other, each one with a single cord and tassel weight hanging off of its respective roller lock mechanism 104. It should be readily obvious that the same embodiments described earlier for the roller lock mechanism 104 on the drive end of the window covering (such as the roller lock with locking dog, and the roller lock with wand) may also be applied to the roller lock mechanism 104 on the tilter end of the window covering. It should also be readily obvious that any other types of locking mechanisms, such as the lever lock mechanism 332 described earlier, may be used instead of the roller lock mechanism 104 to achieve the same results.

FIGS. 57 through 68 show the tilter mechanism 452 of FIG. 10 in more detail. The roller lock mechanism 104 is shown in some views but is deleted from other views for the sake of clarity. In any event, this roller lock mechanism 104 and its operation are identical to the roller lock mechanism 104 described earlier with respect to earlier embodiments.

Figure 59:
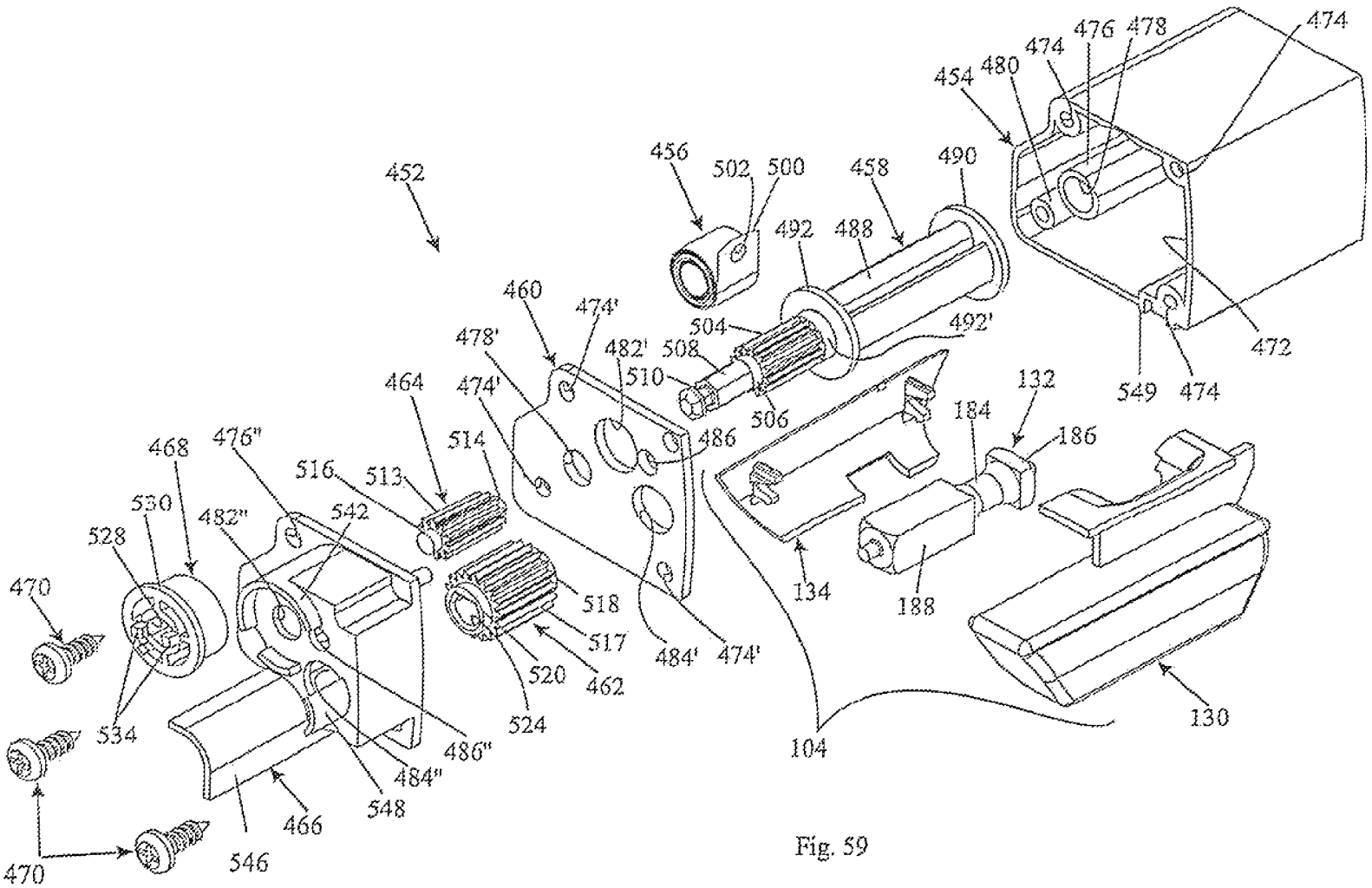
FIG. 59 is an exploded perspective view of the tilter mechanism of FIG. 57 (cord removed for clarity)

Referring to FIG. 59, the tilter mechanism 452 includes a spring housing 454, a spring 456, a pulley gear 458, a housing plate 460, a tilt gear 462, an idler gear 464, a gear housing 466, a pulley 468, and self-tapping screws 470. The roller lock mechanism 104 includes the previously described roller lock housing 130, the roller lock 132, and the roller lock housing cover 134.

Figure 58:
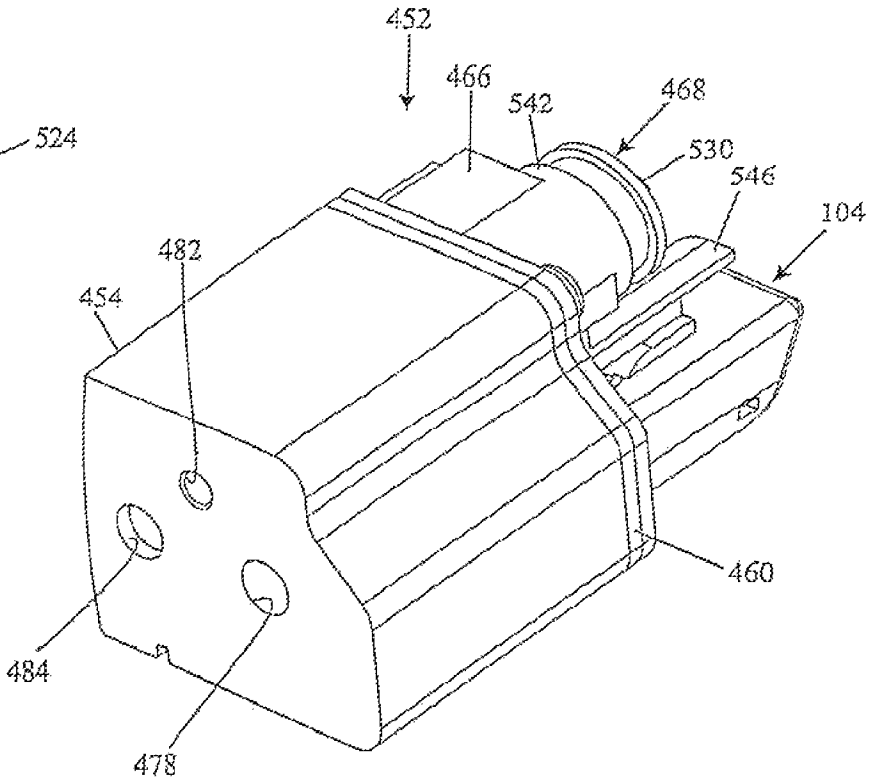
FIG. 58 is a rear perspective view of the tilter mechanism of FIG. 57.
Figure 61:
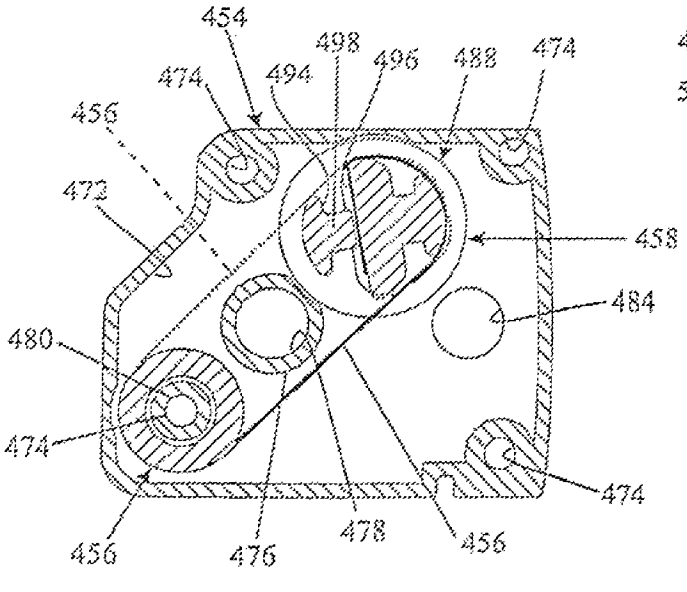
FIG. 61 is a view along line 61-61 of FIG. 60.

Referring to FIGS. 58, 59, and 61, the spring housing 454 is a substantially rectangularly-profiled member defining a cavity 472 and corner-placed screw holes 474 to accommodate the self-tapping screws 470 during final assembly. A first axially-extending projection 476 defines a through hole 478 to allow the lift rod 118 (See FIG. 10) to extend through the tilter mechanism 452. A second axially-extending projection 480 rotationally supports the spring 456 as described in more detail later and as shown in FIG. 61. The rear wall of the spring housing 454 also defines a hole 482 (See FIG. 58) for rotational support of the pulley gear 458, and a hole 484 which allows the tilt rod 119 (See FIG. 10) to extend through the tilter mechanism 452. Thus, the tilter mechanism 452 may be placed anywhere along the length of the head rail 108, since both the lift rod 118 and the tilt rod 119 may extend completely through the tilter mechanism 452.

Figure 62:
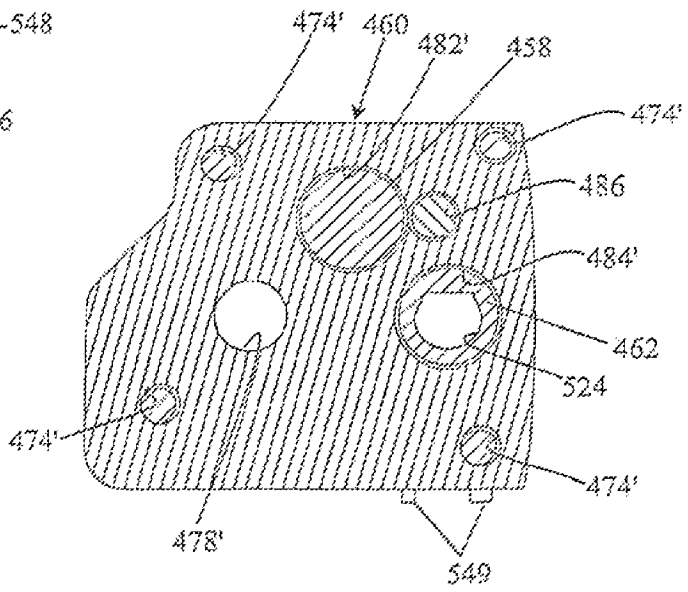
FIG. 62 is a view along line 62-62 of FIG. 60.
Figure 60:
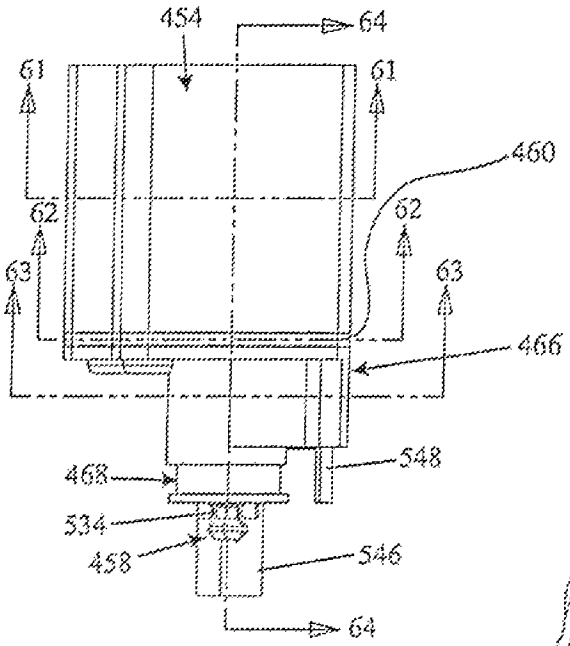
FIG. 60 is a plan view of the tilter mechanism of FIG. 57 (with the roller lock mechanism removed for clarity)

Referring to FIGS. 59 and 62, the housing plate 460 has a substantially rectangularly-shaped profile to match that of the spring housing 454, and it defines holes 474', 478', 482', and 484', which line up with and correspond to the holes 474, 478, 482, and 484 respectively in the spring housing 454. An additional hole 486 provides rotational support for the idler gear 464, while the hole 484' provides similar rotational support for the tilt gear 462.

Figure 66:
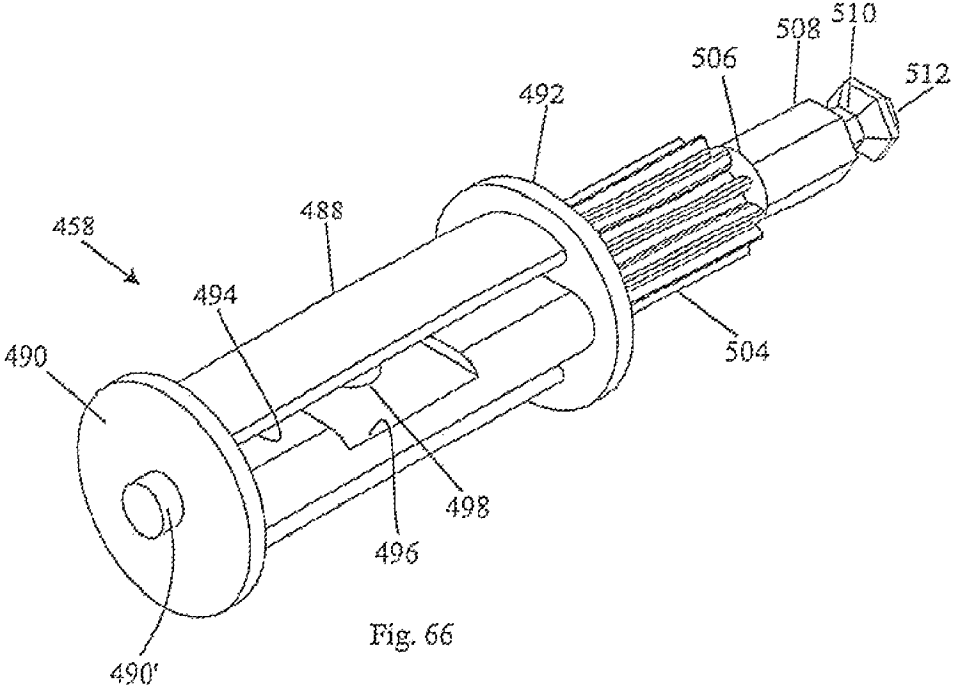
FIG. 66 is a perspective view of the pulley gear of FIG. 59.

Referring to FIGS. 59 and 66, the pulley gear 458 includes a spring wind-up spool 488 with two end flanges 490, 492. The wind-up spool 488 defines a longitudinal slotted cavity 494 further defining a recessed flat 496 and an inwardly projecting button 498 projecting from the opposite side of the cavity 494 toward the recessed flat 496 (See FIGS. 61 and 66). The spring 456 has a first end 500, which defines a hole 502 that receives the button 498 to releasably attach the end 500 of the spring 456 to the wind-up spool 488 of the pulley gear 458.

Shoulders 490' and 492' just outside the respective flanges 490, 492, are supported by the hole 482 in the spring housing 454, and corresponding hole 482' in the housing plate 460, for rotational support of the pulley gear 458. The pulley gear 458 has a splined extension 504, another shoulder 506 for rotational support of the pulley gear 458 against the gear housing 466, and yet another extension 508, having a hexagon profile, with a circumferential notch 510 proximate the end 512 of the pulley gear 458. As described below, the notch 510 is used to secure the pulley 468 to the pulley gear 458.

Referring to FIG. 59, the idler gear 464 is a splined cylinder 513 with short axles 514, 516 which are supported for rotation by the housing plate 460 at the hole 486 and by the gear housing 466 at the hole 486". The splined cylinder 513 meshes with the splined extension 504 of the pulley gear 458 and with the splined cylinder 517 of the tilt gear 462 (See FIG. 63). The tilt gear 462 also has axles 518, 520 which are supported for rotation by the housing plate 460 at the hole 484' and by the gear housing 466 at the hole 484". The hub of the tilt gear 462 defines a non-circular profile opening 524, which engages the similarly shaped profile of the tilt rod 119.

Figure 65:
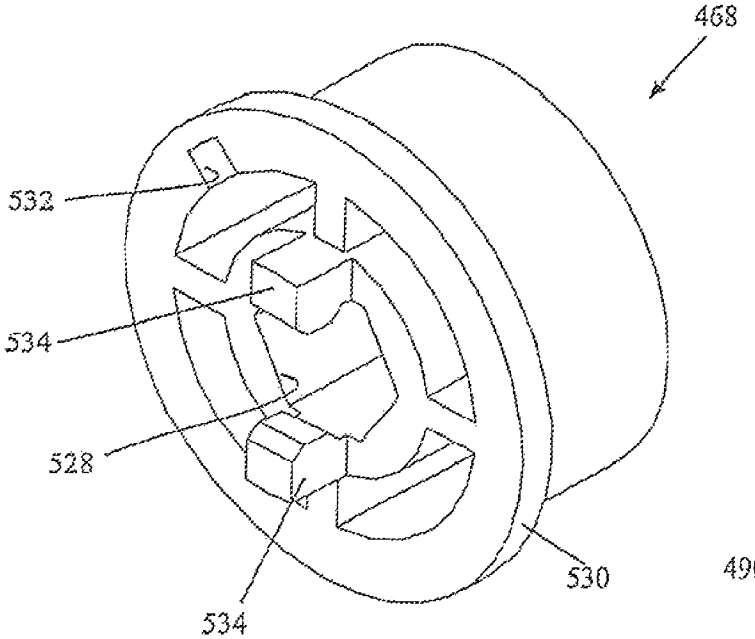
FIG. 65 is a perspective view of the pulley of FIG. 59.

Referring to FIGS. 59 and 65, the pulley 468 is a cylindrical member with a hollow, hexagonally-profiled central opening 528 which closely matches the profile of the extension 508 of the pulley gear 458. A flange 530 at one end of the pulley 468 defines an axially extending hole 532 for tying off the tilt cord 121 to the pulley 468, as described later. Two ramped arms 534 project axially from the pulley 468 and are designed to snap in place around the notch 510 in the pulley gear 458 to securely attach the pulley 468 to the pulley gear 458 when the pulley 468 is mounted over the extension 508 of the pulley gear 458.

Figure 68:
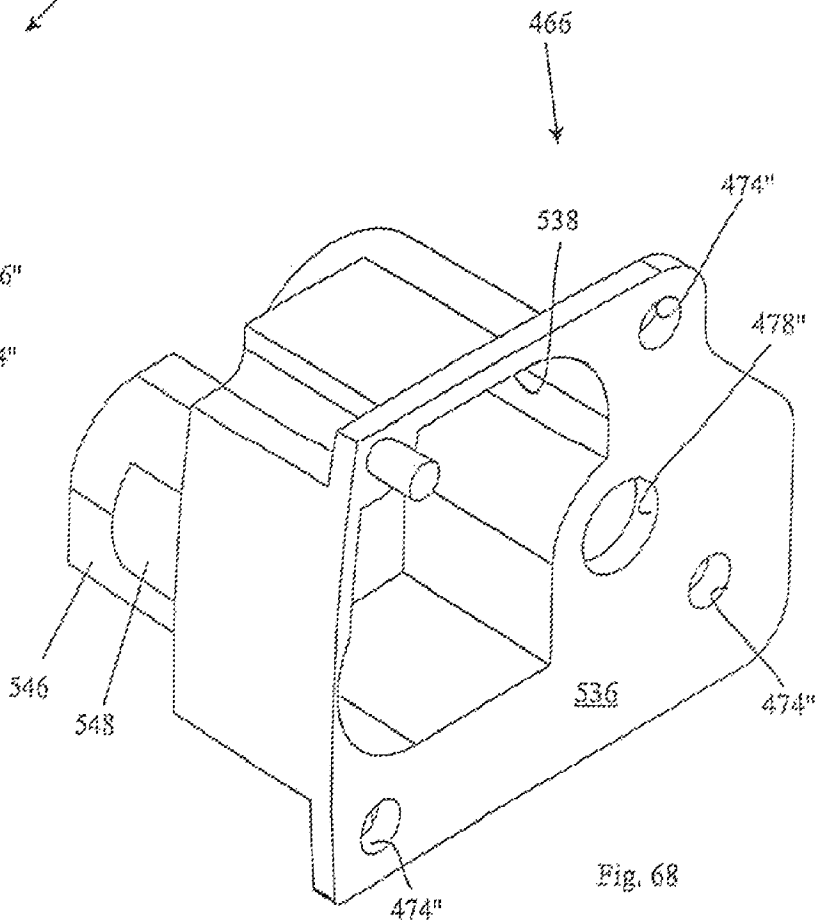
FIG. 68 is an opposite-end, perspective view of the gear housing of FIG. 67.
Figure 67:
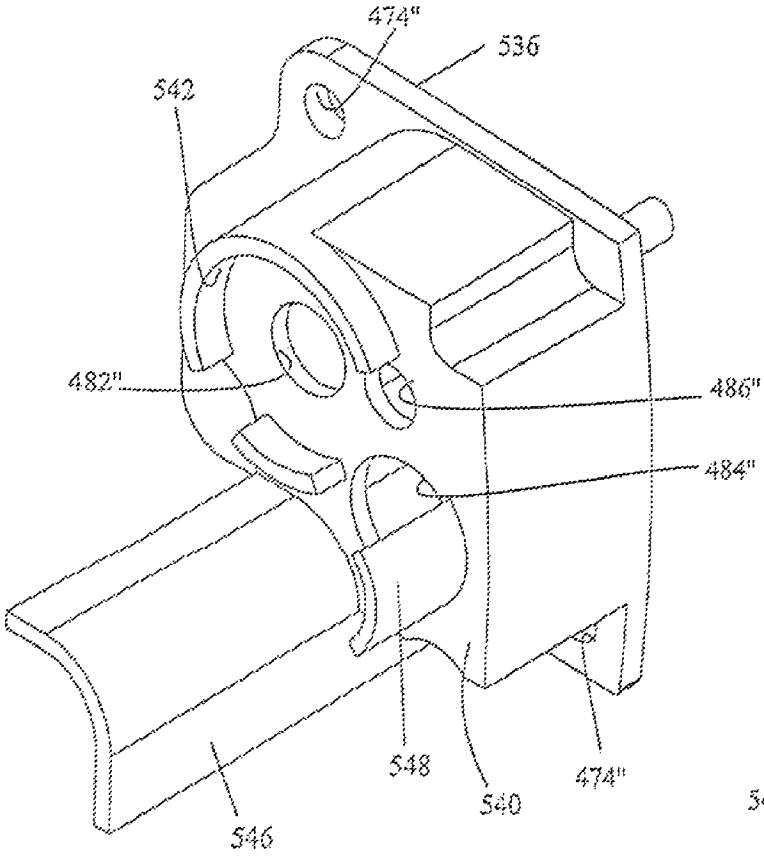
FIG. 67 is a perspective view of the gear housing of FIG. 59.

Referring to FIGS. 67 and 68, the gear housing 466 is a substantially rectangularly-shaped member including a first end wall 536 having the same shape as the housing plate 460 and defining holes 474" which line up with corresponding holes 474' in the housing plate 460 and corresponding holes 474 in the spring housing 454. The tilter 452 is held together by inserting the self-tapping screws 470 through these sets of corresponding holes. The end wall 536 of the gear housing 466 also defines a hole 478" which lines up with the hole 478' in the housing plate 460 and with the hole 478 in the spring housing 454 to form a passageway for the lift rod 118.

A cavity 538 in the gear housing 466 (See also FIG. 63) is open to the end wall 536, and this cavity 538 houses the splined extension 504 of the pulley gear 458, the idler gear 464, and the tilt gear 462. The opposite end wall 540 of the gear housing 466 defines holes 482", 486", and 484" which line up with and correspond to the holes 482', 486, and 484' of the housing plate 460. As has already been described, the cylindrical shoulder 506 of the pulley gear 458 rests on the hole 482" of the gear housing 466; the axle 516 of the idler gear 464 rests on the hole 486" of the gear housing 466; and the axle 520 of the tilt gear 462 rests on the hole 484" of the gear housing 466, such that the pulley gear 458, the idler gear 464 and the tilt gear 462 are meshed together and supported for rotation about their respective axes of rotation. The hexagonally-profiled extension 508 of the pulley gear 458 extends through the hole 482" and beyond the end wall 540 of the gear housing 466, and the pulley 468 is mounted onto this extension 508, with the ramped projections 534 of the pulley 468 snapping in place in the groove 510 to lock the pulley 468 onto the pulley gear 458. (See FIG. 64)

Figure 57:
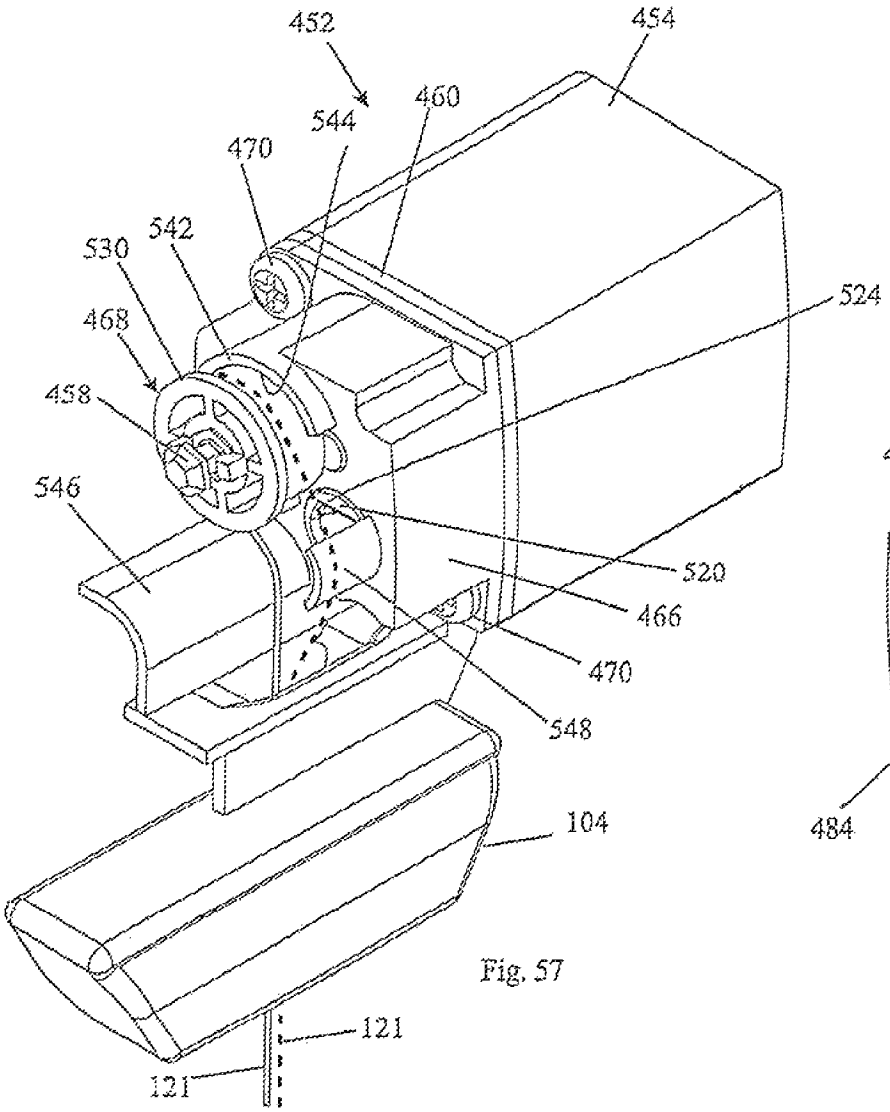
FIG. 57 is a front perspective view of the tilter mechanism of FIG. 10.

Referring briefly to FIGS. 57-59, an arcuate lip 542 surrounding a substantial portion of the hole 482" defines a radial gap 544 preferably less than the diameter of the tilt cord 121 between the cord-receiving surface of the pulley 468 and the lip 542, in order to prevent the tilt cord 121 from sliding off the pulley 468. Thus, the cord 121 winds onto the pulley 468 between the flange 530 and the lip 542. An axially-extending shield 546 serves to guide the tilt cord 121 onto the pulley 468 when the tilt cord 121 is wrapped onto the pulley 468 in a counter-clockwise direction as seen from the vantage point of FIG. 57 and represented by the solid line drawing of the cord 121. The shield 546 also protects the tilt cord 121 from contact with the lift rod 118. A second axially-extending shield 548 serves to guide the tilt cord 121 onto the pulley 468 when the tilt cord 121 is wrapped onto the pulley 468 in a clockwise direction as seen from the vantage point of FIG. 57 and represented by the phantom line drawing of the cord 121. This second shield also protects the tilt cord 121 from contact with the tilt rod 119.

Assembly:

To assemble the tilter 452 with roller lock mechanism 104, the end 500 of the spring 456 is inserted in the slotted cavity 494 of the pulley gear 458 and is deformed slightly to enter the area of the flat 496, so that, when the end of the spring returns to its normal shape the button 498 of the pulley gear 458 is received the hole 502 of the spring 456, securing the spring 456 to the pulley gear 458.

Figure 64:
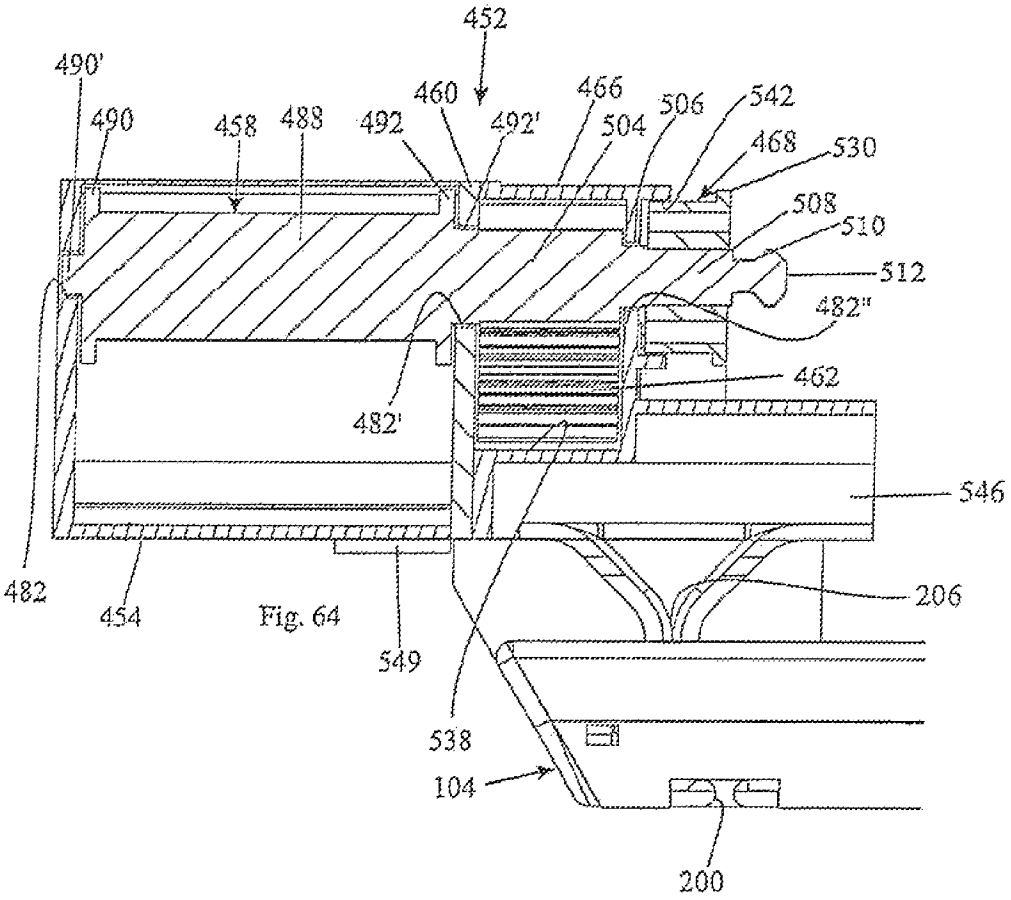
FIG. 64 is a view along line 64-64 of FIG. 60 (but with the partially-broken-away roller lock mechanism added back in to show the relationship between the tilter mechanism and the roller lock mechanism)
Figure 63:
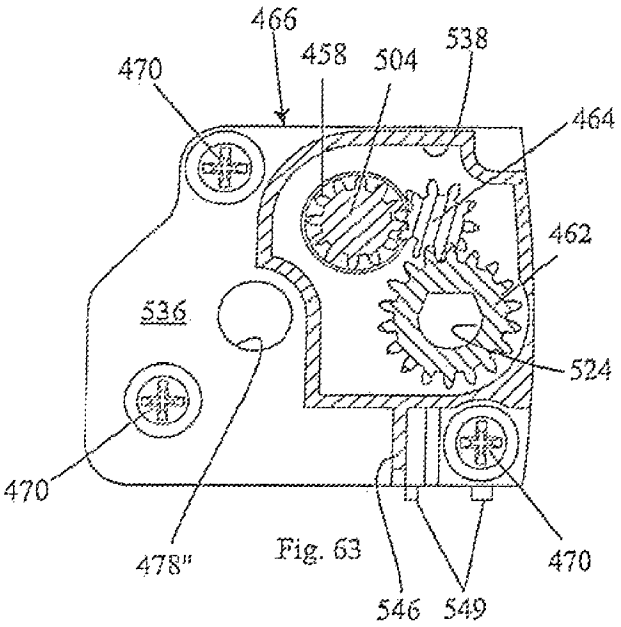
FIG. 63 is a view along line 63-63 of FIG. 60.

This spring 456 and pulley gear 458 assembly is then installed in the cavity 472 of the spring housing 454, with the spring 456 mounted for rotation on the extension 480 and the pulley gear 458 mounted for rotation in the hole 482 (see FIG. 64). The housing plate 460 is installed so as to enclose the cavity 472, with the shoulder 492' of the pulley gear 458 resting in the hole 482'.

The idler gear 464 and the tilt gear 462 are mounted into the corresponding holes 486 and 484' respectively of the housing plate 460 such that the splined extension 504 of the pulley gear 458 meshes with the idler gear 464, and the idler gear 464 in turn meshes with the tilt gear 462. The gear housing 466 is then installed such that the splined extension 504 of the pulley gear 458, the idler gear 464, and the tilt gear 462 are all housed within the cavity 538, and the hexagonally-profiled extension 508 of the pulley gear 458 projects through the hole 482" of the gear housing 466. The axle 516 of the idler gear 464 rests in the hole 486" and the axle 524 of the tilt gear 462 rests in the hole 484". The pulley 468 then is installed over the extension 508 of the pulley gear 458, such that the ramped projections 534 snap into the notch 510 to secure the pulley 468 to the pulley gear 458, and the screws 470 then are threaded through the openings 474" of the gear housing 466, the openings 474' of the housing plate 460 and the openings 474 of the spring housing 454 and are tightened to secure the entire assembly 452 together.

The assembly 452 then is snap mounted onto the head rail 108 with the aid of the feet 549 (See FIGS. 62, 63, and 64), and the roller lock mechanism 104 is also mounted onto the head rail 108 as has already been described for earlier embodiments.

One end of the tilt drive cord 121 is fed through the opening 532 in the pulley 468 and a knot or other enlargement is tied to the cord 121 on the outside of the pulley flange 530 to secure the cord to the pulley 468. The cord 121 then is wrapped around the pulley 458, and the other end of the cord 121 is fed into the roller lock mechanism 104, as shown in FIG. 57. Once inside the roller lock mechanism 104, the cord 121 is wrapped around the capstan 184 (See FIG. 59) and then the cord 121 extends out the bottom of the roller lock mechanism 104. The free end of the tilt drive cord 121 then is attached to the tassel weight 106 as has already been described for earlier embodiments of the roller lock mechanism 104.

The tilt drive cord 121 may be wrapped onto the pulley 468 either in a clockwise or counter-clockwise direction (See FIG. 57, the phantom line and the solid line depiction of the tilt cord 121 respectively), depending on which way the user prefers to install and operate the mechanism 452. If the cord 121 is wrapped in a counter-clockwise direction, it is routed between the two shields 546, 548. If the cord 121 is wrapped in a clockwise direction, it is routed outside of the shield 548.

Referring briefly to FIGS. 57, 59, 61 and 63, assuming the cord 121 is wrapped in a counter-clockwise direction around the pulley 468 (as shown in a solid line in FIG. 57), the spring 456 (shown in a solid line in FIG. 61) is routed below the projection 476 and is wrapped onto the pulley gear 458 in a clockwise direction. Then, as the user pulls on the tilt drive cord 121 to unwrap it from the pulley (or tilt drive spool) 468, the pulley 468 rotates counter-clockwise, and the pulley gear 458 rotates with it in the same counterclockwise direction. This causes the spring 456 to uncoil from the projection 480 and to wrap onto the wind-up spool 488 of the pulley gear 458.

The counter-clockwise rotation of the pulley gear 458 causes the idler gear 464 to rotate clockwise, which causes the tilt gear 462 to rotate counter-clockwise. The tilt rod 119, which is received in the hub 524 of the tilt gear 462, will also rotate counterclockwise. The tilt rod 119 is connected to the lift and tilt stations 116' (See FIG. 10) and, as explained in the aforementioned U.S. Pat. No. 6,536,503, "Modular Transport System for Coverings for Architectural Openings", the tilt cables (driven cords) 121' on the ladder tapes tilt the slats 112' through the fully open position and then to the fully closed position (if the user continues to pull on the tilt cord 121).

If the operator releases the tilt drive cord 121, the weight of the tassel weight 106 tightens the cord 121 onto the capstan 184 of the roller lock 104, so the cord 121 will not slip around the capstan 184. The spring 456 exerts a clockwise force or load on the pulley gear (or tilt drive spool) 458, trying to unwind itself from the pulley gear 458 in order to return to its relaxed state, and this force rotates the pulley gear 458 clockwise. Clockwise rotation of the pulley gear 458 also rotates the pulley 468 in a clockwise direction, thus pulling up on the tilt cord 121, which lifts the roller lock 132 to its locked position (as already described in earlier embodiments of the roller lock mechanism 104), thereby locking the roller lock mechanism 104. Thus, the slats 112' of blind 450 remain at the angle of tilt in which they were when the operator released the tilt cord 121.

If the operator eases up on the tassel weight 106, the cord 121 slides upwardly past the capstan 184 (surges the capstan 184) and winds up onto the pulley 468 while the pulley 468 is rotating clockwise, driven by the spring 456. If the operator continues to ease up on the weight pulling on the cord 121, the cord 121 continues to wrap onto the pulley 468, the spring continues to unwrap from the pulley gear 458, and the tilt gear 462 also rotates clockwise and with it the tilt rod 119, until the slats 112' are tilted closed.

Thus, in this arrangement, the "relaxed" state of the tilter mechanism 452 is with the spring 456 substantially, if not fully, unwrapped from the pulley gear 458, the cord 121 wrapped onto the pulley 468 and the slats 112' in the tilted closed position (at least tilted closed for privacy, if not titled fully closed for full light closure). By pulling on the tilt cord 121, the operator can rotate the slats 112' of the blind 450 until the blind is fully open or even rotate them further until the slats 112' are fully tilted closed in the opposite direction of the relaxed spring 456 state. If the operator exerts enough force on the cord 121, he can even tilt the slats 112' to the fully closed position for full light closure, which typically requires enough force to overcome the weight of the blind. Releasing of the tilt cord 121 at any point during the rotation of the slats 112' locks the roller lock mechanism 104, holding the slats 112' in the tilted angle in which they were at the point the tilt cord 121 was released.

It will be obvious to those skilled in the art that other tilter mechanisms may be used in conjunction with a locking mechanism and a biasing means to allow a single cord to be used to tilt the window covering. For example, a planetary gear drive tilter mechanism with a biasing spring may be used in conjunction with a locking means. A planetary gear tilter mechanism may be designed to allow a combination of pulley size and gearing within the space available in the head rail 108 which results in increased stroke on the tilt cord 121, yielding finer control and lower forces for tilting the slats 112'. Another example could be a tilter mechanism without any gears, accomplished by wrapping the tilt cord around a drum which is mounted directly to the tilt rod, but again, including the biasing means in conjunction with a locking means to allow a single cord to be used to tilt the window covering.

Single Cord Drive with Spring Assist

Figure 9:
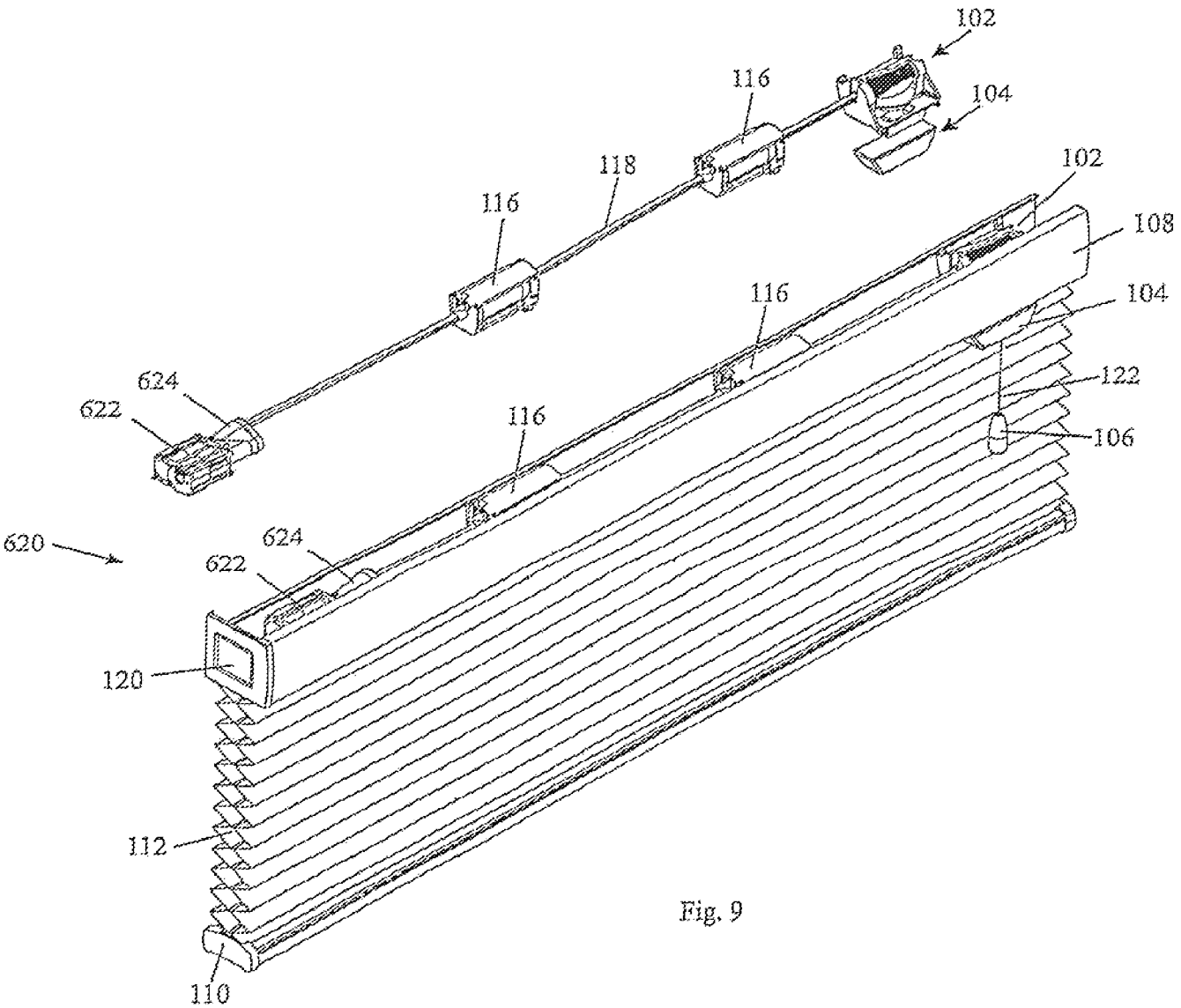
FIG. 9 is a partially exploded, perspective view of a cellular product shade similar to that of FIG. 1 but incorporating a spring motor assist with a transmission.

FIG. 9 depicts another embodiment of a window covering 620, in this case a cellular product, and it includes elements already described with respect to the cellular product 100 of FIG. 1, such as the cone drive 102, the roller lock mechanism 104, the tassel weight 106, the lift rod 118, and the lift stations 116 mounted in the head rail 108. This window covering 620 also includes an assist motor 622 and a transmission 624 as disclosed in the referenced U.S. Pat. No. 6,536,503, "Modular Transport System for Coverings for Architectural Openings". The operation of the cone drive 102 with roller lock mechanism 104 and tassel weight 106 is identical to that already described for the cellular product 100, but the motor 622 assists the rotation of the lift rod 118, to help raise the window covering.

As may be appreciated by comparing FIGS. 1 and 9, the window covering may have no motor assist (be unpowered), or it may have a motor assist 622 with or without a transmission 624 for either an underpowered system or an overpowered system.

If the system is underpowered, the spring motor 622 is too weak to raise the window covering on its own. Instead, it assists the operator, reducing the amount of force the operator has to exert pulling on the drive cord 122 to raise the window covering 620. This feature is particularly useful for large window coverings or for heavy window coverings (such as blinds with wooden slats), where the force required to raise the window covering might otherwise exceed the desirable 12 to 15 pound maximum.

If the system is overpowered, the spring motor 622 is actually stronger than required to raise the window covering 620. In this instance, the operation of the window covering 622 is reversed. Pulling on the drive cord 122 lowers the window covering 620, with the force of gravity assisting the operator in this task. The catalytic force (operator supplied force) required is at a minimum toward the top of the window covering 620, where the entire weight of the window covering 620 is resting on the bottom rail 110 and may be acted upon by the force of gravity to lower it. It is at this point that the drive cord 122 is unwrapping from the cylindrical portion 174 (See FIG. 13) of the drive cone 124. As the window covering 620 is lowered, more of its weight is transferred from the bottom rail 110 to the head rail 108, so less weight is available to assist the operator in lowering the window covering 620, and the operator must thus exert a greater force to overcome the load of the spring motor 622 which is acting to raise the window covering 620. It is at this point that the drive cord 122 is unwrapping from the frustroconical portion 176 (See FIG. 13) of the drive cone 124 resulting in increased leverage (at the expense of increased stroke travel of the drive cord 122).

Other than this "reversal" of the raising and lowering action of the window covering 620, the operation of the cone drive 102 and of the roller lock 104 remains the same as already described for previous embodiments. Thus, also previously described embodiments, such as the roller lock with locking dog, the roller lock with wand, the lever lock, and the single cord tilter mechanism with different types of locking mechanisms may also be used in conjunction with a motor assist.

Alternate Embodiments for a Roller Lock Mechanism

FIGS. 83 through 91 depict an alternate embodiment for a roller lock mechanism 104''' made in accordance with the present invention. This roller lock mechanism 104''' may be used instead of the roller lock mechanisms previously described herein. For brevity, only the embodiment 104''', which may be a direct replacement for the roller lock mechanism 104 of FIGS. 1 and 11, is depicted here. It will be obvious to those skilled in the art that the same concept may readily be used to replace the roller lock mechanism with the locking dog 104', the roller lock mechanism with wand actuator 104'', and the tilter 452 with roller lock mechanism 104.

As may be appreciated by comparing this alternate embodiment of a roller lock mechanism 104' with the roller lock mechanism 104 (See FIG. 13), the differences are subtle but significant. This roller lock mechanism 104' includes a rotor 132''' (also referred to as a roller lock 132'''), a housing 130' and a cover 134'''. The cover 134' serves only an aesthetic purpose, snapping onto and covering the front of the housing 130''' (as compared with the cover 134 which snaps onto the rear of the housing 130 and serves the functional purpose of trapping the rotor 132 in the cavity 218 of the housing 130).

Figures 86, 87:
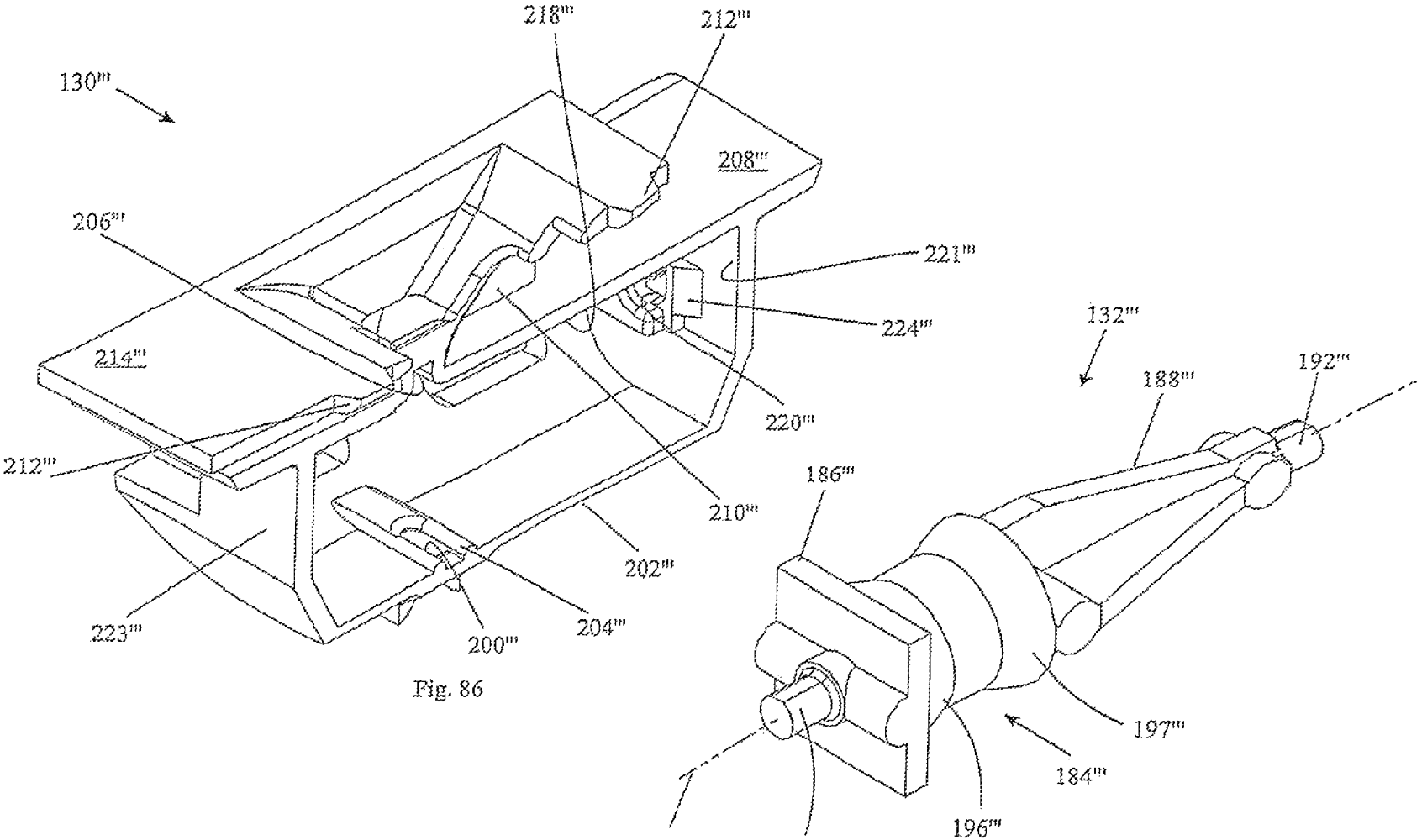
FIG. 86 is a perspective view of the main housing of the roller lock mechanism of FIG. 83.
FIG. 87 is a perspective view of the rotor of the roller lock mechanism of FIG. 85.

Referring to FIG. 87, the rotor 132''' includes a capstan 184''' flanked by outer and inner ramped surfaces 196''' and 197''', respectively. Proximate the outer ramped surface 196''' is a square-profiled portion 186''', followed by a short outer axle end 190''. Proximate the inner ramped surface 197''' is a frustroconically-profiled portion 188', which ends in a short inner axle end 192'. The axle ends 190''', 192' define the axis of rotation 198''' of the rotor 132'''. The capstan 184''' is depicted as having a smooth surface as compared with the octagonally-profiled capstan 184 of the roller lock mechanism 104. As discussed earlier, the capstan 184 or 184''' may have a variety of profiles, and the texture of this surface may be enhanced (by such means as knurling, sandblasting, or coating with rubber, for instance) to improve its frictional characteristics.

Figure 85:
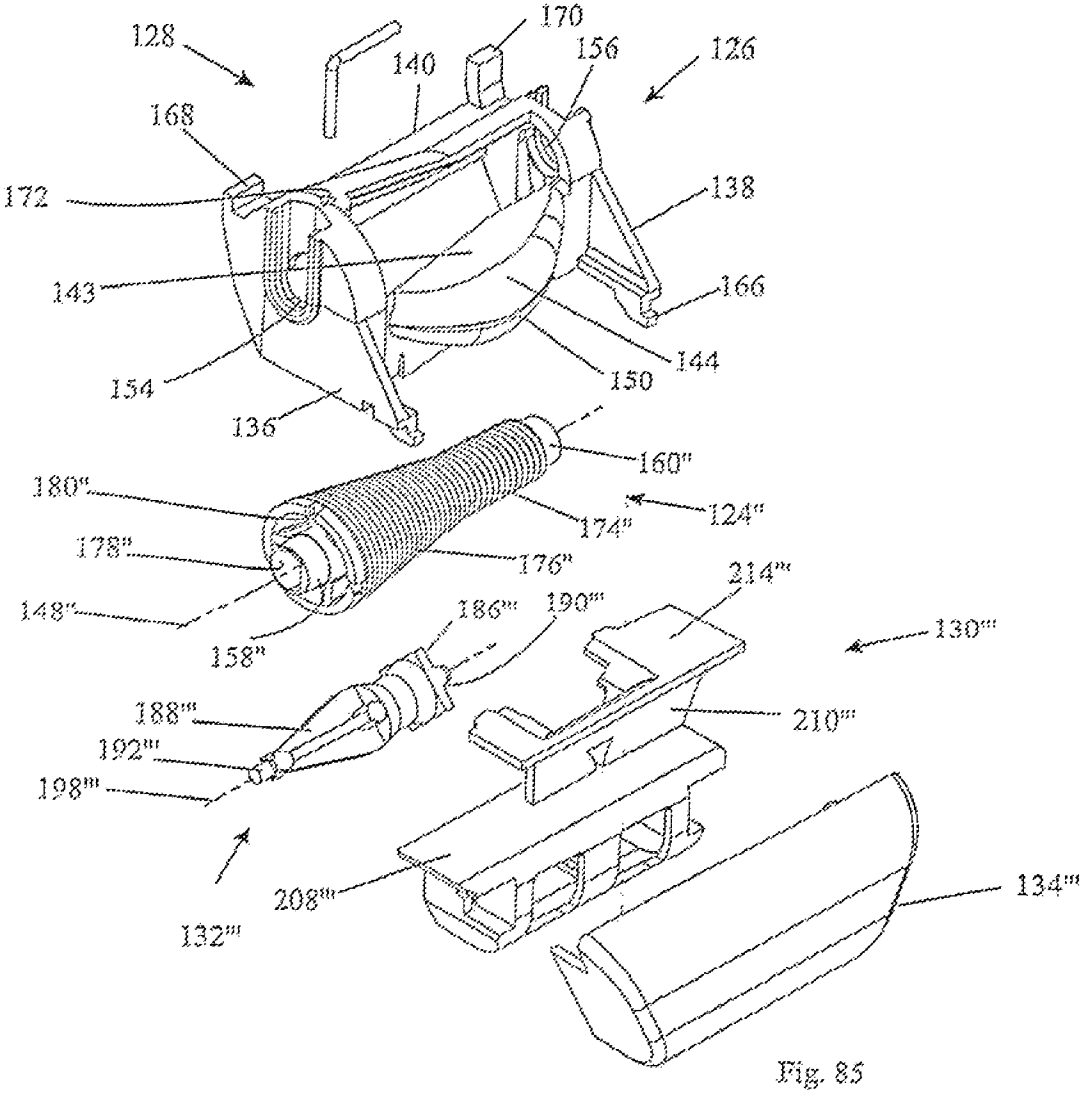
FIG. 85 is an exploded perspective view of the cord drive with roller lock mechanism of FIG. 83.
Figure 89:
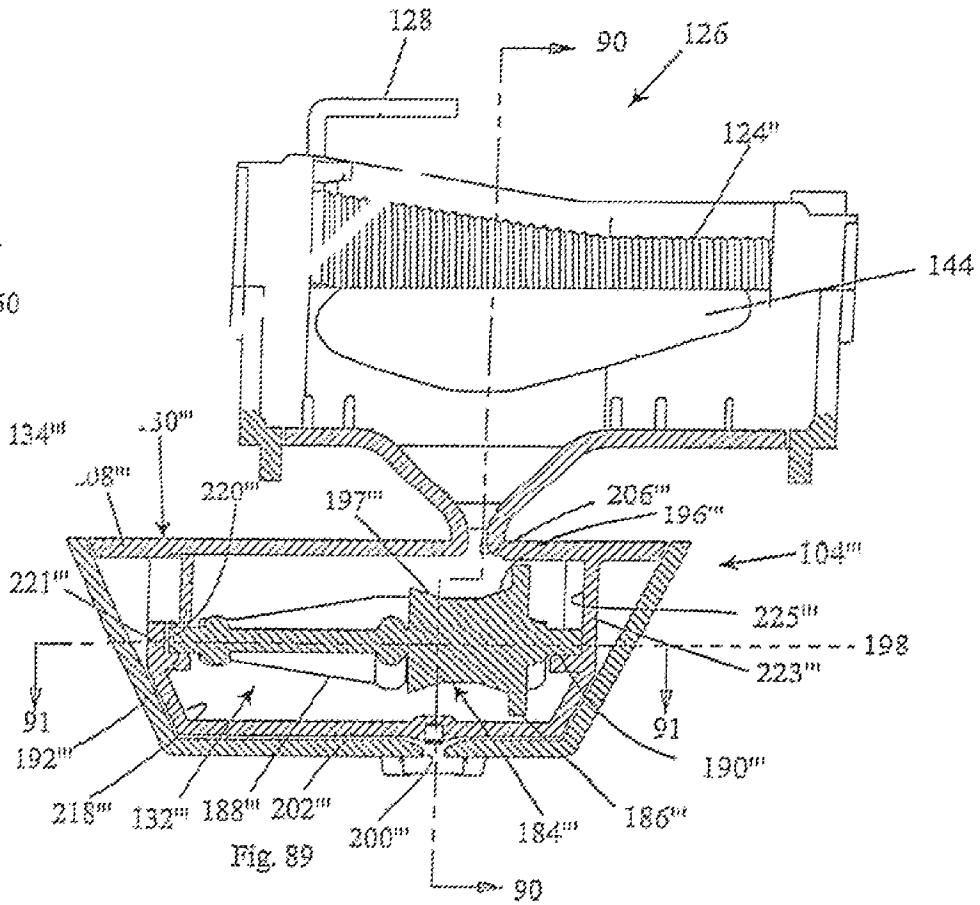
FIG. 89 is a sectional view along line 89-89 of FIG. 88 with the roller lock in the rotating position.
Figure 88:
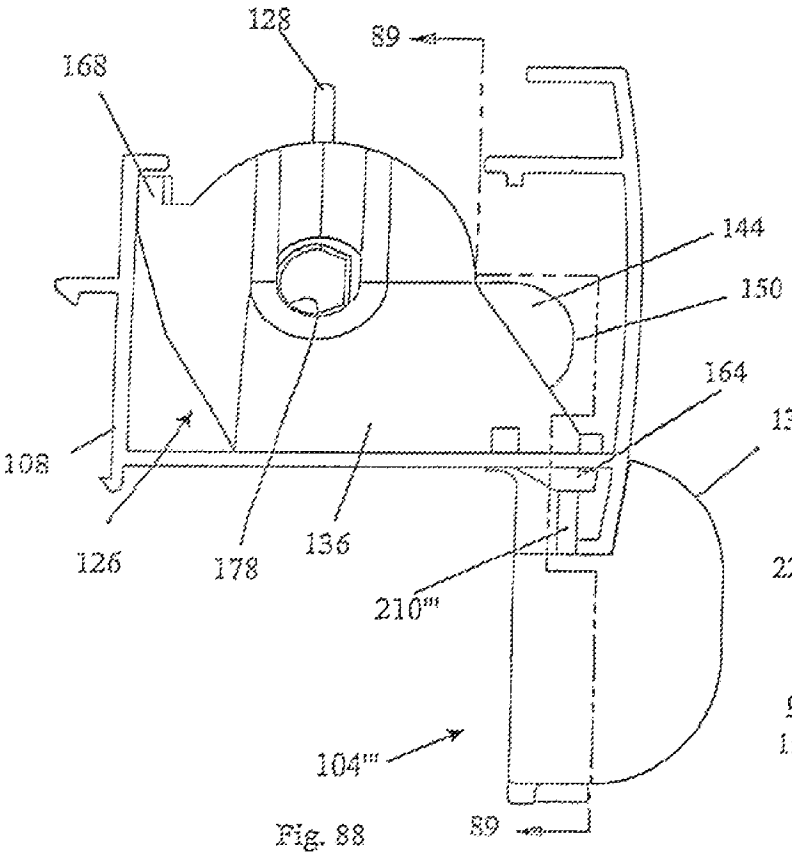
FIG. 88 is a left side end view of the cord drive with roller lock mechanism of FIG. 83 (with the head rail added)
Figure 91:
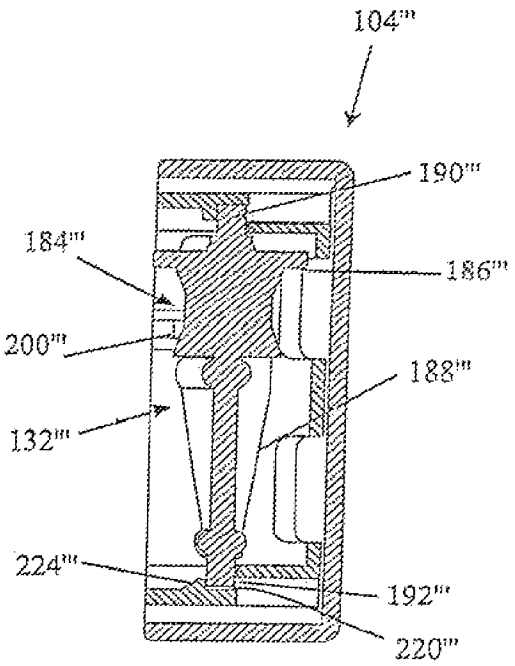
FIG. 91 is a sectional view along line 91-91 of FIG. 89.
Figure 90:
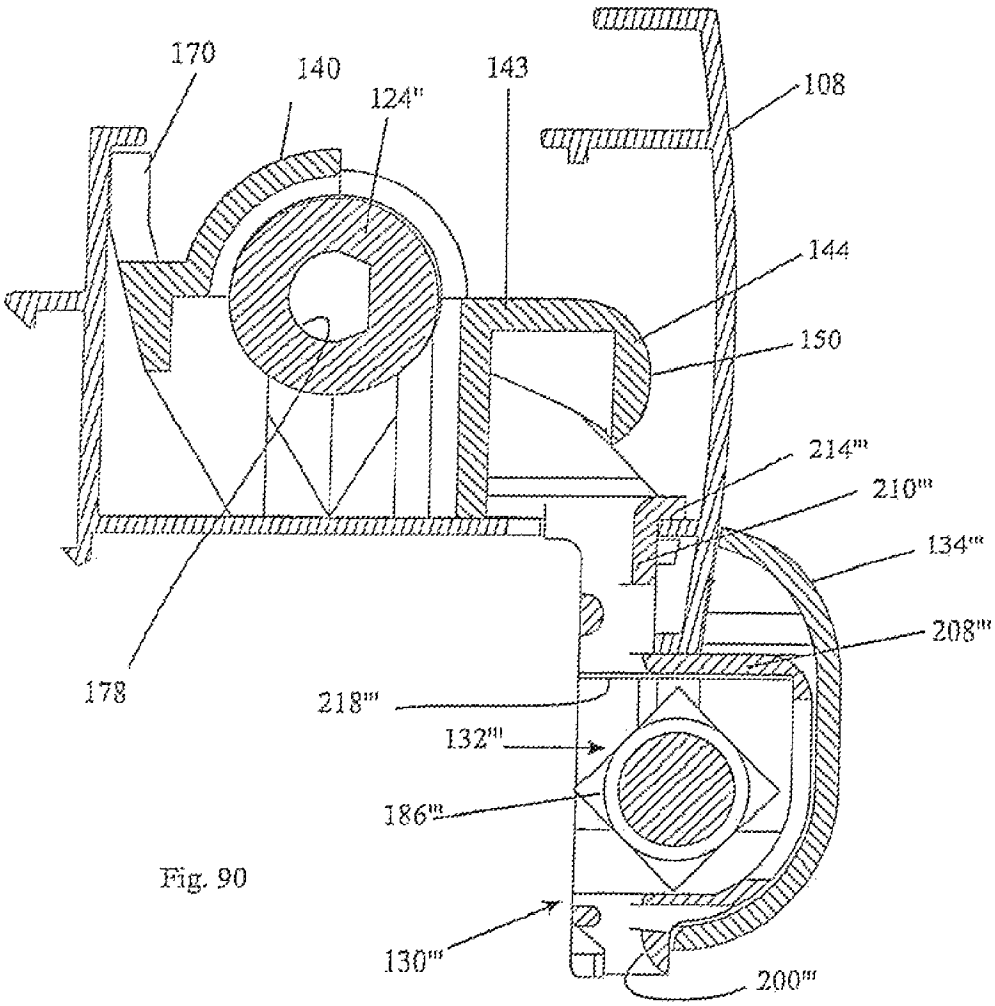
FIG. 90 is a sectional view along line 90-90 of FIG. 89.

Referring to FIGS. 85 and 86, the housing 130''' is similar to the housing 130 of the roller lock mechanism 104, including a lower wall 202''' defining a lower cord inlet opening 200''' with generous radii 204', and an upper wall 208''' defining an upper cord opening 206''' which flares out to a mounting platform 214''' designed to go through an opening 209 in the head rail 108, and engage the head rail 108, snapping in place with the aid of the vertical wall 210''' and the ears 212' projecting from the platform 214'. The housing 130''' defines a cavity 218''' for rotationally housing the roller lock rotor 132'''. One end wall 221''' defines a cavity 220''' for rotationally supporting the axle end 192''' of the roller lock rotor 132'''. As can be seen in FIG. 89, the cavity 220''' restricts movement of the axle end 192''' in the vertical direction, which is substantially different from the slotted pocket 220 shown in the embodiment of FIG. 17. The other end wall 223''' (See also FIG. 89) defines a vertically-oriented, slotted cavity 225''' which rotationally supports the axle 190''' and which also allows vertical movement of the axle 190' along the slotted cavity 225''', similar to the slotted pocket 220 of the embodiment shown in FIG. 17. So, unlike the embodiment of FIG. 17, in this embodiment, one axle end 190''' of the roller lock 132''' can move a substantial distance in the vertical direction, while the other end 192''' is restricted to much less movement in the vertical direction. This means that, when the roller lock 132' shifts between its first and second positions, it pivots or tilts at an angle rather than shifting upwardly to a parallel position.

A ramp 224' (See also FIG. 91) aids in snapping the restricted axle end 192' of the rotor 132''' into the cavity 220''' once the other axle end 190''' is already inserted into its slotted cavity 225'''. The cavity 220''' in the housing 130' acts as a fulcrum point for the fixed axle end 192''' of the roller lock rotor 132' as it pivots about this fulcrum point while the other axle end 190''' slides vertically along the slotted cavity 225'''. In the rotor's lower position depicted in FIGS. 89 and 90, the roller lock rotor 132''' is able to rotate about its axis of rotation 198'. As the roller lock 132''' pivots upwardly about its fulcrum point 220''', pivoting the axis of rotation 198' so that it now lies at an angle to its previous position, the square-profiled portion 186''' of the roller lock 132''' impacts against the upper inside wall of the cavity 218', which serves as a stop, preventing the rotation of the roller lock 132''' relative to the housing 130'''.

Referring to FIG. 89, the asymmetry of the roller lock 132''' can be seen. Namely, the frustroconically-profiled portion 188''' of the roller lock 132''' to the left of the capstan 184''' is considerably longer than the portion 186''' to the right of the capstan 184'''. Referring briefly to FIG. 17A (which depicts the roller lock 132 in the roller lock mechanism 104), one can appreciate that the drive cord 122 acts at different points on the roller lock 132. This is also true of the roller lock of FIG. 89. The force pulling down on the cord 122 by the operator is in line with the opening 200 and is closer to the longer portion 188, while the force pulling up on the cord 122 is shifted to the right and is in line with the opening 206 (not shown in FIG. 17A but its counterpart 206' is shown in FIG. 89), closer to the shorter portion 186.

Going back to FIG. 89, the force acting upwardly on the roller lock 132''' is equal to the weight (or force) pulling up on the cord 122 times the distance of the lever arm (which is the distance from the fulcrum point 220''' to the point where the cord 122 contacts the rotor 132''', roughly in line with the opening 206''' in the housing 130'''). In order to pull the roller lock rotor down, a slightly larger weight (force) needs to be applied by the operator such that the product of this slightly larger force times the shorter lever arm (which is the distance from the fulcrum point 220''' to the point where the cord 122 contacts the roller lock 132''', roughly in line with the opening 200''' in the housing 130''') is equal to the product of the force pulling up on the roller lock 132' times its longer lever arm. Since the lever arms in both instances are fairly long (due to the length of the portion 188''') and the difference between where the forces are applied is very short relative to the length of the lever arms, the difference in the magnitude of the forces to be applied is very small. However, if the roller lock 132''' were symmetrical and very short, then the length of the lever arms would also be fairly short, and the difference in distance from the fulcrum point to where the forces are applied becomes much more significant, making the force required to pull down on the roller lock 132' considerably higher than the force pulling up on the cord 122.

Except for the fact that the roller lock 132' pivots about the fulcrum point 220''' rather than shifting parallel to itself and the fact that the housing 130' does not require the cover 134''' to hold the roller lock 132''' within the cavity 218''', the assembly and operation of the roller lock mechanism 104' is the same as that of the roller lock mechanism 104 described earlier.

Figure 95:
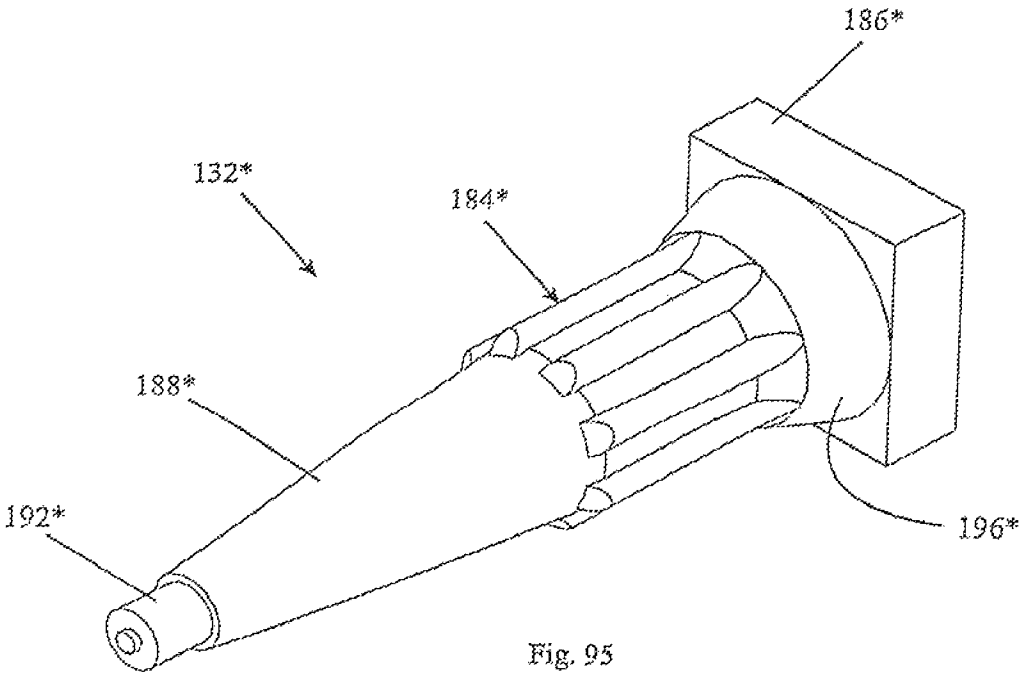
FIG. 95 is a perspective view of an alternate embodiment of a rotor for a roller lock mechanism made in accordance with the present invention.

FIG. 95 depicts an alternate embodiment of a roller lock 132*, which may be used instead of the roller lock 132''' described above. This alternate embodiment is very similar to the roller lock 132''', except that the capstan 184* is slightly longer, and it has only the outer tapered side wall 196*. The inner tapered side wall 197' has been eliminated as being unnecessary. The resulting roller lock 132* is a significantly easier part to manufacture, with no loss in functionality, as discussed below.

Referring briefly back to FIG. 89 and to the description of the operation of the roller lock mechanism 104''', the roller lock 132''' is in its lower, unlocked position when the user is pulling on the drive cord 122 in order to raise the window covering. In this position, the roller lock 132' is rolling about its axis of rotation 198''' (See FIG. 87). When the roller lock 132''' is rotating, the windings of the drive cord 122 tend to "walk" in the direction in which the cord is wrapping onto the roller lock 132'', which is toward the outer tapered wall 196'''. However, when the cord is sliding over the capstan 184''', as opposed to rolling, it does not tend to "walk" (assuming the capstan is in a substantially horizontal position). Thus, when the user is lowering the window covering, and the roller lock 132' is in the upper, locked position with the drive cord 122 sliding around the capstan 184''', the windings do not have a tendency to "walk" toward the inner tapered side wall 197', so this inner tapered side wall 197''' may be eliminated without any loss in functionality.

Note that if the user pulls on the drive cord 122 with just the right amount of force to allow the window covering to be lowered while keeping the roller lock 132''' in its lower, unlocked position, it is possible for the roller lock 132''' to rotate about its axis 198''' and the windings of the drive cord 122 would then have a tendency to walk toward the tapered side wall 197''' as the cord wraps onto the capstan from the free end of the cord. However, this balancing act is unlikely to occur in actual use and, even if it should occur, it would likely happen only momentarily before the changing weight of the window covering as it is lowered upsets the fine balance required for the condition to persist. The end result is that, in real life operation, the roller lock 132' is practically always locked in the non-rotating, upper position whenever the window covering is being lowered and the drive cord is surging the capstan 184'''. That being the case, the windings do not have a tendency to walk toward the inner tapered side wall 197''', so this side wall 197' may thus be eliminated as in the embodiment of a roller lock 132* depicted in FIG. 95.

FIGS. 96 through 105 depict yet another embodiment for a roller lock mechanism 104 made in accordance with the present invention. This roller lock mechanism 104** may be used instead of the roller lock mechanisms that have previously been described. For brevity, only the embodiment 104**, which may be a direct replacement for the roller lock mechanism 104 of FIGS. 1 and 11, is depicted here. It will be obvious to those skilled in the art that the same concept may readily be used to replace the roller lock mechanism with the locking dog 104', the roller lock mechanism with wand actuator 104'', and the tilter 452 with roller lock mechanism 104**.

Comparing this embodiment of a roller lock mechanism 104 (See FIG. 97) with the roller lock mechanism 104''' (See FIGS. 86 and 87), the differences are subtle but significant. This roller lock mechanism 104** includes a roller lock rotor 132** (also referred to as a roller lock 132**), and a housing 130**. A cover 134''' (See FIG. 85**) is no longer present in this embodiment.

Figure 98:
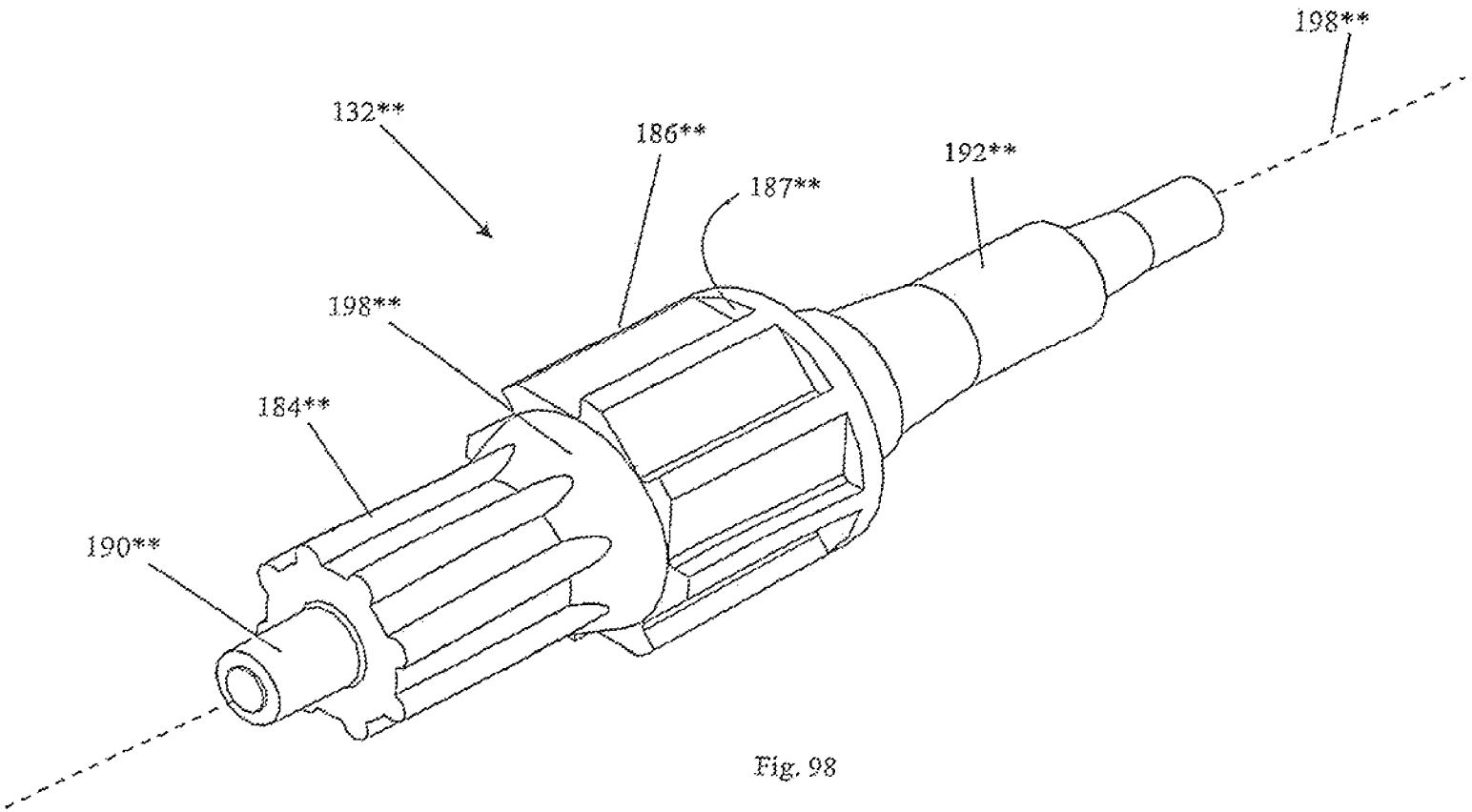
FIG. 98 is a perspective view of the rotor of the roller lock mechanism of FIG. 97.

Referring to FIG. 98, the rotor 132 includes a capstan 184** flanked by only one ramped surface 198**. Proximate the ramped surface 198** is an octagonally-profiled portion 186**, followed by a shoulder 187** (which serves to provide structural integrity to the octagonally-profiled portion 186**), and then an axle end 192**. The opposite end of the roller lock rotor 132**, proximate the capstan 184** ends in a short axle end 190**. The axle ends 190**, 192** define the axis of rotation 198** of the rotor 132**. As discussed earlier, the capstan 184**** may be polygonally-profiled (as depicted), or it may have a circular or other desired profile, and the texture of its surface may be enhanced (by such means as knurling or sandblasting or coating with rubber, for instance) to improve its frictional characteristics.

Figure 97:
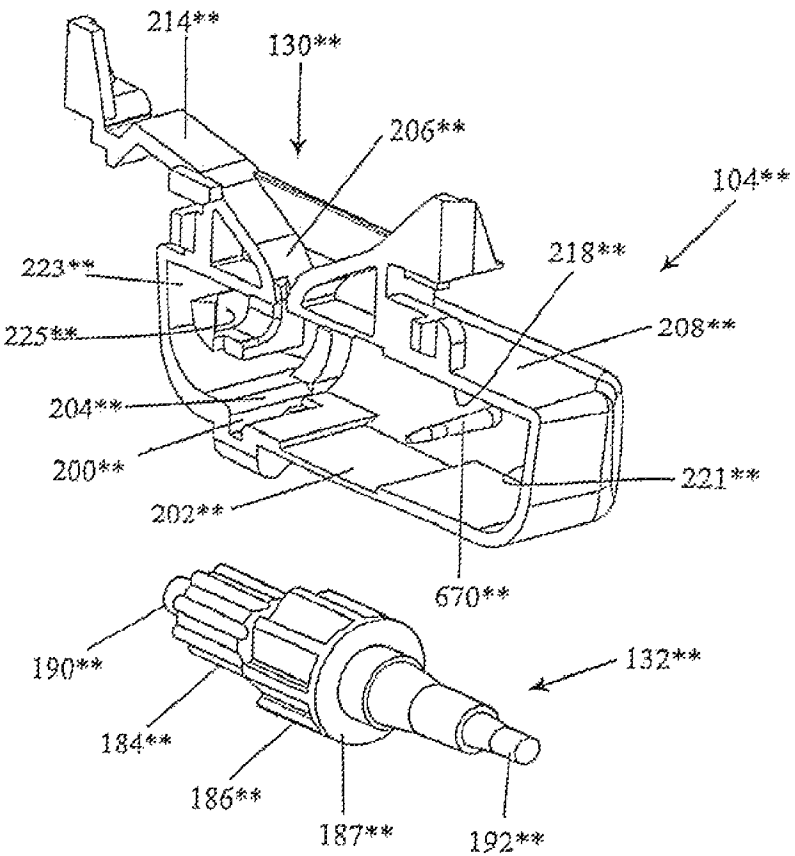
FIG. 97 is an exploded perspective view of the roller lock of FIG. 96.
Figure 96:
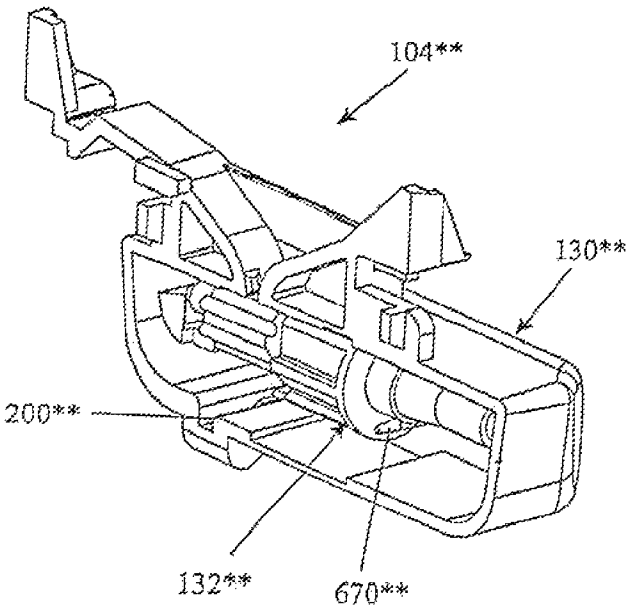
FIG. 96 is a perspective view of another embodiment of a roller lock made in accordance with the present invention.
Figures 99, 101:
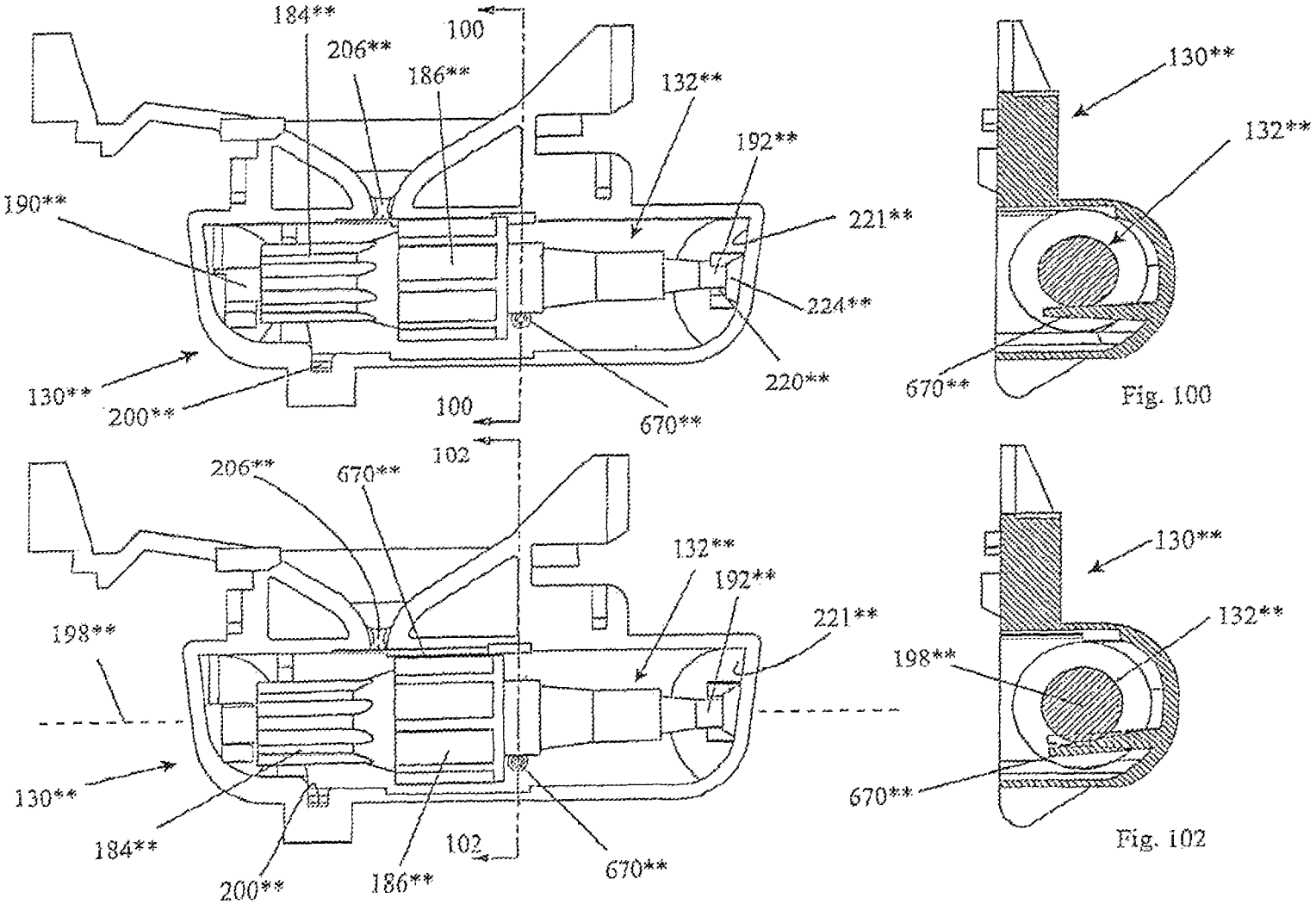
FIG. 99 is a side view of the rotor lock of FIG. 96.
FIG. 101 is the same view as FIG. 99, but with the rotor in the lowered, unlocked position.
Figure 104:
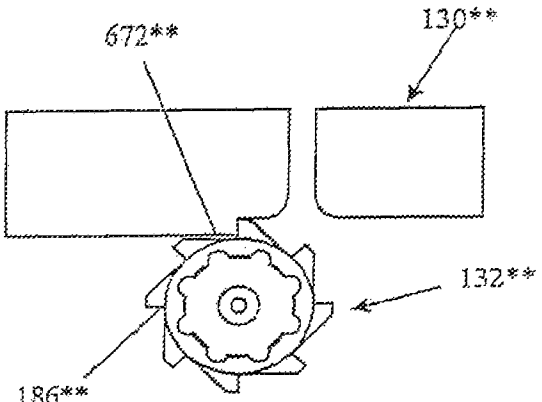
FIG. 104 schematically shows the rotor of FIG. 96 in the upper, locked position relative to the rotor lock housing.
Figure 105:
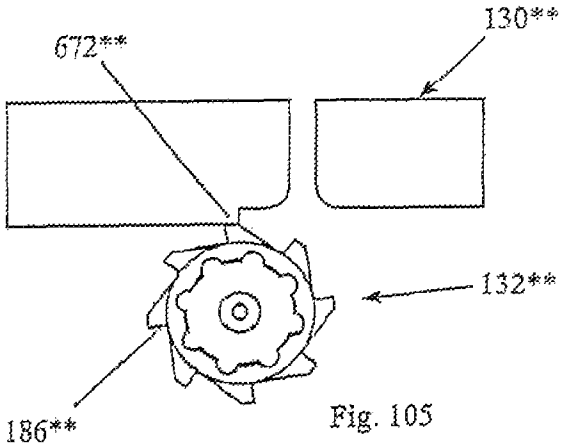
Figure 103:
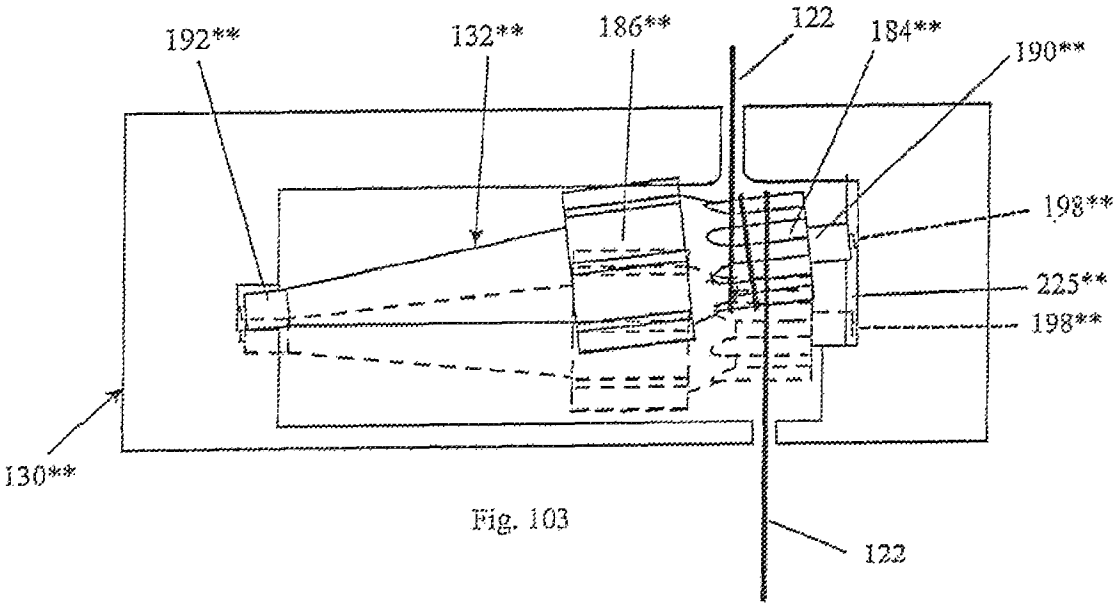
FIG. 103 schematically shows the rotor of FIG. 96 inside the rotor lock housing, with the rotor shown in the upper, locked position and also shown, in phantom, in the lowered, unlocked position.

Referring to FIGS. 97 and 99, the housing 130 is similar to the housing 130''' of the roller lock mechanism 104', including a lower wall 202** defining a cord inlet opening 200** with generous radii 204**, and an upper wall 208** defining a cord outlet opening 206** which flares out to a mounting platform 214** designed to go through an opening 209 in the head rail 108, and engage the head rail 108, snapping in place as has already been described with respect to previous embodiments of the roller lock mechanism. It should be noted that, in this embodiment, the inlet 200** from the tassel weight end of the cord is farther away from the pivot axle 192** than is the inlet 206** from the drive roller, which is opposite to the situation in the embodiment of the roller lock 104''' shown in FIG. 89. This arrangement is preferred, as it eliminates a "clicking" that occasionally occurred in the roller lock 104''''. The housing 130** defines a cavity 218** for rotationally housing the roller lock rotor 132**. One end wall 221** defines a cavity 220** (See FIG. 99) for rotationally supporting the axle 192** of the rotor 132** while severely restricting vertical movement of that axle end 192**. The other end wall 223** (See FIG. 97) defines a vertically-oriented, slotted cavity 225** which rotationally supports the axle end 190** and which also allows much greater vertical movement of the axle end 190** along the slotted cavity 225**. Again, this restriction of one end of the roller lock while permitting substantial vertical movement of the other end means that the roller lock will tilt and pivot between its two operating positions rather than shifting parallel to itself. A ramp 224** (See FIG. 99) aids in snapping the inner axle end 192** of the rotor 132** into the cavity 220** once the outer axle end 190** is already inserted into its slotted cavity 225****.

The housing 130 has an added appendage 670** which projects from the rear wall of the housing 130** and lies beneath the rotor 132**, biasing the rotor 132** upwardly toward the upper (locked) position as shown in FIGS. 99 and 100. In this embodiment, the appendage 670** is a thermoplastic, and it is deflected downwardly, as shown in FIGS. 101 and 102, to allow the rotor 132** to shift to the lowered (unlocked) position when the user is pulling on the drive cord 122 (See FIG. 1) so as to raise (retract) the window covering. However, as soon as the user releases the drive cord 122 and the catalytic force of the user is removed, the resilience of the appendage 670** causes it to move the rotor 132** upwardly to the locked position, as shown in broken lines in FIG. 102 and in solid lines in FIG. 100**.

While normally the use of a thermoplastic for a spring does not work, as the thermoplastic will cold flow and lose its ability to spring back to its original shape, in this instance, the thermoplastic does work well because the appendage 670 is normally unloaded and is only loaded for very short periods of time (namely when the user is pulling on the drive cord 122 to raise the window covering), so the spring 670** does not have an opportunity to cold flow or to take a set. Furthermore, this spring 670** is very small, approximately 0.035 inches in diameter, such that the amount of force required to deflect the spring 670** is very small and does not add any measurable force to that required to raise the window covering. It should also be noted that the spring 670** need not necessarily be a thermoplastic appendage as shown. It could just as readily be a more conventional spring, perhaps pushing off of the bottom wall 202** of the housing 130****.

Figure 84:
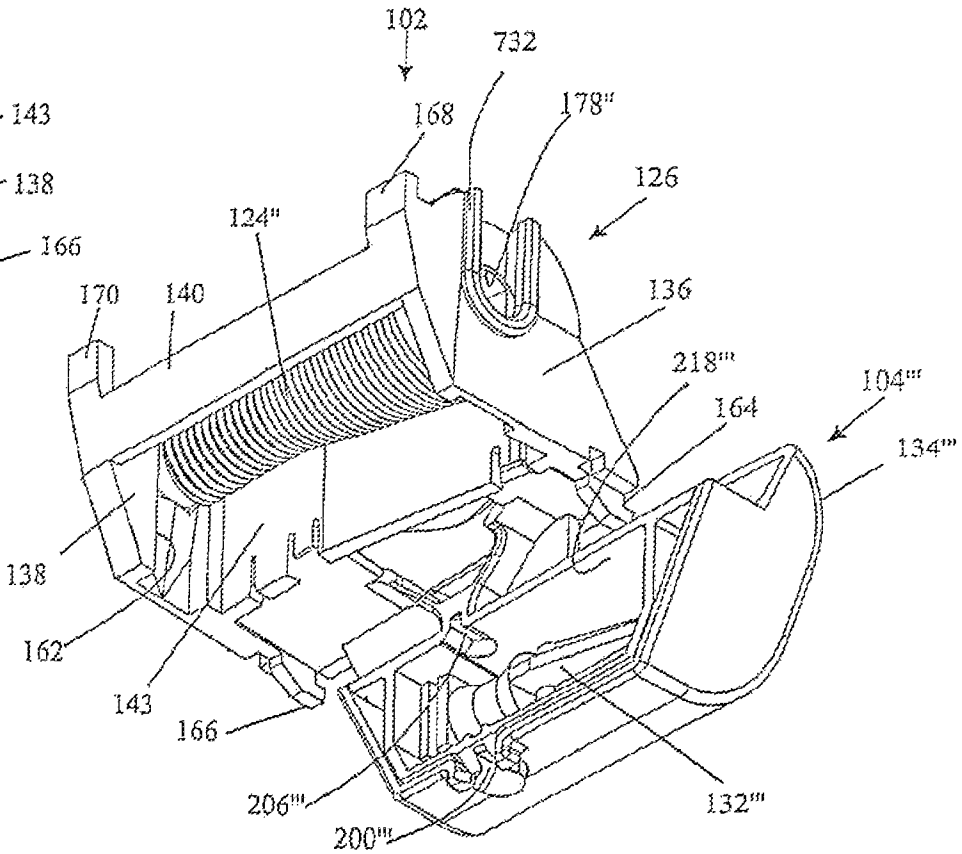
FIG. 84 is a rear perspective view of the cord drive with roller lock mechanism of FIG. 83.

In the previously described embodiments of a roller lock mechanism, such as the roller lock 104' of FIG. 84, there is an inherent time dwell between the time the user releases the drive cord 122 and the roller brake engages. In addition to the slight vertical travel of the rotor 132' (See FIG. 87) to engage with the housing 130''', the rotor 132''' also has to rotate along its axis of rotation 198''' until the flat profile 186''' engages the housing 132'. In the present embodiment 104 the spring 670** assists the roller lock rotor 132** upwardly at a much faster rate than it would without the spring 670**. This, together with the octagonal-toothed profile portion 186** of the rotor 132** which impacts against a shoulder 672** (See FIGS. 101 and 104), bring the rotor 132** to a full stop essentially immediately after the drive cord 122** is released by the user, limiting the drop-back of the bottom rail of the window covering to a minimum.

Except for the fact that the rotor 132 is lifted by the spring 670** and the fact that the rotor has the octagonal-toothed profile portion 186** to impact against the shoulder 672** of the housing 130**, the assembly and operation of the roller lock mechanism 104** is the same as that of the roller lock mechanism 104'''** described earlier.

While the roller locks shown here use a shifting of the axis of rotation of the capstan to provide for locking the capstan against rotation in one direction, it would also be possible to use a ratchet or pawl mechanism to permit rotation in one direction and prevent rotation in the other direction, or to use other one-way devices as an alternative to shifting the axis of rotation.

Figure 18:
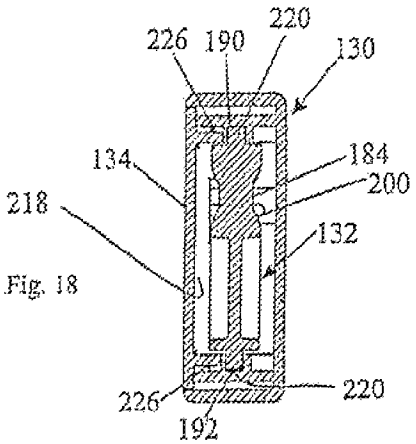
FIG. 18 is a sectional view along line 18-18 of FIG. 16.
Figure 18A:
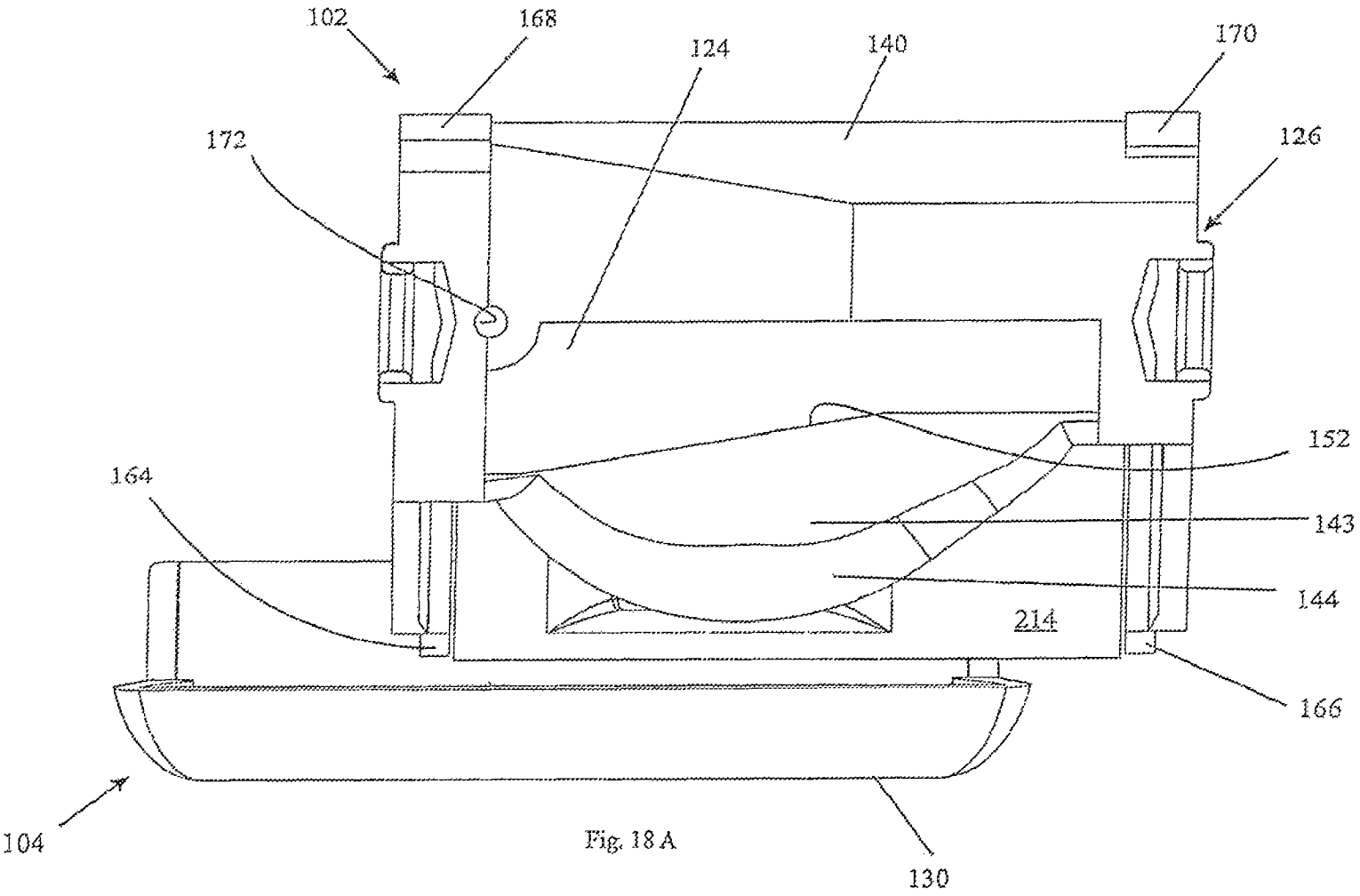
FIG. 18A is a plan view of the cone drive and roller lock of FIG. 11.
Figure 20A:
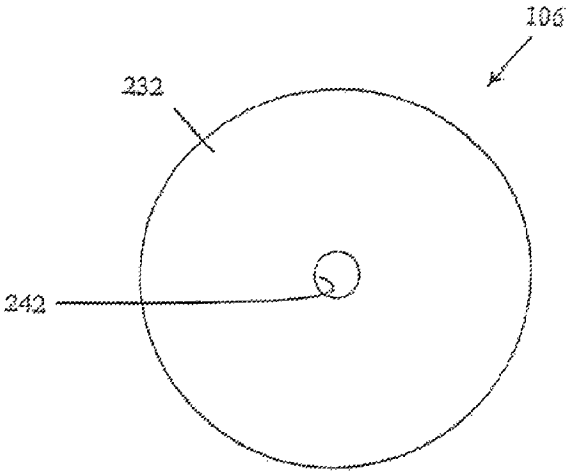
FIG. 20A is a top view of the tassel weight of FIG. 19.
Figure 20B:
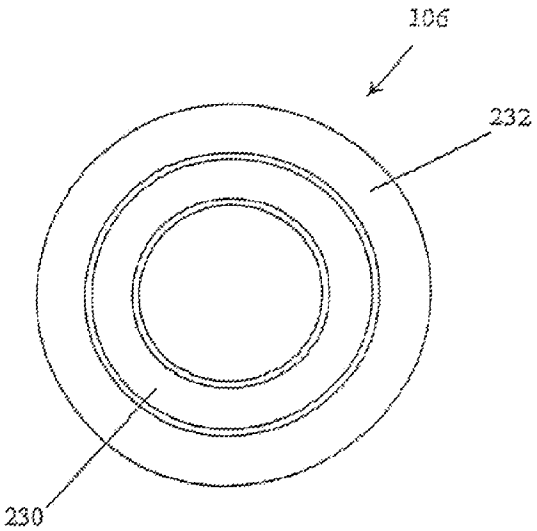
FIG. 20B is a bottom view of the tassel weight of FIG. 19.
Figure 20:
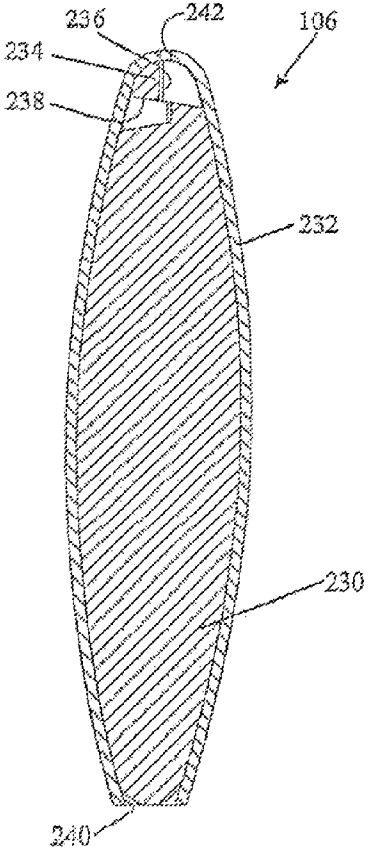
FIG. 20 is a sectional view along line 20-20 of FIG. 19.
Figure 19:
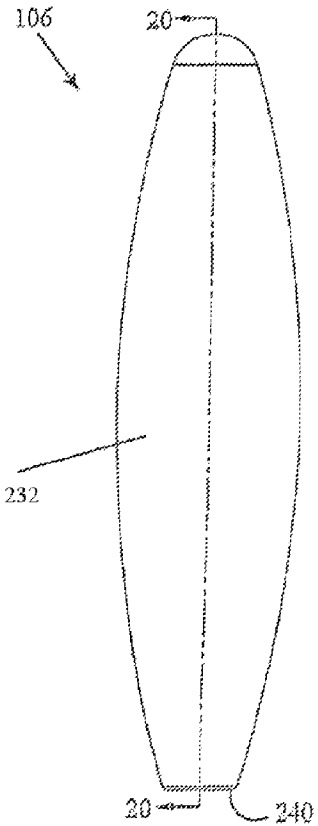
FIG. 19 is a side view of the roller lock tassel weight of FIG. 1.
Figure 30:
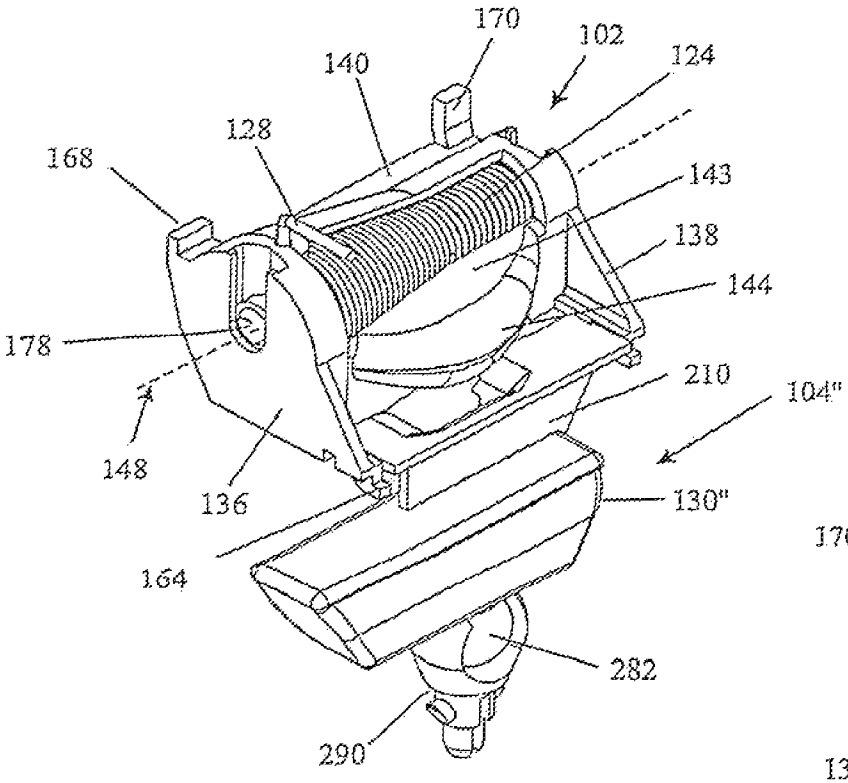
FIG. 30 is a front perspective view of the cord drive of FIG. 8 (drive cord removed for clarity)
Figure 32:
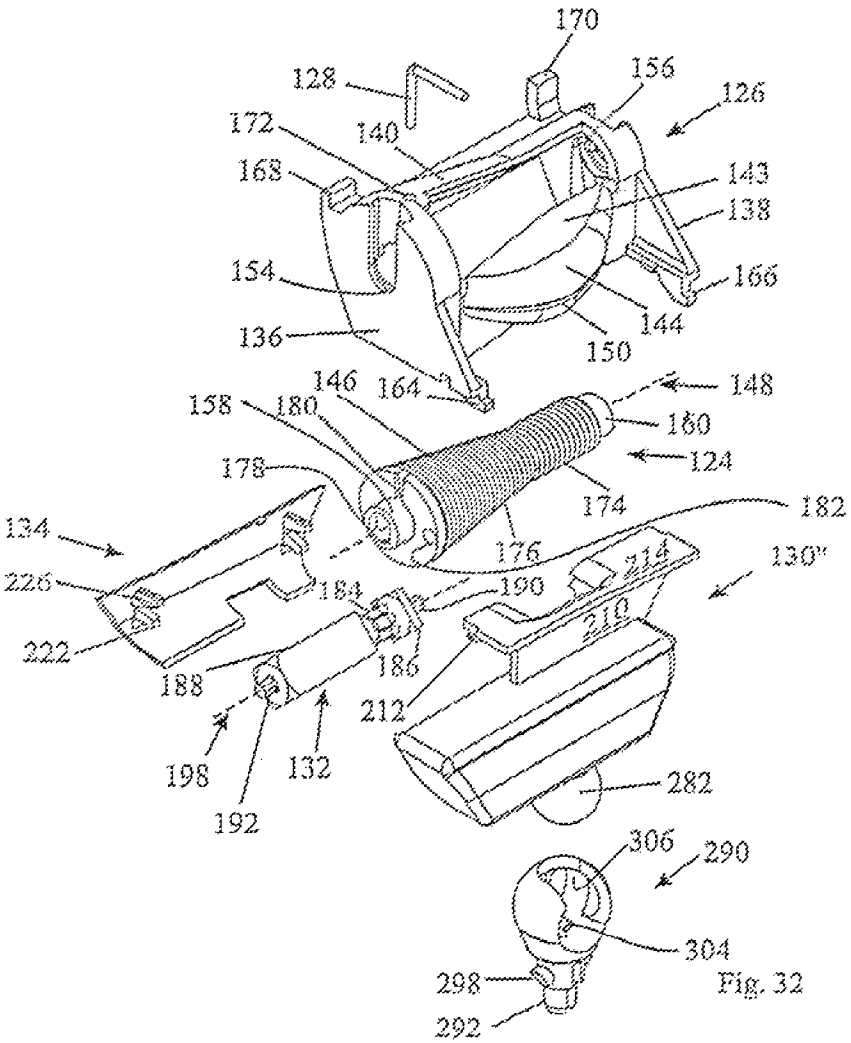
FIG. 32 is an exploded perspective view of the cord drive of FIG. 30.
Figures 33, 34:
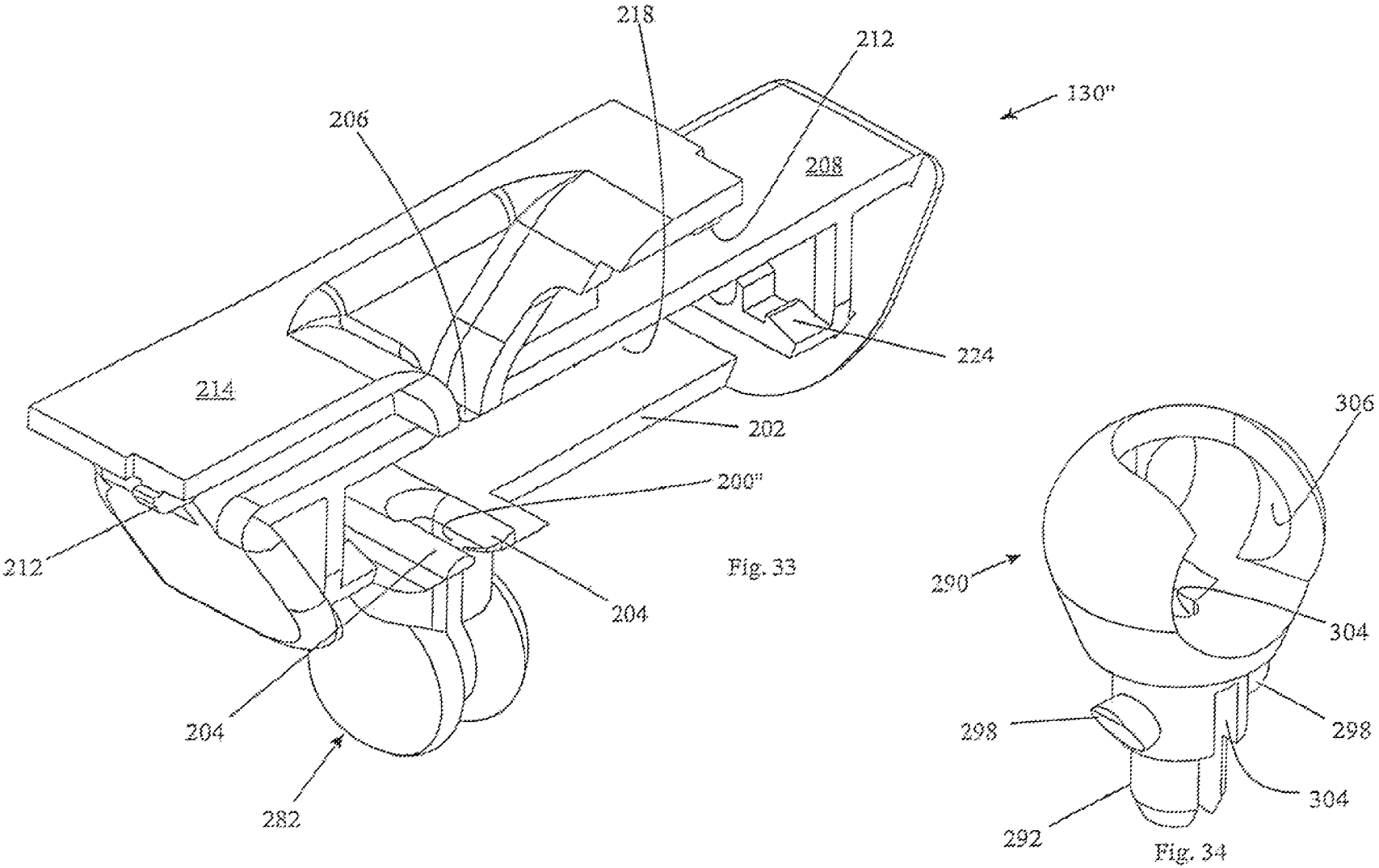
FIG. 33 is a perspective view of the main housing of the roller lock mechanism of FIG. 32.
FIG. 34 is an enlarged, perspective view of the wand attachment plug of FIG. 32.

It should be noted that the axis 198 of the roller lock 104 of FIGS. 16-18 shifts up and down parallel to itself, with both axles 190, 192 moving substantially the same distance in order to shift from the unlocked, idling position to the locked position (similarly, the roller lock 104' with locking dog, and the roller lock 104" in FIG. 30 also have an axis that shifts parallel to itself), while the roller lock 104 of FIGS. 96-105 has an axis 198** that tilts at an angle to itself, with one axle 192** remaining substantially fixed and the other axle 190** shifting upwardly, so that the roller lock pivots about one of its axles rather than moving both axles upwardly substantially the same distance. (The roller lock 104''' of FIGS. 83-91, the roller lock 132* of FIG. 95, and the roller lock 778 of FIGS. 116-117** also shift by pivoting about one of the axles, tilting the axis of rotation angularly rather than shifting it parallel to itself.)

FIG. 169 through 171 depict yet another embodiment of a roller lock 132* made in accordance with the present invention. This roller lock 132***** may be used instead of the roller locks that have been described previously.

Comparing this embodiment of a roller lock 132* (See FIG. 169) with the roller lock 132** (See FIG. 98), the main difference is that this roller lock 132*** once again includes two ramped surfaces 197*****, 198*** instead of the single ramped surface 198** of the roller lock 132**. All other features of the roller locks remain essentially unchanged. The ramped surface 197* has been restored into this embodiment 132* because, if the roller lock 132* is not substantially horizontal, there is a tendency for the cord to "walk", even when the cord is surging the capstan 184*. As discussed previously with respect to other embodiments of the roller lock, such as roller lock 132''' shown in FIG. 87, the ramped surface 197* prevents the cord from walking off of the capstan 184***.

Casting this roller lock 132*, with the addition of the ramped surface 197*, is a challenge. It is undesirable to have a parting line on the capstan portion 184* of the roller lock 132*, because a parting line in this area typically results in additional wear on the cord 122 (cord 122 is not shown in these views), which reduces the life of the cord 122. FIG. 169 through 171 depict a solution to this difficulty.

In FIG. 169, the cross-hatched area 1246 includes the capstan 184* and the left and right hand ramped surfaces 197*, 198* respectively. The mold to cast this roller lock 132* includes four cams labeled C1 through C4 in FIG. 170. These cams C1-C4 are designed to retract radially outwardly.

The parting line 1248 (See FIG. 169) for the main mold (not for the cams) is adjacent the shoulder 187*. As the live half of the mold (in this instance, the live half is the portion of the mold which lies to the right of the parting line 1248) pulls back, fingers connected to this live half retract the four cams C1-C4, freeing the rest of the casting for extraction from the mold.

The interesting detail of the cams C1-C4 is that their parting lines (designated PL in FIG. 170) are all designed to meet in the "valleys" of the octagonal profile of the capstan 184*. As the cord 122 wraps around the capstan 184*, it makes contact with the peaks of the octagonal profile which support the cord 122 away from the valleys such that, even if there is a parting line PL in some of these valleys, these parting lines PL will not contact the cord 122, so there will be no deleterious effects to the cord 122.

It should be noted that it is not necessary for the parting lines PL not to be in contact with the cord 122. For instance, it is possible for the valleys to be so shallow that the parting lines PL do contact the cord 122. However, this contact would then take place in the non-stressed portions of the cord 122, minimizing, if not totally eliminating, the wear on the cord 122 due to its contact with the parting lines PL.

FIG. 172 depicts the roller lock 132* installed in a roller lock housing 130*. This housing 130* is very similar to the housing 130 of FIG. 97, described earlier. The main differences, discussed in more detail below, are the presence of reinforcing ribs 1250 in the cavity 218* of the housing, and an open-bottom hook arrangement 1252 for mounting the shaft 192* of the roller lock 132***.

This housing 130* is stiffer than the embodiment 130 shown in FIG. 97. Greater stiffness is achieved by the strategic placement of the ribs 1250 which reinforce all three sides of the cavity 218* without interfering with the operation (rotation and axle tilting) of the roller lock 132*. As a result of this greater stiffness, the installation of the roller lock 132* in a housing with a previously disclosed mounting arrangement, such as the ramp 224''' shown in FIG. 86 becomes very difficult, if even possible. The walls of the housing 130* are so stiff that they "give" very little such that the installation, and especially the removal, of the roller lock 132*** is no longer practical with that ramp arrangement.

A solution to the above problem is the use of an open-bottom hook mounting arrangement 1252, as seen in FIG. 172, to accommodate the shaft 192* of the roller lock 132*. The biasing appendage 670 (not shown in FIG. 172, but visible in FIG. 97) urges the shaft 192* of the roller lock 132* into the hook portion of the mounting arrangement 1252 and holds it there except during the relatively rare moments when the drive cord 122 is being pulled, pulling the roller lock 132* to its freely-rotating position. During those rare moments, the tension of the cord 122 around the capstan 184* prevents the roller lock 132* from falling out of the housing 132***.

Except for the fact that the rotor 132* has the added ramped surface 197* (shown in FIG. 169) and the housing has the open-bottom hook mounting arrangement 1252 (shown in FIG. 172), the assembly and operation of the roller lock mechanism 104* is the same as that of the roller lock mechanism 104** described earlier.

It should be noted that other brakes, including one-way brakes, can be used instead of any of the embodiments of roller lock mechanisms disclosed above. For instance, as has already been described, the lever lock mechanism 102' (See FIGS. 48-50), may be used. Also for instance, as has already been discussed, the roller lock with locking dog mechanism 104' (See FIGS. 23-25) may be used. In fact, in this instance, if the locking dog 254 is omitted and a tassel weight is added, the mechanism behaves identically to the roller lock mechanism 104 (See FIGS. 11-13). In this same instance, if the capstan 132 is omitted instead, the locking dog 254 acts as a one-way brake which may be manually engaged or released as described earlier, when discussing this embodiment.

Alternate Embodiments of Cone Drives

Figure 92:
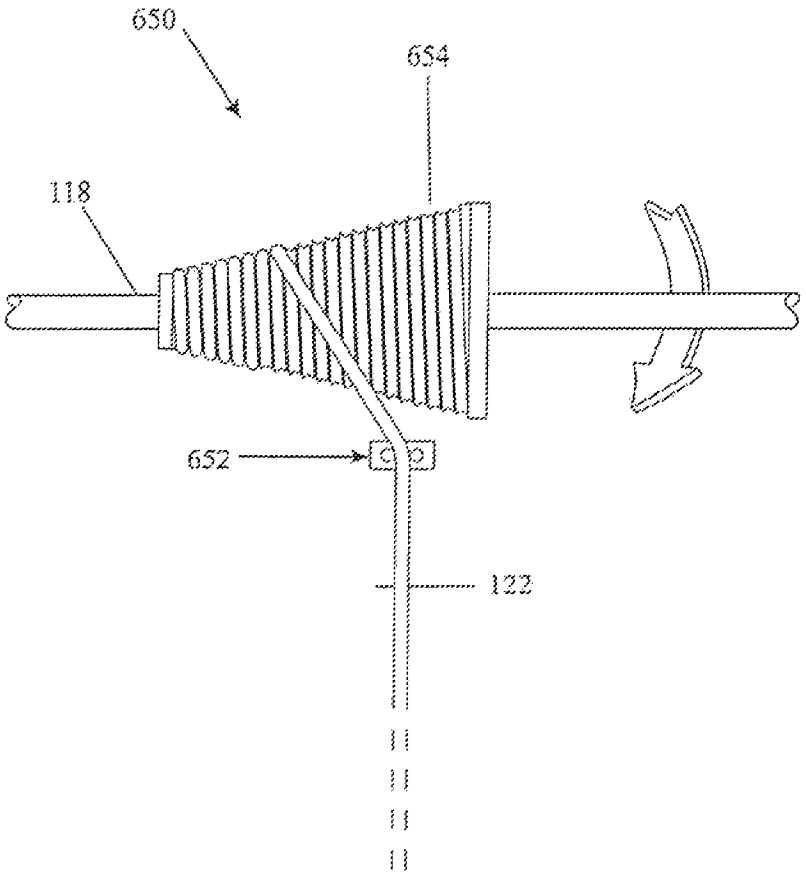
FIG. 92 is a broken away, schematic view of a drive spool with a fixed guide to lead the drive cord onto the drive spool.

FIG. 92 is a broken away, schematic view of a cone drive 650 with a fixed cord-guide 652 to lead the drive cord 122 onto the drive cone 654. As may be appreciated from this schematic, the fixed guide 652 performs well only when it is substantially aligned with the point on the surface of the cone 654 where the cord 122 is wrapping onto the cone 654. In the condition pictured in FIG. 92, the fixed guide 652 is aligned approximately with the axial mid-point of the cone 654, but the cord 122 is wrapping onto the cone 654 at the extreme left end of the cone 654. This misalignment causes the cord 122 to under-wrap when wrapping onto the left end of the cone 654, and to over-wrap (wrap onto itself) as the cord wrapping moves toward the right end of the cone 654. It is clear that a fixed point guide 652 (without a compound arcuate guide surface as shown in previous embodiments) is a less than effective solution to the problem of wrapping a cord 122 onto a cone 654 without over wrap conditions.

Figure 93:
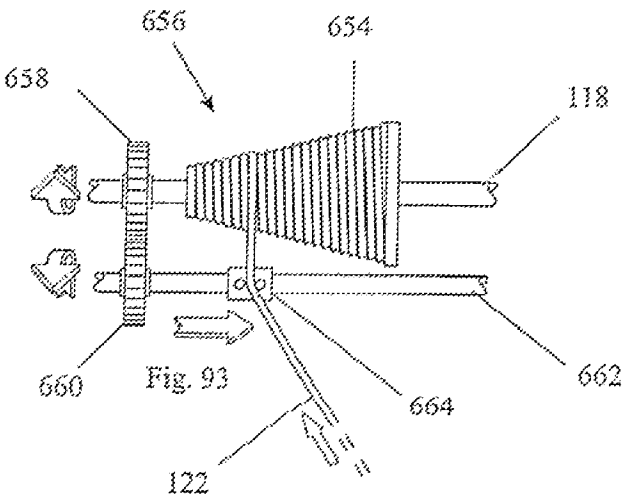
FIG. 93 is a broken away, schematic view of a drive spool with a geared and threaded guide to lead the drive cord onto the drive spool.

FIG. 93 depicts a cone drive 656 which presents a first solution to the problem of wrapping a cord 122 onto a cone 654 without over-wrap conditions. In this instance, a first gear 658 is mounted for rotation with the lift rod 118 and the drive cone 654. An identical second gear 660 meshes with the first gear 658 and is mounted for rotation with a threaded guide rod 662 such that, when the cone 654 and the first gear 658 rotate, the second gear 660 and its guide rod 662 also rotate, albeit in the opposite direction.

An internally threaded point guide 664 is mounted on the guide rod 662 and is precluded from rotating with the guide rod 662 but travels axially along the guide rod 662 as the rod 662 rotates. This may be accomplished, for instance, by having a portion of the guide 664 engage an axially-extending, slotted opening (not shown), such that the guide cannot revolve about the guide rod 662, and yet may travel axially as the internal threads of the guide 664 engage the threaded guide rod 662. As the cone 654 rotates in one direction, the first gear 658 rotates in the same direction, the second gear 660 rotates in the opposite direction, and the guide 664 travels axially along the guide rod 662, parallel to the lift rod 118. If the threads on the guide rod 662 and on the guide 664 are designed correctly, the guide 664 moves axially at a rate which matches the threads on the cone 654, such that the cord 122 is laid onto the cone 654 at an angle which is substantially perpendicular to the axis of the lift rod 118 for all positions along the axial length of the cone 654. This arrangement precludes over-wrapping (or under wrapping) of the cord 122 as it wraps onto the cone 654.

Figure 94:
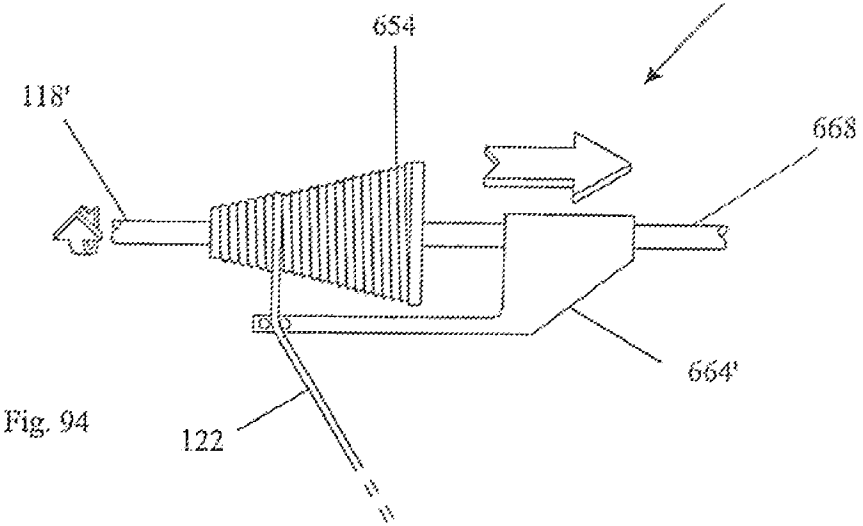
FIG. 94 is a broken away, schematic view of a drive spool with a threaded guide to lead the drive cord onto the drive spool.

FIG. 94 depicts a cone drive 666 which presents another solution to the problem of wrapping a cord 122 onto a cone 654 without over wrap conditions. In this instance, instead of a gear driven guide rod as in the previously described cone drive 656, the internally threaded guide 664' mounts directly on the lift rod 118', which has been modified to have a threaded portion 668. Once again, the internally threaded guide 664' is restrained from rotation about the lift rod 118' but travels axially as the cone 654 and the lift rod 118' rotate. As in the previously described embodiment 654, in this instance, the guide 664' moves axially at a rate which matches the threads on the cone 654, such that the cord 122 is wrapped onto the cone 654 at an angle which is substantially perpendicular to the axis of the lift rod 118' for all positions along the axial length of the cone 654. This arrangement precludes over-wrapping (or under wrapping) of the cord 122 as it wraps onto the cone 654.

High Strength Sleeve

FIGS. 106-110 depict a V-rod lift rod 702 and a high strength sleeve 704 made in accordance with the present invention. As window coverings increase in size and/or in weight, it becomes necessary to transmit higher forces between the different rotating components, such as the motors, transmissions, gear boxes, cord drives, and lift stations, in order to raise or lower the window coverings. The V-rod lift rod 702 and the high strength sleeve 704 disclosed below address the issues of transmitting these forces in a more efficient manner.

Referring briefly to FIG. 13, the drive cone 124 has a "D" shaped opening 178 to accommodate the D-shaped lift rod 118 (hereinafter referred to as the D-rod 118) as seen in FIGS. 1-10. The V-shaped lift rod 702 of FIGS. 106 and 107 (hereinafter referred to as the V-rod 702) has a "V" notch 706 as is better appreciated in the profile depicted in FIG. 108. This "V" notch design is better able to transmit the torque forces to the different components included in the window covering 700 than the D-rod shown in FIG. 1. Naturally, the different components are modified or adapted such that the non-circular-profile opening in each of the components now matches the "V" notch geometry, instead of matching the D-rod design. This particular "V" notch forms an angle of approximately 90° at a point 707 that is recessed approximately one-fourth of the diameter from the outer edge of the circular profile, which is most preferred, but the "V" notch could be greater or less than 90° and inset from the outer edge more or less than one-fourth of the diameter.

As the window coverings increase in size, the number of components in the head rail and the distance between these components also increases. For instance, for a wider window covering, three or more of the lift stations 116* shown in FIG. 106 may be installed onto the lift rod 702. The result may overwhelm the lift rod 702, which would require a larger diameter lift rod 702, or a lift rod made from a different material with a higher torsional strength, to handle the added force across the longer distance. However, if the diameter of the lift rod 702 is increased, so will the diameters of the components discussed above, making it harder to fit them into the confined area available within the head rail 108. Furthermore, the larger diameter of the rotating portion of these components (for instance a larger diameter drive cone 124 of the cone drive 102 in FIG. 13) results in increased frictional losses between the rotating portion of these components and their respective housings (housing 126 in the case of the cone drive 102), and a consequent overall loss in efficiency.

Figure 110:
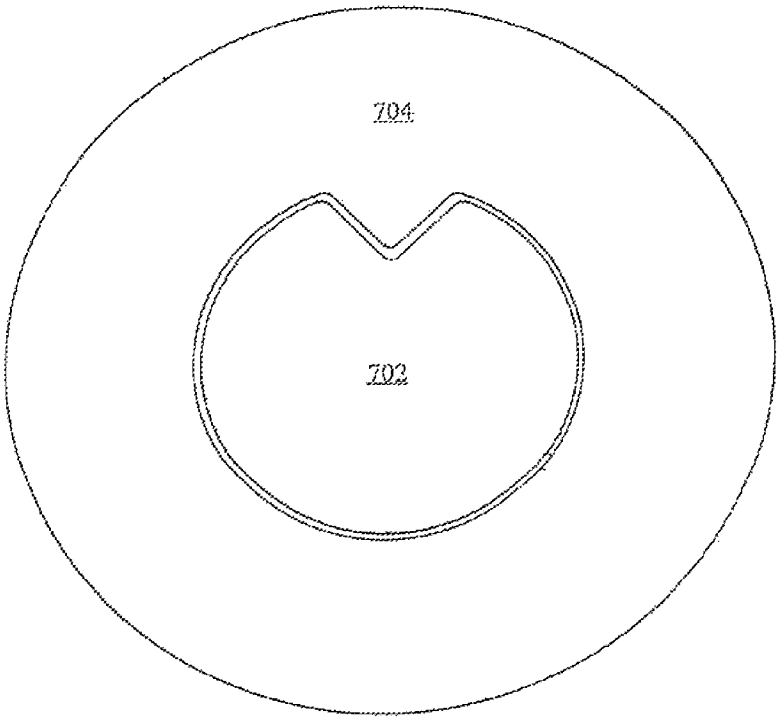

The present design overcomes this problem by providing a high strength sleeve 704 (See FIG. 109) with an internal geometry 708 which closely matches the "V" notch profile of the V-rod 702, including a V-projection which fits into the V-notch. By installing lengths of the high strength sleeve 704 between the components mounted onto the lift rod 702, the lift rod 702 takes advantage of its small diameter in driving lift stations and other rotating components, while effectively having a larger diameter for most of its length, making it stronger and more able to resist bending and torsional forces. For instance, in FIG. 9, a length of high strength sleeve 704 (not shown in FIG. 9) may be installed between the cone drive 102 and the first lift station 116, another length of the sleeve 704 between the two lift stations 116, and yet another length of sleeve 704 between the second lift station 116 and the transmission 624. The torsional moment and bending forces are constantly transmitted to the larger diameter sleeve 704 for any length that the sleeve 704 is enveloping the lift rod 702, as shown in FIG. 110.

The result is that, for instance, in a typical 10 foot wide blind which may have four lift stations 116, each of which is approximately 2 inches long, the torsional deflection demonstrated by the total assembly is effectively the same as that of a lift rod which is only 8 inches long (4 lift stations 116, each one two inches long), rather than experiencing the torsional deflection faced by a 10 foot long rod.

In the present embodiment, the V-rod 702 and the sleeve 704 are made from pultruded fiberglass. Fiberglass was selected because it offers an excellent combination of strength, smoothness, straightness, and cost. However, other materials, such a metal and plastic could also be used.

While the V-shaped rod that is shown here is preferred, it will be understood that various other non-circular cross-sections of lift rod, including the D-shaped rod shown in other embodiments, could take advantage of the use of sleeve sections having an internal cross-section that closely matches the external cross-section of the rod, so that the torsional and bending forces are supported by the larger diameter sections of sleeve, while the actual lift rod that mates with components, such as the drive spool, motors, transmissions, and the like, continues to have a small diameter.

Gearbox

FIG. 111 through 115 depict a gearbox for use in a window covering made in accordance with the present invention. As window coverings increase in size (or in some cases, as the materials used in the window covering increase in weight as in the case when wooden slats are used in a blind), the weight of the window covering may increase to the point where it is difficult for the user to open or close the window covering simply by pulling on a drive cord. One approach to deal with this problem is to include motors and/or transmissions in the drive to assist the user. Another approach, as explained below, is to use one or more gearboxes, possibly in conjunction with additional motor and/or transmissions, to accomplish the same end result of assisting the user.

Figure 111:
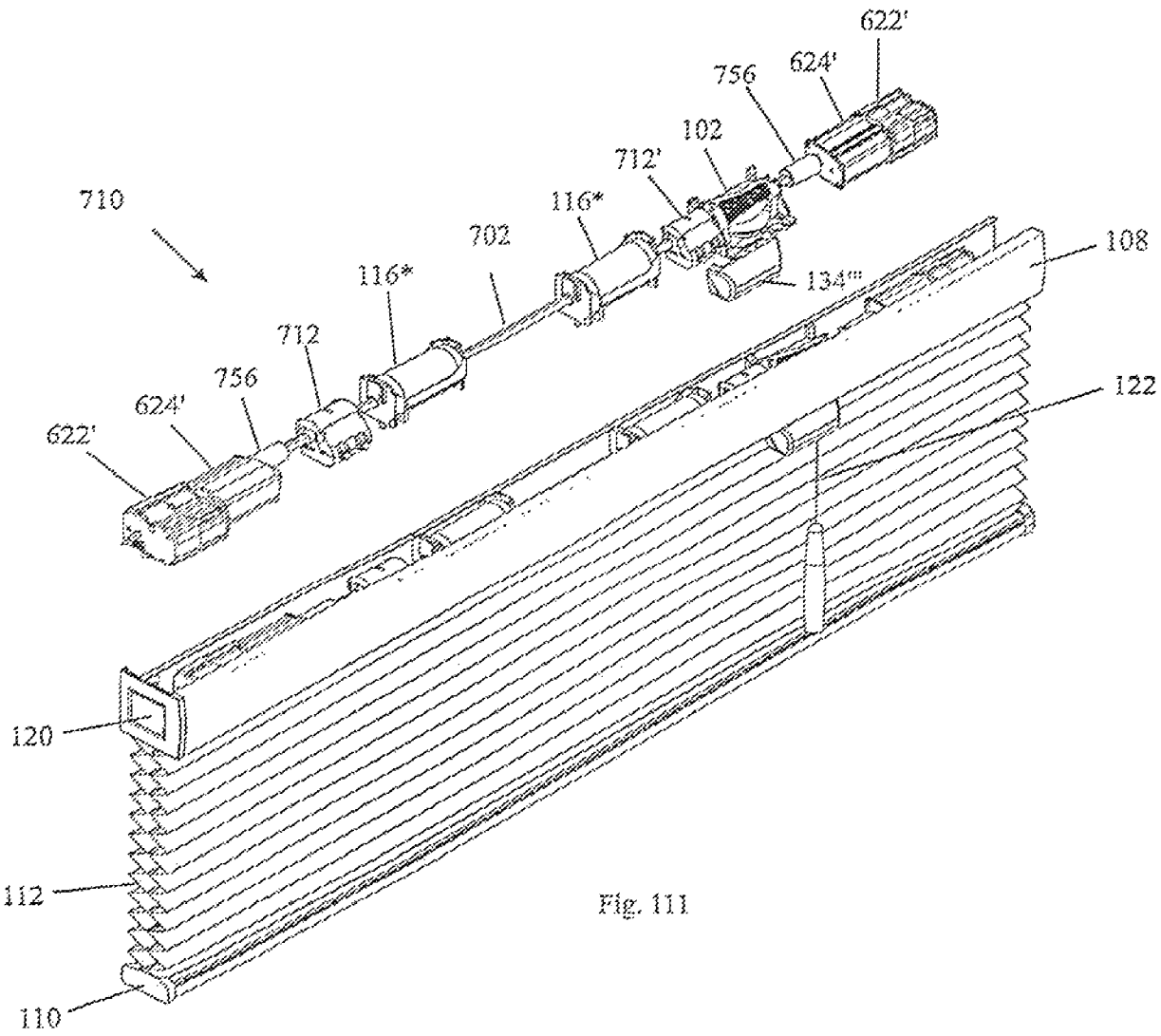

Referring now to FIG. 111, the window covering 710 depicted is a cellular product similar to that shown in FIG. 9, but incorporating gearboxes 712 and 712' as well as motors 622' and transmissions 624' at both ends of the window covering 710.

Figure 113:
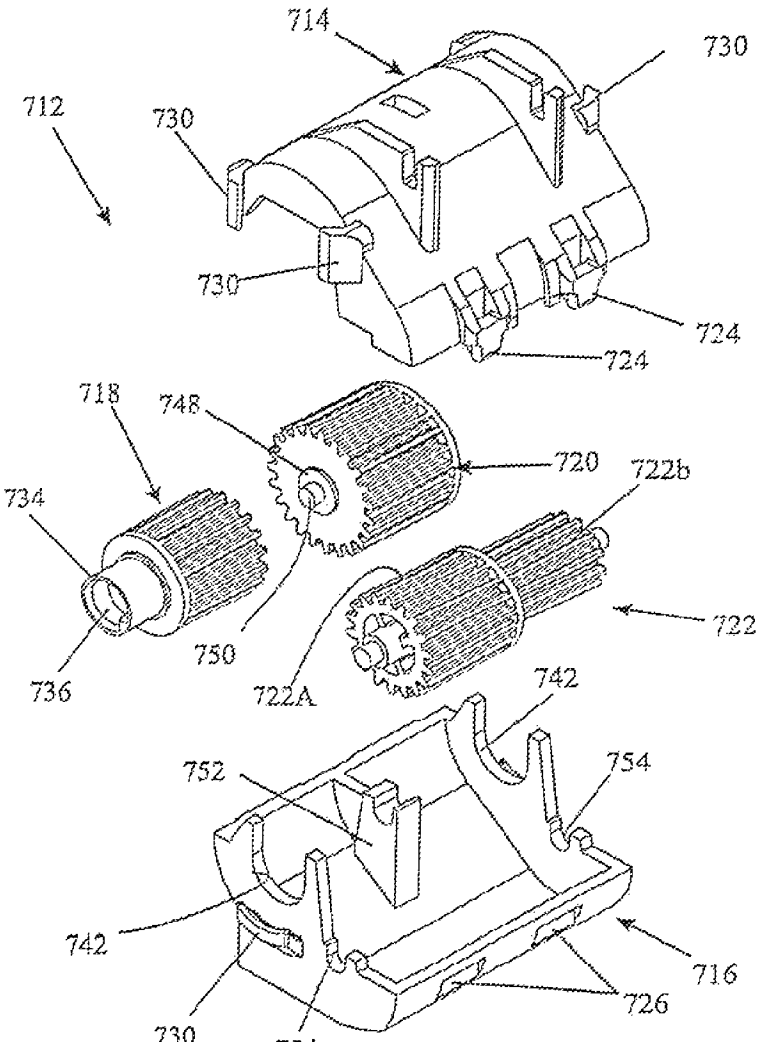
Figure 112:
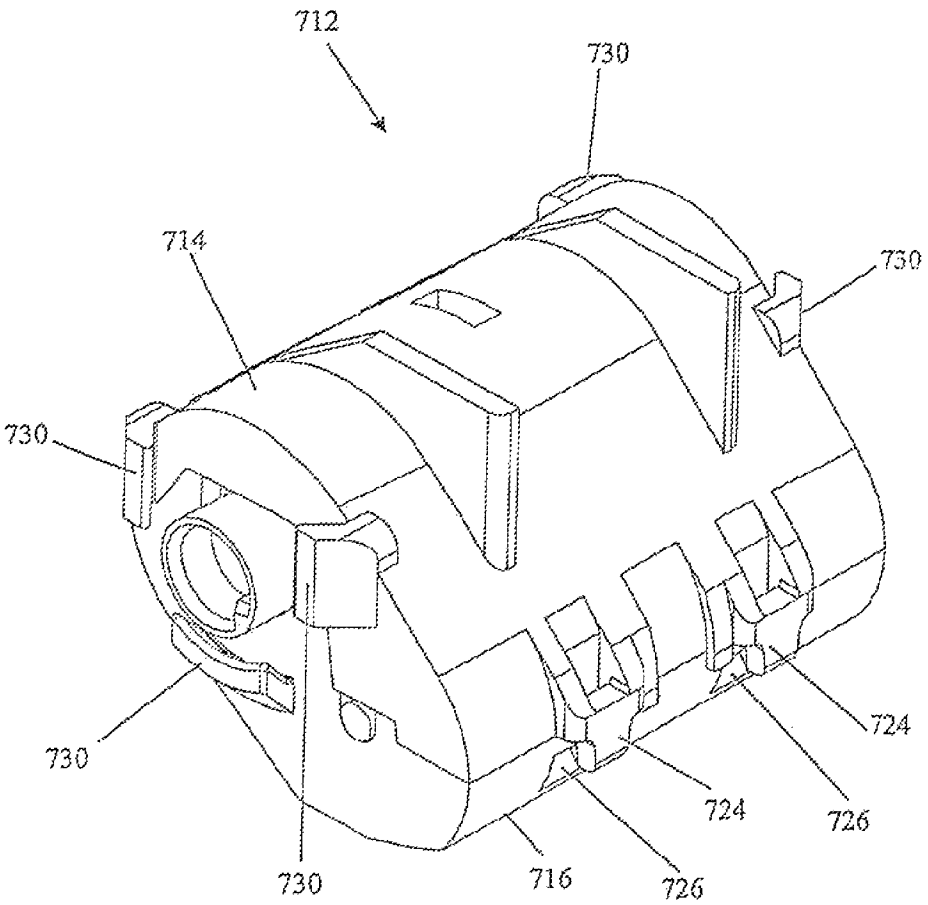
Figure 114:
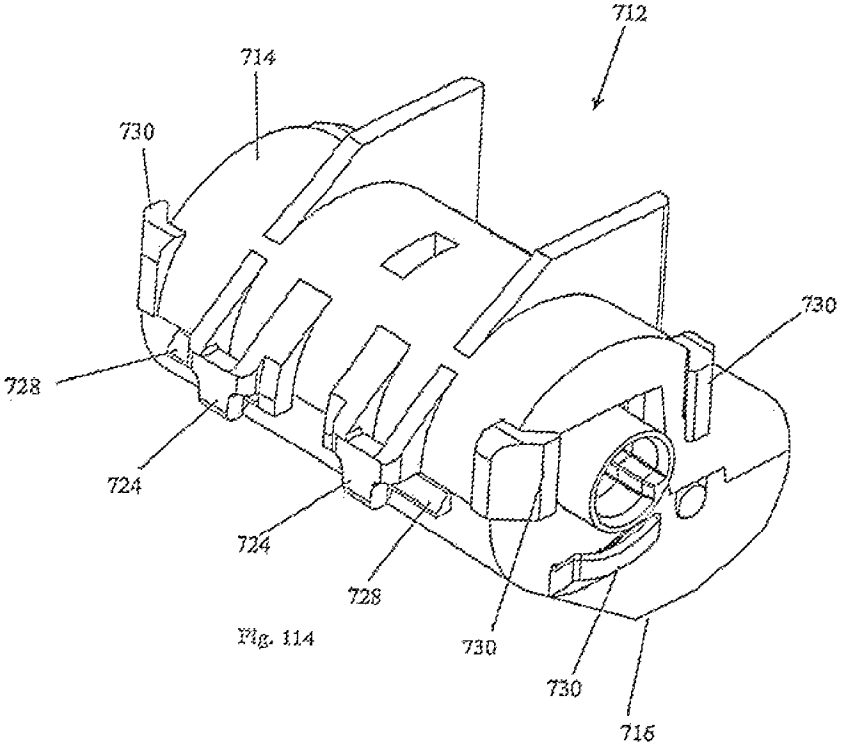

Referring now to FIGS. 112, 113, and 114, the gearbox 712 includes an upper housing 714, a lower housing 716, a first gear 718, a second gear 720, and a double gear 722. Clips 724 on the upper housing 714 snap into corresponding sockets 726 and over ramped ledges 728 to releasably engage the housing portions 714, 716 into a single housing which defines a cavity which rotationally supports the gears 718, 720, 722. The ends of the assembled housing of the gearbox 712 also define hooked projections 730 which may be used to releasably secure the gearbox 712 to other components on the drive. For instance, in FIG. 111 the gearbox 712' is attached to the cone drive 102 by sliding the "U"-shaped flange 732 on the cone drive housing 126 (See also FIG. 83) into the slot formed by the hooked projections 730 on the gearbox 712.

The gear 718 has a first end 734 (See FIG. 113) which defines a non-circular opening 736 with an internal geometry which closely matches the shape of the V-rod lift rod 702, and a second, closed end, 738 (See FIG. 115) which defines a short axle 740. Likewise, the second gear 720 has a first end 744 (See FIG. 115) which defines a non-circular opening 746 with an internal geometry which closely matches the shape of the V-rod lift rod 702, and a second, closed end, 748 (See FIG. 113) which defines a short axle 750. The first ends 734, 744 of the first and second gears 718, 720 respectively are rotationally supported by "U"-shaped saddles 742 in the lower housing 716. A pedestal 752 midway between the two "U"-shaped saddles 742 rotationally supports the short axles 740, 750 projecting from the second ends 738, 748 of the first and second gears 718, 720 respectively.

The double gear 722 (See FIG. 113) is rotationally supported by small "U"-shaped saddles 754 in the lower housing 716. This double gear 722 is sized and designed such that, when it is installed in the gearbox 712, the teeth in its first portion 722A engage the first gear 718, and the teeth in its second portion 722B engage the second gear 720.

Figure 115:
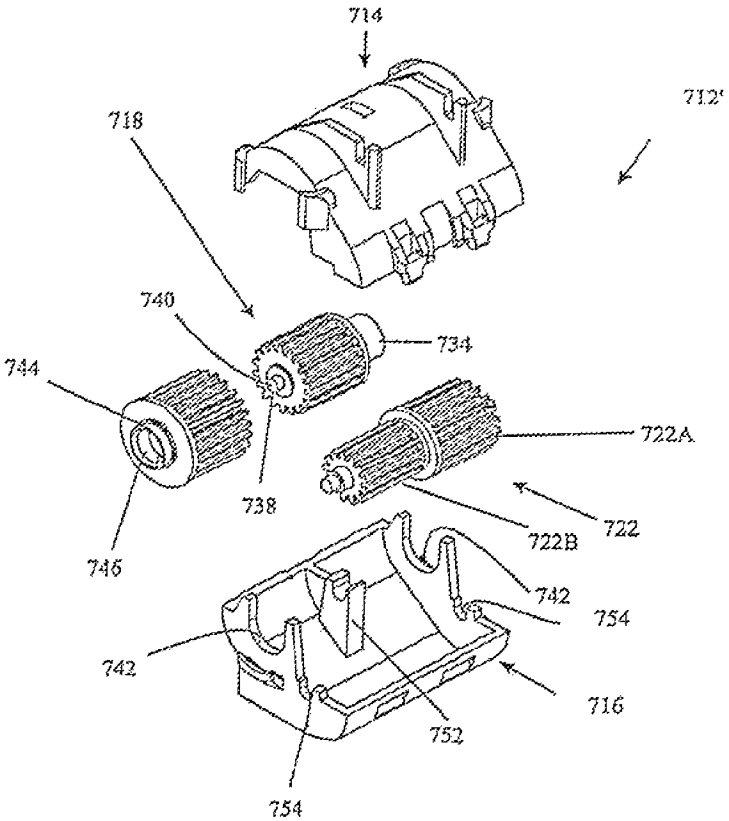

Comparing FIGS. 113 and 115, the location of the first and second gears 718, 720 in the lower housing 716 may be swapped by flipping these gears end-for-end. In this instance, the double gear 722 would also be flipped end-for-end so that the first portion 722A still engages the first gear 718 and the second portion 722B engages the second gear 720. Alternatively, a totally different set of gears 718, 720, 722 may be substituted in the same housing in order to obtain a different gear ratio (in the event that a different mechanical advantage is required).

To assemble the gearbox 712, the first and second gears 718, 720 are installed in the lower housing 716 such that their first ends 734, 744 rest on the "U"-shaped saddles 742 and their second ends 738, 748 rest on the pedestal support 752. The double gear 722 is installed in its respective "U"-shaped supports 754 (also in the lower housing 716) such that the first portion 722A engages the first gear 718 and the second portion 722B engages the second gear 720. The upper housing 714 then is snapped onto the lower housing 716 enclosing the gears 718, 720, 722.

One length of the V-rod 702 is inserted into the non-circular opening 736 of the first gear 718. Another length of V-rod 702 is inserted into the non-circular opening 746 of the second gear 720. In the example shown in FIG. 111, the first length of V-rod 702 extends to the transmission 624' via an adapter 756, which mates with the output gear of the transmission 624' at one end and with the V-rod 702 at the other end. The second length of V-rod 702 extends to a lift station 116*. In this embodiment, the gearbox is designed to reduce the amount of force available at any instant and distribute that reduced force over a longer distance, reducing the torque. So, in this instance, the input force coming from the motor 622' and transmission 624' is reduced by the gearbox 712.

The gearbox also could be configured to provide the advantage of a shorter stroke. Referring briefly to FIG. 115, the gearbox 712' has the gears 718, 720, 722 flipped end-over-end as compared to the gearbox 712 discussed above. This allows the gearbox 712' to be mounted on the drive end of the window covering 710 such that the input force (supplied by the motor 622' and the transmission 624' at the drive end of the window covering 710) may enter the gearbox 712' from its right side (as seen from the vantage point of FIG. 111) and still provide the same mechanical advantage as the gearbox 712 which has its input force coming in from its left side.

Roller Shade with Roller Lock

FIGS. 116-121 depict an embodiment of a roller shade 760 with a roller lock mechanism 762. FIG. 117 shows an exploded view of the components of the roller shade 760, including the shade element 764, the rotator rail 766, mounting brackets 768, drive-end end cap 770, drive cord 122, tassel weight 772, drive spool 774, roller lock housing 776, roller lock 778, idler spool 780, skew adjustment mechanism 782, and idler-end end cap 784. A similar roller shade system is described in U.S. patent application Ser. No. 10/819,690, Cord Drive for Covering for Architectural Openings, filed Apr. 7, 2004, which is hereby incorporated herein by reference. That application describes many of the components for the roller shade, such as the end caps, the mounting brackets, and the skew adjustment mechanism, so those will not be described again here. Only the relevant description for the application of the roller lock mechanism 762 to the roller shade 760 is described in detail below.

FIG. 118 depicts the drive-end end cap 770 with the roller lock mechanism 762. Referring now to the exploded, perspective view of FIG. 119, the end cap 770 defines a rectangular cavity 786 designed to releasably receive the roller lock housing 776. The cavity 786 defines two openings 788, 790 in its bottom wall 792. As is explained in more detail later, these openings 788, 790 serve to retain the roller lock housing 776 inside the cavity 786 and to provide a passage for the drive cord 122 to exit the end cap 770.

The drive spool 774 (See also FIG. 120) has already been described in detail in the aforementioned U.S. patent application Ser. No. 10/819,690, Cord Drive for Covering for Architectural Openings. The rib structure 794 positively engages the rotator rail 766 such that, when the drive spool 774 rotates, so does the rotator rail 766, and vice versa. The hollow shaft 796 on the drive spool 774 mounts onto the shaft 798 of the end cap 770 for rotation of the drive spool 774 about this shaft 798. A flange 800 on the drive spool 774 defines a peripheral groove 802 for the drive cord 122 to wrap onto (or unwrap from) the drive spool 774. In this case, the drive spool 774 does not wrap the drive cord 122 in a single layer, but, instead, wraps the drive cord 122 on top of itself, stacking the cord and creating a larger diameter lever arm when the drive cord 122 is fully wrapped onto the drive spool 774, with the lever arm decreasing as the drive cord 122 unwraps from the drive spool 774. This corresponds to the load that is being pulled by the operator, giving the mechanical advantage of the large lever arm when the blind is fully extended and the operator is pulling against the entire weight of the blind, and giving a smaller advantage as the blind rolls up and the operator is having to lift less weight to raise the blind.

Referring to FIGS. 118, 119 and 121, the roller lock housing 776 is received inside the cavity 786 of the end cap 770. A downwardly extending projection 804 on the roller lock housing 776 snaps into one of the openings 788, 790 of the end cap 770 in order to retain the roller lock housing 776 in the cavity 786. The projection 804 further defines a lower slotted opening 806, which provides an exit point from the roller lock housing 776 for the drive cord 122. As depicted in FIGS. 118 and 119, the projection 804 snaps into the left opening 788. However, if the roller lock housing 776 is turned end-for-end, the projection 804 snaps instead into the right opening 790, allowing these same components to be assembled for a left-side exit of the drive cord 122 (as seen from the vantage point of FIGS. 119 and 116) or a right-side exit of the same drive cord 122.

The roller lock housing 776 defines a cavity 808 to receive the roller lock 778, including ramped niches 810 in its side walls to rotationally support the shafts 812, 814 of the roller lock 778. In order to assemble the roller lock 778 into the housing 776, one of the shafts 812, 814 is inserted into its respective niche or recess 810. Then, the other of the shafts 812, 814 is pushed along its respective ramp until it reaches its respective niche or recess 810, where it snaps into place, so that both of the shafts 812, 814 are retained in their respective recesses 810. The housing 776 also defines an upper slotted opening 816 in the upper wall of the housing 776, for guiding the drive cord 122 to the drive spool 774 and to the capstan 818 on the roller lock 778. An appendage 820 in the housing 776 serves the same purpose as the appendage 670 (See FIG. 97) in the roller lock mechanism 130 described earlier, namely, to bias the roller lock 778 upwardly, into the upper, locked position, where the roller lock 778 is prevented from rotating.

The operation of the roller shade 760 with the roller lock mechanism 762 is quite similar to the operation of other window coverings discussed above. Initially, the shade element 764 may be fully lowered, and the drive cord 122 will be mostly wrapped onto the peripheral groove 802 of the drive spool 774. To raise or retract the shade element 764, the user pulls on the tassel weight 772, causing the roller lock 778 to move to its lower, unlocked position, where it is free to rotate. The drive cord 122 unwinds from the drive spool 774 as the roller lock 778 rotates, causing the drive spool 774 to rotate. The rotation of the drive spool 774 also causes the rotator rail 766 to rotate, so that the shade element 764 wraps onto the rotator rail 766.

As soon as the tassel weight 772 is released by the user, the appendage 820 pushes the roller lock 778 upwardly to the upper, locked position, where it cannot rotate. The weight of the shade element 764 also causes the rotator rail 766 to rotate, which causes the drive spool 774 to rotate, pulling up on the drive cord 122, and lifting the roller lock 778 into its locked position. The tassel weight 772 pulling on the drive cord 122 tightens the drive cord 122 onto the capstan 818 so it does not slip, thereby locking the drive spool 774, the rotator rail 766, and the shade element 764 in place. Since gravity is exerting a downward force on the shade element 764, if the tassel weight 772 is lifted (even if only enough to relax the tension on the drive cord 122), the drive cord 122 will surge the capstan 818, slipping around the capstan 818, and allowing the drive spool 774 and the rotator rail 766 to rotate, thereby lowering the shade element 764.

Product with Movable Middle Rail

FIG. 122 is a partially exploded, perspective view of an embodiment of a cellular shade 822, which is very similar to the shade 100 of FIG. 1 except for the addition of a middle, movable rail 824 (a secondary bottom rail) and a complete second cord drive 826, in addition to the first cord drive 825, which, together, are mounted in a wider head rail 108'. The second cord drive 826 includes a lift rod 118, a cone drive 102 with a roller lock 134''', and two lift stations 116*, and it is connected to the middle rail 824 via lift cords (not shown).

In a typical shade with a movable middle rail, there may be either no fabric between the middle rail 824 and the head rail 108', or there may be different fabrics used above the middle rail 824 than below the middle rail 824. For instance, a translucent fabric may be used above the middle rail 824 and an opaque fabric may be used below the middle rail 824. Then, if the middle rail 824 is fully raised, the opaque fabric is fully extended, creating the effect of closing the shade 822 and obscuring the room. If the middle rail 824 is fully lowered, then the translucent fabric is fully extended, creating the effect of closing the shade 822 but still allowing light to shine into the room. With the middle rail 824 somewhere in between the fully raised and the fully lowered positions (such as is shown in FIG. 122), the effect is to allow some light to shine into the room in the upper, translucent portion while providing some privacy in the lower, opaque part of the shade 822. Finally, the bottom rail 110 may be raised to fully open the shade 822, such that the opening is completely uncovered (the shade being completely retracted), in order to provide ventilation into the room. Raising and lowering the bottom rail 110 is controlled by the first cord drive 825, which is described below.

As shown in FIG. 122, the first cord drive 825 (on the right side of the shade 822) is connected to the bottom rail 110 via lift cords (not shown) as has already been explained with respect to the shade 100 with cone drive and roller lock of FIG. 1. As the drive cord 122 of the first cord drive 825 is pulled by the user, the drive cord 122 first unwraps from the cylindrical portion 174 (See FIG. 13) of the drive cone 124, rotating the drive cone 124, the lift rod 118, and the lift stations 116* connected to this cord drive 825. This raises the bottom rail 110. As the bottom rail 110 is raised, more of the cellular shade material 112 stacks onto the bottom rail 110, increasing the force required to raise this bottom rail 110. Eventually, the drive cord 122 begins to unwrap from the frustroconical portion 176 of the drive cone 124, providing a mechanical advantage to help raise the bottom rail 110, albeit at the expense of a longer travel for the drive cord 122.

The second cord drive 826 is connected to the middle rail 824. Although the cone drive 102 is "reverse" mounted on this cord drive 826, it operates in the same manner as the cone drive 102 described above. When the middle rail 824 is in its lowered position, essentially resting on top of the bottom rail 110, the left drive cord 122 is raised and wrapped onto the drive cone of its respective cone drive 102. As the user pulls on the left drive cord 122, it first unwraps from the cylindrical portion 174 (See FIG. 13) of its respective drive cone 124, rotating its respective drive cone 124, lift rod 118, and lift stations 116*. This raises the middle rail 824. As the middle rail 824 is raised, more of the upper portion of the cellular shade material 112 stacks onto the middle rail 824, increasing the force required to raise this middle rail 824. Eventually, the left drive cord 122 begins to unwrap from the frustroconical portion 176 of its drive cone 124, providing a mechanical advantage to help raise the middle rail 824, again at the expense of a longer travel for the left drive cord 122.

Roman Shade with Cone Drive and Roller Lock

FIGS. 123-128 depict an embodiment of a Roman shade 830 with a cone drive and roller lock mechanism 832. FIG. 124 shows an exploded view of most of the components of the Roman shade 830, including the head rail 834, end caps 836, tassel weight 772 (which is connected to drive cord 122, as shown in FIG. 123), roller lock 132, roller lock housing 104, drive cone 124'', cone drive housing 126', drive cord relocation adapter 838 (including pulleys 840), lift stations 116**, lift rod 702, adapter 756, transmission 624', transmission mounting plate 842, motor 622', and motor mounting plate 844.

A similar Roman shade 100' is shown in FIG. 4, with the difference being that the cone drive 102 and roller lock mechanism 104 in that embodiment are in front of the shade 112''', while the present embodiment makes use of a drive cord relocation adapter 838, shown in FIGS. 123 and 124 to locate the cone drive and cord lock mechanism combination 832 behind the shade 112', as explained below.

Other than relatively small modifications to allow for the installation of components onto the head rail 834 (for instance, the use of a transmission mounting plate 842 and a motor mounting plate 844 to aid in the mounting of their respective transmission 624' and motor 622', the use of a screw 848 to mount the slightly modified housings of the lift stations 116**, and the slightly modified housing 126' of the cone drive), the major difference is the use of the drive cord relocation adapter 838, as described below.

FIGS. 125, 126, and 127 are perspective views of the cone drive and roller lock mechanism 832 complete with the drive cord relocation adapter 838. As best appreciated in FIG. 128, the drive cord relocation adapter 838 includes a first pulley 840A and a second pulley 840B. The first pulley 840A serves to change the direction of the drive cord 122 from its downward direction as it exits the roller lock housing 104** to an upward direction and shifts the drive cord 122 longitudinally along the head rail 834. The second pulley 840B once again changes the direction of the drive cord 122 back to a downward direction at a point where the exiting drive cord 122 is substantially aligned with one of the end caps 836 of the head rail 834. This leaves the drive cord 122 and the tassel weight 772 just beside and slightly behind the shade 112''' of the Roman shade 830.

The cone drive and roller lock mechanism 832 behaves no differently than the cone drive 102 and roller lock 104 of the Roman shade 100''' shown in FIG. 4. The addition of the drive cord relocation adapter 838 simply shifts the location of the drive cord 122 so that the entire mechanism may remain hidden inside the head rail 834, and only the drive cord 122 and the tassel weight 772 are unobtrusively visible and available beside and just behind the shade 112'''.

Shutter-Like Blind with Cone Drive

FIGS. 129-130 depict an embodiment of a shutter-like blind 850 with a cone drive 852 made in accordance with the present invention. This is a blind which has no obvious head rail or bottom rail. It may also be described as a shutter which has no rails and no stiles. All the louvers 858 of this shutter blind 850, including the head rail 854 and the bottom rail 856, look essentially the same, and the entire blind stack, including the pivoting head rail 854 and the pivoting bottom rail 856, pivot in unison along the elongated pivot at the centroid of each of the louvers. In addition, the mounting arrangement provides for the elongated pivot axis of each louver 858 to traverse inwardly toward the window when the louvers tilt closed, and outwardly, away from the window, when the louvers tilt open, so that the window frame itself creates the appearance of the frame that would be provided by the rails and stiles of a traditional shutter. The majority of this shutter blind and its mounting and tilting mechanism, including mounting brackets 860, and wand actuator 870 for the drive cord 122 for raising and lowering the shutter blind are described in U.S. patent application Ser. No. 10/197,674 which is hereby incorporated herein by reference. Only those items relevant to the cone drive 852 of the present embodiment are described below.

FIG. 129 shows a partially exploded, perspective view of some of the components of the shutter-like blind 850, including a cone drive 852, a head rail 854, a bottom rail 856, louvers 858, mounting brackets 860, lift stations 862, a lift rod 864, a hollow spacer 866, lift cords 868, and a wand actuator 870.

Figure 106:
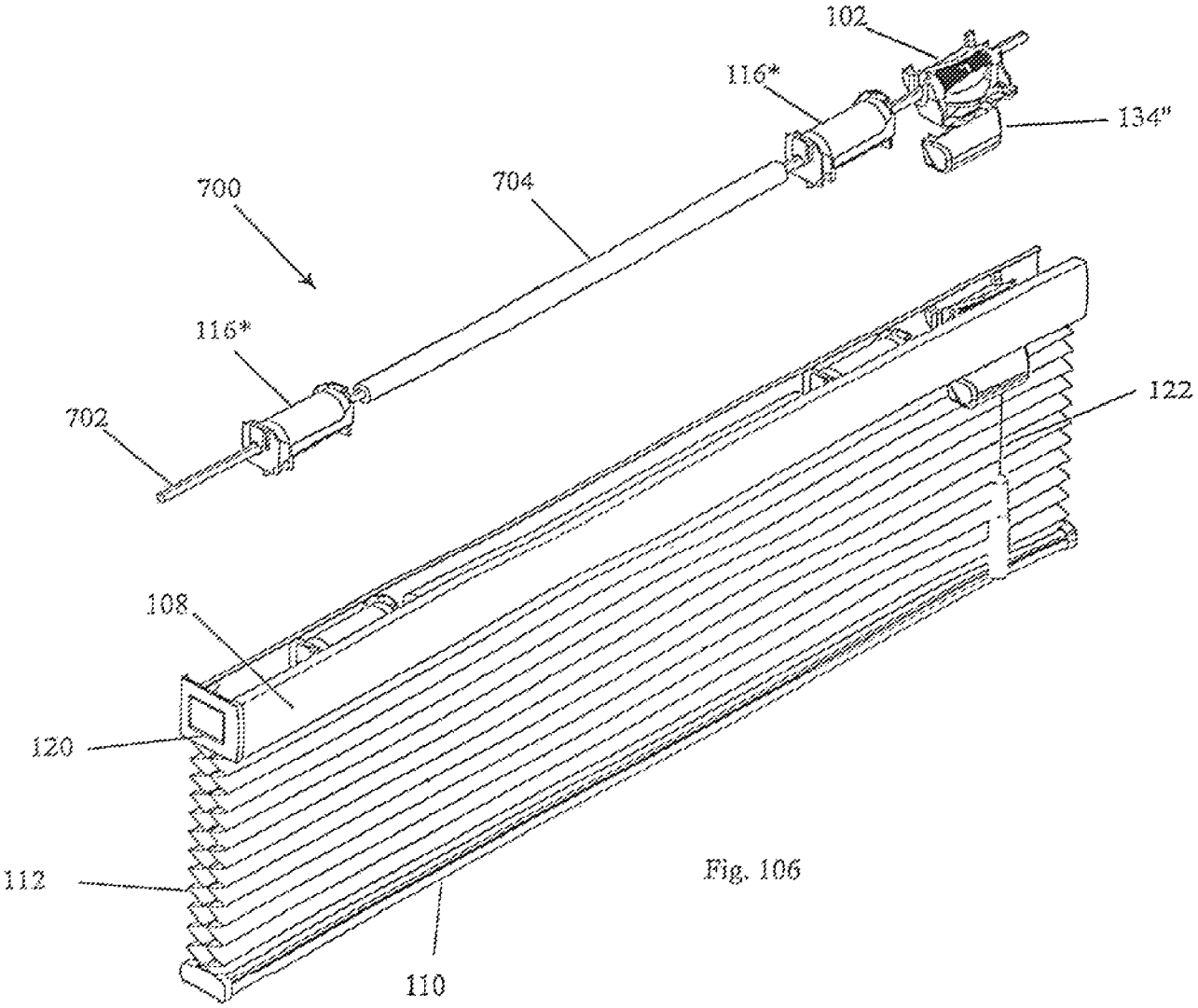
Figure 108:
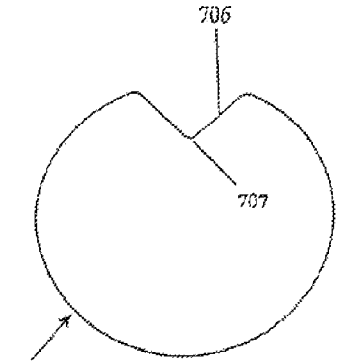
Figure 109:
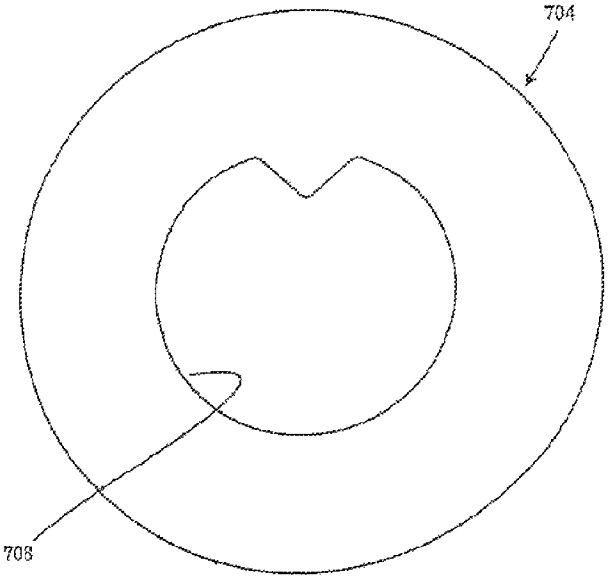
Figure 107:
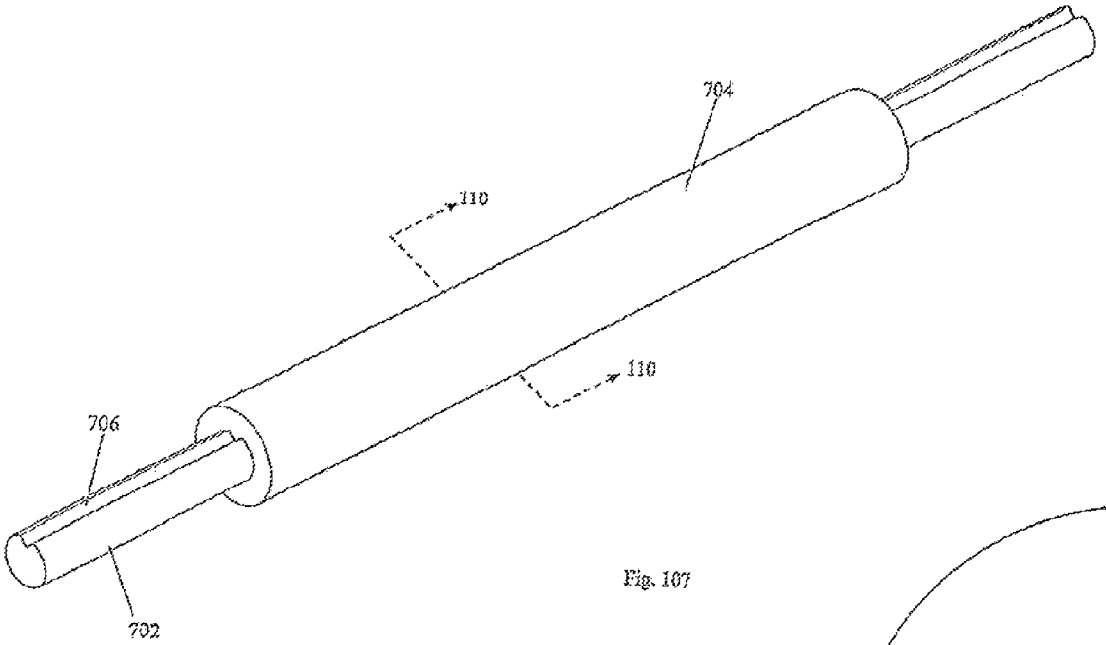

The lift stations 862 are similar to the lift stations 116* of FIG. 106, except that they include stabilizer wings 872 to assist in the mounting of the lift stations 862 to the inside of the hollow, airfoil-shaped head rail 854. The stabilizer wings 872 keep the lift stations 862 from rotating inside the head rail 854 once the lift rod 864 begins to rotate. The lift stations 862 are also properly axially located along the length of the lift rod 864 by using hollow spacers 866 (which may in fact be the high strength sleeves 704 depicted in FIG. 106) to maintain the proper axial separation between the different components, such as between the lift stations 862 and between the lift station 862 and the cone drive 852. Other means for properly maintaining these axial separations, such as the use of star fasteners (not shown) which grip onto the lift rod 864 with the components abutting these star fasteners, may also be used. The forward and rear lift cords 868 are attached at one end to the bottom rail 856. The other ends of the lift cords 868 are threaded through slits 874 in the head rail 854 and are attached to the lift spools 863 of the lift stations 862 such that, when the lift spools 863 rotate, the lift cords 868 wrap onto (or unwrap from) their respective lift spools 863 to raise or lower the blind.

As shown in FIGS. 129 and 130, the cone drive 852 includes a housing 876, which serves multiple purposes, including: rotational support of the drive cone 878 (which corresponds to the drive cone 124 of FIG. 13); anchoring of the guide surface 880 (which corresponds to the guide surface 144 of FIG. 13); anchoring of the pulley 882 (which serves the same purpose as the opening 206 in the roller lock mechanism 130 of FIG. 14, as explained below); anchoring of the wand actuator 870, and, finally, housing the entire cone drive assembly 852 for installation into the head rail 854.

FIG. 131 is a plan view of a cone drive assembly 852', very similar to the cone drive 852 of FIGS. 129 and 130, except that the drive cone 878' is cylindrical rather than frustoconical. These two FIGS. 130, 131 show how the pulley 882 serves to locate the emanation point of the drive cord 122 relative to the guide surface 880 in much the same manner that the opening 206 in the roller lock mechanism 130 of FIG. 14 accomplishes the same task. The pulley 882 alternatively may be any other turning surface (such as an eyebolt, for instance).

A first end of the drive cord 122 is attached to the drive cone 878. The drive cord 122 then is wrapped onto the drive cone 878 and routed over the guide surface 880, around the pulley 882, and through an opening 884 in the housing 876. It is then connected to the wand actuator 870 (as shown in FIG. 129).

As the handle 886 of the wand actuator 870 is pulled down by the user, the drive cord 122 is also pulled down, so it unwraps from the drive cone 878, making the drive cone 878 rotate. The lift rod 864, in turn, rotates with the drive cone 878. As the lift rod 864 rotates, the lift spools 863 of the lift stations 862 also rotate, causing the lift cords 868 to wrap onto the lift spools 863, raising the bottom rail 856 of the blind 850. When the user releases the handle 886, the handle 886 locks onto the wand actuator 870, locking the blind so that the bottom rail 856 and the louvers 858 remain in place.

As the handle 886 of the wand actuator 870 is pushed up by the user, the tension on the drive cord 122 is relieved. The force of gravity acting on the bottom rail 856 causes the lift cords 868 to unwrap from their respective lift stations 862, causing the spools 863 in the lift stations 862 to rotate and also causing the lift rod 864 to rotate. This rotation of the lift rod 864 causes the drive cone 878 to rotate and the drive cord 122 to wrap onto the drive cone 878 until the tension is once again restored on the drive cord 122 (or until the bottom rail reaches the bottom or the lift cords 868 reach their fully extended lengths).

Vertical Blind with Cone Drive and Roller Lock

FIG. 132 depicts an embodiment of a vertical blind 890 with a cone drive 892 and roller lock mechanism 894 made in accordance with the present invention. In most instances of a cone drive and/or of a roller lock described earlier in this specification (with the exception of the tilter mechanism 452 shown in FIGS. 57 through 68, and the possible exception of an overpowered window covering), the roller lock mechanism acts against the force of gravity. In the case of a vertical blind 890, an artificial force or load is introduced (in this instance via a spring motor 896 as described in more detail below) to provide an opposing force instead of gravity.

The vertical blind 890 of FIG. 132 includes a head rail 898, vanes 900 suspended from a carrier assembly 902 (or carrier train 902), a spring motor 896, a cone drive 892, a roller lock mechanism 894, a drive cord 122, a tassel weight 772, end caps 904, an idler end housing 906, a tilt rod 908, tilt mechanism 910, tilt chain 912, and two carrier cables 914, 916. As is well known in the industry, the vanes 900 clip onto their respective carriers in the carrier assembly 902. The tilt chain 912 is used to "tilt" the vanes 900 open or closed via the tilt mechanism 910 and the tilt rod 908.

In a typical prior art vertical blind, there are two carrier cables, both of them attached to the lead carrier in the carrier assembly. The first (extending) cable is used to pull the lead carrier (and therefore all the vanes attached to the carrier assembly) to the fully extended position. The second (retracting) cable, routed through an idler housing, is used to pull the lead carrier to the fully retracted position. Note that the two carrier cables could be a single cable with the lead carrier attached to this cable at a point in between the two ends of the single carrier cable.

In this embodiment of a vertical blind 890, the first carrier cable 914 (the extending cable 914) is attached, at its first end, to the lead carrier in the carrier assembly 902, and, at its second end, to an extending spool 918 mounted for rotation with the spring motor 896. The spring motor 896 is similar (if not identical) to the spring motor 622 shown in FIG. 9, except that, instead of having a transmission 624 attached to it at its output, this spring motor 896 has the extending spool 918 mounted to its output shaft. The second carrier cable or driven cord 916 (the retracting cable 916) is attached, at its first end, to the lead carrier in the carrier assembly 902, and, at its second end, to a retracting spool 920 mounted for rotation with the drive cone 124" of the cone drive 892. The retracting cable 916 is routed from the lead carrier in the carrier assembly 902 to the retracting spool 920 via the idler housing 906.

Figure 83:
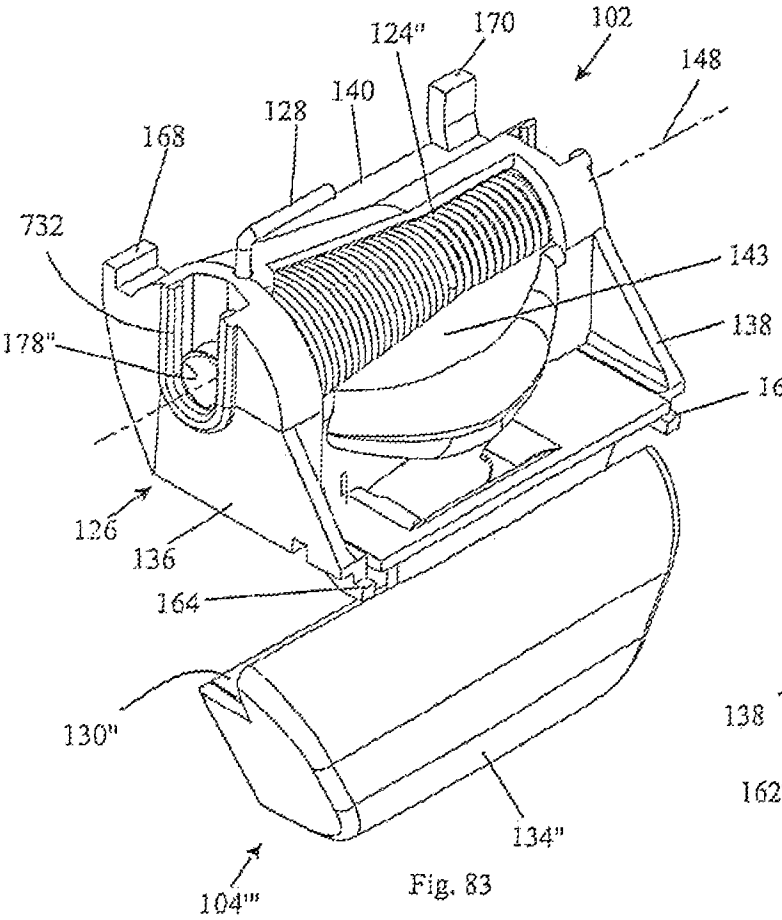
FIG. 83 is a front perspective view of the cord drive of FIG. 11 but with an alternate embodiment for a roller lock mechanism made in accordance with the present invention.

The cone drive 892 and the roller lock mechanism 894 of this embodiment operate in the same manner as the cone drive 102 and roller lock mechanism 104'" of FIG. 83. As the drive cord 122 is pulled by the user, the roller lock rotor 132'" (See FIG. 85) of the roller lock mechanism 894 is pulled down to its lower, unlocked position, enabling it to rotate about its axis of rotation 198'", and the drive cord 122 unwraps from the drive cone 124", rotating the drive cone counterclockwise (as seen from the vantage point of FIG. 132). The retracting spool 920 is mounted for rotation together with the drive cone 124", and the retracting cable 916 is attached to the retracting spool 920, so the retracting cable 916 wraps onto the retracting spool 920 as the drive cord 122 unwraps from the drive cone 124". Since the retracting cable 916 passes around the idler pulley at the idler end housing 906, this action pulls the other end of the retracting cable 916 back toward the idler end housing 906, and drags with it the lead carrier of the carrier assembly 902, retracting the stack of vanes 900 to open the blind 890.

Since the first end of the extending cable 914 is also attached to the lead carrier of the carrier assembly 902, this first end of the extending cable 914 is also pulled toward the idler end housing 906 as the carriers are retracted. The second end of the extending cable 914 is attached to the extending spool 918 on the spring motor 896, so, as the carriers are retracted, the extending cable 914 unwraps from this extending spool 918, causing the spring motor 896 to wind up.

As soon as the user releases the drive cord 122, the wound up spring in the spring motor 896 rotates the extending spool 918 in a counterclockwise direction as seen in FIG. 132, pulling on the extending cable 914, which pulls on the lead carrier in the carrier assembly 902, pulling the vanes 900 back to the extended position. However, this also pulls on the retracting cable 916, which begins to unwrap from the retracting spool 920. This rotates the retracting spool 920 and the drive cone 124" in a clockwise direction, pulling up on the drive cord 122, which pulls the roller lock rotor 132'" to its upper and locked position. The weight of the tassel 772 pulling on the drive cord 122 tightens the drive cord 122 around the capstan 184'" so that the drive cord 122 does not slip around the capstan 184'". This locks the drive cord 122 onto the capstan 184'", which locks the entire blind 890 in the position it was in when the drive cord 122 was released by the user.

To move the vanes 900 to the fully extended position, the user lifts up on the tassel weight 772, which allows the drive cord 122 to surge the capstan 184'" in the roller lock mechanism 894. The drive cord 122 is guided by the guide surface 144 to wrap onto the drive cone 124" as the drive cone 124" rotates clockwise. The drive cone 124" is driven by the spring motor 896 via the extending and retracting cables 914, 916, as the spring motor 896 returns to its unwound condition. The unwinding spring motor 896 rotates the extending spool 918 in a counterclockwise direction, causing the carrier assembly 902 to extend, and closing the blind 890. This rotates the retracting spool 920 in a clockwise direction, thereby driving the drive cone 124".

Of course, alternatively, the cables could be reversed, so that pulling on the drive cord 122 extends the blind, and the spring motor 896 retracts the blind.

Top Down/Bottom Up Shade with Drag Brake

FIGS. 133 and 134 depict a top down/bottom up shade 1002, which uses a drag brake. The shade 1002 includes a top rail 1004 with end caps 1006, a middle rail 1008 with end caps 1010, a bottom rail 1012 with end caps 1014, a cellular shade structure 1016, a drag brake 1000, bottom rail lift stations 1018, middle rail lift stations 1020, a bottom rail lift rod 1022, a middle rail lift rod 1024, spring motors 1026 and 1026', transmissions 1028 and 1028', adapters 756, and motor mounting plates 844*. Some of these items have already been shown in previous embodiments, such as the adapter 756 (already seen in FIG. 11), the motor mounting plate 844*(a similar motor mounting plate 844 is shown in FIG. 124), and the lift stations 1018 and 1020 (shown in FIG. 122, for instance, as lift stations 116*). Only the drag brake 1000 is described in detail in this section, since the other components are described elsewhere in the specification.

FIG. 134 to 137 depict the drag brake 1000. As will be described later, the drag brake 1000 allows rotation of a lift rod in first and second directions about its axis of rotation. When rotating in the first direction, a relatively small torque, referred to as the release torque, is required to overcome the resistance of the drag brake 1000. When rotating in the second direction, a relatively large torque, referred to as the slip torque, is required to overcome the resistance of the drag brake 1000. In this embodiment, the slip torque is an order of magnitude larger than the release torque.

Prior art brakes of this general type, also referred to as spring-wrapped slip clutches, utilize two springs of opposite hand (that is, a right hand spring and a left hand spring) to control slip forces in both directions. Other prior art brakes of this general type may use a stepped spring, part of which clamps onto a shaft, and another part of which clamps onto a sleeve surrounding the shaft. The drag brake 1000 utilizes one spring on the drum to generate both torsional resistances (slip torque and release torque) as discussed in more detail below. This results in a very low cost and simple design.

In the case of the top down/bottom up shade 1002 of FIG. 134, the drag brake 1000, the lift stations 1018, 1020, the lift rods 1022, 1024, the spring motors 1026, 1026', and the transmissions 1028, 1028' are all housed in the top rail 1004. The front lift rod 1024 interconnects the two lift stations 1020, the motor 1026', the transmission 1028', and the middle rail 1008 via lift cords 1030 (See FIG. 133). In this instance, the middle rail 1008 may travel all the way up until it is resting just below the top rail 1004, or it may travel all the way down until it is resting just above the bottom rail 1012, or the middle rail 1008 may remain anywhere in between these two extreme positions. To lower the middle rail 1008, the user grasps the middle rail 1008 and pulls it down to the desired position. Once released, the middle rail 1008 remains in position due to the system friction inherent in the device. To raise the middle rail 1008, the user once again grasps the middle rail and raises it up. The motor 1026' and the transmission 1028' assist in raising the middle rail 1008 by rotating the lift rod 1024 and thus having the lift cords 1030 (which are connected to the middle rail 1008) wind up onto their respective lift stations 1020 as has already been described with respect to previous embodiments.

The rear lift rod 1022 interconnects the two lift stations 1018, the motor 1026, the transmission 1028, the drag brake 1000, and the bottom rail 1012 via lift cords 1032 (See FIG. 133). In this instance, the bottom rail 1012 may travel all the way up until it is resting just below the middle rail 1008 (regardless of where the middle rail 1008 is located at the time), or it may travel all the way down until it is extending the full length of the shade 1002, or the bottom rail 1012 may remain anywhere in between these two extreme positions. In fact, the bottom rail 1012 may be raised until it makes contact with the middle rail 1008, and then these two rails 1012, 1008 may be raised further until they are both stacked up just below the top rail 1004.

To lower the bottom rail 1012, the user grasps the bottom rail 1012 and pulls it down to the desired position. Once released, the bottom rail 1012 remains in position due to the system friction inherent in the device and due to the slip torque resistance of the drag brake 1000, which imparts a relatively high resistance to rotation to the lift rod 1022 so as to restrain the bottom rail 1012 from lowering any further. Of course, this means that the user must overcome the slip torque resistance in order to lower the bottom rail 1012. To raise the bottom rail 1012, the user once again grasps the bottom rail 1012 and raises it up. The motor 1026 and the transmission 1028 assist in raising the bottom rail 1012 by rotating the lift rod 1022 and thus having the lift cords 1032 (which are connected to the bottom rail 1012) wind up onto their lift stations 1018 as has already been described. The drag brake 1000 contributes a relatively low resistance to rotation in this first direction (release torque) in order to allow rotation of the lift rod 1022.

Normally, in a more conventional top down shade, the force required to raise the bottom rail 1012 is lowest when the bottom rail 1012 is fully lowered, and this force gradually increases as the bottom rail 1012 is raised and more of the cellular structure 1016 stacks on top of the bottom rail 1012. However, in the top down/bottom up shade 1002, the loads on the bottom rail may vary greatly for a given position of the bottom rail 1012, depending upon the position of the middle rail 1008. For example, if the middle rail 1008 is fully raised, then the loads on the bottom rail 1012 will gradually increase as the bottom rail is raised, just as they do in a more conventional top down shade. However, if the middle rail 1008 is fully lowered, then the bottom rail 1012 bears the full weight of the shade as it begins to be raised from its bottom-most position. This makes it very difficult if not impossible to design a lifting system that will match the needs of the bottom rail under all conditions. If a second spring motor or a stronger spring motor is used to handle the large load conditions, this may lead to an overpowered condition where the bottom rail 1012 will not stay in the desired position and instead creeps upwardly when the middle rail 1008 is not stacked up against it.

The drag brake 1000 solves this problem without the need for a second spring motor or for a stronger spring motor. The original spring motor 1026 still may be used. The drag brake 1000 keeps the bottom rail 1012 in the desired position when it is released, even under heavy load conditions where the spring motor 1026 is too weak to prevent the bottom rail from falling, since the slip torque required to rotate the drag brake 1000 in the direction required to lower the bottom rail 1012 is higher than the force exerted by the weight of the middle rail 1008 and the cellular structure, even when these are fully stacked on top of the bottom rail 1012. Thus, the drag brake 1000 prevents the bottom rail 1012 from falling downwardly in an underpowered situation. On the other hand, the release torque required to rotate the drag brake in the direction required to raise the bottom rail 1012 is much less than the slip torque, adding very little force to what would otherwise be needed to raise the bottom rail 1012. The extra force required is so small as to be unnoticeable by the user.

Referring to FIGS. 135 and 136, the drag brake 1000 includes a housing 1034, a lock spring 1036, and a lock spring spool 1038. The housing 1034 is a substantially cube-shaped box 1039 defining a cavity 1040 which is open at the top. The housing 1034 houses the lock spring spool 1038 and supports the spool 1038 for rotation. V-shaped notches 1042 in the front and rear walls of the cube-shaped box 1039 define semi-circular surfaces 1044 which rotationally support the shaft ends 1046 of the lock spring spool 1038. Shoulders 1048 on the side walls of the cube-shaped box 1039 keep the lock spring 1036 from "walking" off of the spool 1038 as described in more detail below. A tab 1050 projects from the top of one of the side walls and, together with a corresponding flange 1052 on the other side wall, they provide means for releasably securing the drag brake 1000 to the top rail 1004. A slotted through-opening 1054 at a bottom corner of the cube-shaped box 1039 provides a convenient anchoring point for the lock spring 1036 as described below. The opening 1054 has two portions. The right portion has a large opening, and the left portion has a small opening.

The spool 1038 defines a hollow shaft 1056 with a non-circular profile which closely matches the profile of the lift rod 1022. The spool 1038 is substantially cylindrical in shape, and its outside surface 1058 defines an outside diameter which is just slightly larger than the diameter of the inside surface 1060 of the lock spring 1036 when the lock spring 1036 is in its relaxed, or at rest, position. The outside surface 1058 of the spool 1038 also defines three radially-extending grease grooves 1062 (the purpose of which is explained shortly). A flange 1064 at one end of the spool 1038 keeps the spring 1036 from sliding off that end of the spool 1038.

The lock spring 1036 is a tightly coiled spring with a first end 1066, a second end 1068, and an internal surface 1060. The second end 1068 defines a loop or curl 1070 which helps lock the second end 1068 of the spring 1036 to the housing 1034 as described in the assembly procedure below.

Referring to FIG. 137, step one in the assembly of the drag brake 1000 is to add grease to the grease grooves 1062. This reduces friction between the spool 1038 and the spring 1036, in order to reduce the force required to rotate the lift rod 1022, especially in the release direction. The preferred grease is petrolatum lubricant (i.e. Vasoline). It should also be noted that other mechanisms may also benefit from such lubrication, such as the spring motors, gear box, and so forth. Step two is to slide the spring 1036 onto the surface 1058 of the spool 1038. It may be necessary to push up slightly on the curl 1070 to open up the spring 1036 enough so that it may slide over the spool 1038. Step three is to insert the assembled spool 1038 and spring 1036 into the housing 1034 such that the curl 1070 extends through the right portion of the opening 1054 in the bottom corner of the housing 1034. As shown in Step four of FIG. 137, the curl 1070 is then shifted in the direction of the arrow 1055 and into the left (smaller) portion of the opening 1054 to lock the curl 1070 onto the housing 1034, since the curl 1070 is too large to fit through the smaller portion of the opening 1054. The lift rod 1022 is then inserted through the hollow shaft 1056 of the spool 1038, and the drag brake 1000 may now be mounted in the head rail 1004. It may be noted that the spring 1036 lies over the surface 1058 of the spool 1038, and it remains there due to the flange 1064, which limits the axial motion of the spring 1036 in one direction, and due to the shoulders 1048 in the housing 1034, which limit the axial motion of the spring 1036 in the other direction.

The release torque of the drag brake 1000 is proportional to the diameter of the lock spring wire raised to the fourth power. Therefore, the thinner the wire from which the spring 1036 is made, the lower the release torque. Since it is desirable to have a low release torque, in order to make it easy to raise the blind, the diameter of the wire used in this embodiment is very small. However, this causes a problem in trying to securely anchor the end of the spring 1036 to the housing 1034. The curl 1070 provides an easy assembly of the end 1068 of the spring 1036 to the housing 1034. The curl 1070 is formed and located such that it gets tighter under load (as when the spring 1036 is trying to pull its end 1068 out of the housing 1034), rather than unwinding, so it does not allow the wire to pull out of its anchor point.

As seen from the vantage point of FIG. 135, as the spool 1038 is rotated counterclockwise, the spring 1036 "opens up". The inside surface 1060 of the spring 1036 expands because friction between the spring 1036 and the spool 1038 causes the spring 1036 to rotate counterclockwise with the spool 1038, while the second end 1068 of the spring 1036 is fixed. This causes the spring 1036 to release its grip on the outside surface 1058 of the spool 1038, and the spool 1038 is able to rotate with relative ease.

As the spool 1038 is rotated in a clockwise direction, the spring 1036 "closes down", tightening its grip on the spool 1038. The inside surface 1060 of the spring 1036 contracts, because the spring 1036 rotates clockwise with the spool 1038, while the second end of the spring 1036 is fixed to the housing 1034 via the curl 1070. Because the spring 1036 tightly grips the spool 1038, the spool 1038 is able to rotate only with much difficulty, when the force urging the spool 1038 to rotate exceeds the slip torque of the drag brake 1000.

As described earlier, when the drag brake 1000 is installed in the shade 1002 of FIG. 134, it allows rotation of the lift rod 1022 with relative ease in the direction for raising the bottom rail 1012. The resistance to rotation by the drag brake 1000 in this instance is the release torque, which is relative low. However, the drag brake 1000 allows rotation of the lift rod 1022 in the opposite direction (so as to lower the bottom rail 1012) only when the force exerted by the weight of the shade and the catalytic force by the user pulling down on the bottom rail 1012 exceeds the slip torque of the drag brake 1000. The weight of the shade alone is not sufficient to overcome the slip torque resistance of the drag brake 1000, and the shade remains in the desired position as placed by the user regardless of the position of the middle rail 1008.

It will be obvious to those skilled in the art that it is possible to combine the use of the drag brake 1000 with any of the other mechanisms described in this specification, without departing from the scope of the present invention.

Top Down/Bottom Up Shade without a Drag Brake

FIG. 134A depicts another configuration of a transport drive 1254 for a top down/bottom up covering for architectural openings. This transport drive 1254 would typically be housed inside the top rail (not shown), similar to what is shown in the partially exploded views of FIGS. 1-10. This embodiment of the transport drive 1254 includes two complete, independent drives; the first drive interconnected by the lift rod 1022 and the second drive interconnected by the lift rod 1024. Each drive includes, at its first end, a cone drive 102 with a corresponding roller lock 104, and a first gear box 712', and, at its opposite, second end, another gear box 712', a transmission 1028, and a spring motor 1026. Mounted in between these two ends of each drive are lift stations 116*, which are similar to the lift stations 116* shown in FIGS. 116 and 122, except for the use of twin station mounting adapters 1256 which serve to mount the lift stations 116* to the top rail (not shown) and stiffen the mounting arrangement of the entire transport drive 1254.

It may be noted that this Top Down/Bottom up transport drive 1254 does not make use of a drag brake 1000 as seen in FIG. 134. This is because the roller lock 104 serves the same purpose, which is to lock the window covering where it is released by the user despite the weight of the window covering acting to lower it, as has already been discussed in conjunction with other embodiments of window coverings.

It should also be noted that different combinations of components may be used to accommodate different sizes and weights of window coverings. For instance, it may be possible to remove one or both of the gear boxes 712' from each drive. It may also be possible to remove the transmission 1028 and/or the spring motor 1026. It may also be possible to add more of these components, for instance to have two or more motors 1026 on each drive.

Transmission with Low System Resistance

FIG. 134 also shows transmissions 1028 and 1028' used in the shade 1002. It may be appreciated that, in some of the embodiments of window coverings described in this specification, it is not advantageous to have an inherently high system friction in the component train of the window covering. The U.S. Pat. No. 6,536,503, Modular Transport System for Coverings for Architectural Openings, which (as indicated earlier) is hereby incorporated herein by reference, discloses a transport system in which a relatively high system friction is indeed advantageous in order to keep the blind in the desired position as determined by the user. In such a window covering, the system friction and the spring motor(s) are balanced such that only a small catalytic force input is required by the user to move the window covering to a new position. The system friction assists in keeping the window covering in the desired position, acting against the force of gravity and/or the force of the spring motor(s) to move the window covering from the desired position.

Some of the components disclosed in this specification, such as the roller lock mechanism and the drag brake, reduce the need for a system where the forces are finely balanced and instead reward the use of inherently low-friction components. These components assist in holding the window covering in position instead of relying on the high system friction for this function. Lower friction components result in lesser need for spring motors and/or smaller catalytic force by the user to change the position of the window covering.

FIG. 138 to 145 depict an embodiment of a low-friction transmission 1080 made in accordance with the present invention. Referring briefly to FIG. 139, the transmission 1080 has only four major parts: a housing 1082, a drive shaft 1084, a driven shaft 1086, and a cover 1088. Other parts include the locking pin 1090, the locator pins 1092, rivet studs 1091 to hold the transmission 1080 together, and the transmission cord 1094, not shown in this view but seen in FIGS. 144 and 145.

Referring now to FIG. 143, one may compare the relative size and the simplicity of design of the present transmission 1080 with a higher friction transmission 1096. The higher friction transmission 1096 has ten major parts: a housing 1098, a drive shaft 1100, a driven shaft 1102, four bushings 1104A, 1104B, 1104C, 1104D, an output shaft 1106, an intermediate cap 1108, and an end cap 1110, as well as including locking pins, assembly screws and the transmission cord.

The housing 1082 and the end cap 1088 of the present transmission 1080 are made from a bushing material which precludes the need for separate bushings. Also, the driven shaft 1086 has an integral output shaft 1112 to drive the lift rod 1022 via a lift rod adapter 756 (See FIG. 134), instead of using an intermediate cap and a separate output shaft as found in the higher friction transmission 1096. These changes reduce the number of parts and lower the inherent system friction of the transmission 1080.

Referring now to FIG. 141, the driven shaft 1086 is a substantially conical element which is threaded throughout the majority of its external, conical surface 1114. As described in further detail below, the threads on this threaded, conical surface 1114 may be either left hand threads or right hand threads depending upon where the transmission 1080 will be used in the drive train. A first end of the driven shaft 1086 defines a short axle 1116 from which projects the output shaft 1112. The second end of the driven shaft 1086 defines a flange 1118 from which projects another short axle 1120. A notch 1122 and hole 1122' allow one end of the transmission cord 1094 to be secured to the driven shaft 1086. The cord 1094 is threaded through the hole 1122', and its free end is enlarged, such as by tying a knot, allowing it to "catch" and thus prevent the cord 1094 from being pulled back out. Finally, four holes 1123 extend axially from the first end of the driven shaft 1086, and these holes 1123 line up with an opening 1128 in the end cover 1088 so that the driven shaft 1086 may be releasably locked against rotation relative to the housing 1082 by inserting the locking pin 1090 through the opening 1128 in the end cover 1088 and into one of the holes 1123 in the driven shaft 1086.

Referring now to FIG. 142, the drive shaft 1084 is an elongated element with a first frustroconical, threaded portion 1124, and a second cylindrical portion 1126. In this embodiment, the cylindrical portion 1126 is not threaded and has a slight taper. As in the case of the driven shaft 1086, the drive shaft 1084 has a notch 1130 and hole 1130' for attaching the transmission cord 1094 to the shaft 1084. Also, an axle 1132 projects from one end of the drive shaft 1084, and an axle (not shown) and an input shaft 1134 project from the second end of the drive shaft 1084. The taper is so steep in the portion 1124 of the drive shaft 1084 that this portion 1124 is threaded to ensure proper wrapping and tracking of the transmission cord 1094 onto and off of the drive shaft 1084.

As shown in FIG. 140, the driven shaft 1086 and the drive shaft 1084 are mounted for rotation inside the housing 1082. As indicated earlier, no bushings are required, as the housing 1084 and the end cover 1088 are made from bushing material. This view also shows how the locking pin 1090 is inserted through the opening 1128 in the end cover 1088 and into one of the holes 1123 in the driven shaft 1086 to lock the transmission 1080 until the transmission 1080 has been installed and is ready for operation.

Referring back to FIG. 134, the transmission 1028 is identical to the transmission 1080, and it uses the left hand thread driven shaft 1086' shown in FIG. 144, with the transmission cord 1094 wrapped under the drive shaft 1084 and over the driven shaft 1086' in order to obtain the desired effect. To ensure that no mistakes are made during assembly and installation, the driven shaft 1086' is marked (in this instance with the letters "L H" to indicate "left hand") and, when assembled into the housing 1082, the end cover 1088 is color coded to signify that this is a left hand transmission 1028.

When the transmission cord 1094 is fully wrapped onto the driven shaft 1086' (as shown in FIG. 144), the spring in the spring motor 1026 (See FIG. 134) is in its fully relaxed position, and the bottom rail 1012 is in the fully raised position. As the user pulls down on the bottom rail 1012, the lift cords 1032 (See FIG. 133) unwrap from the lift stations 1018 and the lift rod 1022 rotates clockwise (as seen from the left hand side of FIG. 134). The drag brake 1000 resists this rotation with the slip torque of the drag brake 1000, such that the user must overcome this slip torque and also wind up the spring in the spring motor 1026 as he lowers the bottom rail 1012. However, the user has the force of gravity acting on the shade to assist him in this endeavor. The spring motor 1026 need only be strong enough to assist in raising the bottom rail 1012 and the associated cellular structure 1016 (and possibly the middle rail 1008 once the bottom rail 1012 reaches the middle rail 1008). The spring motor 1026 need not be sufficiently strong so as to keep the bottom rail 1012 from continuing to drop from the combined weight of the bottom rail 1012, the cellular structure 1016, and the middle rail 1008, since the drag brake 1000 resists this motion.

When the bottom rail 1012 is at or near its lowered position, the transmission cord 1094 is fully (or substantially) unwrapped from the driven shaft 1086' and wrapped onto the drive shaft 1084. As the bottom rail 1012 is raised by the user, the transmission cord 1094 unwraps from the drive shaft 1084 and wraps onto the driven shaft 1086'. Thus, as the weight being raised increases (because the bottom rail 1012 is picking up more of the cellular structure 1016 and possibly also the middle rail 1008 as these stack on top of the bottom rail 1012), the transmission 1080 provides a mechanical advantage to the force exerted by the spring motor 1026 as the transmission cord 1094 unwraps from a smaller diameter to a progressively larger diameter on the drive shaft 1084, and wraps onto a larger diameter to a progressively smaller diameter on the driven shaft 1086'.

Referring once again to FIG. 134, the right hand transmission 1026' is quite similar to the left hand transmission 1026 and operates in the same manner, except that, as shown in FIG. 145, the driven shaft 1086" is a right hand threaded shaft and the transmission cord 1094 is wrapped under the drive shaft 1084 and also under the driven shaft 1086' in order to obtain the desired effect. The transmission 1026' is turned end-for-end from the transmission 1026 and is installed on the right hand side of the top rail 1004 as shown.

While the transmission 1026 has been shown in use with a spring motor and drag brake, it could be used in embodiments with or without a motor or a drag brake, and, as was explained with respect to the drive spool, the profiles of the shafts in the transmission could vary, depending upon the function the transmission is intended to perform. Similarly, while the drag brake was shown in this embodiment using a motor and transmission, it could be used in a wide variety of embodiments, with or without motors or transmissions.

Referring to FIGS. 151 and 152, one, two, or more spring motors 1026 may be attached to a transmission 1028. The spring motors 1026 are designed such that the axes of rotation of their output spools 1136 line up with the axis of rotation of the drive shaft 1084 of the transmission 1028, as shown in FIG. 152. The input shaft 1134 of the transmission 1028 fits into the output socket 1138 of the spring motor 1026.

Referring to FIGS. 153 and 154, the transmission 1028 has locating pins 1092 and locating holes 1092'. The spring motor 1026 has corresponding locating pins 1093 and locating holes 1093'. When the motor 1026 and transmission 1028 are assembled together, the locating pins 1092 in the transmission 1028 fit into locating holes 1093' in the motor 1026, and the locating pins 1093 in the motor 1026 fit into locating holes 1092' in the transmission 1028. The transmission 1028 also has a hook projection 1140 which engages a shoulder 1142 on the motor 1026, and the motor 1026 also has a similar hook projection 1144 which engages a shoulder 1146 on the transmission 1028, such that the motor 1026 and the transmission 1028 may be aligned and snapped together for assembly.

Referring to FIG. 154, the area around the input shaft 1134 of the transmission 1028 defines a semi-circular shoulder 1148 on the bottom half and a semi-circular cavity 1150 on the top half. The area around the output socket 1138 of the motor 1026 defines a similar semi-circular shoulder 1152 on the top half and semi-circular cavity 1154 on the bottom half. When the transmission 1028 is assembled to the motor 1026, the semi-circular shoulders 1148, 1152 fit into their corresponding semi-circular cavities 1150, 1154, to further ensure a proper alignment and tight fit of the transmission 1028 and the motor 1026.

Referring back to FIG. 153, the output end (adjacent the output shaft 1112) of the transmission 1028 defines outwardly-facing hook projections 1156 and C-shaped flats 1158, which may be used to assist in releasably securing the transmission 1028 to other components in the drive train, such as the gearbox 712' described below.

Transmission and Power Unit Assembly

FIGS. 173-175 depict a high efficiency transmission and power unit assembly 1258 made in accordance with the present invention. Even though the transmission 1080 of FIG. 143 is more efficient than the transmission 1096 (same FIG. 143), due in part to its fewer number of component parts, the overall efficiency of the motor and transmission assembly depicted in FIG. 152 is still relatively low. As discussed in more detail below, this embodiment of a high efficiency transmission and power unit assembly 1258 substantially improves the overall efficiency by, among other things, eliminating alignment issues between the components (which eliminates connectivity losses) and by eliminating some bearings. The motor itself also has improved efficiency by using a storage spool to rotationally support the spring when it is off of the power spool.

Referring to FIGS. 174 and 175, and comparing these with FIGS. 139 and 152, it is clear that a major difference is that what were separate components for the output spool 1136 of the motor 1026 and the drive shaft 1084 of the transmission 1080 have now been combined into a single, one-piece component 1260 which includes a motor output spool portion 1136' and a transmission drive shaft portion 1084'. This component 1260, together with the storage spool 1262 fit inside the housing 1264. The end cap 1088' encloses these items 1260, 1262 inside the housing 1264.

As better shown in FIG. 175, the housing 1264 includes a support bearing cavity 1266 to rotationally support the axle 1132' of the transmission drive shaft portion 1084'. The end cap 1088' includes a through opening 1268 to rotationally support the axle 1270 of the motor output spool portion 1136'. There are no intermediate supports for the component 1260, thereby eliminating two bearings which would otherwise reduce the efficiency of the device 1258. Furthermore, because the component is a one-piece design, there are no alignment issues which would result in connectivity losses which would also negatively impact the efficiency of the device 1258.

The transmission driven shaft 1086' of FIG. 174 is slightly different from the transmission driven shaft 1086 of FIG. 139. The output shaft 1112' is splined instead of being rectangularly profiled, and the four holes that were used for releasably locking the driven shaft against rotation are not present in the new driven shaft 1086'. To releasably lock the high efficiency transmission and power unit assembly 1258 against rotation, a locking pin or bracket 1090' (See FIG. 174) is used. The pin 1090' includes a projection 1270 which fits into the through opening 1272 in the end cap 1088', and a square opening 1274 designed to fit over and engage the square shaft 1276. When the locking pin 1090' is installed, the high efficiency transmission and power unit assembly 1258 is prevented from rotation.

Referring back to FIGS. 173 and 174, a housing cover 1278 snaps onto the housing 1264 via the interlocking hooked projections 1280, 1282, and via the interlocking ramped projections 1284, 1286 on the housing cover 1278 and on the housing 1264 respectively. The driven shaft 1086' is rotationally supported inside the housing cover 1278, with the splined shaft 1112' extending through the opening 1288 in the housing cover 1278, and the axle end 1120' supported by the support bearing 1290 in the housing 1264. Since the connection between the transmission drive shaft portion 1084' and the driven shaft 1086' is via a transmission cord 1094 (not shown in these views but seen in FIG. 144), there are no alignment concerns which could cause efficiency-lowering connectivity losses.

This high efficiency transmission and power unit assembly 1258 may be used instead of the individual transmission 1028 and motor 1026 shown in FIG. 152. Of course, additional motors 1026 as well as gear boxes may be attached to the assembly 1258, as required. An adapter, such as the spline adapter 1292 depicted in FIGS. 176, 177 may be used to connect the splined output shaft 1112' of the high efficiency transmission and power unit assembly 1258 to a lift rod (such as the lift rod 702 of FIGS. 106, 107).

The spline adapter 1292 is a substantially cylindrical element with hollow ends. A first end defines a hollow shaft 1294 with an internal profile which matches that of the splined shaft 1112'. A second end defines another hollow shaft 1296 with an internal profile which matches that of the "V"-notched lift rod 702. This adapter 1292 design, in combination with the splined profile of the shaft 1112', permits the use of smaller diameters without diminishing the ability to transfer the torques required during operation.

Alternate Embodiment of a Gearbox

FIG. 155 through 157 depict an alternate embodiment of a gearbox 712' made in accordance with the present invention. Referring to FIG. 156, the gearbox 712' includes a housing 714', a first gear 718', a second gear 720', a double gear 722', and two end caps 1160.

While the gears 718', 720', and 722' remain identical to the gears 718, 720, 722 of the previously described embodiment of the gearbox 712, the housing 714' is a one piece housing with an internal projection 1162 as seen in FIG. 157 for rotational support of the axles 740', 748' of the first and second gears 718', 720' respectively.

The left and right end caps 1160 are identical to each other and include a hole 1164 for rotational support of the axles 734', 744' of the first and second gears 718', 720' respectively, locating pin holes 1166 which match up with the locating pins 1168 of the housing 712', a circular shoulder 1170 for rotational support of the double gear 722', and upper and lower flanges 1172 for a press fit over the housing 714'. The outside face of the end cap 1160 also a defines inwardly-facing hook projections 1174 and flats 1176 which cooperate with the corresponding hooks 1156 and C-shaped flats 1158 in other drive train components, such as the transmission 1028 (See FIG. 153), to releasably secure the gearbox 712' to those other components.

Due to the symmetrical nature of the housing 714' and of the end caps 1160, this gearbox 712' may be driven from its left side or, if flipped end-over-end, it may be driven from its right side while maintaining the same gear ratio in both cases. In contrast to the previously described gearbox 712, it is no longer necessary to disassemble the gear box 712' and flip the gears 718', 720', 722' end for end in order to accomplish this task.

Lift Station

FIGS. 106 and 122 depict lift stations 116*. FIG. 158 through 160 depict one of the lift stations 116* in more detail.

Typically, a transport system for coverings for architectural openings will have one or more lift stations used to raise and lower the covering. Embodiments of such lift stations are described in U.S. patent application Ser. No. 10/613,657, Drum for Wrapping a Cord, filed Jul. 3, 2003, which is hereby incorporated herein by reference. That application describes many of the components and features of the lift station 116*. Therefore, only the improved features of the lift station 116* are described in detail below.

Referring to FIGS. 159 and 160, the lift station 116* includes a cradle 1180, a wind-up spool or drum 1182, and a lift cord (not shown in these views).

The drum 1182 is a substantially cylindrical element defining upstream and downstream ends 1186, 1188, respectively, and an axis of rotation 1190. The drum 1182 includes a shoulder 1192 proximate the upstream end 1186, a first slightly-tapered drum surface portion 1194, and a second substantially cylindrical drum surface portion 1196. This second drum surface portion 1196 may have a very slight taper to assist in mold release in the manufacturing process, and this very slight taper may also assist in minimizing the drag of pushing wraps of the cord across the drum surface, but the taper of this second portion 1196, if any, is less than the taper of the first, slightly tapered portion 1194. The drum 1182 includes an axially-oriented, slitted opening 1198 proximate its downstream end 1188 for securing the lift cord to the drum 1182 via an enlargement (such as a knot) in the lift cord. The drum 1182 also includes short axle ends 1200 (proximate the upstream end 1186) and 1202 (proximate the downstream end 1188) for rotation in the cradle 1180.

The cradle 1180 is an elongate element with first and second upright walls 1204, 1206 respectively. The first wall 1204 defines a slotted opening 1208 for rotatably supporting the upstream axle end 1200 of the drum 1182. The second wall 1206 defines a through opening 1210 for rotatably supporting the downstream axle end 1202 of the drum 1182. This second wall 1206 further defines a circular shoulder or socket 1212 projecting inwardly and enveloping the entire circumference of the drum 1182 at its downstream end 1188 when the drum 1182 is assembled onto the cradle 1180 (See FIG. 161). The radial gap between the shoulder 1212 and the outer surface of the drum 1182 is less than one cord diameter, which prevents the cord from falling off the downstream end of the drum 1182.

The cradle 1180 includes a cord guide 1184, which positions the cord feed onto the drum 1182 proximate the upstream end 1186 of the drum 1182.

To assemble the lift station 1182, one end of the lift cord is first secured to the slitted opening 1198 as has already been described. The other end of the lift cord is fed through the cord guide 1184 proximate the first wall 1204 of the cradle 1180. The drum 1182 is mounted for rotation inside the cradle 1180, with the downstream end 1188 inserted first, such that the downstream axle end 1202 is resting inside the opening 1210 in the second wall of the cradle 1180, and the upstream end 1186 of the spool 1182 then is pushed into the cradle 1180 such that the upstream axle end 1200 snaps into the slotted opening 1208. When assembled, the downstream end 1188 of the drum 1182 is inside the shoulder 1212, and the radial clearance between the surface of the drum 1182 at its downstream end 1188 and the shoulder 1212 is less than one lift cord diameter.

When operating a window covering, it is possible to encounter an obstacle, which impedes the lowering of one end of the window covering. In this situation, it is possible, especially in a motorized window covering, for the lift stations 116* to continue to rotate so as to unwind the respective lift cords from the respective drums 1182 even if the window covering has stopped moving downwardly. At the end of the window covering where the obstacle is impeding the lowering of the window covering, there is no longer any tension pulling on the lift cord to keep it unwrapping properly from its drum 1182. The lift cord may then actually start to backwind onto the drum 1182, and/or push its way back. If the cord falls off of the drum at the drum's downstream end, the only recourse for correction of the problem is to disassemble the lift station 116*. However, the shoulder 1212, with its radial clearance of less than one cord diameter to the surface of the drum 1182, prevents the lift cord from falling off of the downstream end of the drum 1182, and thus prevents the occurrence of this problem.

Alternate Drum for Lift Station

FIG. 178 through 182 depict an alternate embodiment of a drum 1182' for use in the lift station 116* described above. The drum 1182, shown in cross-section in FIG. 161, has a substantial amount of material, which not only increases the cost of the part 1182, but also may result in manufacturing problems with the part 1182. The high mass of the material may cause "sinks" which in turn may cause "swales" or valleys on the cord winding surface of the drum 1182. These swales may cause winding problems.

The drum 1182' shown in FIGS. 178-182 addresses these problems by substantially reducing the mass of the material used in the manufacture of the drum 1182', as can be appreciated by comparing the cross-sectional views of the drum 1182' in FIG. 180 to that of the drum 1182 in FIG. 161.

The drum 1182' has four ribs 1298 (See FIG. 182) which connect the hollow shaft 1200' to the outer surface 1300 of the drum 1182', defining a substantially hollow cavity 1308. This arrangement provides a first tube (the hollow shaft 1200') within a second tube (the outer surface 1300 of the drum 1182'), interconnected by the aforementioned ribs 1298. A web 1302 at one end of the ribs 1298, provides additional strength. A through opening 1304 in the web 1302 allows a lift cord (not shown) to be tied or "cinched" to an axially-projecting post 1306 (shown in FIG. 179), to extend through the web 1302 and axially through the cavity 1308 and to exit via the slotted opening 1198' (see FIG. 178) at the opposite end of the drum 1182'.

FIG. 178 shows that the majority of the outer circumferential end 1188' of the outer surface 1300 of the drum 1182' has been shortened, except for a short segment 1310 which encompasses the slotted opening 1198'. This short segment 1310 extends to its original length and thus still serves to properly locate the drum 1182' within the cradle 1180. This shortening of the length of the outer surface 1300 of the drum 1182' (except for the segment 1310 as discussed above) occurs at the downstream end 1188' of the drum 1182'. This is the end 1188' which fits into the socket 121 of the cradle 1180. The shortening of the length of the outer surface 1300 of the drum 1182' allows the drum 1182' to be more readily installed inside the cradle 1180 without reducing the efficacy of the socket 1212 (the purpose of which, as discussed above, is to prevent the lift cord from falling off of the drum 1182' at this downstream end 1188').

This embodiment of the drum 1182' has substantially less mass than the previously described drum 1182, so there is no tendency to deform the outer surface 1300 of the drum 1182'. It also allows the lift cord to be secured to the drum 1182' at an interior location where it is not likely that the knot will be worked loose. Finally, it also makes it easier to assemble the drum 1182' to the cradle 1180 without compromising the operation of the socket 1212. Despite these improvements, the drum 1182' is a direct replacement for the drum 1182.

Alternate Embodiments of Roller Lock Mechanisms

Several roller lock mechanisms were described earlier for use in cone drives or in tilter mechanisms. Many of these, such as the cone drive 102 of FIG. 11, made use of a capstan wherein the axis of rotation of the capstan shifted from a first position in which the capstan is free to rotate to a second position in which the capstan is locked from rotation. In some instances, the axis of rotation of the capstan moved to a new position which was substantially parallel to the first position, and in some instances the axis of rotation pivoted to a new position at an angle to the first position. FIG. 183 through 192 depict alternative embodiments of roller locks wherein the capstan may not rotate at all, or may rotate in one direction only, without a shift in the axis of rotation of the capstan. For expediency, these embodiments are described relative to the cone drive 102 of FIGS. 1, 11, and 13, with the understanding that they may apply to any and all of the roller lock mechanisms described in this specification.

Referring to FIG. 183, the capstan 1328 is able to rotate counterclockwise about its axis of rotation 1330 but is prevented from clockwise rotation by a ratchet mechanism wherein the pawl 1332 engages the sloping teeth 1334, permitting motion only in the counterclockwise direction. One end of the drive cord 122 is secured to the drive spool 124 (See FIG. 13) and the drive cord 122 then wraps around the capstan 1328 and the other end of the drive cord 122 is secured to a weight or force F, such as the tassel weight 106 (See FIG. 1).

To raise the blind, the user pulls down on the drive cord 122 which rotates the capstan 1328 in a counterclockwise direction about its axis of rotation 1330 (as the pawl 1332 slides over the inclined surfaces of the sloping teeth 1334). The drive cord 12 unwraps from the drive cone 124, rotating the drive cone 124, which in turn rotates the lift rod 118 and the lift stations 116 so as to raise the blind 100.

When the user releases the tassel weight 106, the weight of the blind 100 (specifically the weight of the bottom rail 110 and of the cellular shade structure 112 suspended from the lift stations 116 via lift cords (not shown)) causes rotation of the lift stations 116, of the lift rod 118, and of the drive cone 124, pulling up on the drive cord 122 of FIG. 183 and tending to cause the capstan 1328 to rotate in the clockwise direction. However, the spring 1336 of the ratchet mechanism pulls on the arm 1338 which pivots the pawl 1332 about the pivot point 1337, pushing the pawl 1332 against the teeth 1334, preventing rotation of the capstan 1328 in the clockwise direction. The tassel weight 106 (also represented by the force F in FIG. 183) holds the cord 122 tight, preventing any slippage of the drive cord 122 around the capstan 1328, thus locking the blind 100 where the user released it.

Finally, when the user lifts up on the tassel weight 106, thus reducing the force F acting to lock the drive cord 122 against the capstan 1328, the capstan 1328 remains stationary and the drive cord 122 surges the capstan 1328, allowing the drive cone 124 to rotate, together with the lift rod 118 and the lift stations 116, so as to lower the blind 100.

In FIG. 183, the capstan 1328 rotates counterclockwise about its axis of rotation 1330 to raise the blind. In contrast, in FIG. 184, the capstan 1328' does not rotate at all. Instead, several ratchet mechanisms 1340, one at each corner of the octagonal profile of the capstan 1328', act in unison to permit counterclockwise rotation of the corners or contact surfaces of the capstan 1328' where the drive cord 122 abuts the capstan 1328', while preventing the clockwise rotation of the corners or contact surfaces. The practical result is identical to that of the capstan 1328 of FIG. 183. Namely, pulling down on the drive cord 122 at the tassel weight F results in free rotation of the drive cord 122 about the capstan 1328' for the raising of the blind 100 as the corners rotate counterclockwise. Release of the tassel weight F by the user results in pulling up of the drive cord 122 by the drive spool 124 and locks the drive cord 122 relative to the capstan 1328', since the points where the cord 122 contacts the capstan 1328' are locked against clockwise rotation by the ratchet mechanisms 1340. The tassel weight 106 provides enough tension on the drive cord 122 to prevent any slippage of the drive cord 122 around the capstan 1328', locking the blind 100 in place. Again, lifting up on the tassel weight 106 allows the drive cord 122 to surge the capstan 1328' in order to lower the blind 100.

FIGS. 185-188 schematically depict other embodiments of roller locks, this time wherein not only is the axis of the capstan fixed (i.e. the axis of rotation of the capstan does not shift or pivot), but in fact the capstan does not rotate at all.

Referring to FIG. 185, the capstan 1328* is fixed and does not rotate. In this case, a raising drive cord 122R is used to raise the blind 100 and a lowering drive cord 122L is used to lower the blind 100 (as is explained in more detail below). One end of the raising drive cord 122R is secured to the drive spool 124 (or drive cone 124). The raising drive cord 122R then goes over an idler pulley 1342, and the other end of the raising drive cord 122R is secured to a tassel weight 106R. Similarly, one end of the lowering drive cord 122L is secured to the drive spool 124 (or drive cone 124). The lowering drive cord 122L then goes around the capstan 1328*, and the other end of the lowering drive cord 122L is secured to a tassel weight 106L. It should be noted that the raising tassel weight 106R is very light relative to the lowering tassel weight 106L. In a preferred embodiment, the raising tassel weight 106R is just heavy enough to keep the drive cord 122R hanging straight down but is not heavy enough to raise the blind 100.

To raise the blind 100, the operator pulls down on the raising tassel weight 106R, which pulls on the raising drive cord 122R, causing the drive cone 124 to rotate clockwise, so the raising drive cord 122R unwraps from the drive cone 124. The clockwise rotation of the drive cone 124 also results in rotation of the lift rod 118 and the lift stations 116 so as to raise the blind 100. As the drive cone 124 rotates clockwise, the lowering drive cord 122L also unwraps from the drive cone 124, creating a slack condition which allows the lowering drive cord 122L to surge the capstan 1328*, resulting in the lowering of the tassel weight 106L.

When the operator releases the raising tassel weight 106R, the weight of the blind 100 (acting through the lift stations 116 and the lift rod 118) causes counterclockwise rotation (as seen from the vantage point of FIG. 185) of the drive cone 124, eliminating any slack in the drive cord 122L between the drive cone 124 and the capstan 1328*. The lowering tassel weight 106L keeps tension on the lowering cord 122L so that the lowering drive cord 122L cannot surge the capstan 1328*, and the mechanism locks, locking the blind 100 in place.

To lower the blind 100, the operator lifts up on the lowering tassel weight 106L, allowing the drive cord 122L to surge the capstan 1328*, which allows the drive cone 124 to rotate counterclockwise as it is acted on by the weight of the blind 100 via the lift stations 116 and the lift rod 118. Both of the drive cords 122L, 122R wrap onto the drive cone 124 as the drive cone 124 rotates counterclockwise. Again, releasing the lowering tassel weight 106L restores the tension on the lowering drive cord 122L, which locks onto the capstan 1328*, locking the blind 100 in place.

FIG. 186 depicts a roller lock mechanism which is practically identical to the roller lock mechanism depicted in FIG. 185 except that the idler pulley has been eliminated in this later embodiment. The operation is identical in both cases.

FIGS. 187A and 187B depict a roller lock mechanism which is very similar to the roller lock mechanism depicted in FIG. 185 except that the two tassel weights 106L, 106R have been replaced by a single tassel weight 1344. The raising drive cord 122R (used to raise the blind 100) is secured directly to the tassel weight 1344, while the lowering drive cord 122L (used to lower the blind 100) is secured to the tassel weight 1344 via a short stroke spring 1346. Note that there is some slack in the raising drive cord 122R when the spring 1346 is in its "at rest" position, and the blind 100 is locked in position as explained below.

As the operator pulls down on the tassel weight 1344, the raising drive cord 122R is pulled to remove the slack on this line, while the lowering drive cord 122L is acted upon after a short delay due to the stretching action of the spring 1346, as seen in FIG. 187B. The result is that the drive cone 124 starts to rotate immediately after all the slack in the raising drive cord 122R is removed, causing some slack in the lowering drive cord 122L such that this drive cord 122L can then surge the capstan 1328*. As soon as the operator releases the tassel weight 1344, the weight of the blind 100 causes the drive cone 124 to start rotating counterclockwise, which eliminates the slack in the lowering drive cord 122L, locking the drive cord 122L to the capstan 1328* and locking the blind 100 in place.

If the operator lifts up on the tassel weight 1344, The lowering drive cord 122L surges the capstan 1328* which allows the drive cone 124 to rotate counterclockwise to lower the blind 100 as has already been explained above. Both drive cords 122L and 122R wrap onto the drive cone 124 as the blind 100 is lowered.

FIG. 188 depicts a roller lock mechanism which is practically identical to the roller lock mechanism depicted in FIG. 187A except that the idler pulley has been eliminated in this later embodiment. The operation is identical in both cases.

FIG. 189 is a cross-sectional view of a tassel weight 1344* which may be used instead of the tassel weight 1344 and the spring 136 of FIGS. 187A and 188. The tassel weight 1344* includes an outer sleeve 1348 and an inner weight 1350. The outer sleeve 1348 is very light relative to the inner weight 1350. The inner weight 1350 is shorter than the outer sleeve 1348 such that the inner weight 1350 can travel a relatively short distance within the confines of the outer sleeve 1348.

The raising drive cord 122R is secured to the outer sleeve 1348. The lowering drive cord 122L slides through an opening in the outer sleeve 1348 and is secured to the inner weight 1350. In the depicted embodiment, the inner weight 1350 defines an inner cavity 1352 and a longitudinally aligned inner passageway 1354, wherein the lowering drive cord 122L is fed through the passageway 1354, and an enlargement, such as a knot 1356, is tied to the end of the lowering drive cord 122L to secure it to the inner weight 1350.

As the user pulls down on the tassel weight 1344* by pulling down on the outer sleeve 1348, he immediately starts pulling down on the raising drive cord 122R, which starts the drive cone 124 rotating clockwise. This rotation of the drive cone 124 creates slack in the lowering drive cord 122L between the drive cone and the capstan 1328*, allowing the lowering drive cord 122L to surge the capstan 1328*. The outer sleeve 1348 is able to travel downwardly for a short distance before it bumps against the inner weight 1350, but this distance is enough to allow the rotation of the drive cone 124 to create the slack in the lowering drive cord 122L between the drive cone 124 and the capstan 1328*. Without that short travel distance between the outer sleeve 1348 and the inner weight 1350, as the outer sleeve is pulled down it would immediately start pulling down on the inner weight 1350 as well. However, since the lowering drive cord 122L would be locked around the capstan (due to the weight of the blind 100 acting to rotate the drive cone 124 in the counterclockwise direction, thus keeping the lowering drive cord 122L taut between the drive cone 124 and the capstan 1328*), the entire mechanism would be locked in place without possibility of raising the blind 100.

As soon as the user releases the tassel weight 1344*, the inner weight 1350 locks the lowering drive cord 122L onto the capstan 1328* against the weight of the blind 100 acting to rotate the drive cone 124 in a counterclockwise direction.

Finally, as the user lifts up on the tassel weight 1344 to lower the blind 100, both the outer sleeve 1348 and the inner weight 1350 are lifted up. The lowering drive cord 122L is able to surge the capstan 1328* and wrap onto the drive cone 124. The raising drive cord 122R simply wraps onto the drive cone 124. In this manner, a single tassel weight 134* may be used to raise, lower, and lock in place a blind 100 when using a fixed, non-rotating capstan 1328*.

FIGS. 190-192 depict drag brake arrangements which may also be used instead of the capstan arrangements described earlier, including the rotating capstans with shifting axes of rotation described throughout this specification, as well as the rotating and non-rotating capstans depicted in FIGS. 183-189.

Referring to FIGS. 190 and 191, the drag brake 1358 includes a rotating roller 1360 and a pinching roller 1362. The pinching roller 1362 has an axis of rotation 1364 which shifts so as to move the surface of the pinching roller 1362 tangentially toward the surface of the rotating roller 1360 (as seen in FIG. 191) or away from the surface of the rotating roller 1360 (as seen in FIG. 190).

As the pinching roller 1362 is moved toward the rotating roller 1360, the drive cord 122 is caught between the surfaces of these two rollers 1360, 1362. The harder the drive cord 122 is pulled toward the drive cone 124, the more tightly wedged the drive cord 122 becomes between the rollers 1360, 1362. Pulling down on the tassel weight 106 pulls the pinching roller 1362 tangentially away from the rotating roller 1360, and the drive cord 122 can be pulled unimpeded.

From the vantage point of FIGS. 190, 191, if the drive cord 122 is pulled slightly toward the right prior to lifting up on the tassel weight 106, the drive cord 122 does not contact the pinching roller 1362 which therefore remains uninvolved in the operation, and the drive cord 122 can move upwardly to wrap onto the drive cone 124 so as to lower the blind 100. If at any time during the raising of the tassel weight 106 the drive cord 122 is moved to the left, the drive cord 122 picks up the pinching roller 1364 and shifts it upwardly and tangentially toward the rotating roller 1360, eventually trapping the drive cord 122 between these two rollers 1360, 1362 and locking the drive cord 122 in place. While FIGS. 190 and 191 show the pinching roller 1362 as being gravity-biased to approach the rotating roller 1360 when the drive cord 122 travels in one direction and to move away from the rotating roller 1360 when the drive cord 122 travels in the other direction, the biasing could be accomplished in a variety of different manners, such as spring-biasing or even friction-biasing.

Unlike conventional cord locks, the drag brake 1358, by itself, need not provide an absolute resistance to motion of the drive cord 122. The resistance to motion can be amplified with the tassel weight 106. FIG. 192 depicts a different way to amplify the braking power of the drag brake 1358. Instead of the drive cord 122 just tangentially contacting the rotating roller 1360 (as in FIG. 190), the drive cord 122 may be wrapped one or more times around the rotating roller 1360. The pinching roller 1362 then is able to trap several wraps of the drive cord 122 between the two rollers 1360, 1362, amplifying the holding power of the drag brake 1358.

It will be obvious to those skilled in the art that modifications may be made to the embodiments described above without departing from the scope of the present invention as defined by the claims.

What is claimed is:

1. A covering for an architectural opening, comprising:

an extendable material (112) movable from a lowered position to a raised position for covering and uncovering the opening;

a drive spool (124) mounted for rotation and operatively connected to said extendable material (112) for raising and lowering said extendable material, wherein said drive spool (124) rotates in a first direction to raise said extendable material and in a second direction to lower said extendable material;

a drive cord (122) having first and second ends, said first end of said drive cord being wrapped onto said drive spool (124); and first and second brakes (104"), (284) operatively connected in series to said drive cord (122), with said drive cord (122) extending from said drive spool (124) to said first brake (104), and then to said second brake (284), wherein said first brake (104) includes a roller (132) mounted for selective rotation, and said drive cord (122) is wrapped around said roller (132), wherein braking engagement of said second brake (284) with said drive cord (122) tightens the drive cord (122) around the roller (132) of the first brake (104), and wherein pulling on the second end (320) of said drive cord (122) unwinds the drive cord (122) from the drive spool (124) and raises the extendable material (112).

2. A covering for an architectural opening as recited in claim 1, wherein said second brake (284) (254) (104") is selected from the group consisting of roller brakes (104**"), in which the drive cord (122) wraps around a roller (132), brakes with a pivoting locking dog (254) which pinches the drive cord (122), and wand handle brakes (284) which include an elongated wand body (296) and a handle (286) mounted on the wand body (296) and movable relative to the wand body (296), wherein the drive cord (122) is fixed relative to the handle (286**).

3. A covering for an architectural opening as recited in claim 1, and further comprising a lift spool (116) (863); and a lift cord (114) (868) having a first end secured to said lift spool (116) (863) and a second end secured to said extendable material (112);

wherein said drive spool (124) is operatively connected to said extendable material (112) through said lift spool (116) (863) and lift cord (114), and wherein said lift cord (114) is separate from said drive cord (122).

4. A covering for an architectural opening as recited in claim 3, wherein said second brake (284) (254) (104") is selected from the group consisting of roller brakes (104**"), in which the drive cord (122) wraps around a roller (132), brakes with a pivoting locking dog (254) which pinches the drive cord (122), and wand handle brakes (284) which include an elongated wand body (296) and a handle (286) mounted on the wand body (296) and movable relative to the wand body (296), wherein the drive cord (122) is fixed relative to the handle (286**).

5. A covering for an architectural opening as recited in claim 1, and further comprising a tassel weight secured to the second end of said drive cord.

6. A covering for an architectural opening as recited in claim 3, and further comprising a tassel weight secured to the second end of said drive cord.

7. A covering for an architectural opening as recited in claim 6, wherein said second brake is selected from the group consisting of roller brakes, in which the drive cord wraps around a roller, and brakes with a pivoting locking dog which pinches the drive cord.

* * * * *

UNITED STATES PATENT AND TRADEMARK OFFICE

CERTIFICATE OF CORRECTION

PATENT NO. : 8,997,827 B2
APPLICATION NO. : 13/889409
DATED : April 7, 2015
INVENTOR(S) : Richard Anderson et al.

It is certified that error appears in the above-identified patent and that said Letters Patent is hereby corrected as shown below:

Specification

Column 40, lines 26-35: Replace all instances of "104'" with --104'"--; Replace all instances of "130'" with --130'"--; Replace all instances of "134'" with --134'"--

Column 40, line 41: Replace "188'" with --188'"--

Column 40, line 42: Replace both instances of "192'" with --192'"--

Column 40, line 54: Replace "204'" with --204'"--

Column 40, line 58: Replace "212'" with --212'"--

Column 40, line 59: Replace "214'" with --214'"--

Column 41, line 9: Replace "132'" with --132'"--

Column 41, line 12: Replace "224'" with --224'"--

Column 41, line 13: Replace "192'" with --192'"--

Column 41, line 15: Replace "130'" with --130'"--

Column 41, line 17: Replace "132'" with --132'"--

Column 41, lines 21 and 22: Replace "198'" with --198'"--

Column 41, line 25: Replace "218'" with --218'"--

Column 41, lines 54 and 64: Replace "132'" with --132'"--

Column 41, line 66: Replace "132'" with --132'"--

Signed and Sealed this
Ninth Day of February, 2016

Michelle K. Lee

Michelle K. Lee
*Director of the United States Patent and Trademark Office*

Specification

Column 42, line 1: Replace “130'” with --130'"--

Column 42, line 3: Replace “104'” with --104'"--

Column 42, line 11: Replace “197'” with --197'"--

Column 42, lines 20 and 29: Replace “132'” with --132'"--

Column 42, line 31: Replace “197'” with --197'"--

Column 42, line 46: Replace “132'” with --132'"--

Column 42, line 51: Replace “197'” with --197'"--

Column 43, line 19: Replace “104'” with --104'"--

Column 43, line 33: Replace “104'''” with --104'"--

Column 44, line 14: Replace “104'” with --104'"--

Column 44, lines 17 and 20: Replace “132'” with --132'"--

Column 53, line 4: Replace “100'” with --100'"--

Column 53, line 10: Replace “112'” with --112'"--